US011655986B2

(12) United States Patent
Han et al.

(10) Patent No.: US 11,655,986 B2
(45) Date of Patent: May 23, 2023

(54) AIR CONDITIONER INDOOR UNIT

(71) Applicant: GREE ELECTRIC APPLIANCES, INC. OF ZHUHAI, Guangdong (CN)

(72) Inventors: Peng Han, Guangdong (CN); Chunjie Wang, Guangdong (CN); Qinghui Lin, Guangdong (CN); Pan Yang, Guangdong (CN); Ruqiang Li, Guangdong (CN)

(73) Assignee: GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 463 days.

(21) Appl. No.: 16/480,930

(22) PCT Filed: Dec. 15, 2017

(86) PCT No.: PCT/CN2017/116644

§ 371 (c)(1),
(2) Date: Jul. 25, 2019

(87) PCT Pub. No.: WO2018/137438

PCT Pub. Date: Aug. 2, 2018

(65) Prior Publication Data

US 2019/0390860 A1 Dec. 26, 2019

(30) Foreign Application Priority Data

Jan. 25, 2017 (CN) ..... 201710055871.7
May 2, 2017 (CN) ..... 201710301497.4

(51) Int. Cl.
*F24F 1/0057* (2019.01)
*F24F 1/0007* (2019.01)
(Continued)

(52) U.S. Cl.
CPC ..... *F24F 1/0057* (2019.02); *F24F 1/0063* (2019.02); *F24F 1/00077* (2019.02);
(Continued)

(58) Field of Classification Search
CPC .... F24F 1/0057; F24F 1/0063; F24F 13/0272; F24F 13/20; F24F 2013/205;
(Continued)

(56) References Cited

U.S. PATENT DOCUMENTS

2004/0094289 A1* 5/2004 Harshberger ..... F24F 13/20 165/48.1
2005/0115264 A1* 6/2005 Terada ..... F24F 1/0067 62/298

FOREIGN PATENT DOCUMENTS

CN 1786594 A * 6/2006
CN 1786594 A 6/2006
(Continued)

OTHER PUBLICATIONS

International Search Report for International Application No. PCT/CN2017/116644, dated Mar. 14, 2018, 6 pages.
(Continued)

*Primary Examiner* — Lionel Nouketcha
(74) *Attorney, Agent, or Firm* — Armstrong Teasdale LLP

(57) ABSTRACT

An air conditioner indoor unit is provided. The air conditioner indoor unit includes: a base module, having a base part which is arranged with a fan motor; a heat exchange module having a heat exchanger and a connection pipeline for connecting the heat exchanger to an air conditioner outdoor unit; the heat exchanger and the connection pipeline are arranged in such a way that in a mounted state, the heat exchanger and the connection pipeline are entirely located at a front side of the base module; an air and water duct module having an air duct assembly; the air duct assembly is suitable to be entirely disassembled from the base part without disassembling the fan motor in the base part. During mounting, pre-assembly is first performed and then general assembly is performed; in such manner, the time needed to assemble the whole unit may be reduced.

25 Claims, 119 Drawing Sheets

(51) Int. Cl.
*F24F 1/0063* (2019.01)
*F24F 13/02* (2006.01)
*F24F 13/20* (2006.01)

(52) U.S. Cl.
CPC ..... *F24F 13/0272* (2013.01); *F24F 13/20* (2013.01); *F24F 2013/205* (2013.01); *F24F 2221/36* (2013.01)

(58) Field of Classification Search
CPC .... F24F 2221/36; F24F 1/0043; F24F 1/0007; F24F 13/00; F24F 13/30; H01R 9/00; H01R 9/28
See application file for complete search history.

(56) References Cited

FOREIGN PATENT DOCUMENTS

| | | | |
|---|---|---|---|
| CN | 101532702 | A | 9/2009 |
| CN | 201373506 | Y | 12/2009 |
| CN | 102261700 | A | 11/2011 |
| CN | 202303662 | U | 7/2012 |
| CN | 202792451 | U | 3/2013 |
| CN | 203286721 | U | 11/2013 |
| CN | 103994562 | A | 8/2014 |
| CN | 104266262 | A | 1/2015 |
| CN | 104422026 | A | 3/2015 |
| CN | 104482596 | A | 4/2015 |
| CN | 104748242 | A | 7/2015 |
| CN | 204534826 | U | 8/2015 |
| CN | 205279261 | U | 6/2016 |
| CN | 105928078 | A | 9/2016 |
| CN | 106016472 | A | 10/2016 |
| CN | 106130229 | A | 11/2016 |
| CN | 205860413 | U | 1/2017 |
| EP | 0668473 | A2 | 8/1995 |
| JP | H08135994 | A | 5/1996 |
| JP | 2002213763 | A | 7/2002 |

OTHER PUBLICATIONS

Extended European Search Report for corresponding European Application No. 17893694.4, dated Oct. 16, 2020, 8 pages.

* cited by examiner

AIR CONDITIONER INDOOR UNIT

CROSS-REFERENCE TO RELATED APPLICATIONS

This application is a U.S. National Phase Application of PCT/CN2017/116644, filed Dec. 15, 2017, which claims the benefit of priority to CN Application No. 201710055871.7, filed Jan. 25, 2017, and to CN Application No. 201710301497.4, filed May 2, 2017, the contents of which are hereby expressly incorporated by reference in their entirety.

TECHNICAL FIELD

The disclosure relates to the technical field of air conditioners, and in particular to an air conditioner indoor unit.

BACKGROUND

At present, an indoor unit of a separated wall-type air conditioner usually has numerous and miscellaneous types of parts, so the production efficiency of general assembly is low.

At present, an indoor unit of a separated wall-type air conditioner usually has numerous and miscellaneous types of parts, so the production efficiency of general assembly is low. An existing air conditioner indoor unit includes a bottom shell part, a motor, a motor pressure plate, an electrical box, a fan blade, an evaporator, a panel body, a filter screen, a panel, an air guide plate, and other main structures. There are many structural forms. On a general assembly line, taking the bottom shell part as a basic part, the fan blade and the motor are fixedly connected through a screw, and then mounted above the bottom shell part together. The motor is fixed by using the motor pressure plate. Then, the evaporator is mounted. Because a pipe of the evaporator is at a back side of a base part, it is needed to first break off the pipe of the evaporator, and install the evaporator on the bottom shell part, and then, the pipe is broken back, and the pipe and the evaporator are fixed. Meanwhile, because of a structural limit of the evaporator, it is needed to add tooling in an operating direction of the assembly line to support the base part to a height, so as to conveniently place the pipe of the evaporator. And then, the electrical box is mounted; specifically, the electrical box is fixedly mounted at the right side of the evaporator. At last, the panel body, the filter screen, the panel and the air guide plate are assembled. Accordingly, for such an air conditioner indoor unit, in general assembly, it is needed to assemble in order the above numerous and miscellaneous parts on the general assembly line. The general assembly line is comparatively long, occupies a large space, and has a low general assembly efficiency.

Moreover, when the air conditioner indoor unit is completely mounted, only the air guide plate, the panel and the panel body can be dismounted, so when needing to clean the air conditioner indoor unit, a user can only disassemble the filter screen and the air guide plate to clean simply. However, in a long-term use process of the air conditioner indoor unit, an air duct for air-in and air-out, the fan blade and a water duct for collecting condensed water are very easy to produce dirt. These structures of the above air conditioner indoor unit cannot be dismounted to clean regularly, after a long time, the accumulation of dirt on these structures makes the air conditioner indoor unit become a source of pollution, which influences living environments of users with the operation of the air conditioner, and brings harms to the users. Meanwhile, in a process of overhauling the air conditioner indoor unit, when charged structures like the motor and the electrical box, are overhauled, it is needed to disassemble in order the air guide plate, the panel and the panel body according to a reverse order of assembly; at the same time, the process requires a professional to operate, which causes a high cost of cleaning the complete appliance, and requires much time and effort.

SUMMARY

Therefore, the technical problem to be solved by the disclosure is to overcome the defects of the air conditioner indoor unit in the conventional art that the general assembly efficiency is low, and inconvenient disassembly increases the difficultly of cleaning and overhaul, and provide an air conditioner indoor unit which is high in the general assembly efficiency, convenient and easy to be dismounted, and easy to be cleaned and overhauled.

An air conditioner indoor unit of the disclosure includes: a base module, a heat exchange module, and an air and water duct module.

The base module has a base part arranged with a fan motor.

The heat exchange module has a heat exchanger and a connection pipeline for connecting the heat exchanger to an air conditioner outdoor unit. The heat exchanger and the connection pipeline are arranged in such a way that in a mounted state, the heat exchanger and the connection pipeline are entirely located at a front side of the base module.

The air and water duct module has an air duct assembly. The air duct assembly is suitable to be entirely detached from the base part without detaching the fan motor from the base part.

The heat exchange module and the air and water duct module are mounted on the base part separately and movably.

The air and water duct module has a bottom shell and an impeller which is rotationally mounted on the bottom shell. An impeller shaft of the impeller is suitable to be, by means of a quick release connecting structure, connected to and separated from an output shaft of the fan motor through a position movement between them.

The air conditioner indoor unit of the disclosure further includes: an exterior module and an electrical assembly.

The exterior module has an air guide module which is detachably mounted on the base module, an air outlet frame module which is detachably mounted on the base module and/or the air and water duct module, and a case module which is detachably mounted on the base module.

The electrical assembly has an electrical box, an air guide poking box, and the fan motor for poking the impeller to rotate.

The case module is detachably mounted on the base module, and includes a panel body, and a filter screen and a panel which are detachably mounted on the panel body.

The electrical assembly is detachably mounted on the base part of the base module, or detachably mounted on the bottom shell of the air and water duct module.

The base module includes a motor bracket fixed on the base part. The motor bracket includes a motor stand, and a motor pressure plate and a motor cover plate which are mounted on the motor stand and configured to fix the fan motor. The motor pressure plate and the motor cover plate are detachably mounted on the base part respectively. The motor pressure plate limits the fan motor in a radial direction, and the motor cover plate limits the fan motor in an axial direction.

The electrical assembly further includes a concentrator. Each load terminal of the air conditioner indoor unit is electrically connected with the concentrator. The concentrator is electrically connected with the electrical box.

The electrical assembly is detachably mounted on an end of the base part or an end of the bottom shell.

Both an air duct and a water duct of the air conditioner indoor unit are formed on the bottom shell of the air and water duct module.

The connection pipeline has a liquid inlet pipe and an air collection pipe. Both the liquid inlet pipe and the air collection pipe are connected on one side, far away from the motor bracket, of the heat exchanger. There are tee structures arranged on both the liquid inlet pipe and the air collection pipe. With the tee structure, both sides of the heat exchanger are arranged with an outdoor unit connection terminal of the connection pipeline.

After the liquid inlet pipe and the air collection pipe pass through the tee structure, one branch forms a U-shaped bend which bypasses the motor bracket from the side, far away from a back plate of the base part, of the motor bracket after extending beyond the length of the heat exchanger at a position close to the back plate of the base part, reaches a lower edge of the back plate of the base part in a working and mounting state, and bends, at the position close to the back plate of the base part, towards an end of the base part on this side; another branch extends to the lower edge of the back plate of the base part in the working and mounting state on this side, and bends, at the position close to the back plate of the base part, towards the end of the base part on this side.

A cross section of the heat exchanger is inverted-U shaped, and its two sides are arranged with a hanging fixing structure for mounting the heat exchanger on the base module in a hanging way. Two ends of the heat exchanger are arranged with a sealing part, so that an open chamber is formed in the inverted-U shaped interior of the heat exchanger. An angular frame is fixed on the heat exchanger, and a fixing structure for fixing the connection pipeline is arranged on the angular frame.

The shell module is detachably mounted on the base module, and includes: a panel body, and a filter screen and a panel which are detachably mounted on the panel body. The panel body includes a mounting rack, and two side panels which are detachably mounted on two ends of the mounting rack and correspond to the two ends of the base part.

The shell module is detachably mounted on the base module through a buckle structure.

The air and water duct module is mounted on the base module in a sliding manner through a first guide structure, and performs limiting locking to a mounting state through the buckle structure and a threaded connecting piece. The air outlet frame module is mounted on the base module in a sliding manner through a second guide structure, and performs limiting locking to the mounting state through the buckle structure and the threaded connecting piece.

The first guide structure is a first sliding structure or a first guide rail structure. The second guide structure is a second sliding structure or a second guide rail structure.

The heat exchange module is detachably mounted on the base module through the buckle structure or a hanging structure, and the threaded connecting piece.

The air guide module is detachably mounted on the base module through the buckle structure.

A method for assembling an air conditioner indoor unit of the disclosure includes the following steps.

a. Each part in the base module, the air and water duct module, the heat exchange module, the air outlet frame module and the air guide module as claimed in claim 1 is assembled on a corresponding pre-assembly line, so that the base module, the air and water duct module, the heat exchange module, the air outlet frame module and the air guide module form five independent pre-assembly modules respectively.

b. On a general assembly line, the base module is taken as an assembling basis, the heat exchange module and the air and water duct module are respectively assembled with the base module.

c. The panel body of the shell module as claimed in claim 2 is assembled with the base module, and the filter screen of the shell module is assembled with the panel body of the shell module; then, the air outlet frame module is assembled with the base module, and the panel is assembled with the panel body.

d. At last, the air guide module is assembled with the base module, and the assembly of the whole body of the air conditioner indoor unit is completed.

Another method for assembling an air conditioner indoor unit of the disclosure includes the following operations.

a. Each part in the base module, the air and water duct module, the heat exchange module, the shell module, the air outlet frame module and the air guide module as claimed in claim 1 is assembled on the corresponding pre-assembly line, so that the base module, the air and water duct module, the heat exchange module, the shell module, the air outlet frame module and the air guide module form six independent pre-assembly modules respectively.

b. On the general assembly line, the base module is taken as the assembling basis, the heat exchange module and the air and water duct module are respectively assembled with the base module at first.

c. The shell module and the air outlet frame module are respectively assembled with the base module.

d. The air guide module is assembled with the base module, and the assembly of the whole body of the air conditioner indoor unit is completed.

At Step b, one side, arranged with the motor bracket, of the base module is upwards installed on the assembly line; the heat exchange module is assembled on the base module from top to bottom, and after assembly, an opening of a chamber between the back plate of the base module and the heat exchanger faces to a predetermined direction; after that, the air and water duct module is assembled in the part assembled at Step b along the predetermined direction to which the opening of the chamber between the back plate of the base module and the heat exchanger faces.

At Step b, a guide rail base of a second guide rail structure as claimed in claim 14 is mounted on the base part at first; and then the air outlet frame module is mounted on the base module through a second guide rail structure.

At Step d, after the air outlet frame module is mounted, the air guide module is mounted at an air outlet which is on the air outlet frame.

The technical solutions of the disclosure have the following advantages.

1. When the air conditioner indoor unit provided by the disclosure is assembled, the base module, the heat exchange module and the air and water duct module may be pre-assembled respectively, and each module is generally assembled after the pre-assembly is completed. In such a manner, the time needed to assemble the whole body is greatly reduced, the assembly efficiency is improved, and the manpower and material cost is saved; moreover, a foundation is laid for the subsequent realization of mechanized and automated production. Meanwhile, when the air conditioner indoor unit is disassembled, the base module, the air and water duct module and the heat exchange module may also be disassembled by taking the module as a unit. In such a manner, the disassembly efficiency may be greatly improved, and convenience is brought to cleaning or maintaining, and replacing a certain structure of the air conditioner indoor unit. Meanwhile, the fan motor is mounted in the base part of the base module, the air duct assembly is arranged in the air and water duct module, and the whole body of the air duct assembly is suitable to be disassembled from the base part without disassembling the fan motor in the base part. On one hand, the fan motor may be directly assembled and disassembled, so as to overhaul and replace the fan motor; on the other hand, when needing to clean the air duct assembly, separating the air duct assembly and the fan motor may directly disassemble the air duct assembly to clean. Compared with the problem in the conventional art that the air duct assembly cannot be cleaned due to arranging the air duct assembly on the bottom shell of the base part, or the performance of the fan motor is influenced by wetting when the air duct assembly is cleaned caused by fixedly mounting the fan motor on the bottom shell which is mounted with the air duct assembly, the disclosure can not only clean the air duct assembly, but also separate the air duct assembly from the fan motor when disassembling the air duct assembly from the base module, thereby preventing the fan motor from being damaged by wetting. In addition, compared with that, in the conventional art, the connection pipeline is bent to the back of the base part, and the heat exchanger of the heat exchange module and the connection pipeline are on different sides of the base module, the heat exchanger of the heat exchange module and the connection pipeline of the disclosure are entirely on the front side of the base module. In such a manner, when the heat exchanger is mounted, a working process of bending the connection pipeline is reduced, and convenience is brought to assembling and disassembling the heat exchange module.

2. When the air conditioner indoor unit provided by the disclosure is assembled, the shell module may be pre-assembled at the same time with the base module, the air and water duct module, the heat exchange module, the air outlet frame module and the air guide module, and then generally assembled with the above five modules after the pre-assembly is completed. Or, the base module, the air and water duct module, the heat exchange module, the air outlet frame module and the air guide module are pre-assembled at first, and then the parts of the shell module are generally assembled with the above five modules on the general assembly line. Any mounting way includes the pre-assembly of the five modules, so the time needed to assemble the whole body is greatly reduced, the assembly efficiency is improved, and the manpower and material cost is saved; moreover, a foundation is laid for the subsequent realization of mechanized and automated production. Meanwhile, when the air conditioner indoor unit is disassembled, at least the base module, the air and water duct module, the heat exchange module, the air outlet frame module and the air guide module may be disassembled by taking the module as a unit. In such a manner, the disassembly efficiency may be greatly improved, and convenience is brought to cleaning or maintaining, and replacing a certain structure of the air conditioner indoor unit. Moreover, in design, each structure in the air conditioner indoor unit may be designed in a form of the six modules, namely the base module, the air and water duct module, the heat exchange module, the air outlet frame, the air guide module and the shell module, thereby simplifying a product design process of designers, and improving the design efficiency.

3. Electrical assemblies of the air conditioner indoor unit provided by the disclosure are detachably mounted on the base part of the base module, or detachably mounted on the bottom shell of the air and water duct module, the electric assemblies may be assembled and disassembled directly to facilitate overhaul and replacement of the electric assemblies.

4. In the air conditioner indoor unit provided by the disclosure, when mounted, the fan motor is limited in a radial direction and an axial direction through the motor pressure plate and the motor cover plate; in such a manner, when the fan motor needs to be overhauled or replaced, the cover plate of the fan motor may be disassembled directly, and then the fan motor is disassembled along the axial direction, so the operation is simple and convenient.

5. In the air conditioner indoor unit provided by the disclosure, the concentrator is first connected with each load terminal of the air conditioner indoor unit, and then connected with the electrical box. Compared with directly connecting each load terminal of the air conditioner indoor unit with the electrical box, the connection line between the concentrator and the electrical box and the connection line between each load terminal of the air conditioner indoor unit and the electrical box are much simpler, so convenience is brought to assembling and disassembling the electrical box, and overhauling and replacing the electrical box.

6. In the air conditioner indoor unit provided by the disclosure, the electric assembly is detachably mounted on the end of the base part, so when the needing to be overhauled and replaced, the electric assembly may be directly disassembled from the end of the base part.

7. In the air conditioner indoor unit provided by the disclosure, the air duct and the water duct are arranged on the bottom shell of the air and water duct module; when the air duct and the water duct need to be cleaned, the air and water duct module may be directly disassembled to clean the air duct and the water duct. Compared with the problem in the conventional art that the air duct and the water duct cannot be cleaned due to arranging the air duct and the water duct on the bottom shell of the base part, the disclosure may clean the air duct and the water duct better.

8. In the air conditioner indoor unit provided by the disclosure, the connection pipeline has a liquid inlet pipe and an air collection pipe. Both the liquid inlet pipe and the air collection pipe are connected on one side, far away from the motor bracket, of the heat exchanger. There are tee structures arranged on both the liquid inlet pipe and the air collection pipe; with the tee structure, both sides of the heat exchanger are arranged with an outdoor unit connection terminal of the connection pipeline. In such a manner, during the actual installation of the air conditioner indoor unit, it is convenient for the installation personnel to select, according to the actual situation of the user, a connection end of the connection pipeline at one end of the heat exchanger to be connected with the air conditioner outdoor unit, thereby saving the space occupation of installation, and improving the installation efficiency.

9. In the air conditioner indoor unit provided by the disclosure, the panel body is divided into the mounting rack and two side panels which are detachably mounted on two ends of the mounting rack and correspond to two ends of the base part; when the structure mounted on the end of the base part needs to be disassembled, the side panel on the corresponding end may be disassembled directly, that is, the structure may be disassembled without need of disassembling the mounting rack.

10. Through the method for assembling the air conditioner indoor unit provided by the disclosure, each part in the base module, the heat exchange module and the air and water duct module is pre-assembled, so that the base module, the heat exchange module and the air and water duct module form three independent pre-assembled modules, and then the base module is taken as the assembling basis, the heat exchange module and the air and water duct module are respectively assembled with the base module. In such a manner, the time needed to assemble the whole body is greatly reduced, the assembly efficiency is improved, and the manpower and material cost is saved; moreover, a foundation is laid for the subsequent realization of mechanized and automated production.

11. Through the method for assembling the air conditioner indoor unit provided by the disclosure, each part in the base module, the air and water duct module, the heat exchange module, the shell module, the air outlet frame module and the air guide module are pre-assembled on the corresponding pre-assembly line, so that the base module, the air and water duct module, the heat exchange module, the shell module, the air outlet frame module and the air guide module form six independent pre-assembly modules respectively; on the general assembly line, taking the base module as the assembling basis, the heat exchange module and the air and water duct module are respectively assembled with the base module at first; then, the shell module and the air outlet frame module are respectively assembled with the base module; at last, the air guide module is assembled with the base module, so the assembly of the whole body of the air conditioner indoor unit is completed. In such a manner, the general assembly line is greatly shortened, and by pre-assembling the six modules at the same time, the time needed to assemble the whole body is greatly reduced, the assembly efficiency is improved, and the manpower and material cost is saved; moreover, a foundation is laid for the subsequent realization of mechanized and automated production.

12. Through the method for assembling the air conditioner indoor unit provided by the disclosure, each part in the base module, the air and water duct module, the heat exchange module, the air outlet frame module and the air guide module are pre-assembled on the corresponding pre-assembly line, so that the base module, the air and water duct module, the heat exchange module, the air outlet frame module and the air guide module form five independent pre-assembly modules respectively; on the general assembly line, taking the base module as the assembling basis, the heat exchange module and the air and water duct module are respectively assembled with the base module at first; then, the panel body of the shell module is assembled with the base module, and the filter screen is assembled with the panel body; and then, the air guide module is assembled with the base module, and the panel is assembled with the panel body; at last, the air guide module is assembled with the base module, and the assembly of the whole body of the air conditioner indoor unit is completed. In such a manner, the general assembly line is greatly shortened, and by the assembling the five modules at the same time, the time needed to assemble the whole body is greatly reduced, the assembly efficiency is improved, and the manpower and material cost is saved; moreover, a foundation is laid for the subsequent realization of mechanized and automated production.

13. Through the method for assembling the air conditioner indoor unit provided by the disclosure, the air guide module and the air outlet frame module are disassembled from the base module respectively, and then the whole body of the air duct assembly is disassembled from the base part without disassembling the fan motor in the base part. In such a manner, the air guide module, the air outlet module and the air duct assembly may be disassembled conveniently and efficiently, so as to clean these modules and assemblies. Meanwhile, by using such a disassembling method, the air duct assembly may separate from the fan motor when disassembled from the base module, and the fan motor is not disassembled with the air duct assembly, thereby preventing the fan motor from being damaged by wetting when the air duct assembly is cleaned.

BRIEF DESCRIPTION OF THE DRAWINGS

In order to describe the technical solutions in specific implementation modes of the disclosure or the conventional art more clearly, the drawings required to be used for descriptions about the specific implementation modes or the conventional art will be simply introduced below. It is apparent that the drawings described below are only some implementation modes of the disclosure. Those of ordinary skill in the art may further obtain other drawings according to these drawings without creative work.

FIG. 119 is a structure diagram of an implementation mode that one side of an evaporator extends out of a liquid inlet pipe and an air collection pipe;

FIG. 120 is a structure diagram of another implementation mode that one side of an evaporator extends out of a liquid inlet pipe and an air collection pipe;

FIG. 121 is a structure diagram of another implementation mode that a liquid inlet pipe and an air collection pipe are arranged in a water groove;

FIG. 122 is a structure diagram that a liquid inlet pipe and an air collection pipe are arranged on a lower end of an evaporator;

FIG. 123 is a split structure view of each part of an evaporator in the disclosure;

FIG. 124 is a structural rear view of an air conditioner indoor unit in the conventional art, specifically showing a way of arranging the existing liquid inlet pipe and air collection pipe on a base part;

FIG. 125 is an overall structure diagram of a simplified angular frame in embodiment 2 of the disclosure;

FIG. 126 is a structure diagram that the simplified angular frame in FIG. 125 is fixedly mounted with one end of a heat exchanger;

FIG. 127 is a structure diagram that the simplified angular frame in FIG. 125 is mounted on the heat exchanger to support a connection pipeline;

FIG. 128 is an enlarged structure diagram of the part A in FIG. 127;

FIG. 129 is an overall structure diagram of an angular frame structure in embodiment 5;

FIG. 130 is a structure diagram after the angular frame structure in FIG. 129 is mounted with the heat exchanger in a mating manner;

Figure 31:
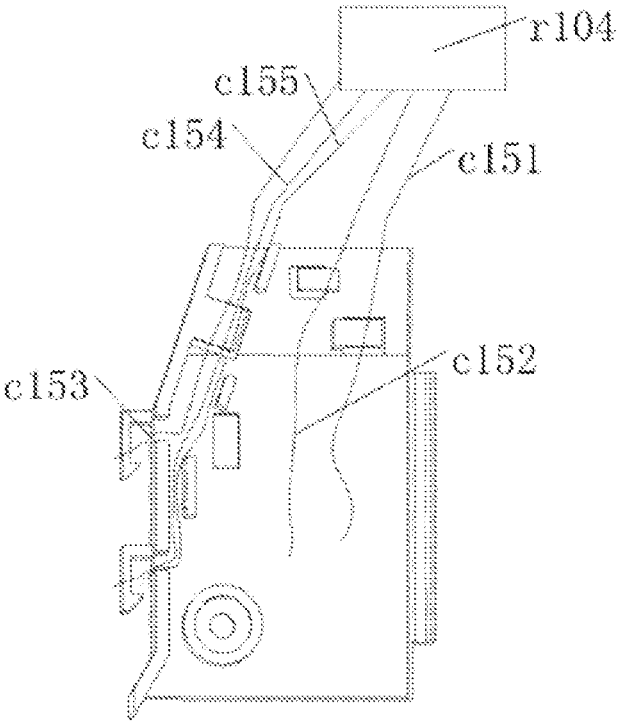
FIG. 31 is a structure diagram of wiring of a pipe pressure plate according to the disclosure.
Figure 130:
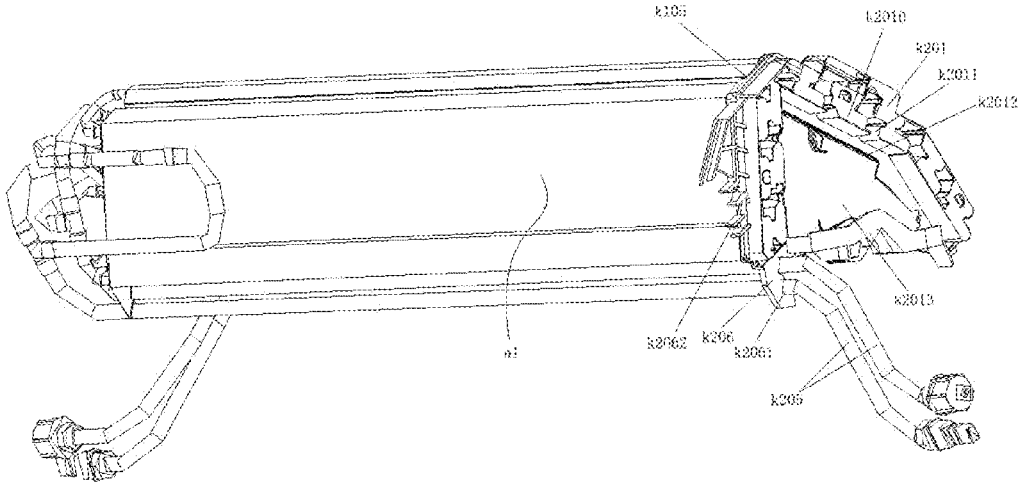
Figure 131:
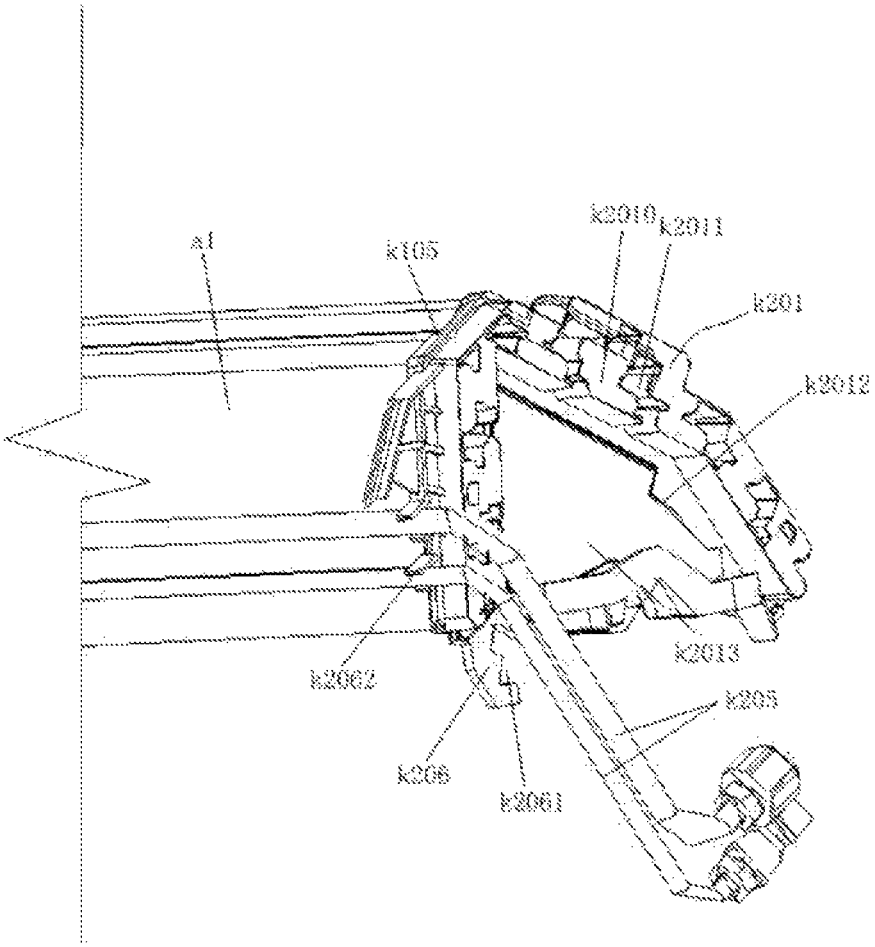
Figure 132:
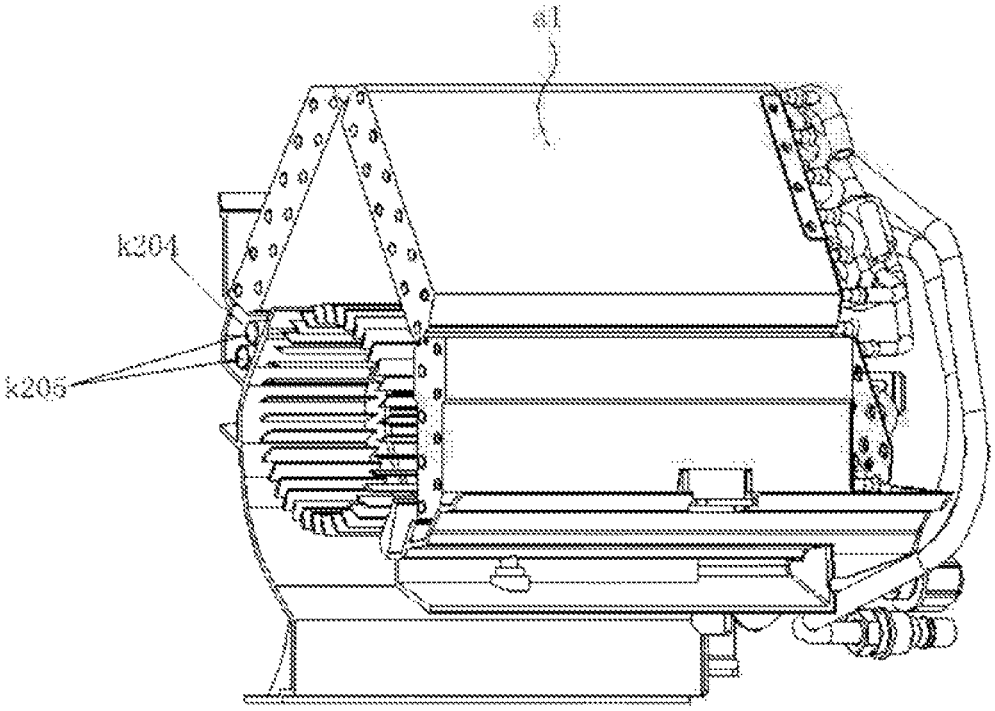
Figure 133:
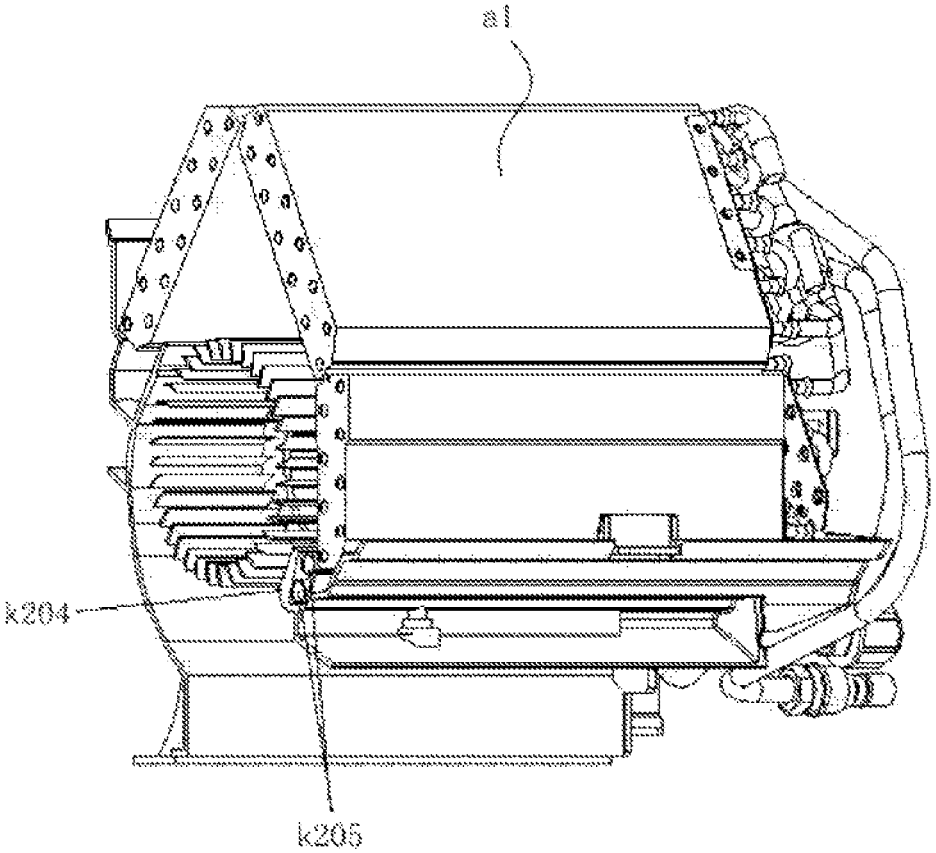
Figure 134:
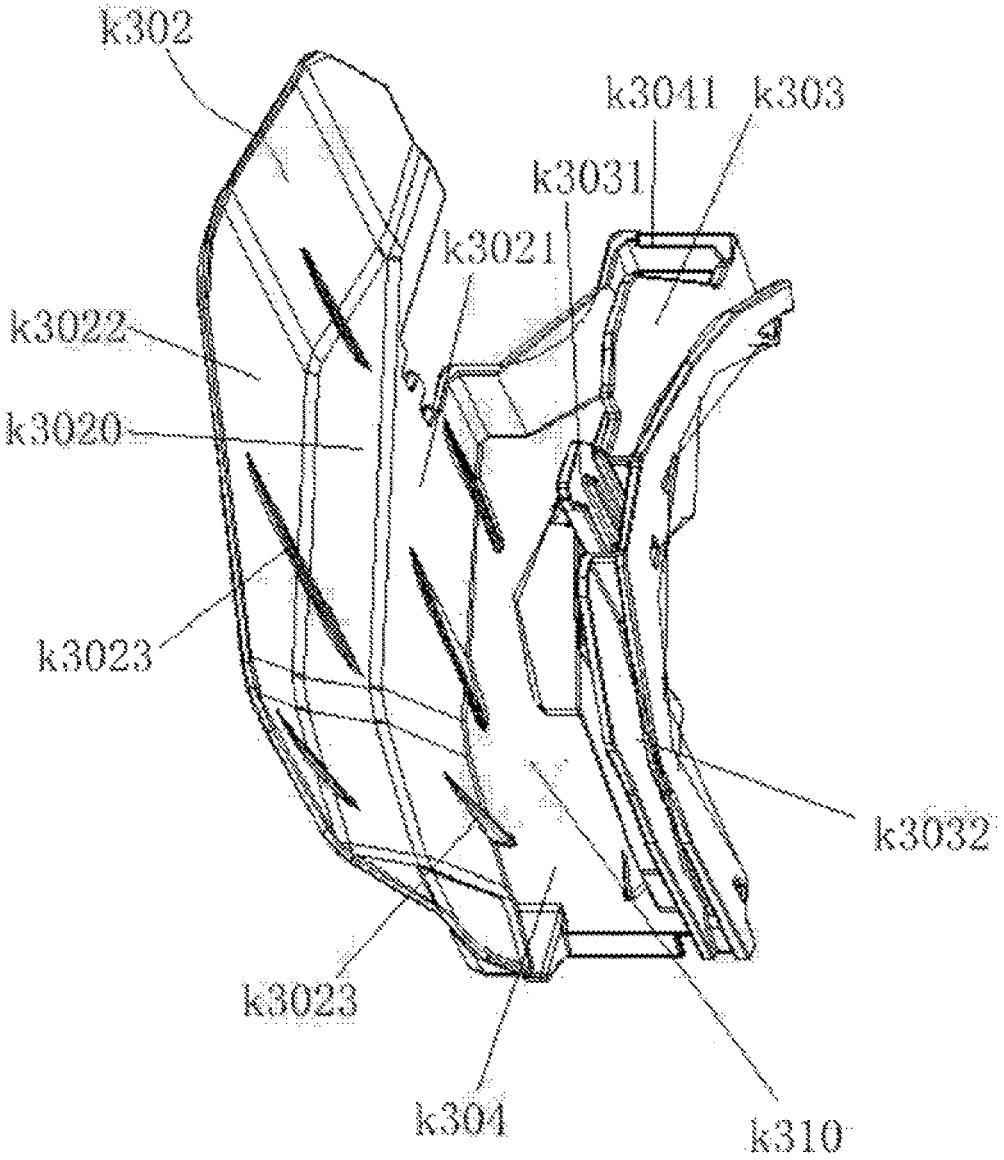
Figure 135:
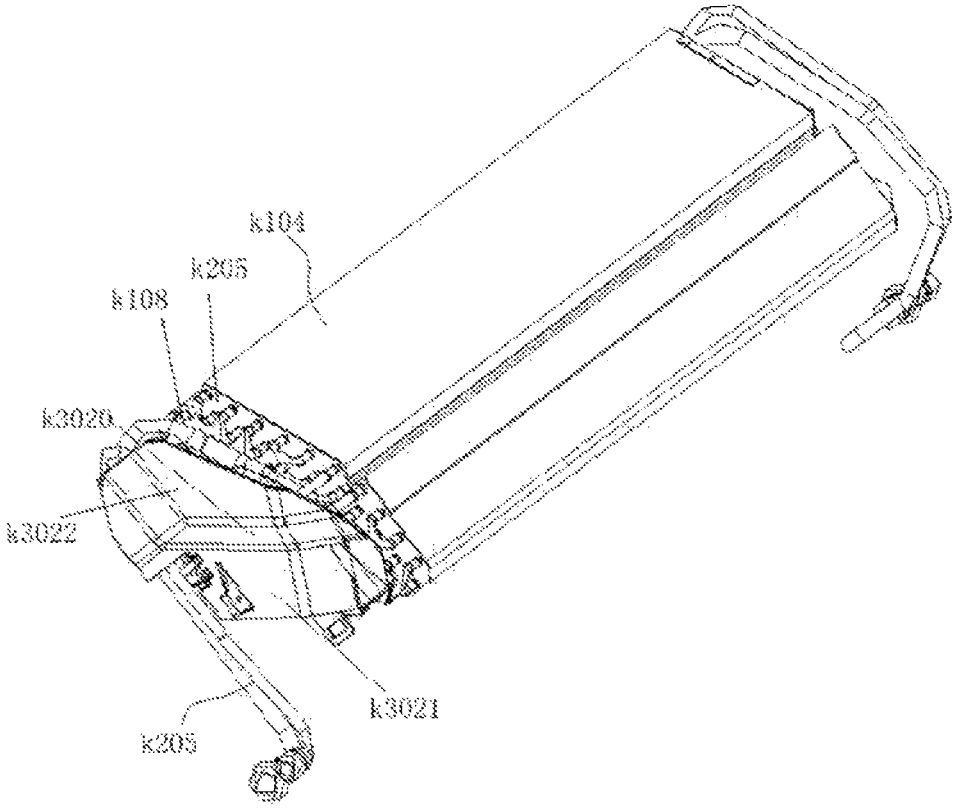
Figure 136:
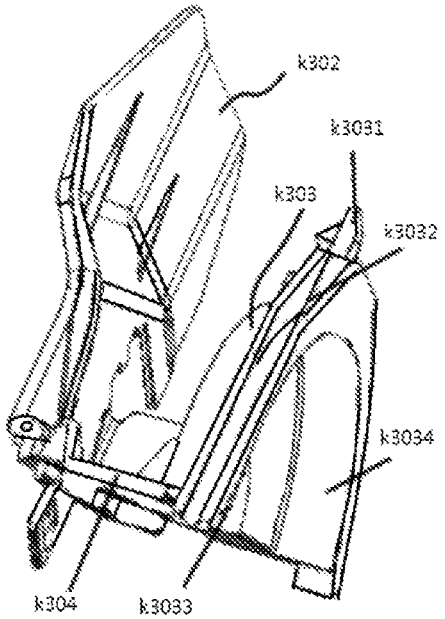
Figure 137:
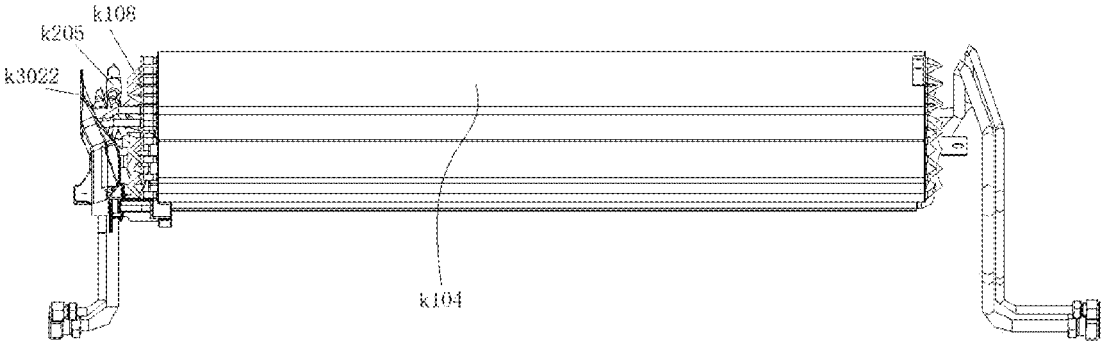
Figure 138:
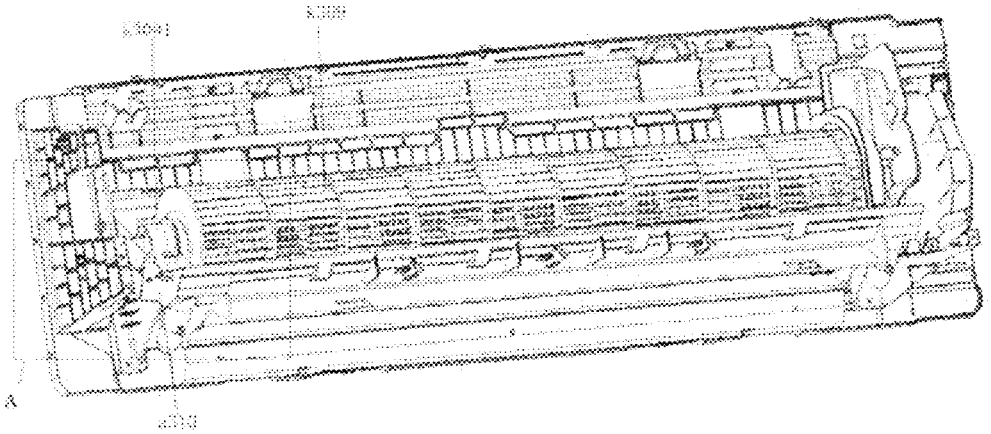
Figure 139:
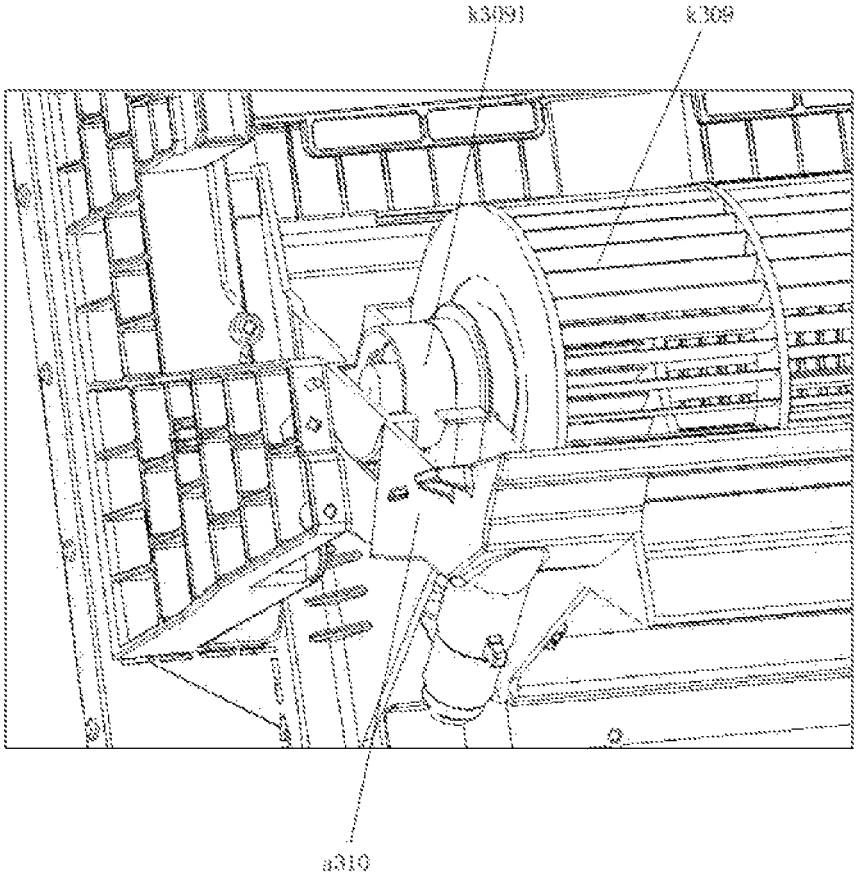
Figure 140:
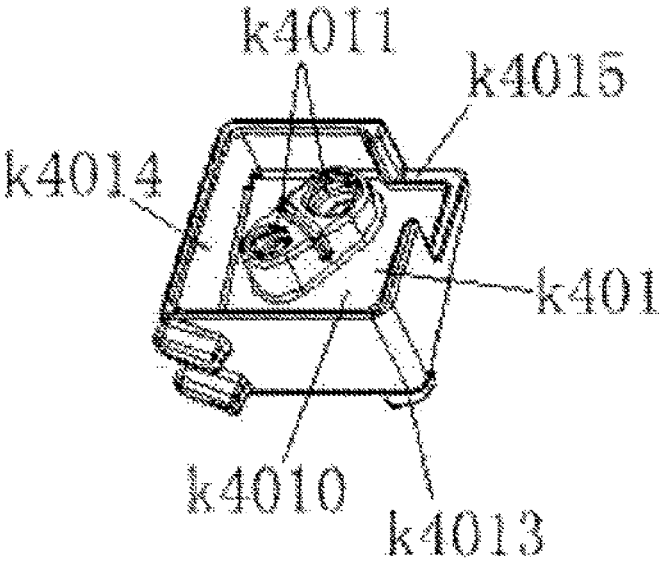
Figure 141:
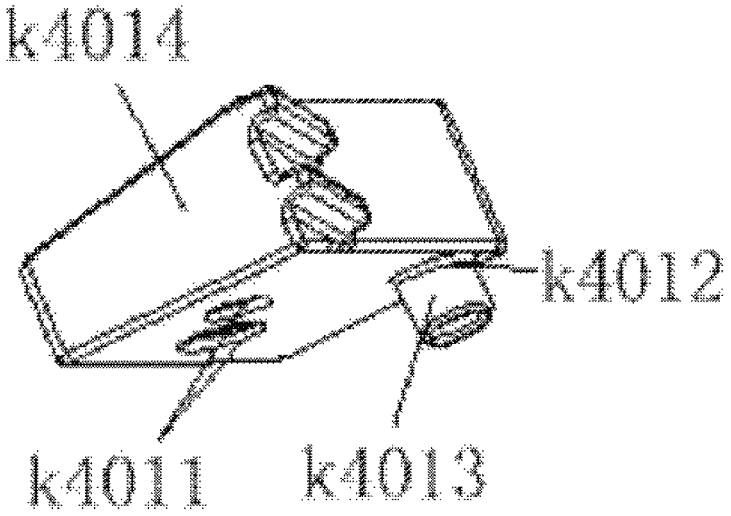
Figure 142:
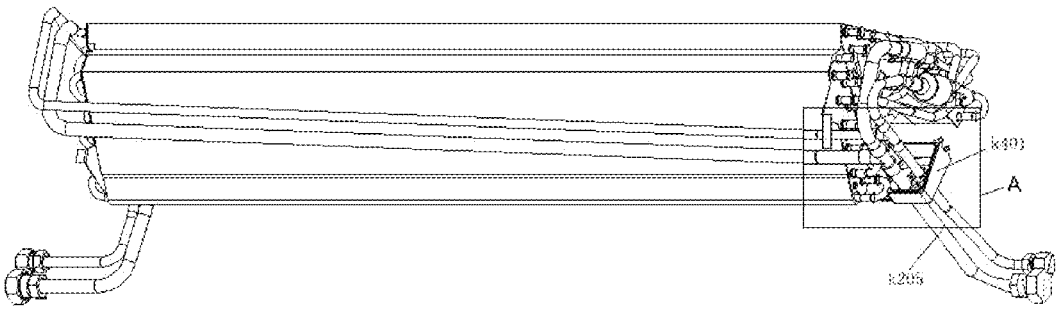
Figure 143:
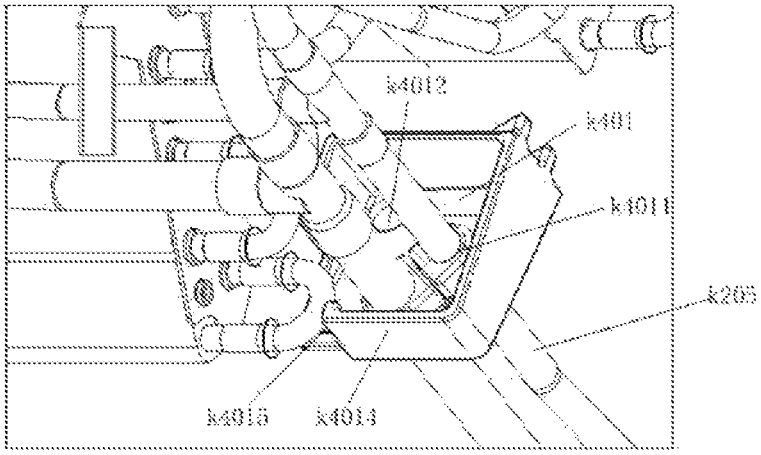
Figure 144:
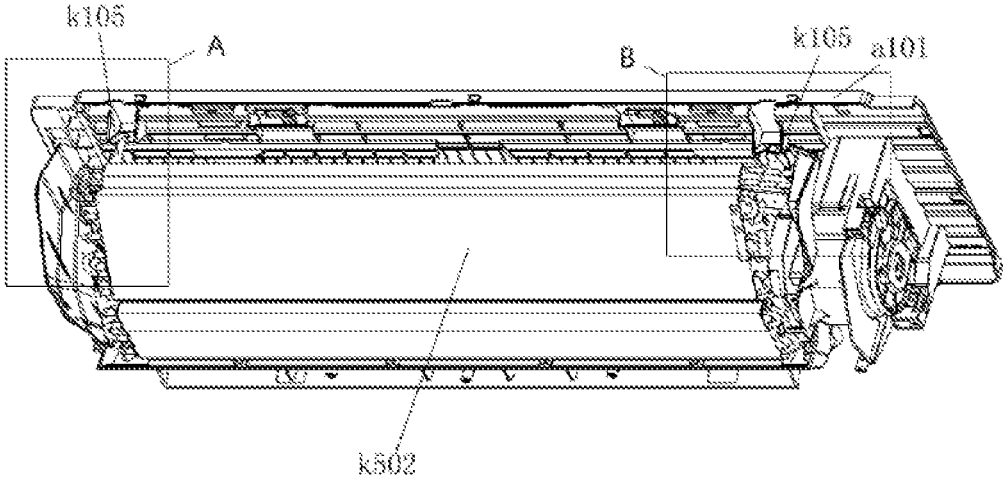
Figure 145:
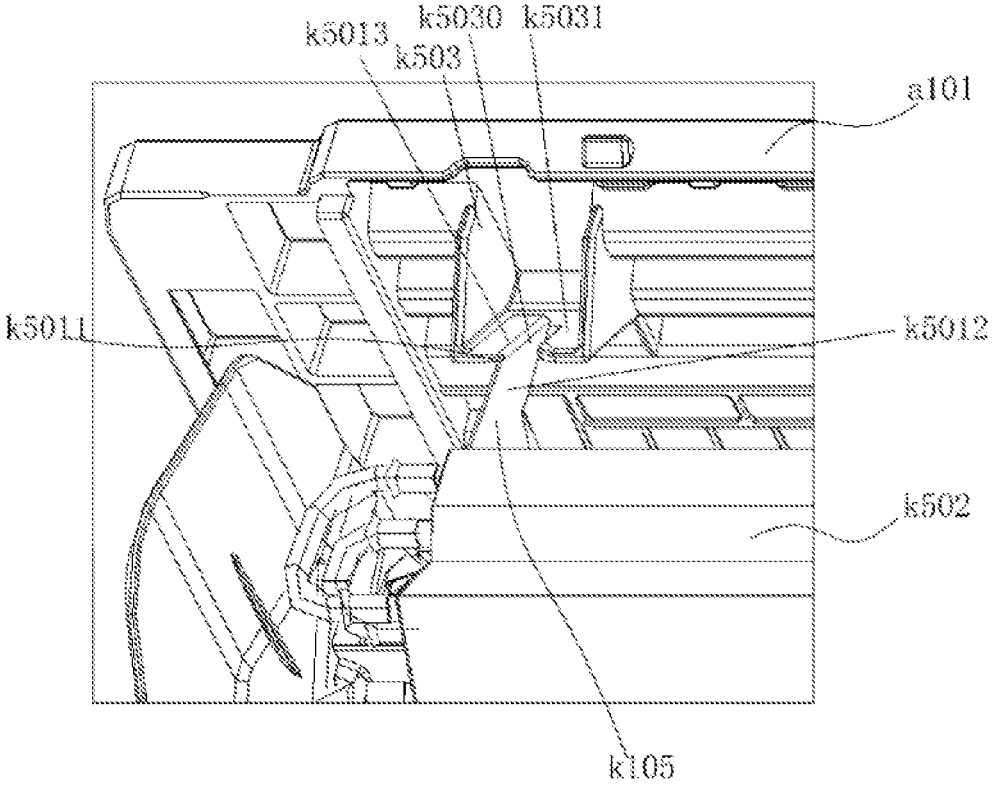
Figure 146:
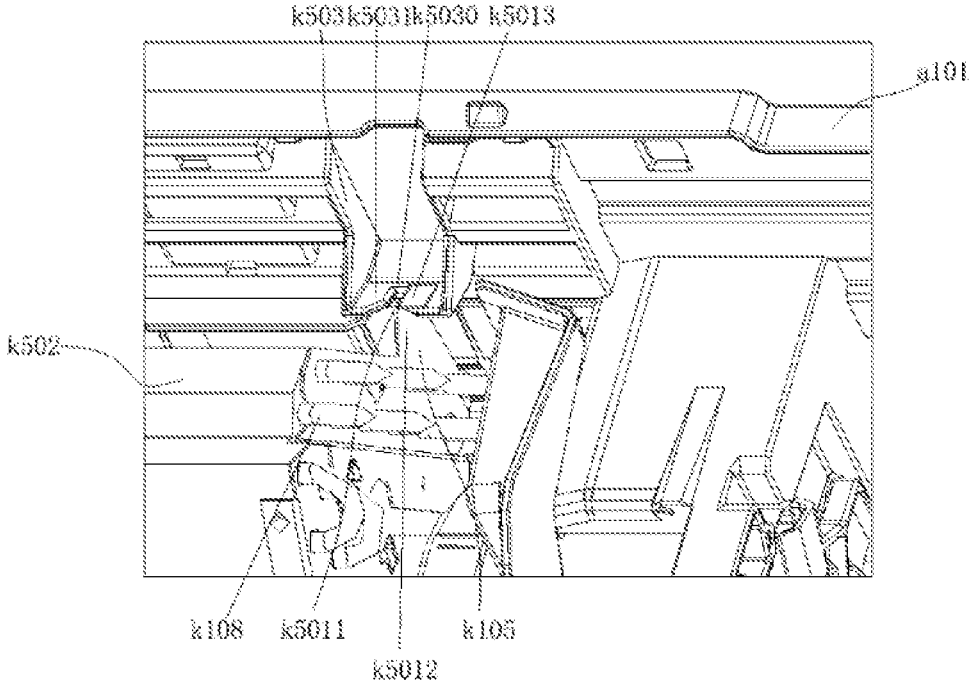
Figure 147:
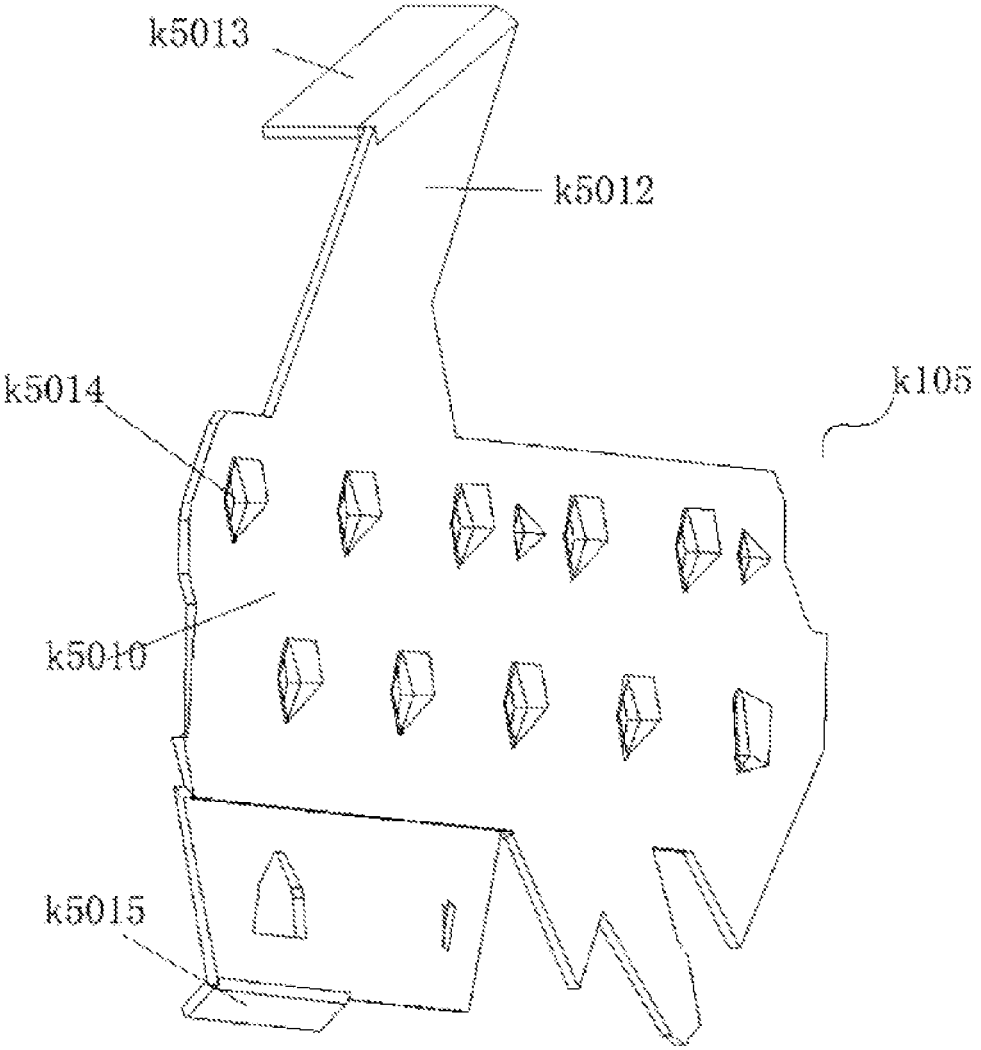
Figure 148:
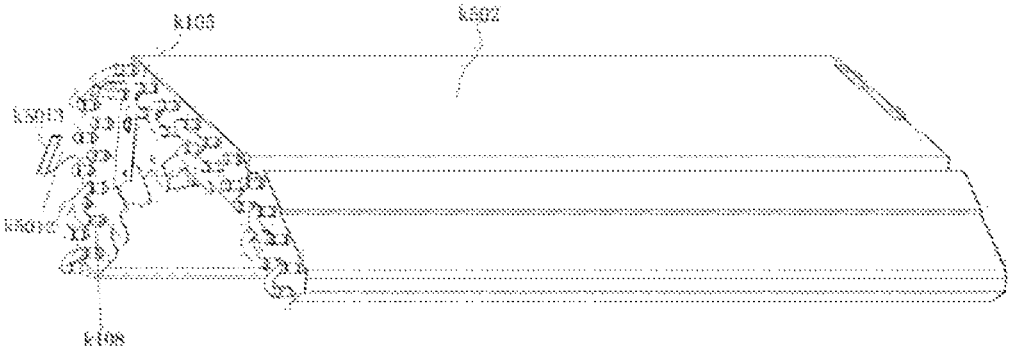
Figure 149:
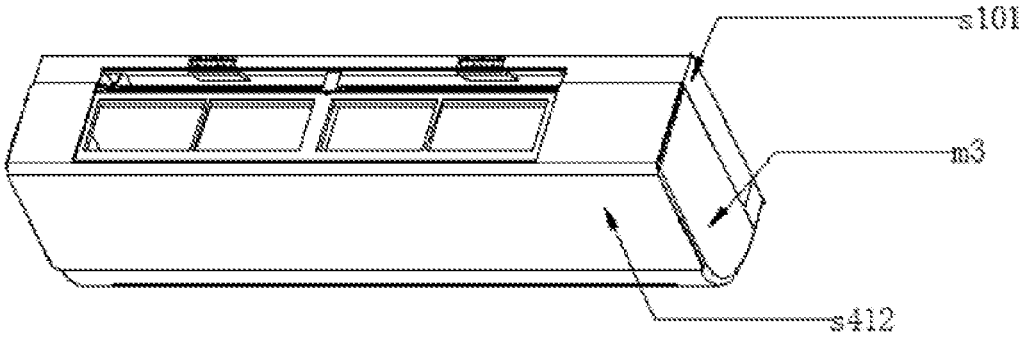
Figure 150:
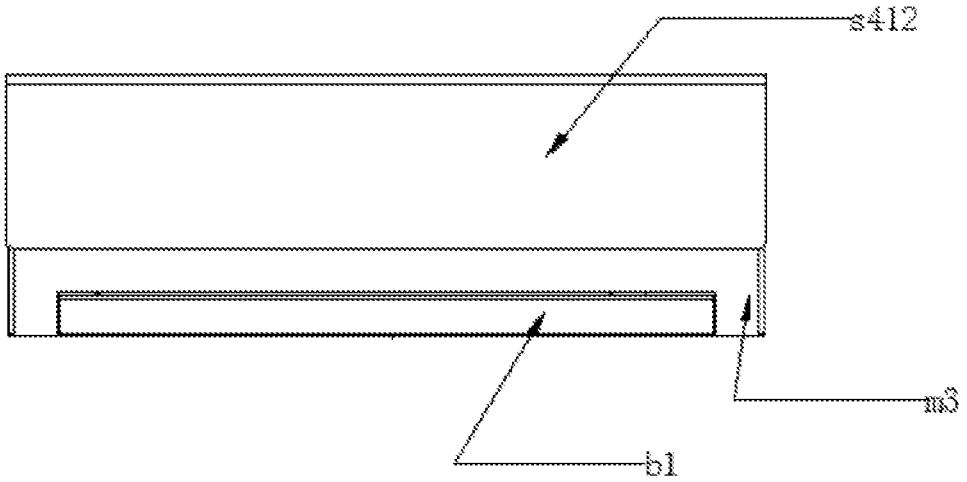
Figure 151:
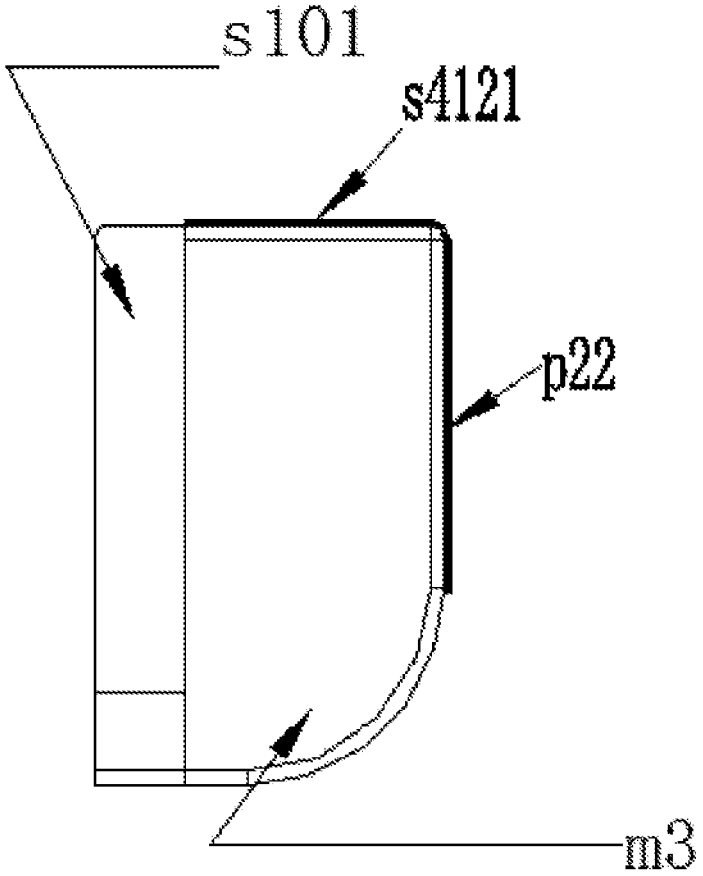
Figure 152:
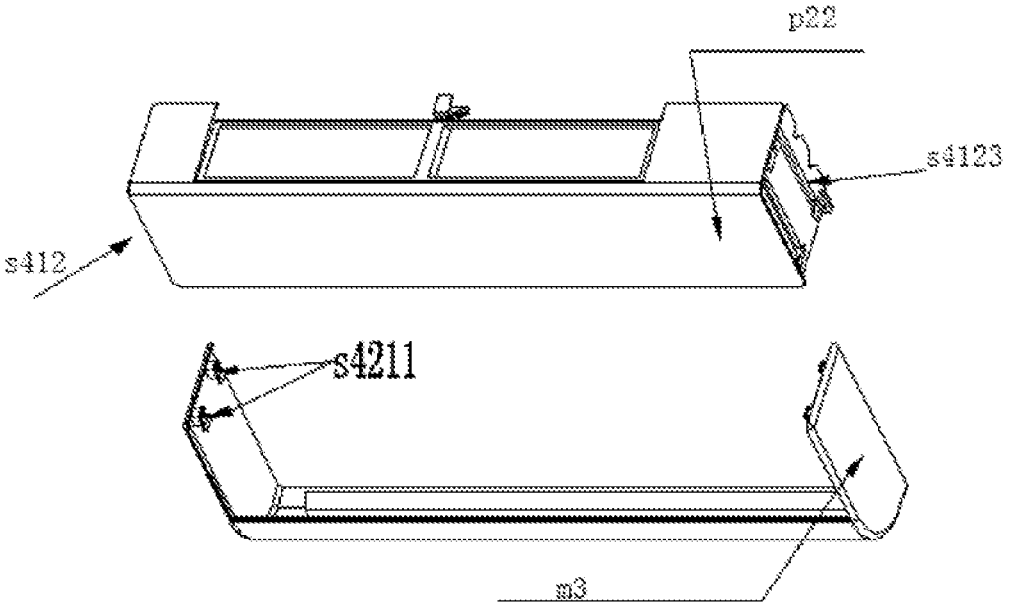
Figure 153:
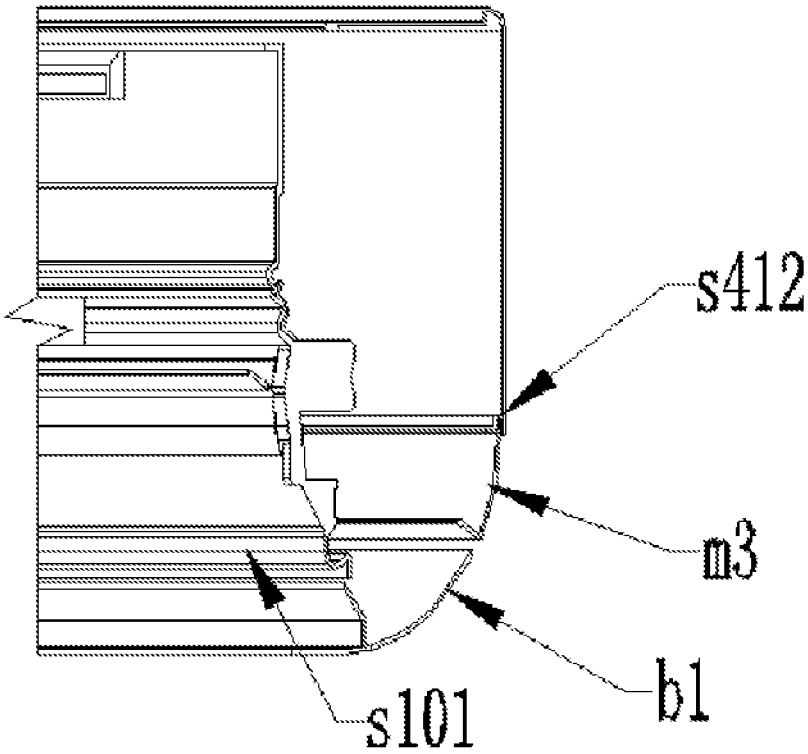
Figure 154:
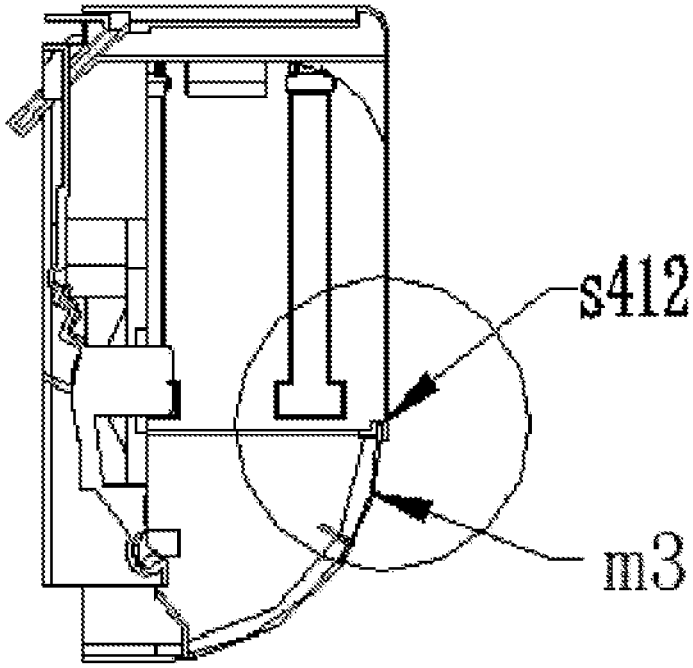
Figure 155:
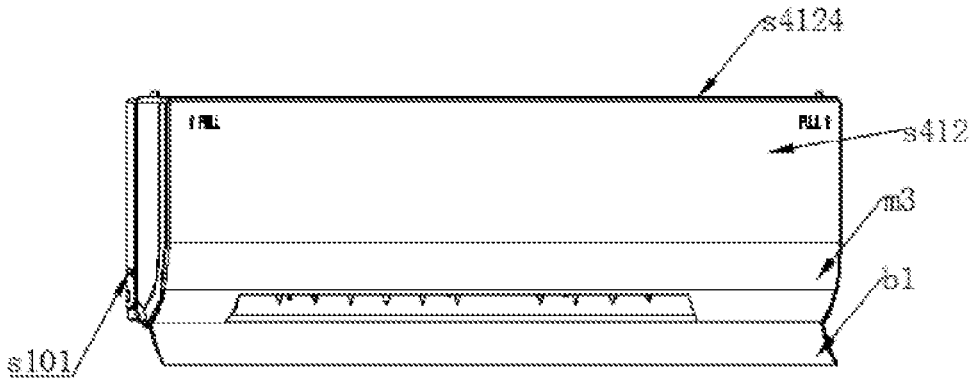
Figure 156:
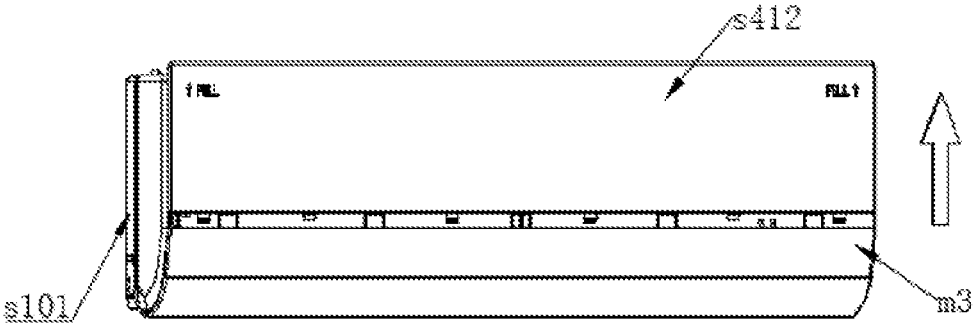
Figure 157:
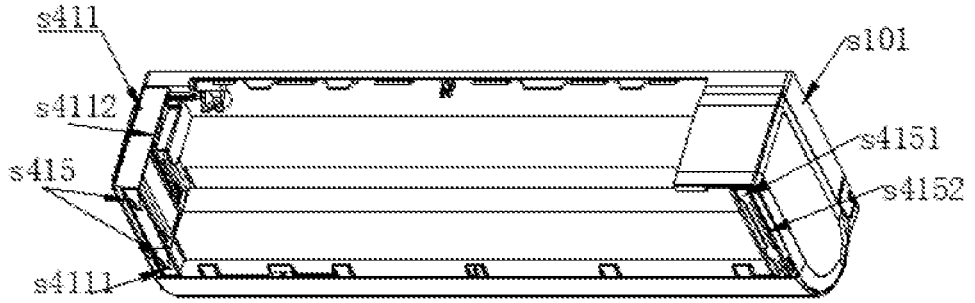
Figure 158:
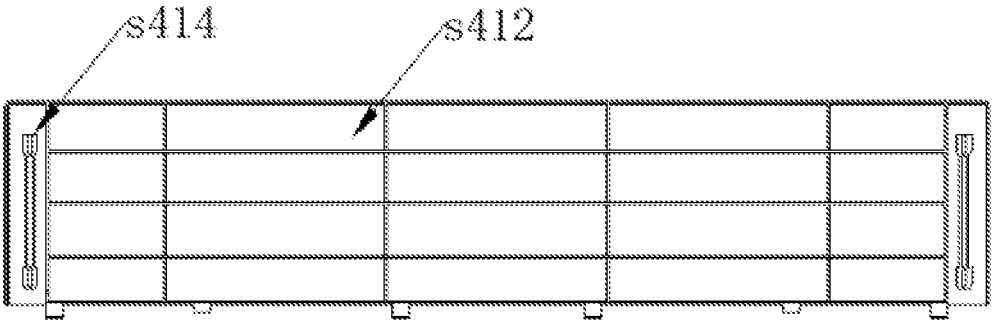
Figure 159:
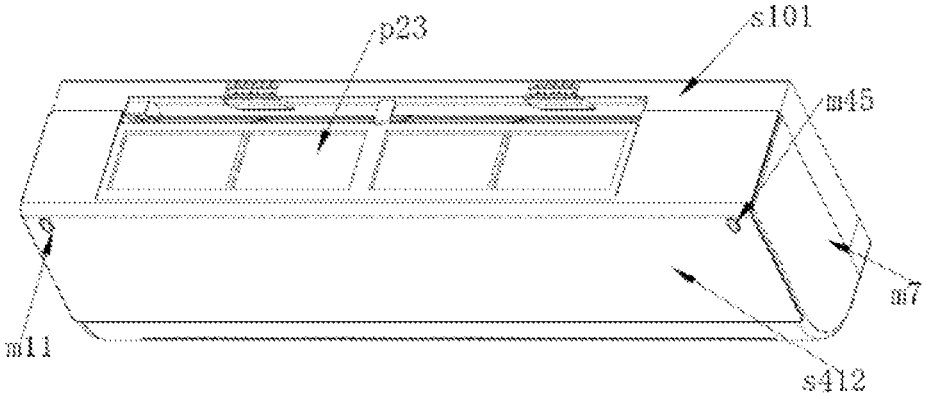
Figure 160:
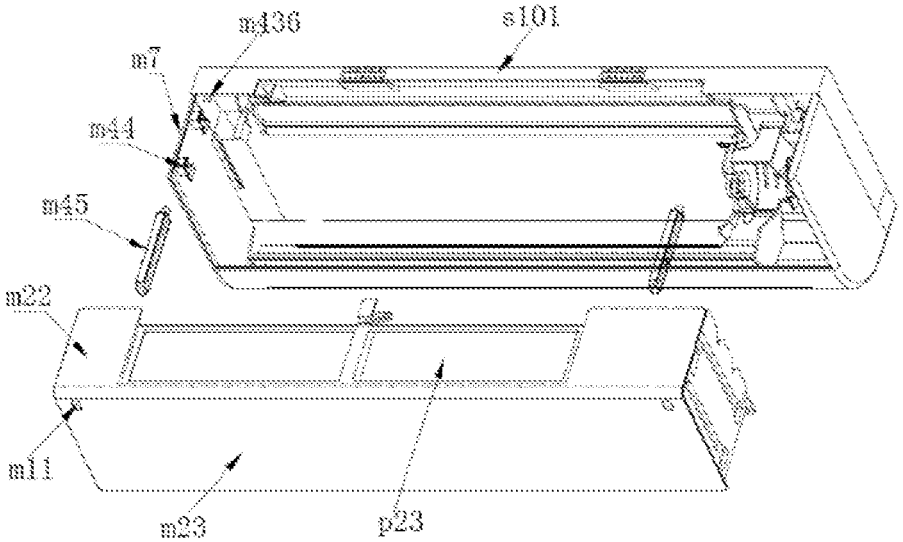
Figure 161:
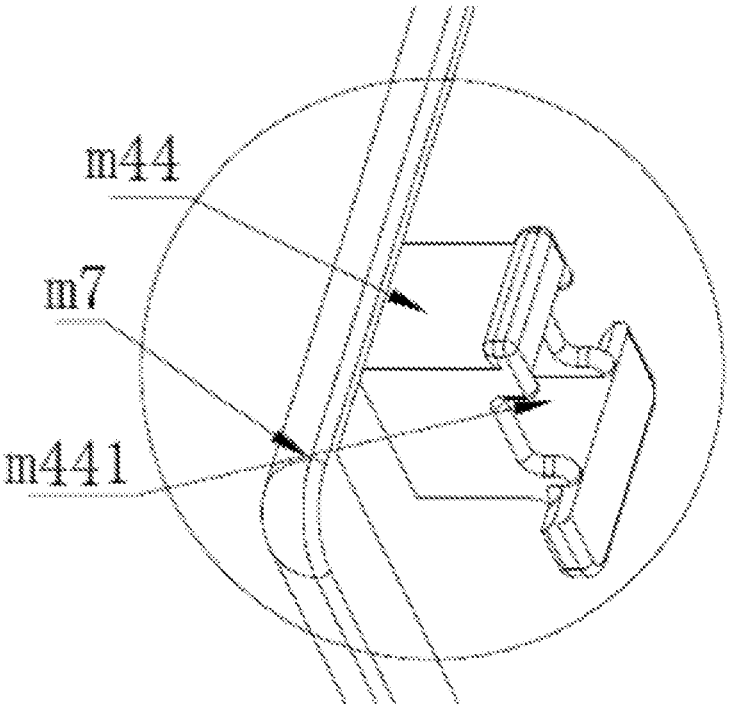
Figure 162:
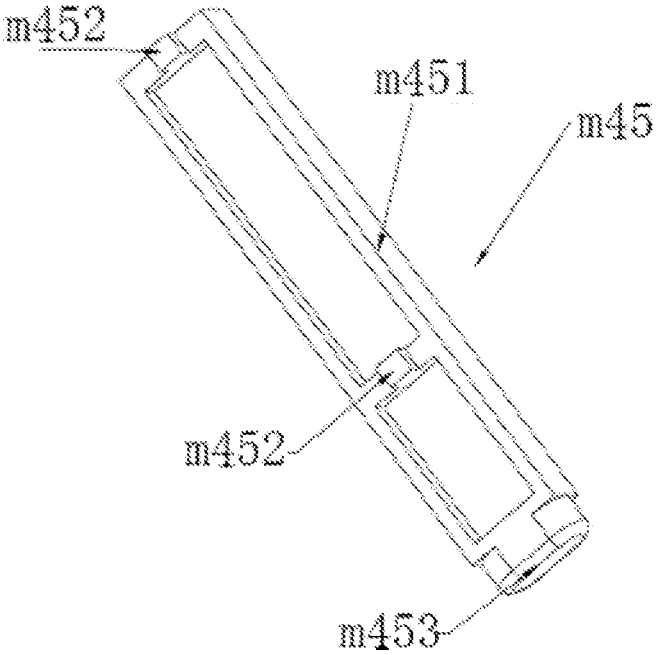
Figure 163:
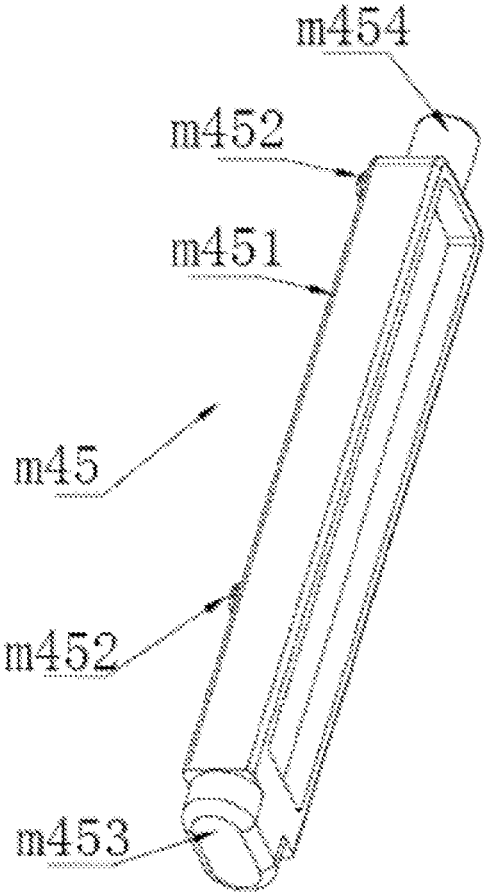
Figure 164:
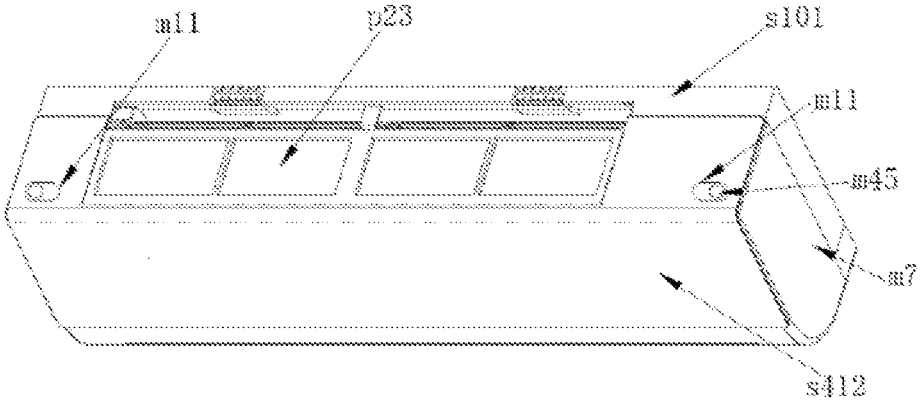
Figure 165:
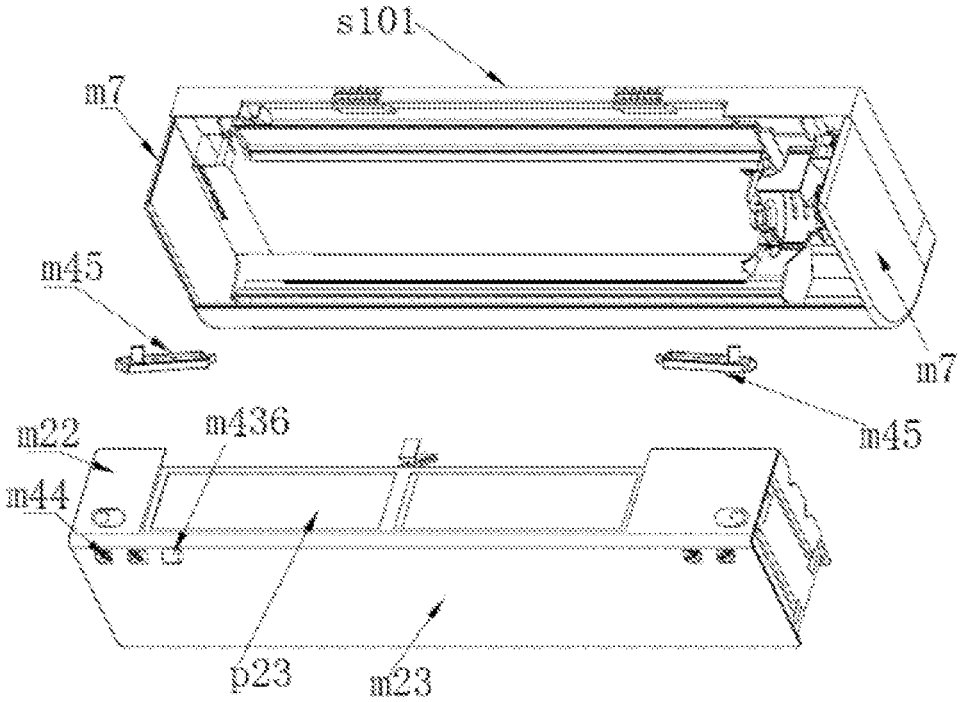
Figure 166:
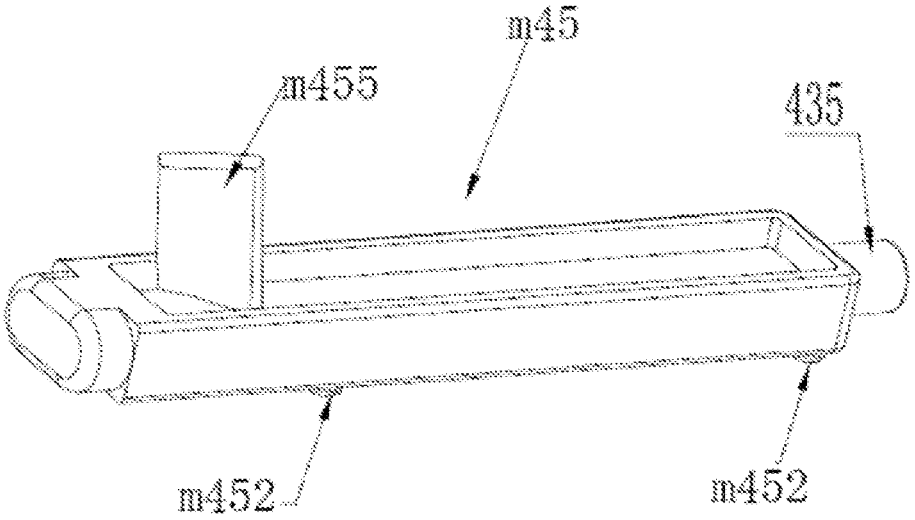
Figure 167:
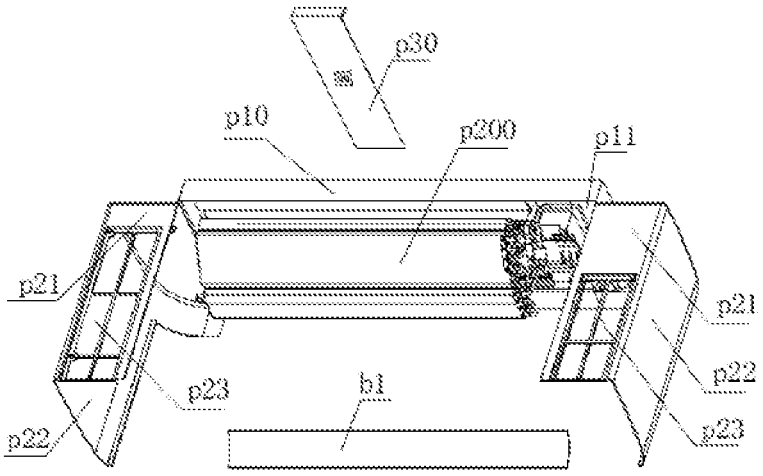
Figure 168:
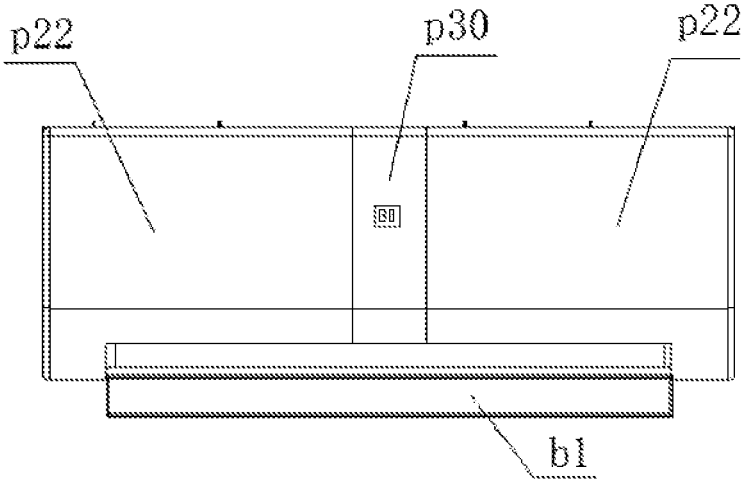
Figure 169:
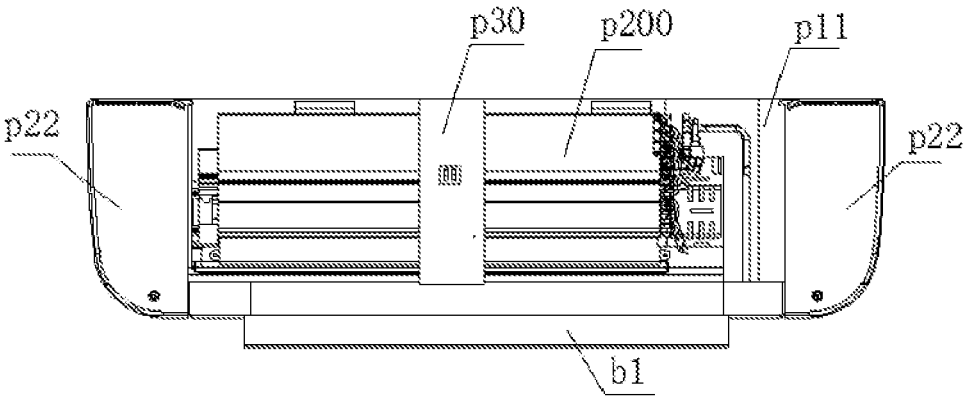
Figure 170:
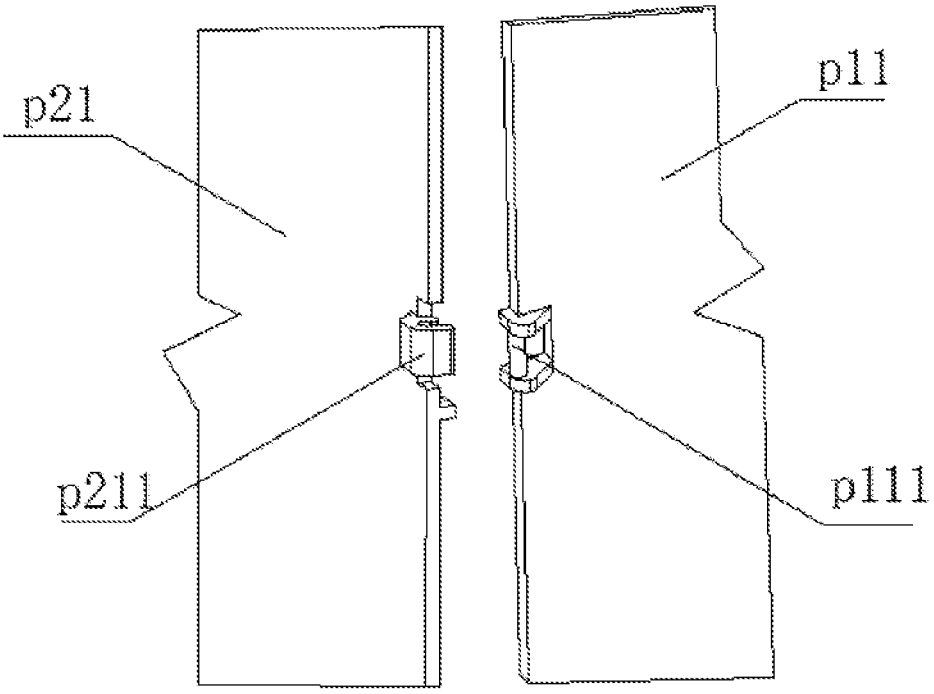
Figure 171:
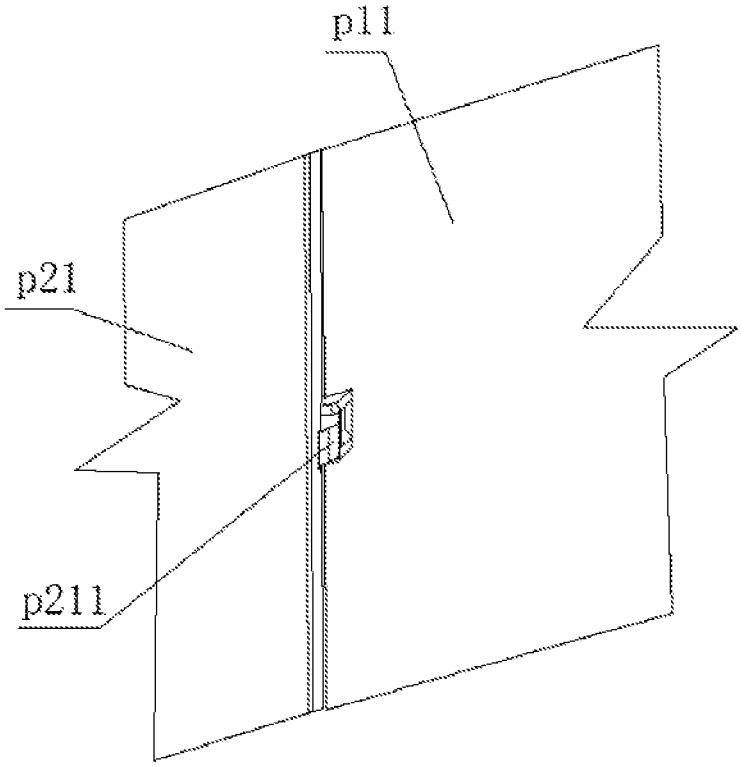
Figure 172:
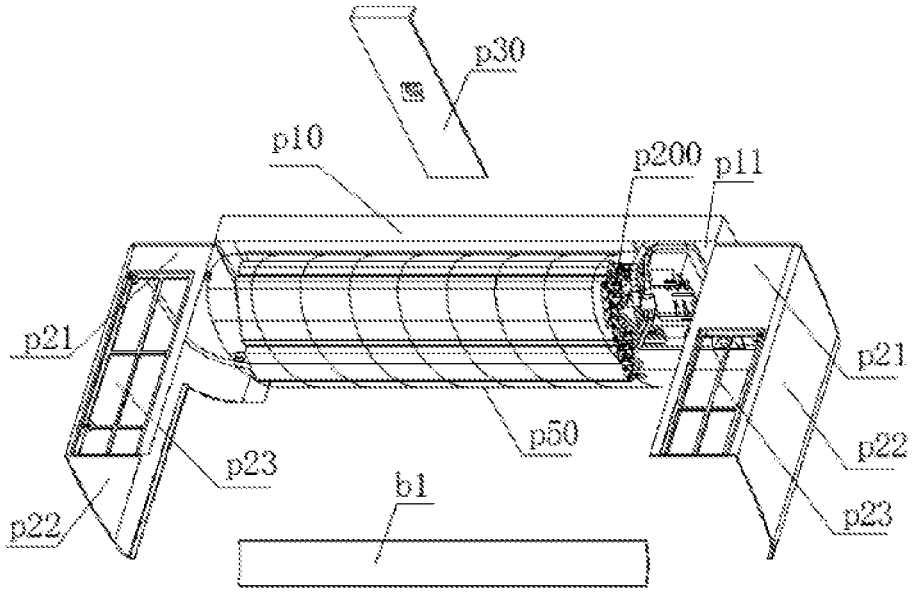
Figure 173:
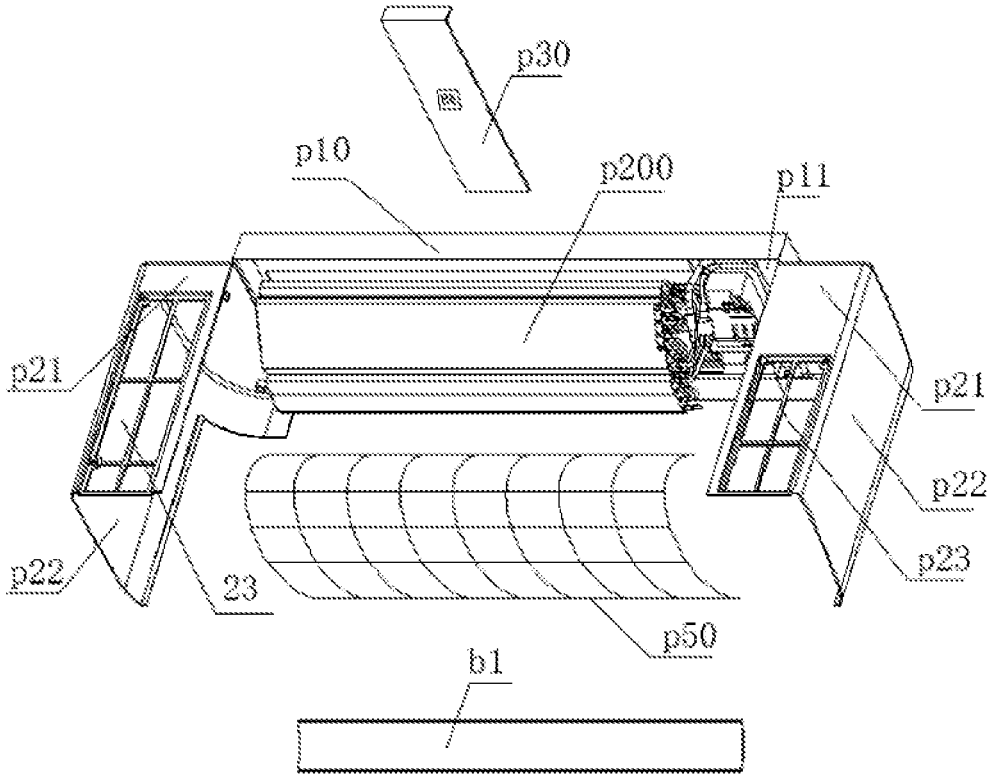
Figure 174:
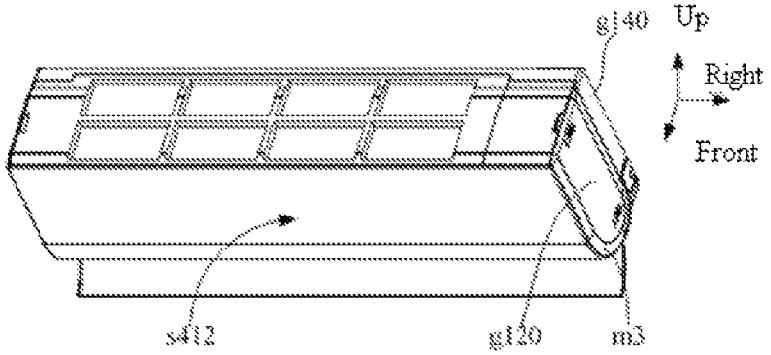
Figure 175:
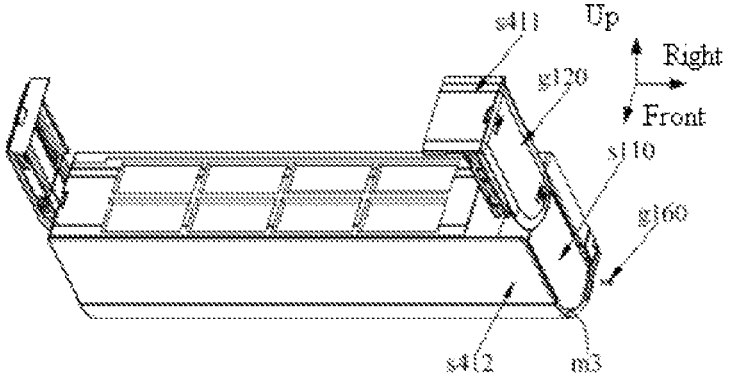
Figure 176:
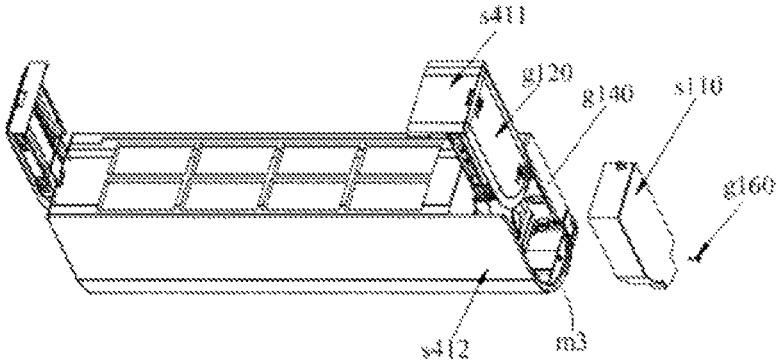
Figure 177:
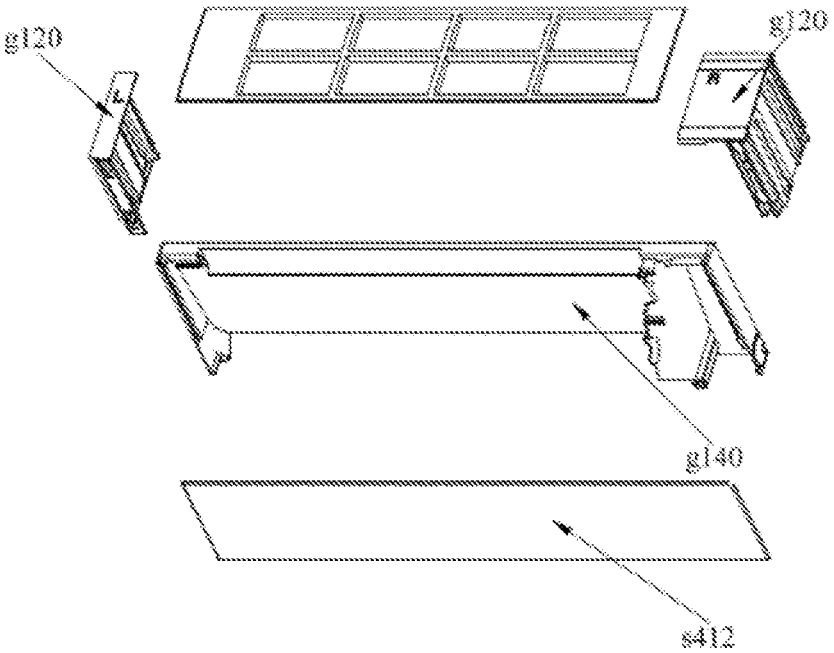
Figure 178:
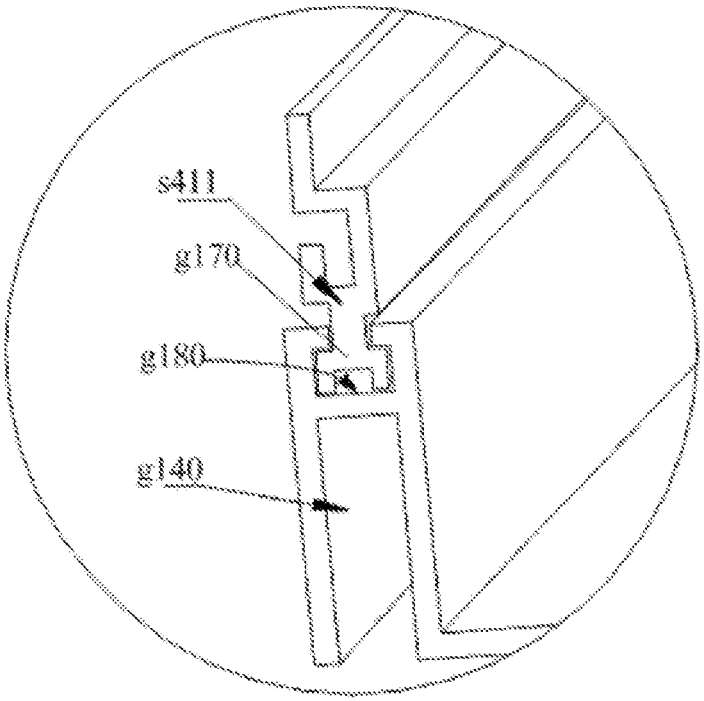
Figure 179:
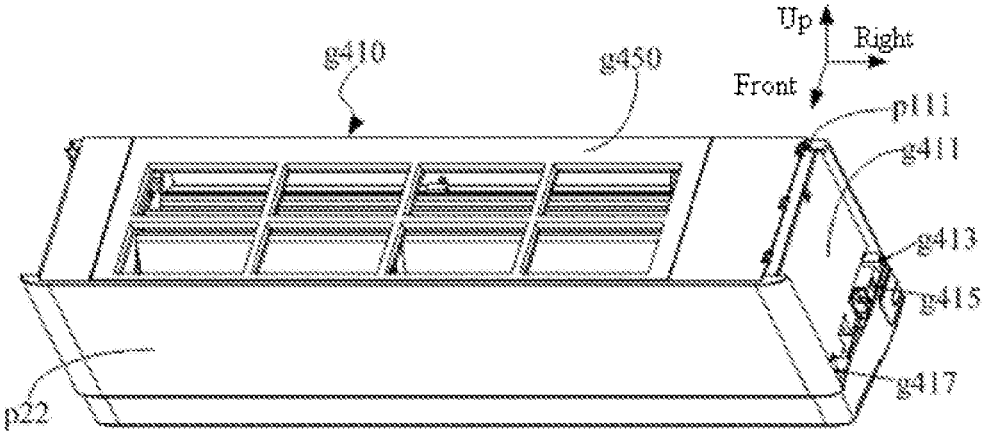
Figure 180:
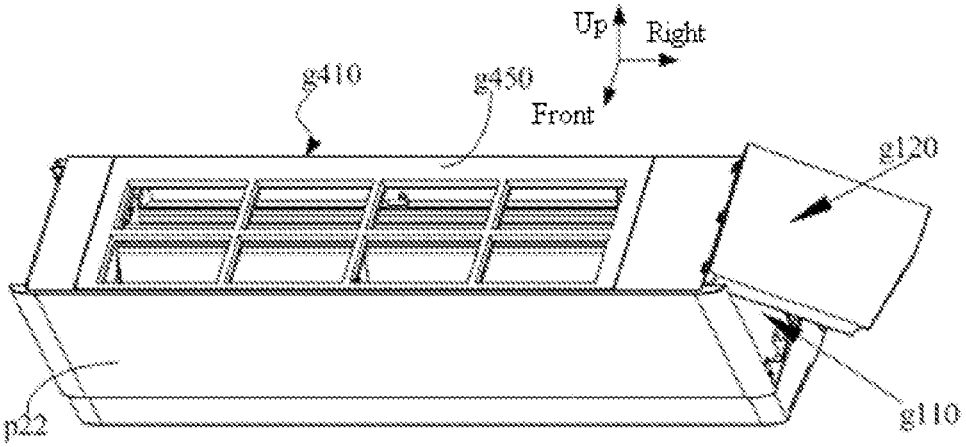
Figure 181:
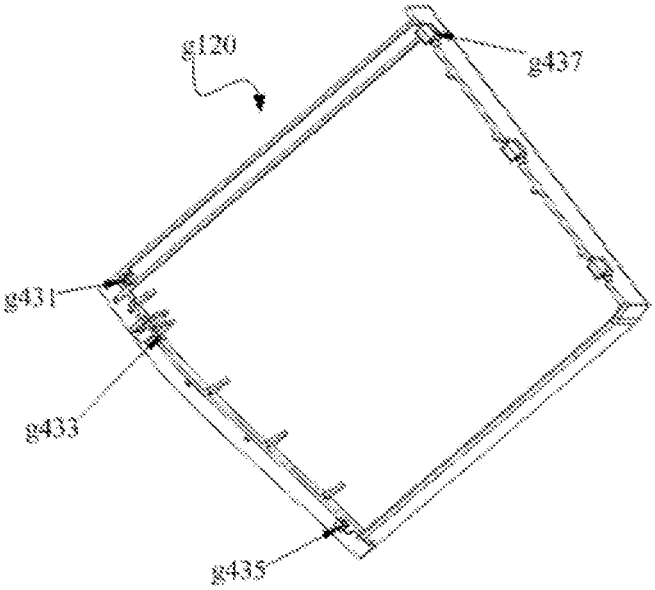
Figure 182:
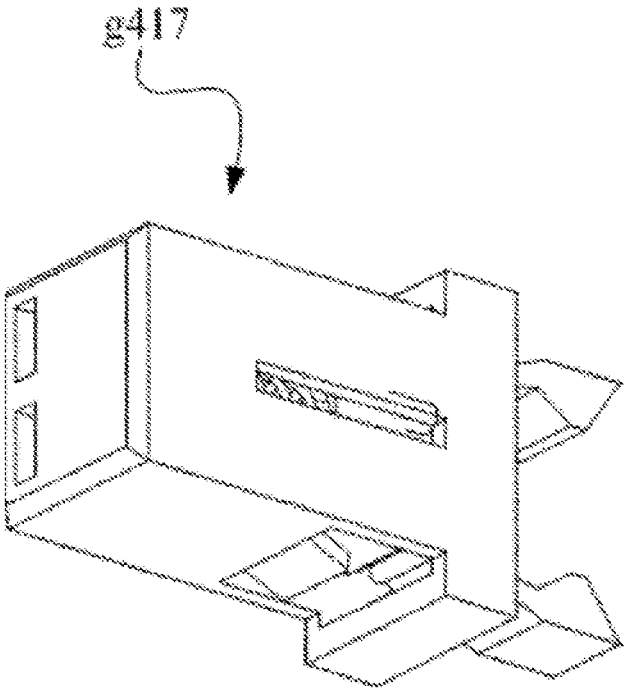
Figure 183:
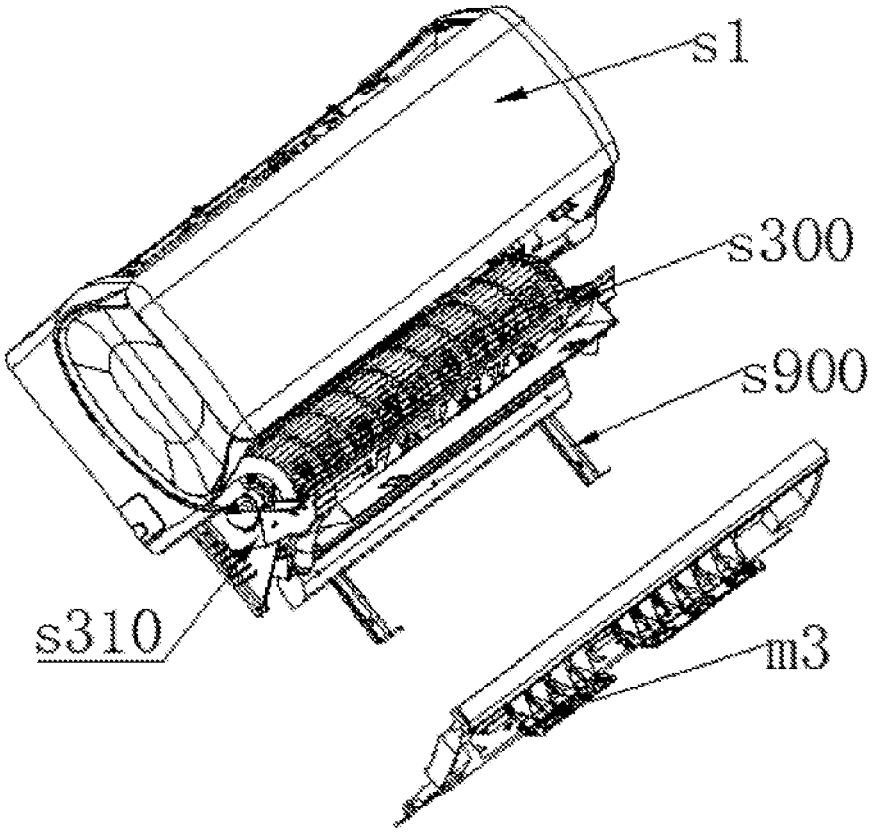
Figure 184:
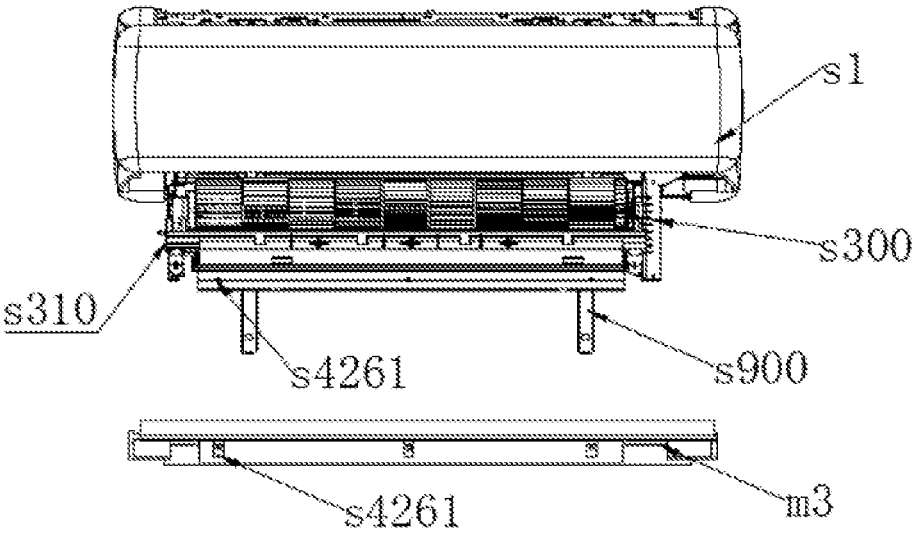
Figure 185:
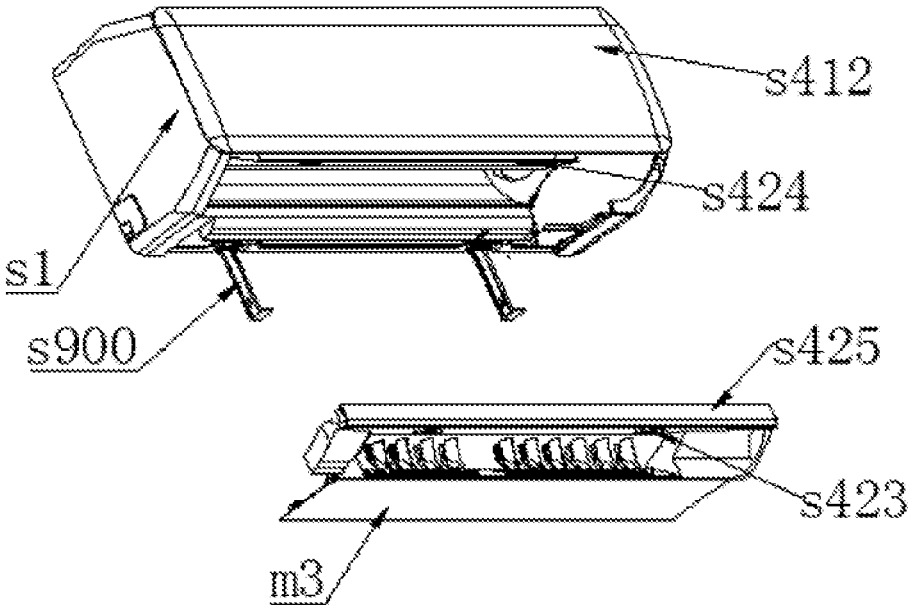
Figure 186:
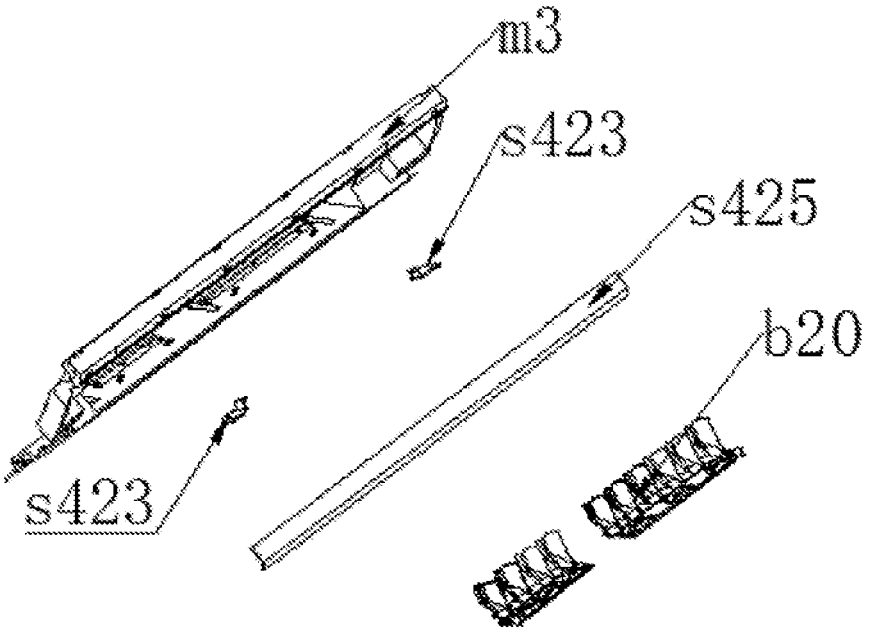
Figure 187:
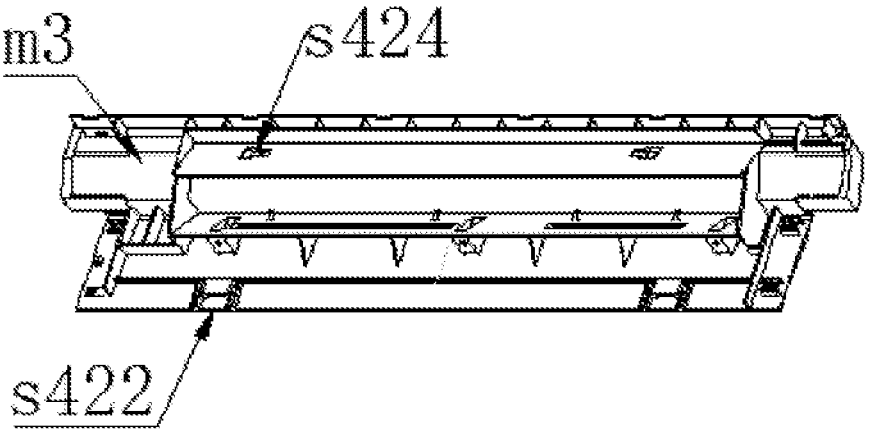
Figure 188:
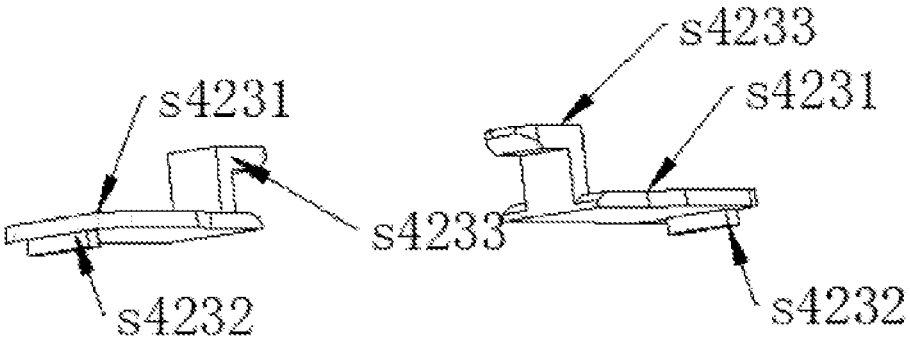
Figure 189:
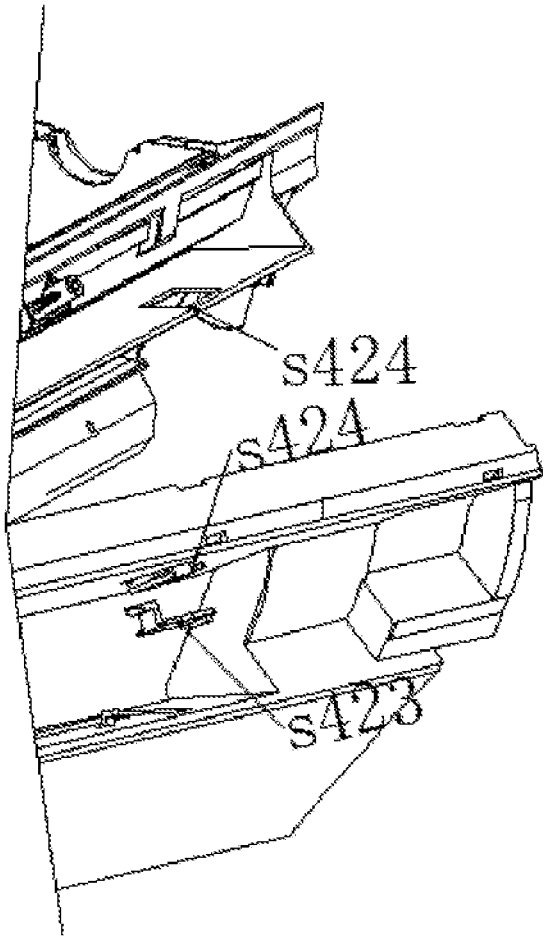
Figure 190:
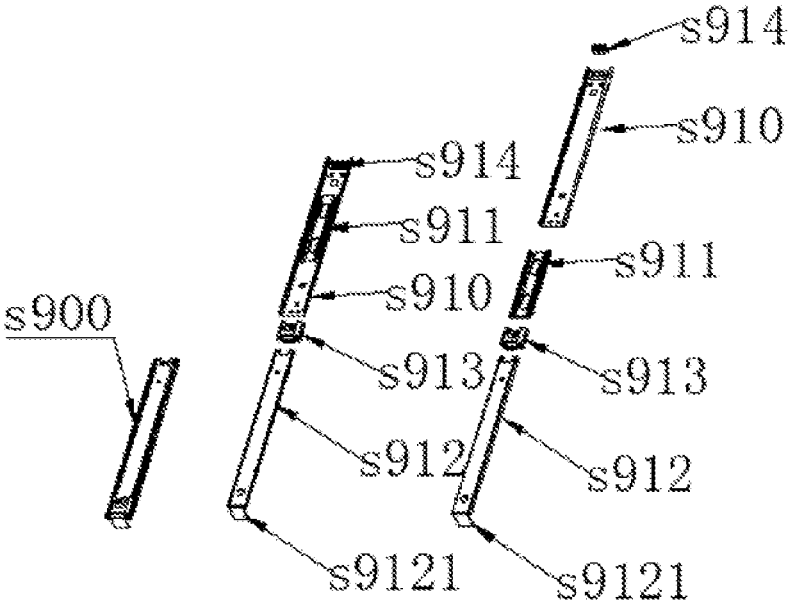
Figure 191:
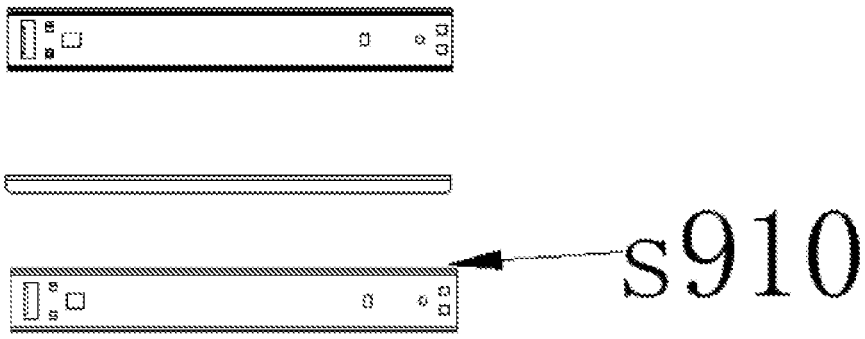
Figure 192:
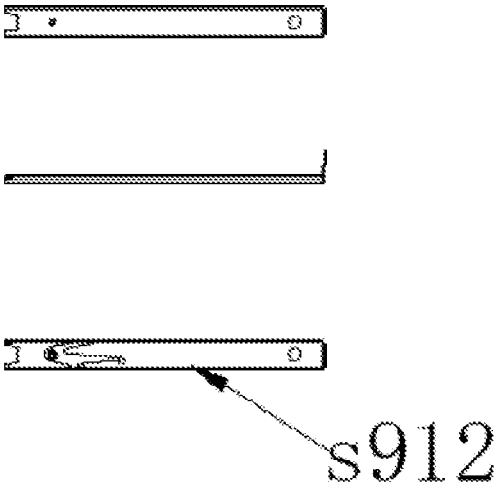
Figure 193:
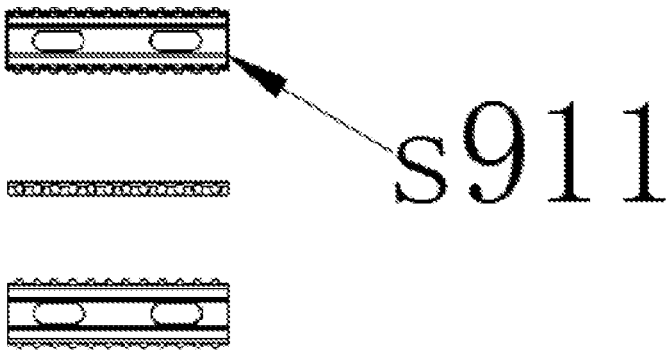
Figure 194:
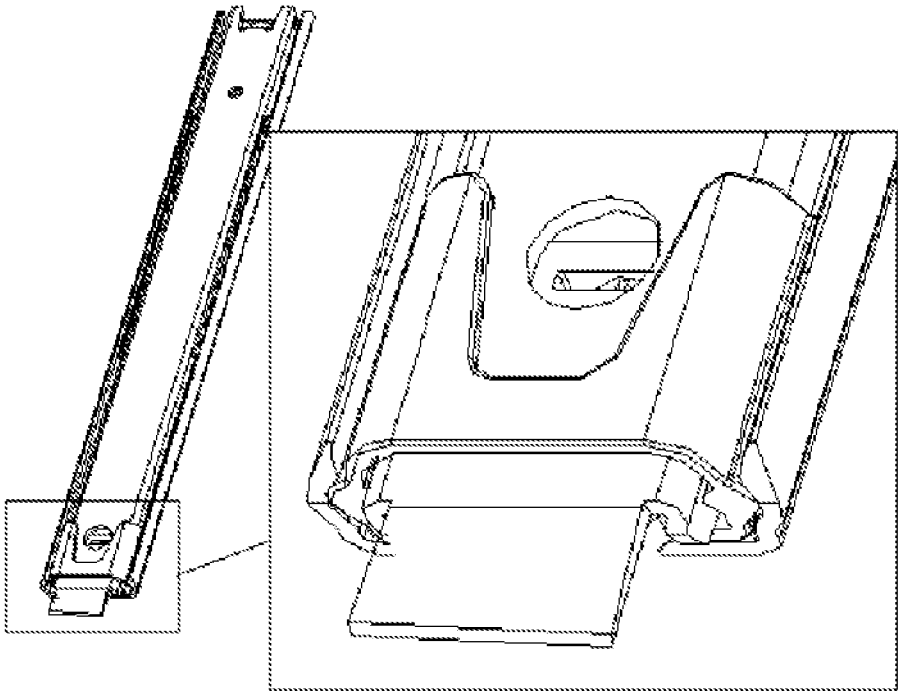
Figure 195:
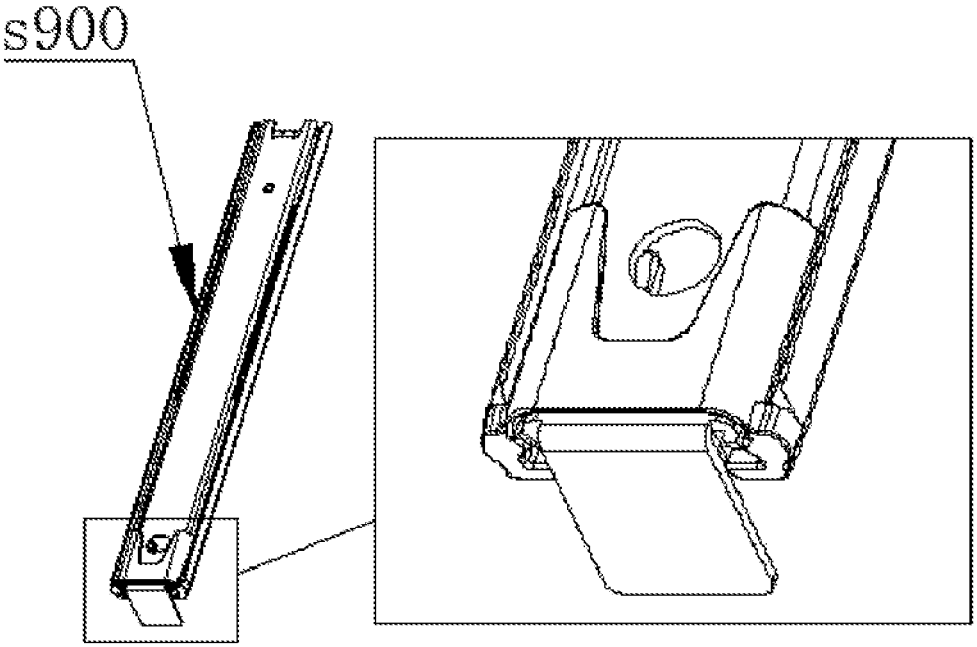
Figure 196:
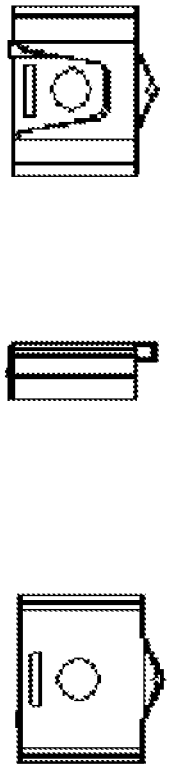
Figure 197:
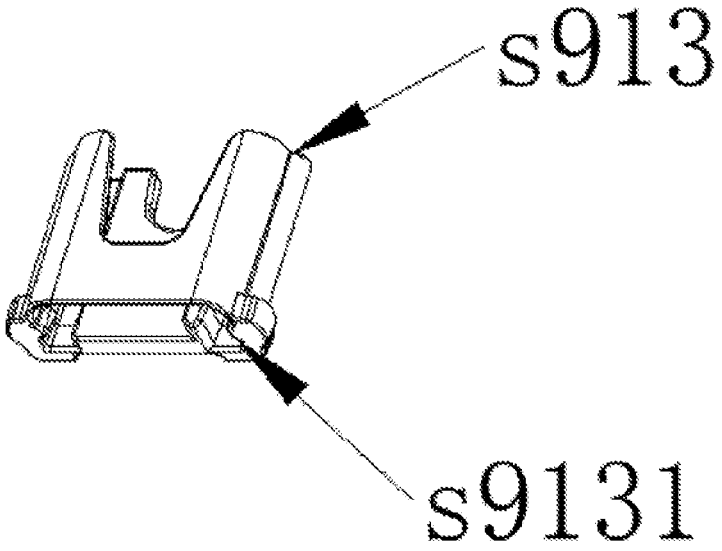
Figure 198:
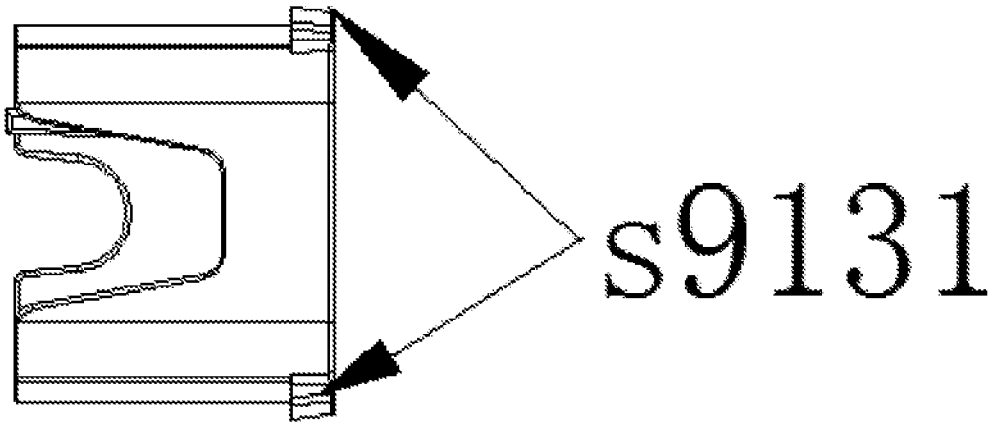
Figure 199:
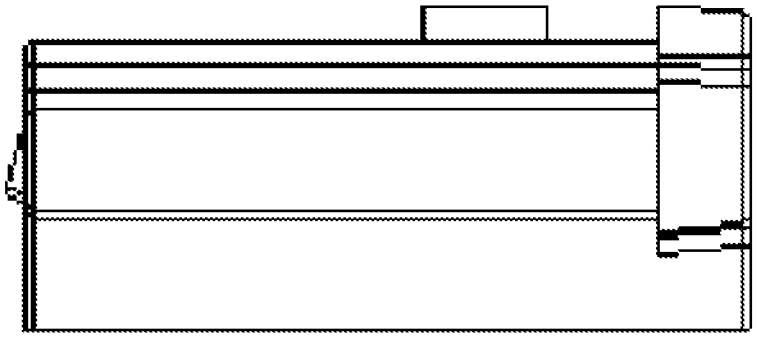
Figure 200:
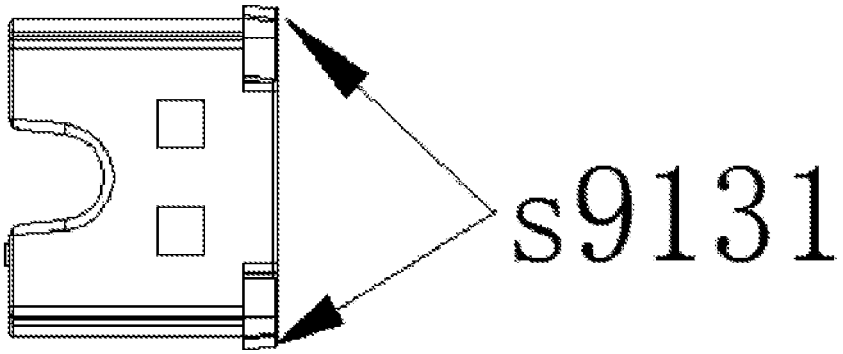
Figure 201:
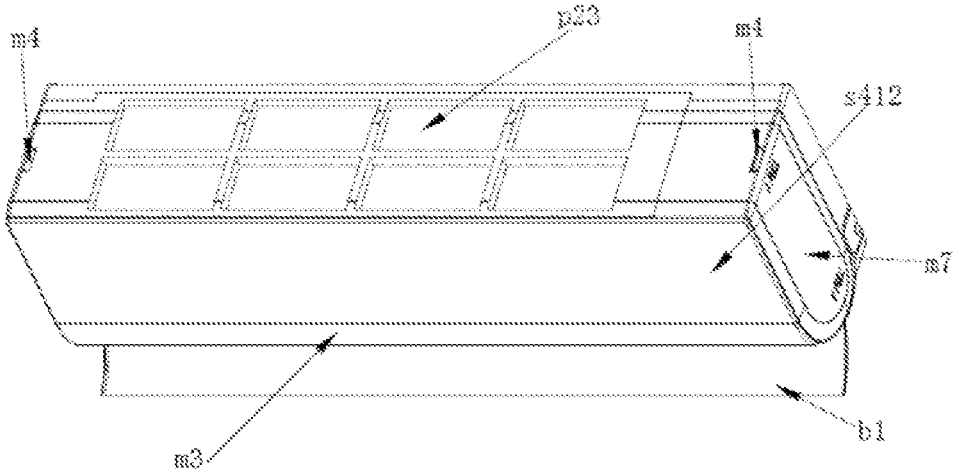
Figure 202:
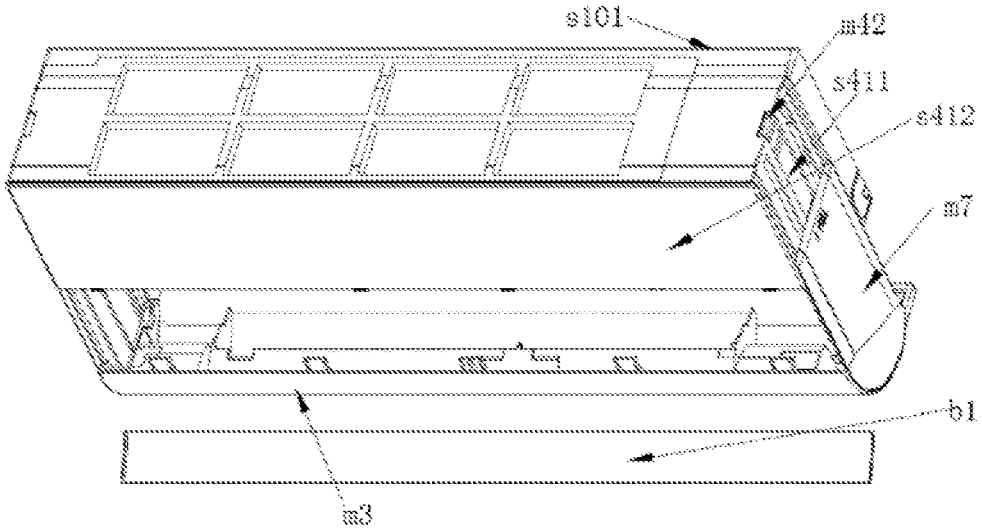
Figure 203:
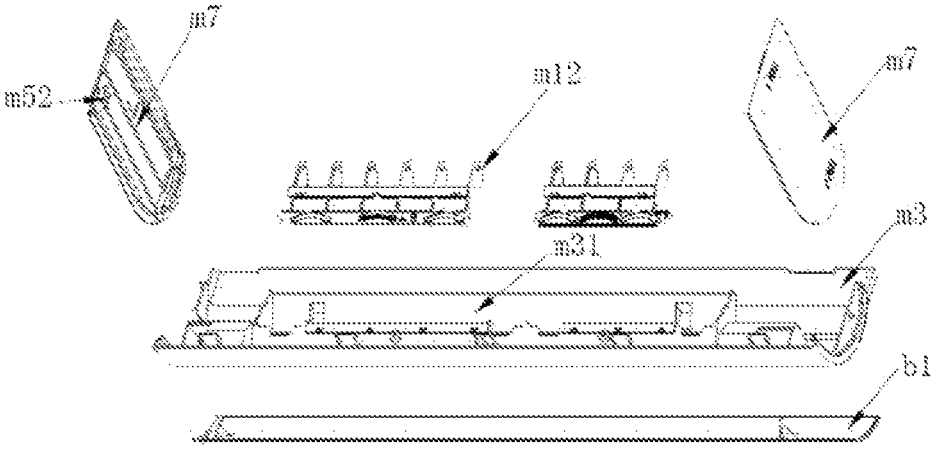
Figure 204:
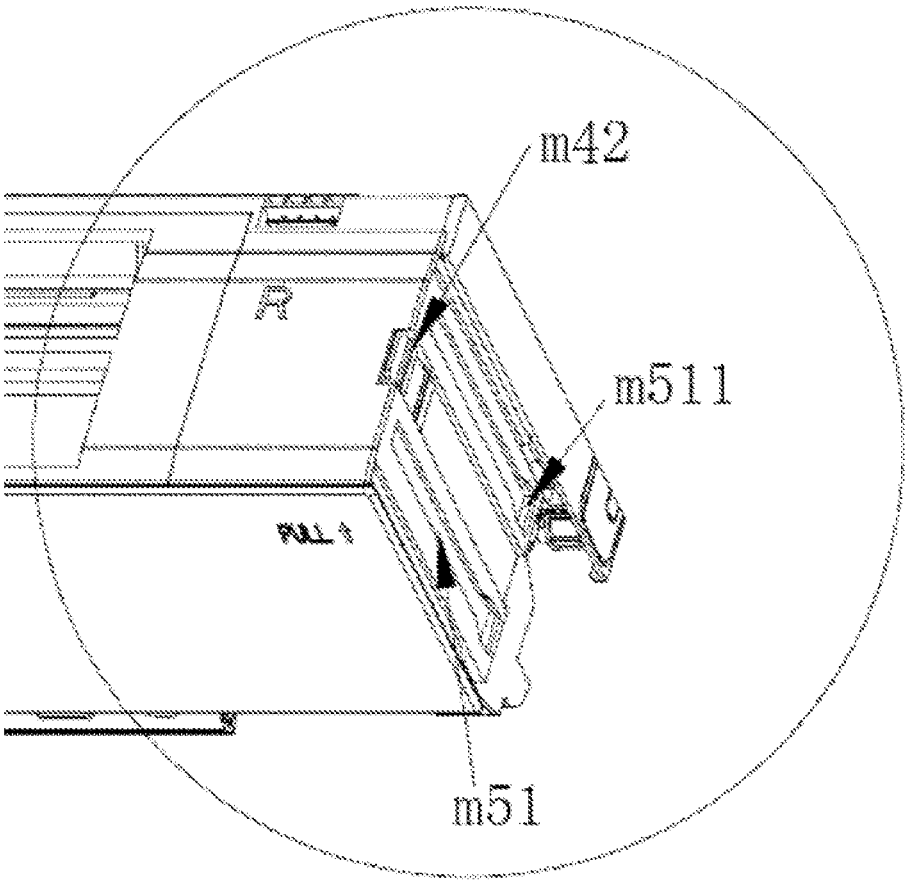
Figure 205:
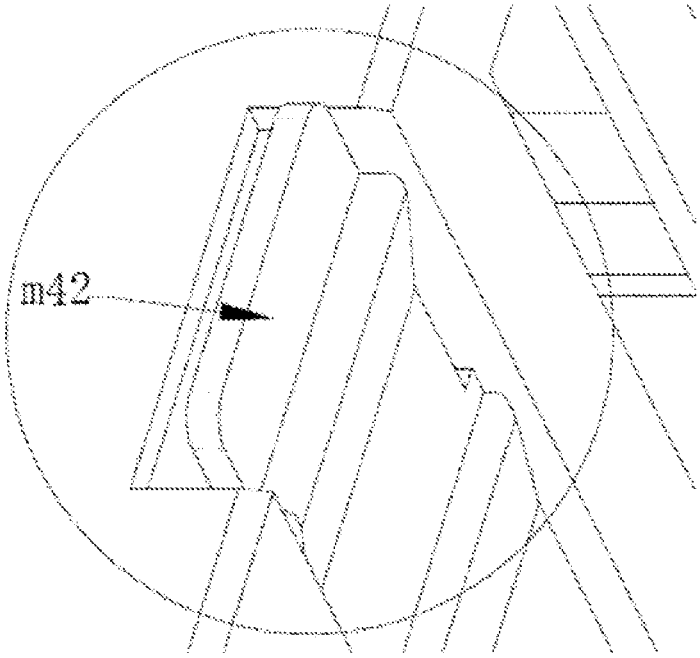
Figure 206:
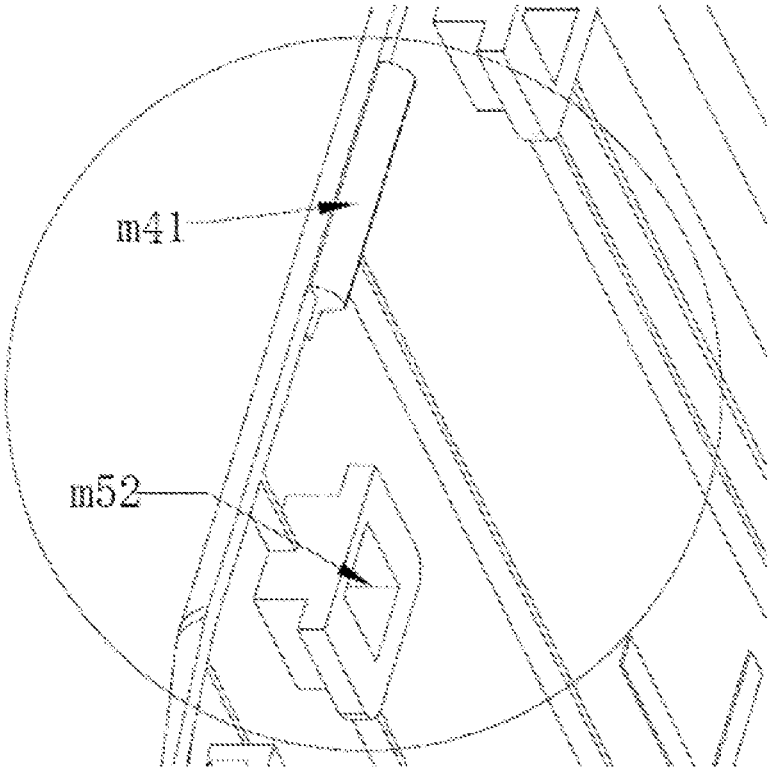
Figure 207:
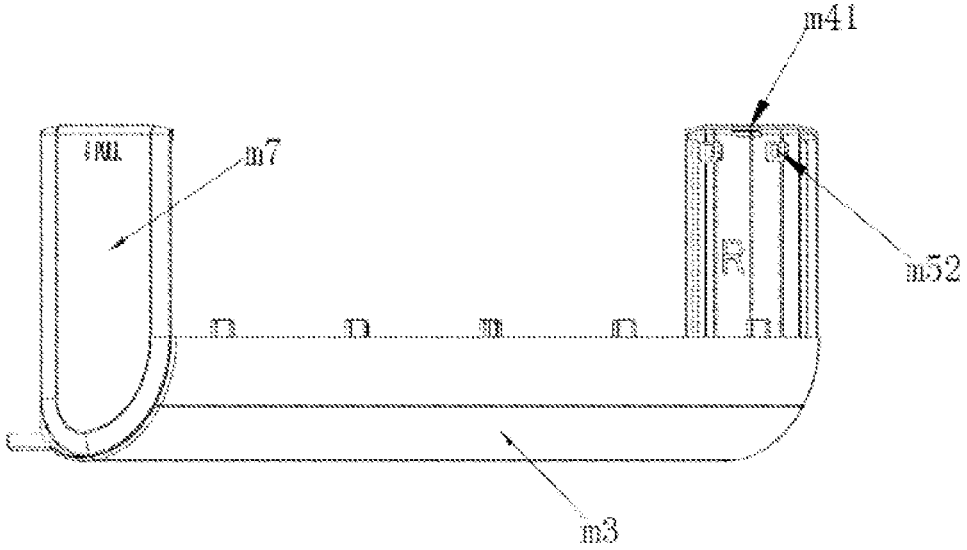
Figure 208:
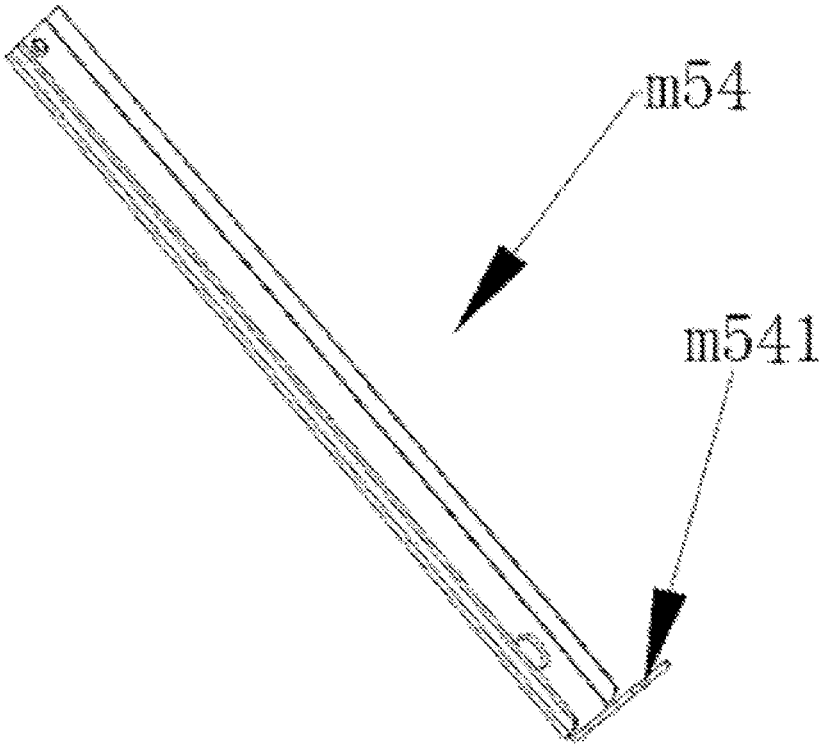
Figure 209:
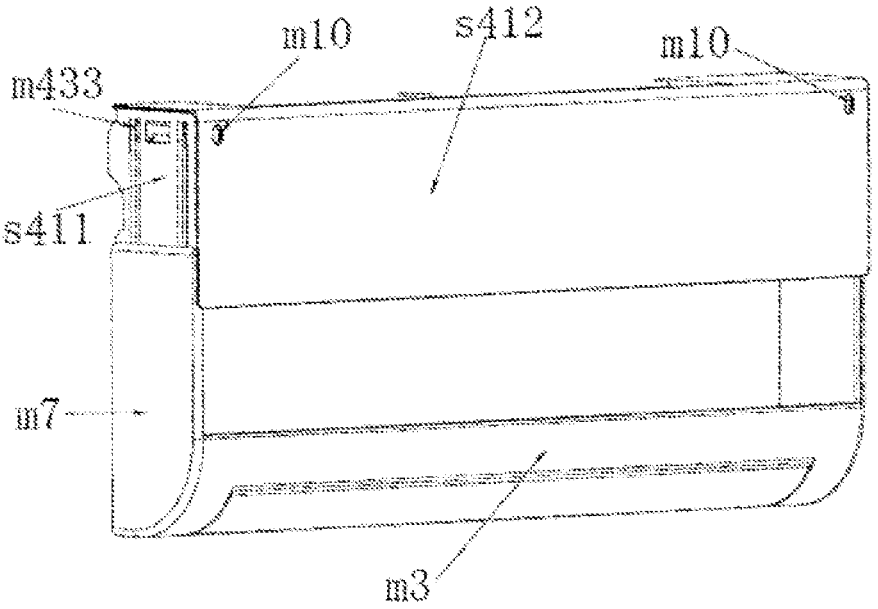
Figure 210:
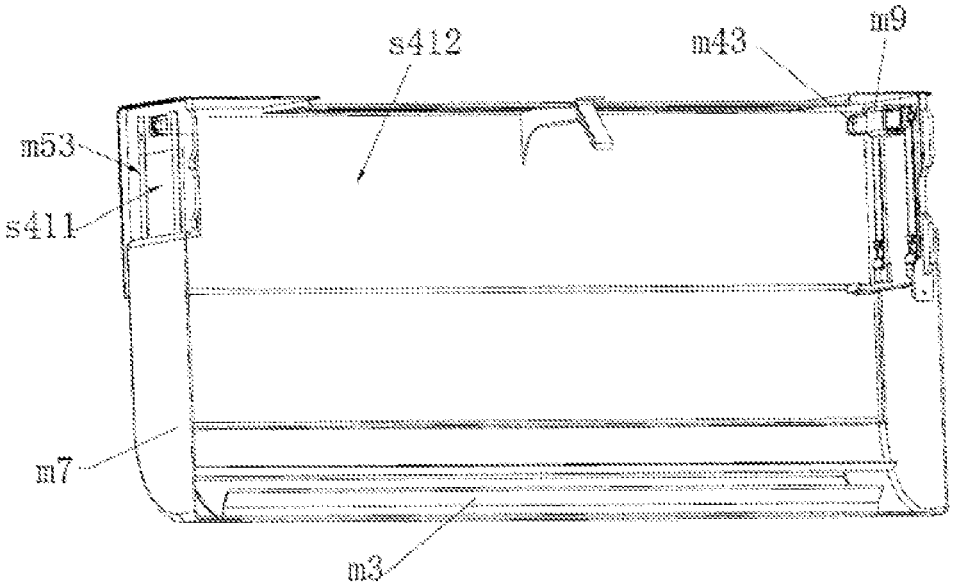
Figure 211:
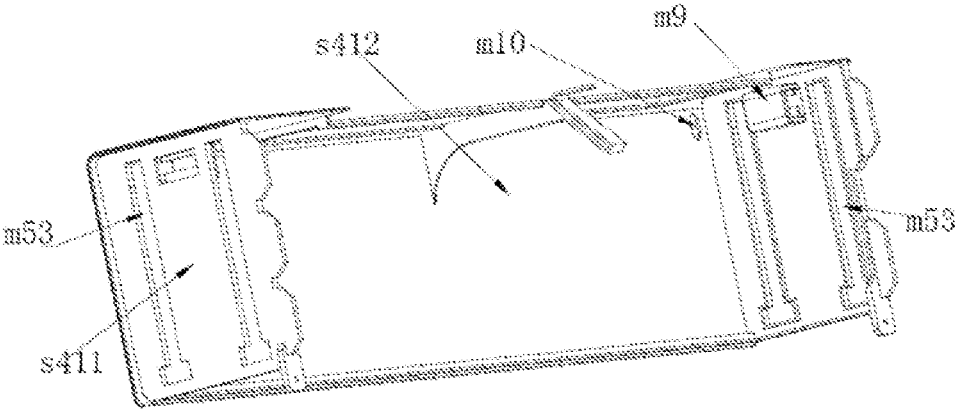
Figure 212:
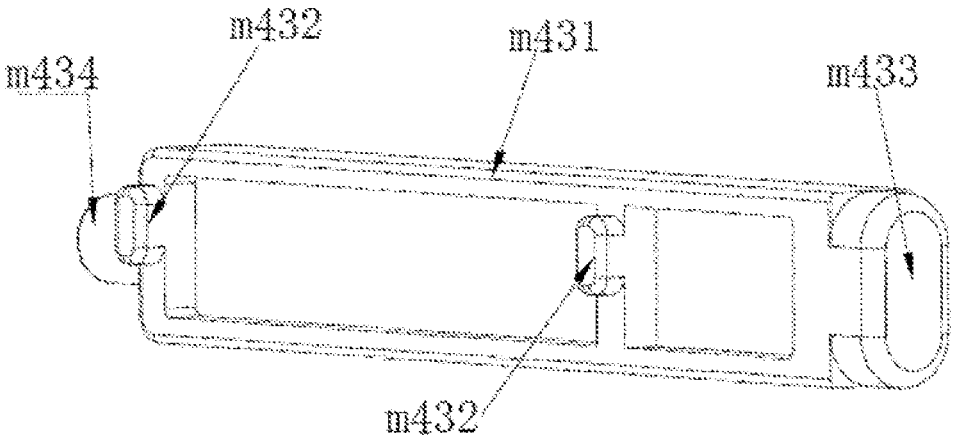
Figure 213:
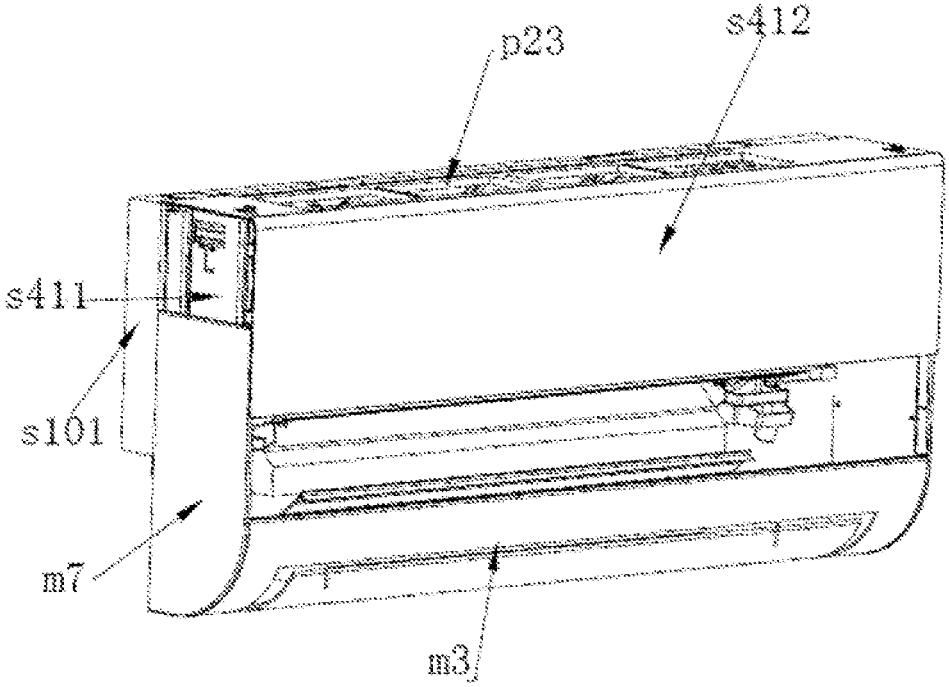
Figure 214:
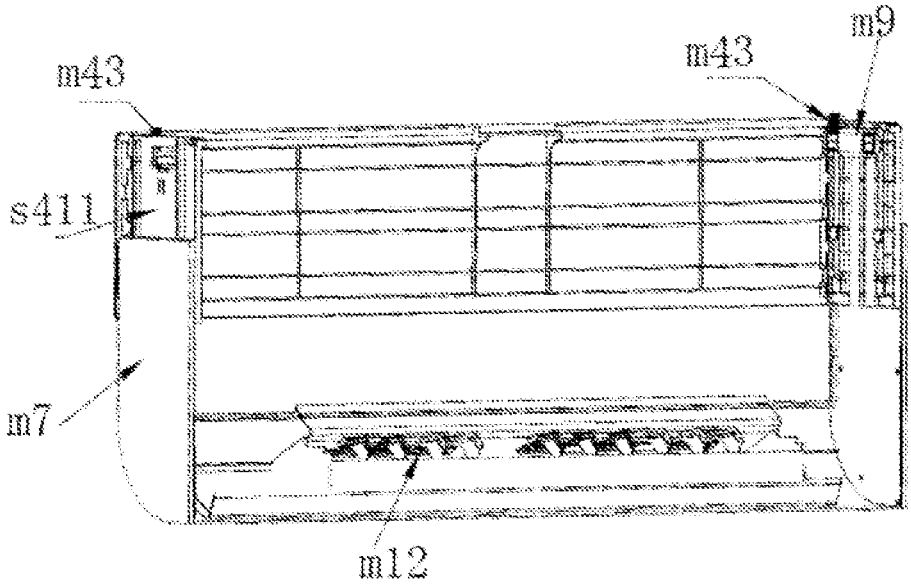
Figure 215:
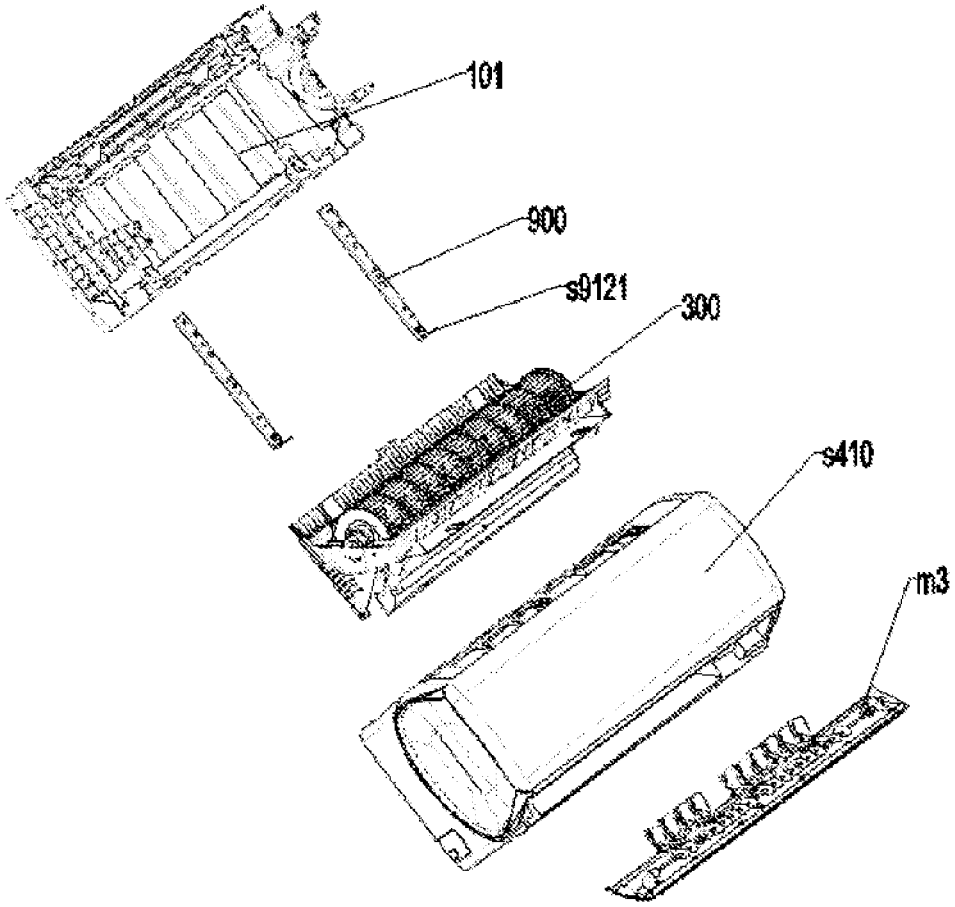
Figure 216:
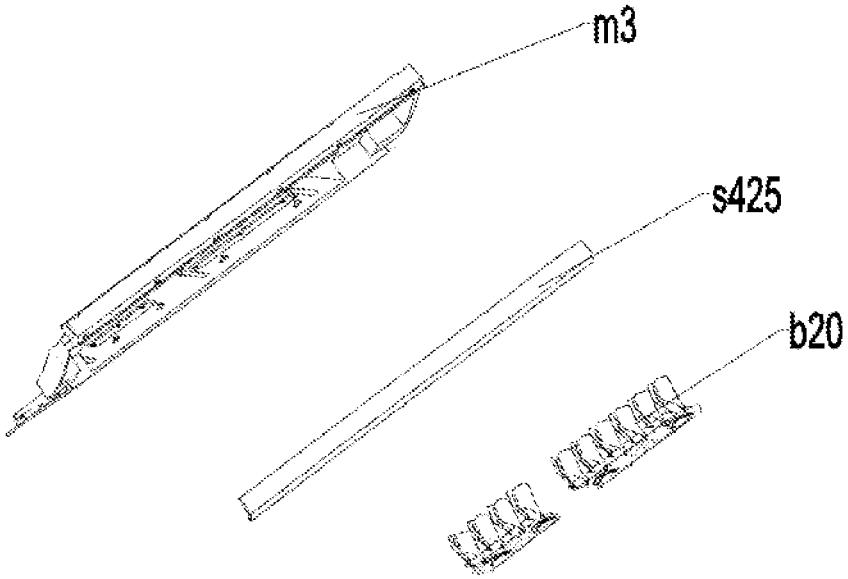
Figure 217:
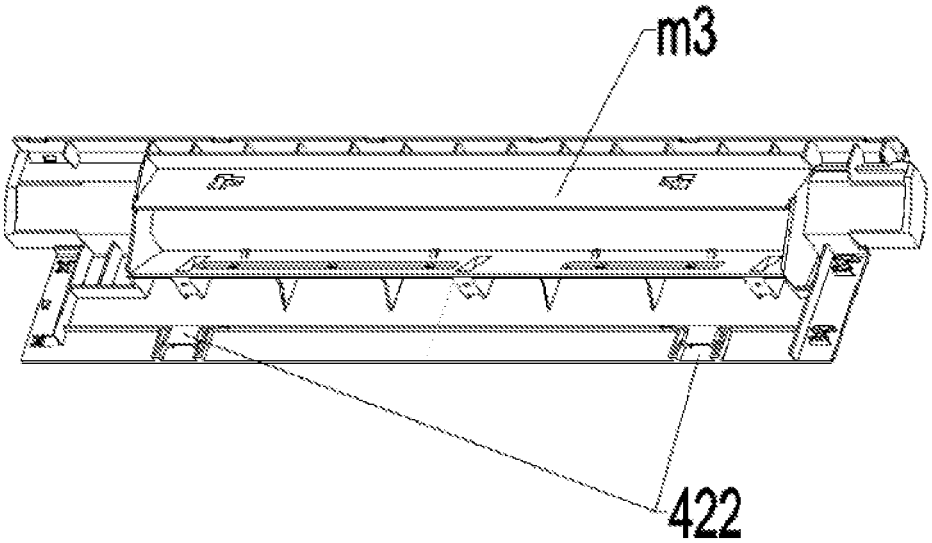
Figure 218:
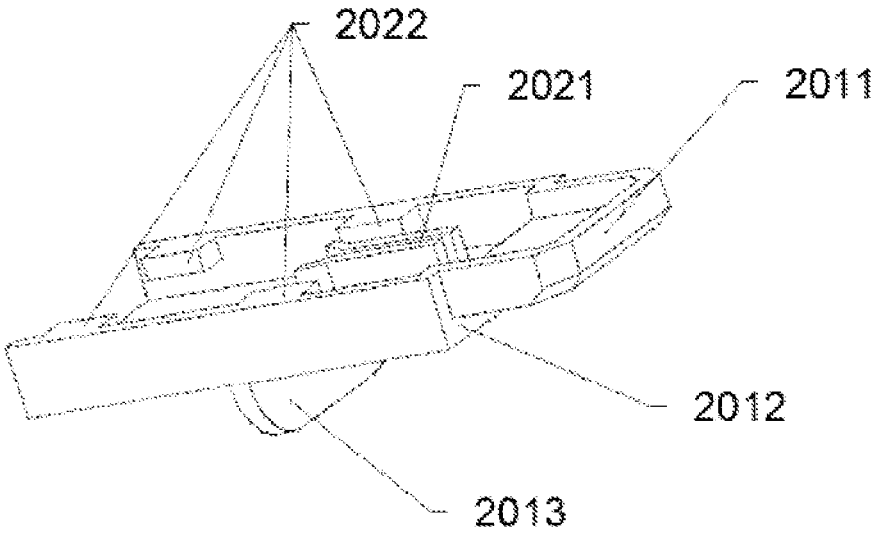
Figure 219:
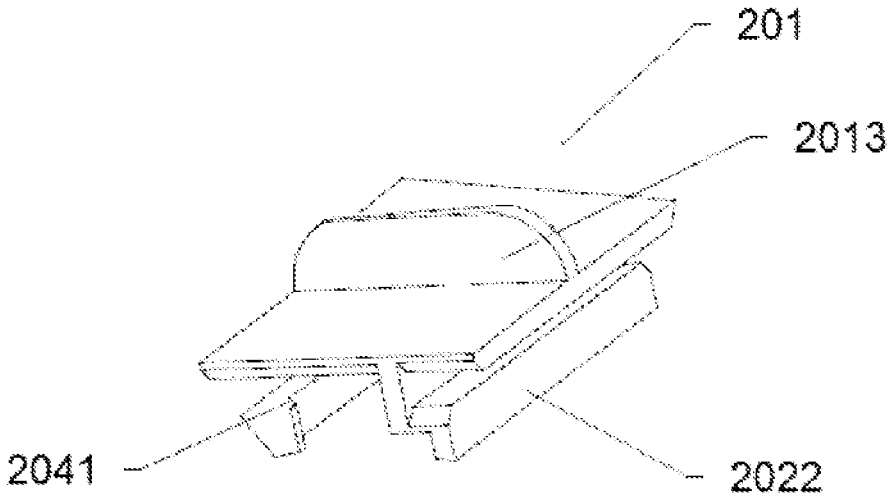
Figure 220:
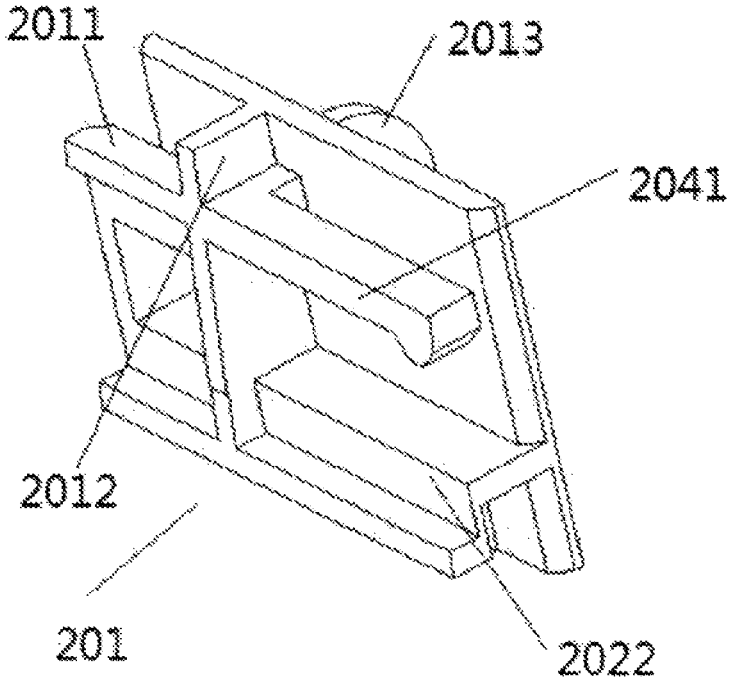
Figure 221:
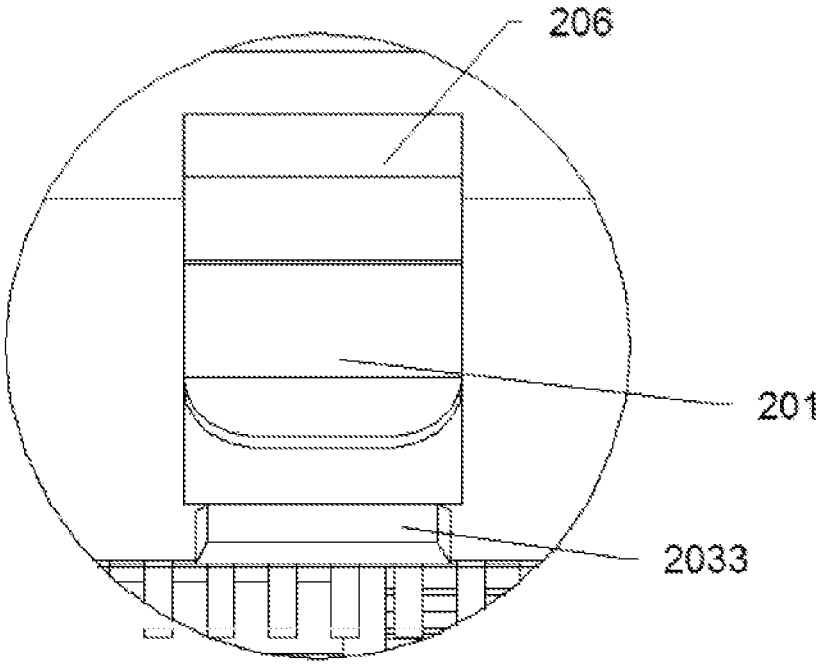
Figure 222:
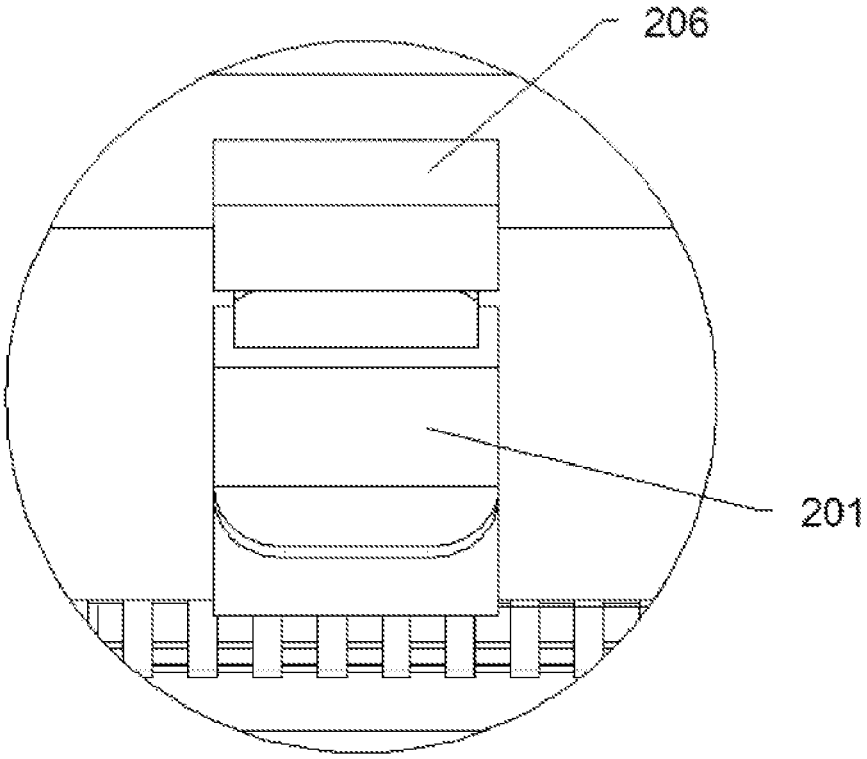
Figure 223:
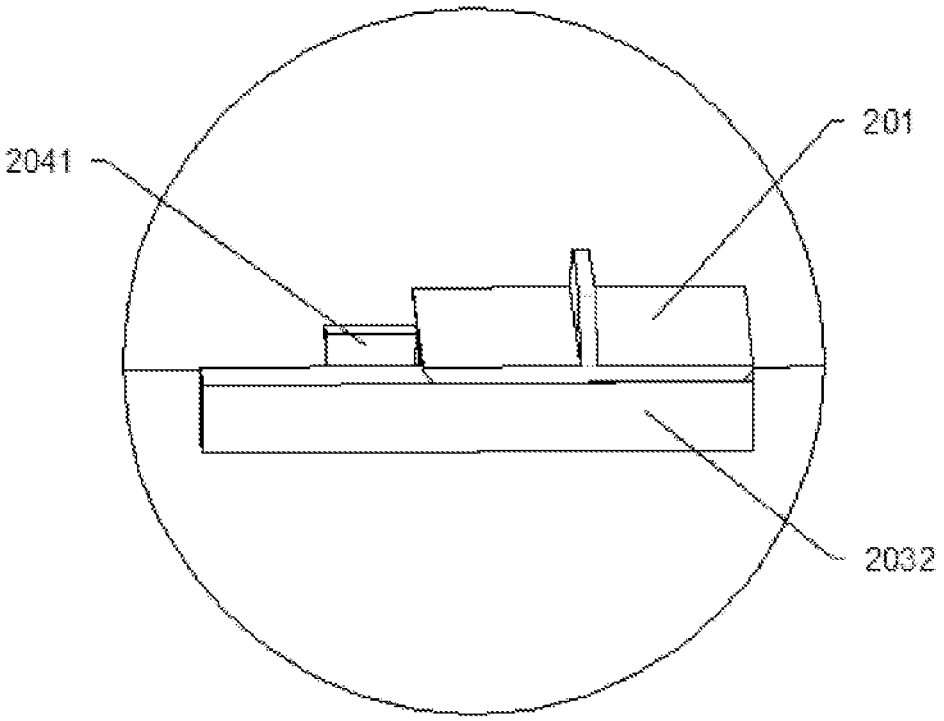
Figure 224:
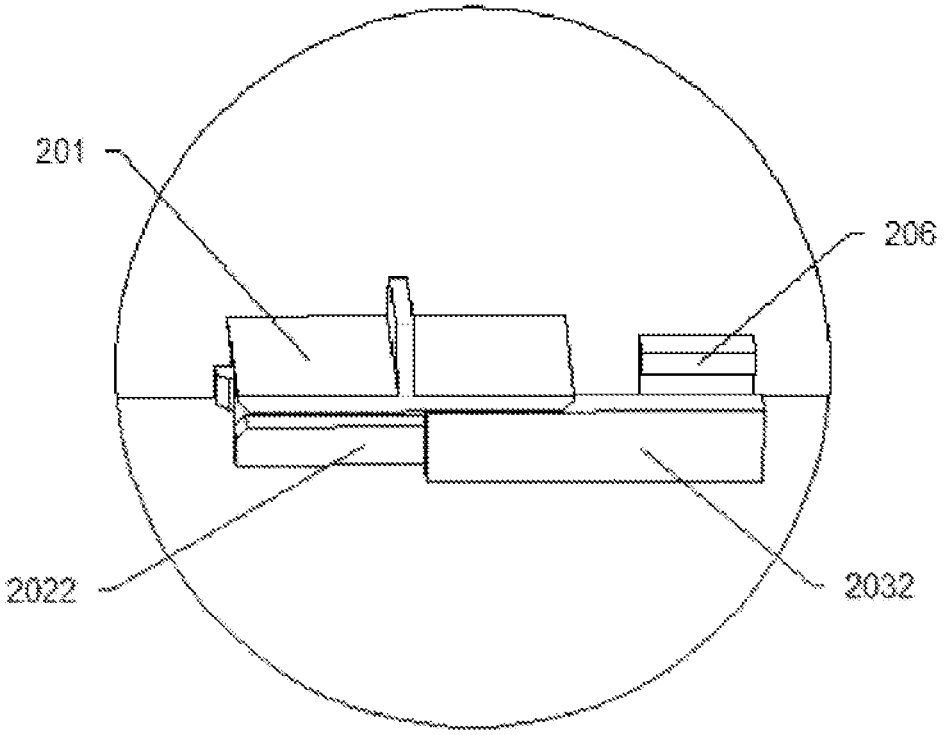
Figure 225:
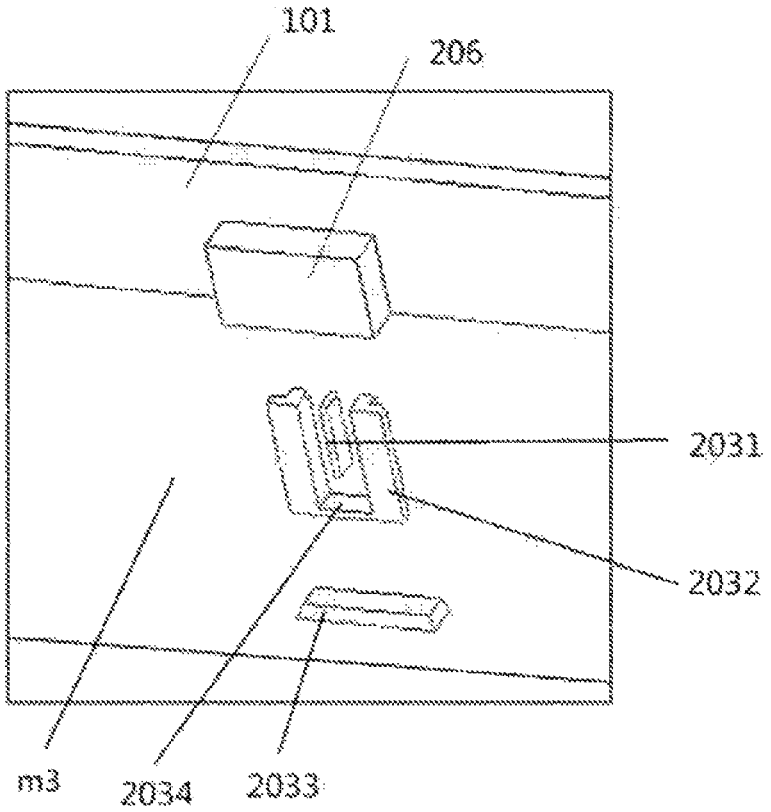
Figure 226:
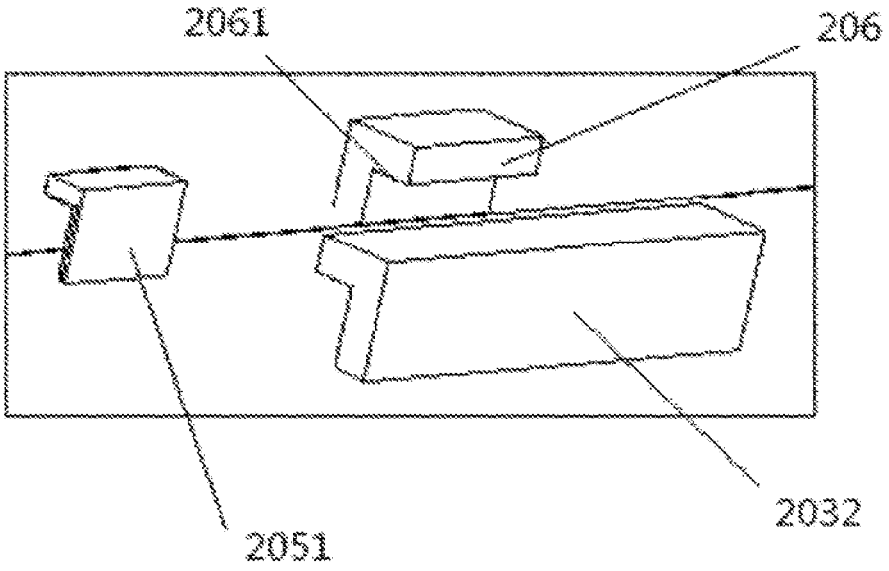
Figure 227:
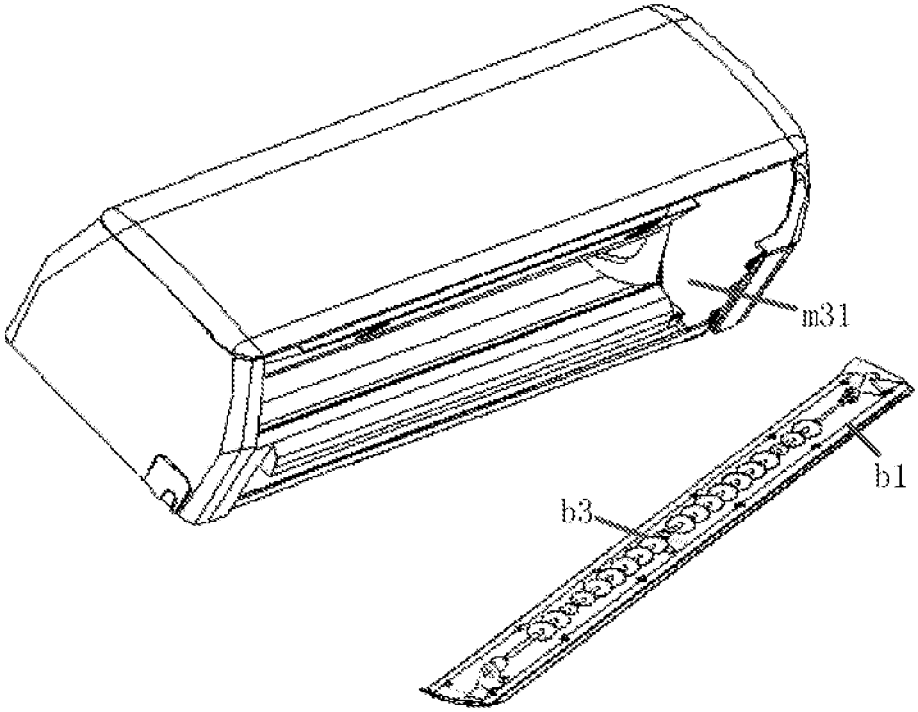
Figure 228:
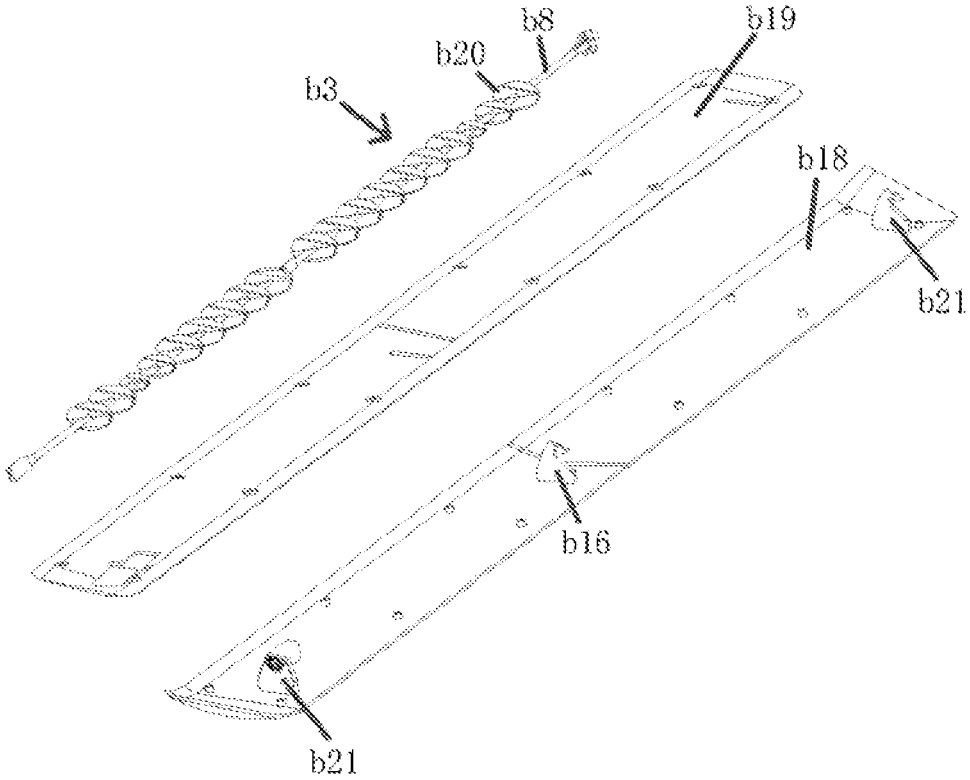
Figure 229:
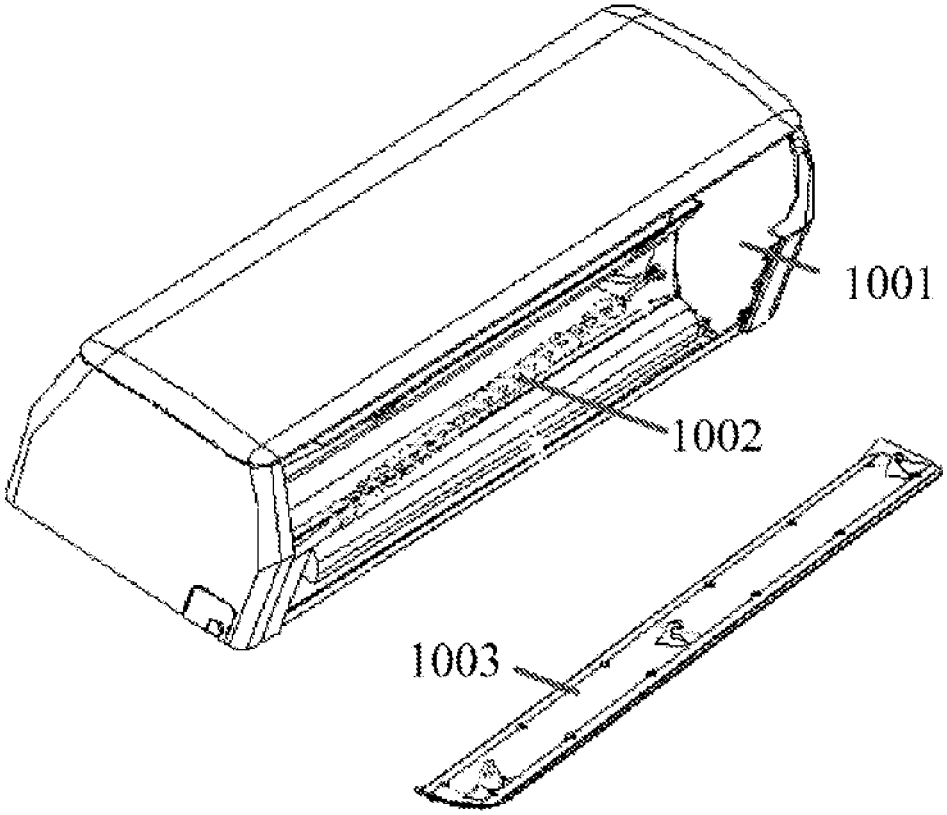
Figure 230:
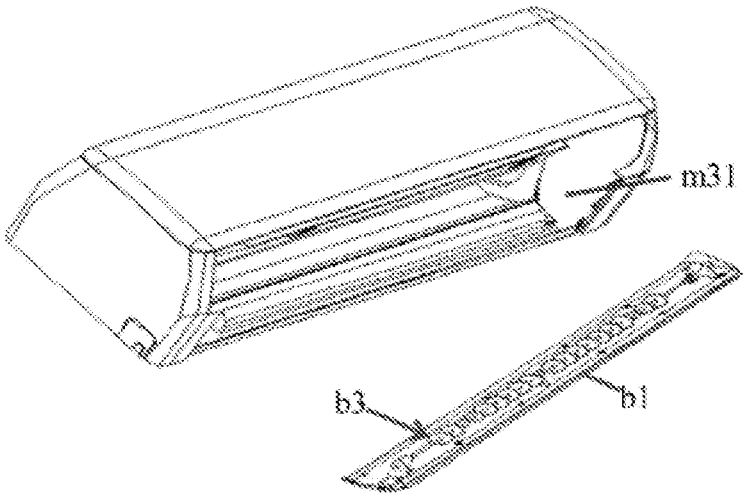
Figure 231:
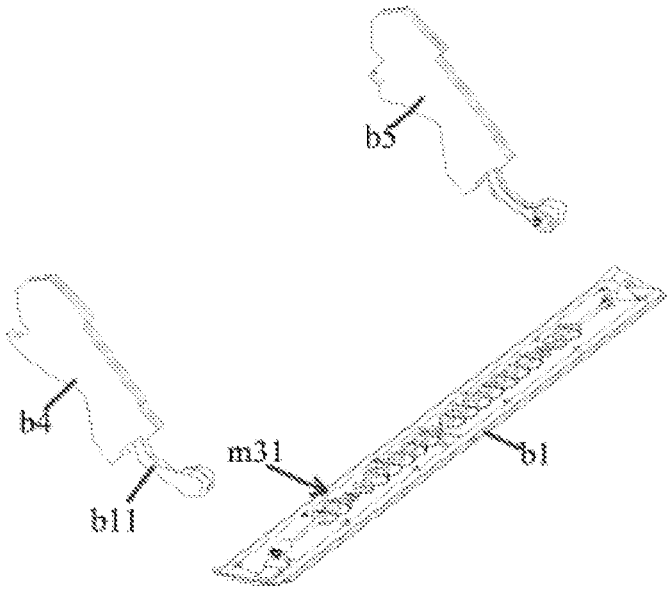
Figure 232:
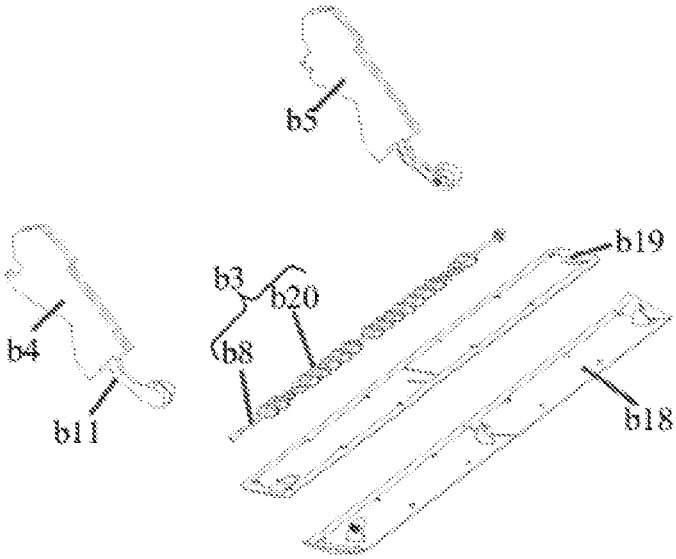
Figure 233:
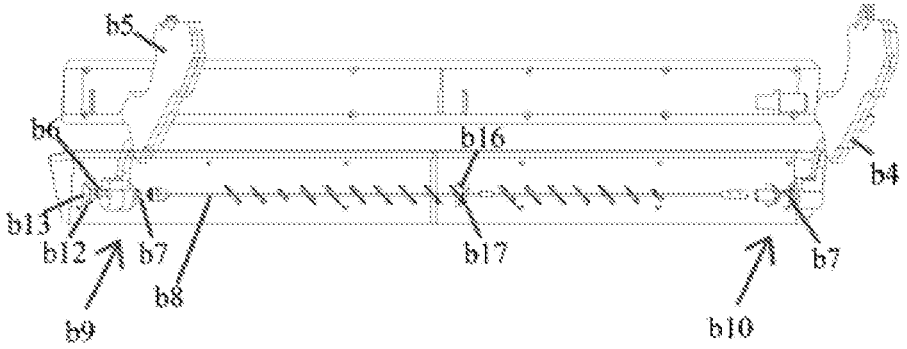
Figure 234:
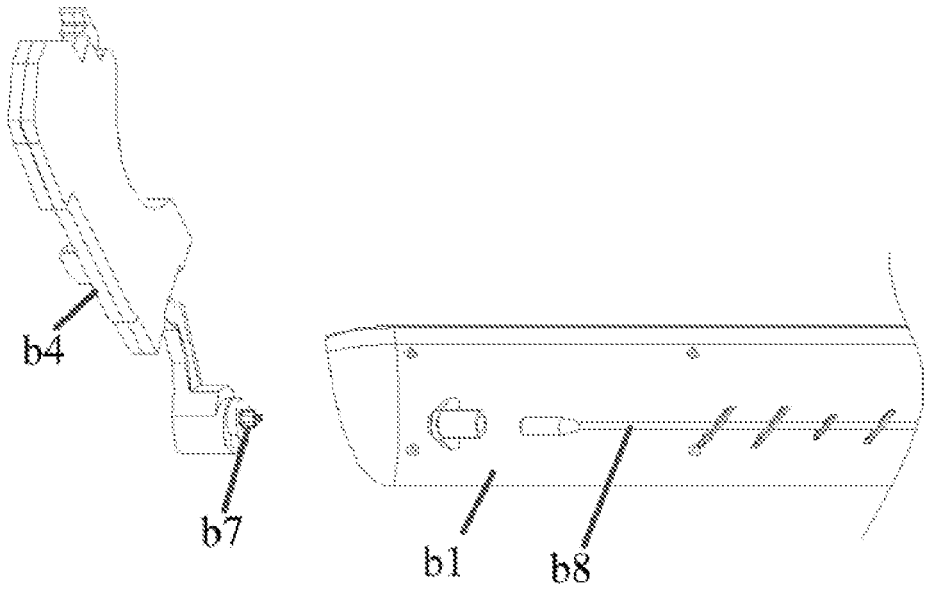
Figure 235:
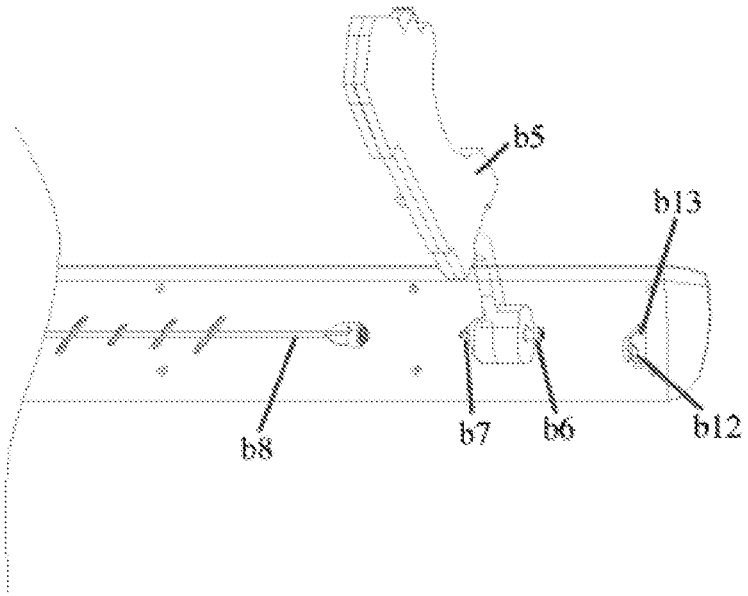
Figure 236:
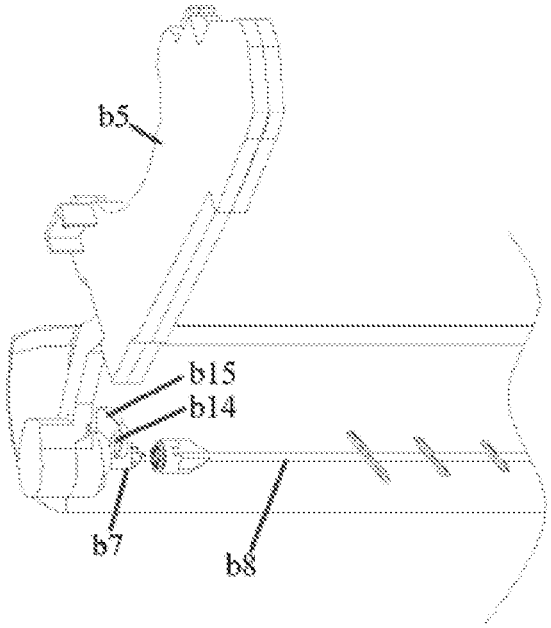
Figure 237:
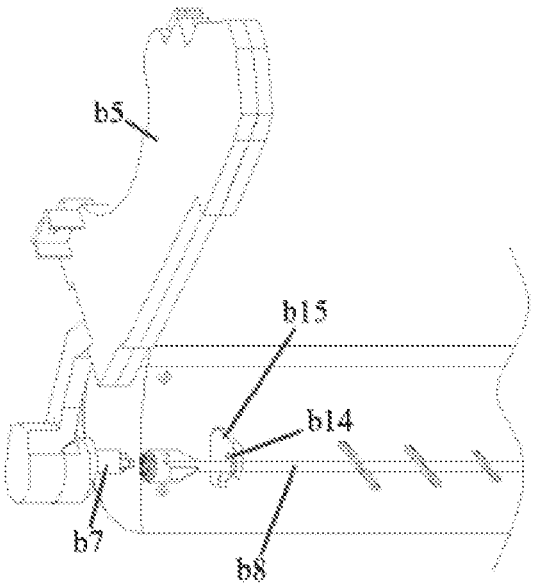
Figure 238:
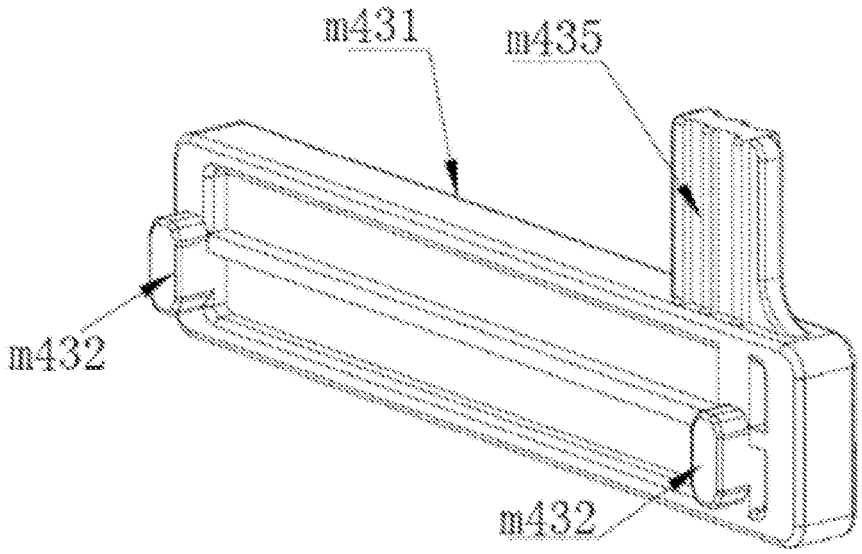

FIG. 131 is an enlarged structure diagram of a position where the angular frame structure in FIG. 130 is mounted with the heat exchanger in a mating manner;

FIG. 132 is a structure diagram that a connection pipeline is arranged in a first condensed water groove of a bottom shell;

FIG. 133 is a structure diagram that a connection pipeline is arranged in a second condensed water groove of a bottom shell;

FIG. 134 is an overall structure diagram of a sealed waterproof structure in embodiment 8 of the disclosure;

FIG. 135 is a structure diagram after the sealed waterproof structure in FIG. 134 is assembled with the heat exchanger in a mating manner;

FIG. 136 is a front view of FIG. 135;

FIG. 137 is a three-dimensional view of FIG. 134;

FIG. 138 is a structure diagram that a fan is mounted on a bottom shell of an air conditioner;

FIG. 139 is an enlarged structure diagram of the part A in FIG. 138;

FIG. 140 is an overall structure diagram of a sealing cup in embodiment 11;

FIG. 141 is another three-dimensional view of FIG. 140;

FIG. 142 is a structure diagram after the sealing cup in FIG. 140 is mounted with the connection pipeline in a mating manner;

FIG. 143 is an enlarged structure diagram of the part A in FIG. 31;

FIG. 144 is an overall structure diagram after a heat exchanger part is mounted with a base part in embodiment 14 of the disclosure;

FIG. 145 is an enlarged structure diagram of the part A in FIG. 144;

FIG. 146 is an enlarged structure diagram of the part B in FIG. 144;

FIG. 147 is a three-dimensional view of a side plate;

FIG. 148 is a structure diagram after a side plate is mounted with a heat exchanger part in a mating manner;

FIG. 149 is a structure diagram of a shell of an air conditioner indoor unit;

FIG. 150 is a front view of the shell of an air conditioner indoor unit shown in FIG. 149;

FIG. 151 is a side view of the shell of an air conditioner indoor unit shown in FIG. 149;

FIG. 152 is an overall assembly drawing of the shell of an air conditioner indoor unit shown in FIG. 149;

FIG. 153 is a section view of the shell of an air conditioner indoor unit shown in FIG. 151, FIG. 154 is a connection structure diagram of an air outlet frame and a panel of the shell of an air conditioner indoor unit shown in FIG. 149;

FIG. 155 is a front view of a shell structure of a wall-type air conditioner indoor unit;

FIG. 156 is an assembly diagram of the shell structure shown in FIG. 155;

FIG. 157 is a structure diagram of a mounting rack of the shell structure shown in FIG. 155;

FIG. 158 is a structure diagram of a panel of the shell structure shown in FIG. 155;

FIG. 159 is a structure diagram of the first implementation mode of an air conditioner wall-type unit provided in embodiment 3 of the disclosure;

FIG. 160 is an exploded view of the first implementation mode of an air conditioner wall-type unit provided in embodiment 3 of the disclosure;

FIG. 161 is a partial enlarged view that a mounted body is formed on a side plate in the first implementation mode of an air conditioner wall-type unit provided in embodiment 3 of the disclosure;

FIG. 162 is a structure diagram of a second limiting piece in the first implementation mode of an air conditioner wall-type unit provided in embodiment 3 of the disclosure (on the left side);

FIG. 163 is a structure diagram of a second limiting piece in the first implementation mode of an air conditioner wall-type unit provided in embodiment 3 of the disclosure (on the right side);

FIG. 164 is a structure diagram of the second implementation mode of an air conditioner wall-type unit provided in embodiment 3 of the disclosure;

FIG. 165 is an exploded view of the second implementation mode of an air conditioner wall-type unit provided in embodiment 3 of the disclosure;

FIG. 166 is a structure diagram of a second limiting piece in the second implementation mode of an air conditioner wall-type unit provided in embodiment 3 of the disclosure;

FIG. 167 is a three-dimensional view of an implementation mode of an air conditioner;

FIG. 168 is a front view of the air conditioner shown in FIG. 167;

FIG. 169 is a front view after a left panel and a right panel opening of the air conditioner shown in FIG. 167;

FIG. 170 is a schematic diagram when a panel body and a mounting part of the air conditioner shown in FIG. 167 is in a disassembled state;

FIG. 171 is a schematic diagram when a panel body and a mounting part of the air conditioner shown in FIG. 167 is in an assembled state;

FIG. 172 is a three-dimensional view that the air conditioner shown in FIG. 167 is mounted with a second filter screen;

FIG. 173 is an exploded view of the air conditioner shown in FIG. 172;

FIG. 174 is a structure diagram of an air conditioner, in which a side panel is at a closed position;

FIG. 175 is a structure diagram of the air conditioner shown in FIG. 174, in which a side panel is at an open position exposing out of an electrical box;

FIG. 176 is a structure diagram of the air conditioner shown in FIG. 174, in which a side panel is at an open position exposed out from an electrical box, and the electrical box is at a position for taking out to maintain;

FIG. 177 is a structure diagram of a base part in an embodiment of the disclosure;

FIG. 178 is a structure diagram that a mounting rack and a base mate through a guide rail structure in an embodiment of the disclosure;

FIG. 179 is a structure diagram of an air conditioner in an embodiment of the disclosure;

FIG. 180 is a structure diagram of the air conditioner shown in FIG. 179, in which a side panel is at an open position;

FIG. 181 is a structure diagram of a side panel in the air conditioner shown in FIG. 179;

FIG. 182 is a structure diagram of a lock clamping groove in the air conditioner shown in FIG. 179;

FIG. 183 is an assembly diagram of a wall-type air conditioner indoor unit;

FIG. 184 is a front view of the assembly diagram shown in FIG. 183;

FIG. 185 is an assembly diagram of an air outlet frame of a wall-type air conditioner in the disclosure;

FIG. 186 is a structure diagram of an air outlet frame of a wall-type air conditioner in the disclosure;

FIG. 187 is a rear view of an air outlet frame of a wall-type air conditioner in the disclosure;

FIG. 188 is a structure diagram of a locking piece of the disclosure;

FIG. 189 is a schematic diagram that an air outlet frame is assembled with a bottom shell of a wall-type air conditioner in the disclosure;

FIG. 190 is a structure diagram of a sliding rail device of the disclosure;

FIG. 191 is a structure diagram of a sliding rail base of the disclosure;

FIG. 192 is a structure diagram of a sliding rail end rod of the disclosure;

FIG. 193 is a structure diagram of a sliding rack of the disclosure;

FIG. 194 is a partial enlarged drawing of a sliding rail device in the conventional art;

FIG. 195 is a partial enlarged drawing of a sliding rail device in the disclosure;

FIG. 196 is a structure diagram of a locating block in the conventional art;

FIG. 197 is a structure diagram of a locating block in the disclosure;

FIG. 198 is a front view of a locating block in the disclosure;

FIG. 199 is a side view of a locating block in the disclosure;

FIG. 200 is a rear view of a locating block in the disclosure;

FIG. 201 is a structure diagram of an air conditioner indoor unit having an air outlet assembly provided by an embodiment of the disclosure;

FIG. 202 is a state diagram that an air outlet frame and a side plate in the indoor unit in FIG. 201 slide on a first sliding mechanism (an air guide plate separates from the air outlet frame);

FIG. 203 is an exploded view of the air outlet frame, the side plate, an air sweeping mechanism and the air guide plate in FIG. 202;

FIG. 204 is a partial enlarged drawing between a mounting rack and a panel in FIG. 202;

FIG. 205 is a structure diagram of a first limiting portion in a first implementation mode of fixed assemblies in the partial enlarged drawing in FIG. 202;

FIG. 206 is a structure diagram of a first slide block and a first clamping part on a side plate in a first implementation mode of fixed assemblies in the partial enlarged drawing in FIG. 202 or FIG. 203;

FIG. 207 is an assembly diagram of an air outlet frame and two side plates in an air outlet assembly provided by an embodiment of the disclosure;

FIG. 208 is a structure diagram of a connecting piece of a second sliding mechanism in an air outlet assembly provided by an embodiment of the disclosure;

FIG. 209 is a structure diagram of an air conditioner indoor unit having an air outlet assembly provided by an embodiment of the disclosure (including a second implementation mode of fixed assemblies, and a state diagram that an air outlet frame and two side plates slide downwards from a mounting rack);

FIG. 210 is a rear view of a working state of the air outlet frame, the panel, the side plate and the mounting rack in FIG. 209;

FIG. 211 is a mating schematic diagram of the panel and the mounting rack in FIG. 209;

FIG. 212 is a structure diagram of a first limiting piece in the fixed assemblies in FIG. 209;

FIG. 213 is a structure diagram of an air conditioner indoor unit having an air outlet assembly provided by an embodiment of the disclosure (including a third implementation mode of fixed assemblies, and a front view that an air outlet frame and two side plates slide downwards from a mounting rack);

FIG. 214 is a rear view of a working state of the air outlet frame, the panel, the side plate and the mounting rack in FIG. 213;

FIG. 215 is a structure diagram of an air conditioner in the disclosure;

FIG. 216 is a structure diagram of an air outlet frame, a decorating plate and an air sweeping blade in the disclosure;

FIG. 217 is a structure diagram of a clamping groove provided in embodiment 12 of the disclosure;

FIG. 218 is a structure diagram of a pushing block provided in embodiment 13 of the disclosure;

FIG. 219 is a structure diagram of a pushing block provided in embodiment 14 of the disclosure;

FIG. 220 is a structure diagram of another direction of the pushing block in FIG. 219;

FIG. 221 is a structure diagram of a locked state of a pushing block and a locking groove provided in embodiment 13 of the disclosure;

FIG. 222 is a structure diagram of an unlocked state of a pushing block and a locking groove provided in embodiment 13 of the disclosure;

FIG. 223 is a structure diagram of a locked state of a pushing block and a locking groove provided in embodiment 14 of the disclosure;

FIG. 224 is a structure diagram of an unlocked state of a pushing block and a locking groove provided in embodiment 14 of the disclosure;

FIG. 225 is a structure diagram of a locked structure mating with a pushing block in embodiment 13 of the disclosure;

FIG. 226 is a structure diagram of a locked structure mating with a pushing block in embodiment 14 of the disclosure;

FIG. 227 is a connection schematic diagram of an air guide module provided by the disclosure;

FIG. 228 is a structure diagram of an air guide module provided by the disclosure;

FIG. 229 is a position schematic diagram of an air sweeping mechanism and an air guide plate of an air conditioner in the conventional art;

FIG. 230 is a position schematic diagram of an air guide plate and an air sweeping assembly in an air guide module of an air conditioner provided by the disclosure;

FIG. 231 is a schematic diagram that an air guide module of an air conditioner is connected with an air guide plate provided by the disclosure;

FIG. 232 is a schematic diagram that an air guide module of an air conditioner is connected with an air guide plate including an outer air guide plate and an inner air guide plate provided by the disclosure;

FIG. 233 is a schematic diagram that an air guide module of an air conditioner is connected with an air guide plate and an air sweeping assembly provided by the disclosure;

FIG. 234 is a schematic diagram of connection positions of a first poking mechanism and an air guide plate provided by the disclosure;

FIG. 235 is a schematic diagram of connection positions of a second poking mechanism and an air sweeping assembly in a first situation provided by the disclosure;

FIG. 236 is a schematic diagram of connection positions of a second poking mechanism and an air sweeping assembly in a second situation provided by the disclosure;

FIG. 237 is a schematic diagram of connection positions of a second poking mechanism and an air sweeping assembly in a third situation provided by the disclosure;

FIG. 238 is a structure diagram of a first limiting piece;

DESCRIPTIONS ABOUT THE REFERENCE SIGNS i100—base module; i101—base part; i102—air guide poking box; i104—concentrator; i112—motor pressure plate; i113—motor cover plate; i141—fan motor; i172—electrical box; i200—heat exchange module; i210—angular frame; i220—heat exchanger; i221—sealing part; i2231—liquid inlet pipe; i2232—air collection pipe; i300—air and water duct module; i310—bottom shell; i320—impeller; i400—exterior module; i410—bottom shell module; i411—mounting rack; i412—panel; i413—side panel; i419—filter screen; i420—air outlet frame module; i421—air outlet frame; i430—air guide module; i431—outer air guide plate; i432—inner air guide plate; i433—air sweeping assembly; i900—second guide rail structure; d1—back plate of base; d2—side mounting frame; d21—vertical plate; d22—transverse plate; d3—sliding rail structure; d31—guide rail; d32—guide groove; d33—limiting surface; d10—panel; and d11—filter screen; d41—guide rail assembly; d42—air outlet part; d43—poking box; d44—limiting hook; d45—indication structure; d46—sliding bridge; d47—first limiting stage; d48—second limiting stage; d49—air duct part; d50—first buckle; d51—poking wire box; d52—second buckle; d53—third buckle; d54—fourth buckle; d55—fifth buckle; d56—sixth buckle; d57—seventh buckle; d58—ambient temperature wrap wire; and d59—poking box wire; f1—box body; f11—bottom surface; f12—opening; f13—avoiding groove; f14—sliding structure; f2—main board; f21—component; f3—terminal board; f31—substrate; f4—box cover; 5—motor assembly; f6—body; f61—guide rail structure; f7—structural body; f71—insertion through hole; f72—elastic clamping structure; and f73—fixing structure; g210—motor stand; g211—sliding rail; g220—motor; g231—sliding chute; g233—clamping groove; g330—base part; g240—motor end cover; g241—end cover buckle; g250—motor pressure plate; g270—screw; g282—right side plate; g311—motor shaft sleeve; g361—helical clamping claw; g370—helical clamping groove; c1—pressure plate body; c2—first mounting hole; c3—first reinforcing wall; c4—second reinforcing wall; c5—fixing groove; c6—third mounting hole; c7—pipe pressure plate body; c8—second mounting hole; c9—fourth wiring structure; c10—second wiring structure; c11—third wiring structure; c12—first wiring structure; c13—fifth wiring structure; c14—sixth wiring structure; c151—Wireless Fidelity (wifi) box wire; c152—display line; c153—cold plasma or mosquito repeller wire; c154—ambient temperature wrap wire; c155—ground wire; c156—poking module wire; c17—fifth wiring structure; c171—wire clip; c172—wire clamping plate; c173—indoor and outdoor unit connecting wire; c174—signal wire; c175—power cord; r11—high-voltage load terminal; r12—high-voltage intermediate terminal; r21—low-voltage load terminal; r22—low-voltage intermediate terminal; r30—intermediate connecting wire; r31—high-voltage connecting wire; r32—low-voltage connecting wire; r33—connecting wire; r41—load terminal block; r42—intermediate terminal block; r50—injection molding part; r51—through hole; r61—high-voltage load wire passage slot; r62—low-voltage load wire passage slot; r63—display wire passage slot; r64—slot; r65—rib plate; r66—first jack; r67—first plug board; r68—fixing clamping hook; r69—bearing substrate; r80—transition wire; r1011—stud; r1012—mounting hole; r104—concentrator; r1041—mounting matrix; r1042—patch panel; r1043—buckle; r1044—screw hole; r1045—mounting lug; r1711—high-voltage terminal; r1712—low-voltage terminal; r1713—main board terminal block; r172—electrical box; r1721—plug board; r1722—second plug board; r1723—second jack; r1724—wire passage hole; and r1727—mounting buckle; 2—air outlet passage; 3—volute tongue; 5—slide; 6—top limiting structure; 30—first connecting piece; 31—second connecting piece; 32—spring; 100—base module; 101—base part; 102—sliding structure; 103—water collecting structure of base; 1031—first sliding rail; 1032—first drainage groove; 104—sliding water collecting structure; 1041—first slide block; 1042—first drainage column; 1043—guiding block; 1044—third drainage groove; 105—drain pipe; 141—fan motor; 142—output shaft; 200—heat exchange module; 220—heat exchanger; 300—air and water duct module; 301—air duct assembly; 3011—impeller assembly; 302—upper clamping structure; 303—lower clamping structure; 304—lower limiting assembly; 305—threaded hole; 306—side limiting piece; 307—side clamping structure; 3001—upper limiting assembly; 310—bottom shell; 3101—opening edge; 3102—guide structure; 3103—hole; 3104—inverted triangular groove; 3105—strip-shaped bump; 3108—lower buckle; 3109—rib; 310*a*—spring column; 310*b*—helical spring; 310*c*—guide groove; 310*d*—guide bar; 311—fan support; 312—water groove on bottom shell; 3121—poking structure; 3122—third drainage column; 320—impeller; 321—impeller shaft; 322—bottom shell guide portion; 330—bearing rubber base assembly; 331—rubber base bracket; 3310—bracket insertion portion; 3311—bracket limiting portion; 3312—bracket guide portion; 3313—bracket barb; 332—support shaft sleeve; 334—impeller bearing; 333—bearing assembly; 341—poking piece; 3411—poking piece protruding point; 3412—poking piece pushing portion; 3413—poking piece driving portion; 3414—poking piece limiting portion; 3415—poking position; 3416—guide flange; 3417—hook; 3418—deformation slot; 342—bottom shell limit slot; 343—poking plate; 3431—poking plate pushing portion; 3432—poking plate driving portion; 3433—sliding bar; 3434—sliding chute; 3435—pushing position; 400—exterior module; 700—quick release connecting structure; 710—fan nest; 711—fan meshing portion; 720—motor shaft sleeve; 721—motor meshing portion; 722—reset spring; 900—sliding rail device; 910—sliding rail base; 911—sliding rack; 912—sliding rail end rod; a210—simplified angular frame body; k1011—protection space; k1012—simplified angular frame limiting portion; k102—liquid inlet branch pipe; k103—air collection branch pipe; k104—heat exchanger; k1040—heat exchanger body; k105—side plate; a2231—liquid inlet pipe; a2232—air collection pipe; k108—radiating pipe; a1—heat exchanger; k105—side plate; k201—angular frame body; k2010—accommodation space; k2011—fluid guide pore; k2012—fluid guide flange; k2013—hermetically connecting plate; k204—condensed water groove; k205—connection pipe; k206—angular frame limiting portion; k2061—hollow gap; k2062—limiting piece; k1041—heat exchanger part; k105—side plate; k108—radiating pipe; k205—connection pipe; k3010—water guide space; k302—pipe protecting plate; k3020—step plate; k3021—first pipe protecting plate; k3022—second pipe protecting plate; k3023—reinforcing plate; k303—inner side plate; k3031—clamping gear; k3032—combining slot; k3033—first mating portion; k3034—second mating portion; k304—baseplate; k3041—water retaining plate; k308—bottom shell; k309—fan motor; k3091—motor shaft sleeve; k205—connection pipe; k401—sealing cup body; k4010—water collecting chamber; k4011—waterproof connection hole; k4012—air; k4013—guide pipe; k4014—flange structure; k4015—gap; k1041—heat exchanger part; k105—side plate; k108—radiating pipe; k5010—side plate body; k5011—first assembling portion; k5012—vertical side plate; k5013—transverse side plate; k5014—radiating pipe mounting hole; k5015—buckling portion; k503—assembling piece; k5030—assembly opening; k5031—second assembling portion; a101—base part; a220—fin; a4—liquid separating head; a5—air collecting head; a2233,a2234—tee structure; a310—bottom shell of air conditioner; a312—water groove; a211—connection pipe clamping groove; s100—base module; s101—base part; s200—heat exchange module; s300—air and water duct module; s310—bottom shell; s400—exterior module; s410—shell module; s412—panel; s4121—upper panel; p22—front panel; s4123—side frame sliding chute; s420—air outlet module; m3—air outlet frame; s4211—air outlet frame buckle; s430—air guide module; b1—air guide plate; s100—base module; s101—base part; s200—heat exchange module; s300—air and water duct module; s310—bottom shell; s400—exterior module; s410—shell module; s411—mounting rack; s4111—vertical plate; s4112—transverse plate; s412—panel; s4124—filter screen; s414—panel buckle; s415—sliding chute of mounting rack; s4151—through hole; s4152—chute body; 420—air outlet module; m3—air outlet frame; s430—air guide module; b1—air guide plate; s101—base part; s412—panel; p23—air inlet; m22—horizontal part; m23—vertical portion; m11—third through hole; m44—mounting body; m441—fourth clamping groove; m436—first elastic piece; m45—second limiting piece; m451—second strip-shaped body; m452—third clamping portion; m453—second pressing portion; m454—second connecting portion; m455—second padding block; m7—side plate; p10—rear shell body; p11—mounting portion; p111—first rotation shaft; p21—panel body; p211—rotating portion; p22—front panel; p23—air inlet; p30—display plate; b1—air guide plate; p50—second filter screen; p200—heat exchanger; s110—electrical box; g120—side panel; s411—mounting rack; g140—base; s412—panel; g160—screw; g170—guide rail; g180—guide groove; m3—air outlet frame; g410—shell body; g411—opening; g413—location hole; g415—location clamping hole; g417—lock clamping groove; p111—rotation shaft; g120—side panel; g431—locating pin; g433—locating buckle; g435—lock buckle; g437—rotation shaft sleeve; g450—top panel; p22—front panel; g110—electrical box; s1—air conditioner indoor unit; s100—base module; s101—base part; s200—heat exchange module; s300—air and water duct module; s310—bottom shell; s400—exterior module; s410—shell module; s412—panel; s420—air outlet module; m3—air outlet frame; m31—air outlet; s422—air outlet frame clamping groove; s423—locking piece; s4231—poking rod; s4232—bump; s4233—poking rod limiting piece; s424—fixing hole; s425—decorating plate; s4261—screw hole; s430—air guide module; b20—air sweeping blade; s900—sliding rail device; s910—sliding rail base; s911—sliding rack; s912—sliding rail end rod; s9121—clamping hook; s913—locating block; s9131—extending expanding structure; 914—rubber block; s412—panel; s101—base part; m3—air outlet frame m31—air outlet; m4—fixing assembly; m41—first clamping portion; m42—first limiting portion; m43—first limiting piece; m431—first strip-shaped body; m432—second clamping portion; m433—first pressing portion; m434—first connecting portion; m435—first poking block; m51—first sliding chute; m511—flaring groove; m52—first slide block; m53—first through hole; m54—connecting piece; m541—first insertion portion; s411—mounting rack; m7—side plate; b1—air guide plate; m9—second support; m10—second through hole; p23—air inlet; m12—air sweeping mechanism; 101—base part; 201—pushing block; 2011—locking tongue; 2012—limiting piece; 2013—manually pushing position; 2021—limiting U-shaped groove; 2022—pushing block limiting bump; 2031—air outlet frame limiting bump; 2032—air outlet frame limiting groove; 2033—air outlet frame limiting lug boss; 2034—air outlet frame limiting groove plate; 2041—pushing block strip body; 2051—air outlet frame limiting body; 206—locking groove; 2061—mating surface; 300—air and water duct module; s410—shell module; m3—air outlet frame; 422—clamping groove; s425—decorating plate; 900—sliding rail device; s9121—clamping hook; b20—air sweeping blade; b1—air guide plate; m31—air outlet; b3—air sweeping assembly; b8—air sweeping rotation shaft; b20—air sweeping blade; b16—third support frame; b21—air guide module connecting piece; b18—outer air guide plate; b19—inner air guide plate; 1001—air duct of air conditioner; 1002—air sweeping mechanism of air conditioner; 1003—air guide plate of air conditioner; 1—air guide plate; 2—air outlet; 3—air sweeping assembly; 4—first poking mechanism; 5—second poking mechanism; 6—transmission portion; 7—poking mechanism output shaft; 8—air sweeping rotation shaft; 9—first support mechanism; 10—second support mechanism; 11—poking rod; 12—first clamping groove; 13—first support frame; 14—second clamping groove; 15—second support frame; 16—third support frame; 17—third clamping groove; 18—outer air guide plate; 19—inner air guide plate; 20—air sweeping blade; 101—air duct of air conditioner; 102—air sweeping mechanism of air conditioner; 103—air guide plate of air conditioner.

DETAILED DESCRIPTION OF THE EMBODIMENTS

The technical solutions of the disclosure will be described clearly and completely below in combination with the drawings. Apparently, the described embodiments are merely a part of the embodiments of the disclosure, not all of the embodiments. On the basis of the embodiments of the disclosure, all other embodiments obtained on the premise of no creative work of those skilled in the art fall within the protection scope of the disclosure.

In addition, the technical features involved in different implementation modes of the disclosure described below may be combined without conflicts.

Embodiment 1

Figure 1:
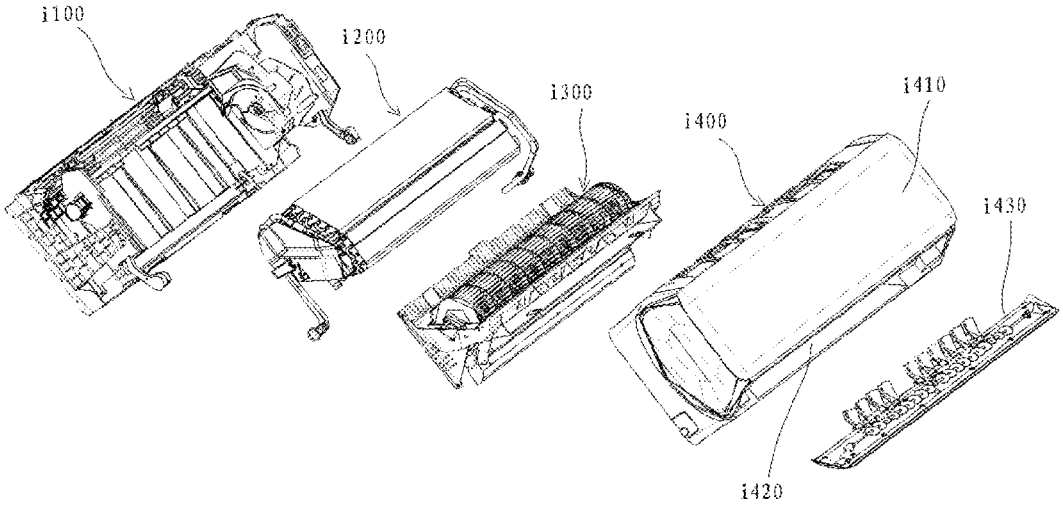
FIG. 1 is a three-dimensional exploded view of a modularized air conditioner provided in embodiment 1 of the disclosure.

As shown in FIG. 1, the embodiment provides an air conditioner indoor unit, which includes: a base module i100, a heat exchange module i200, an air and water duct module i300 and an exterior module i400.

Figure 2:
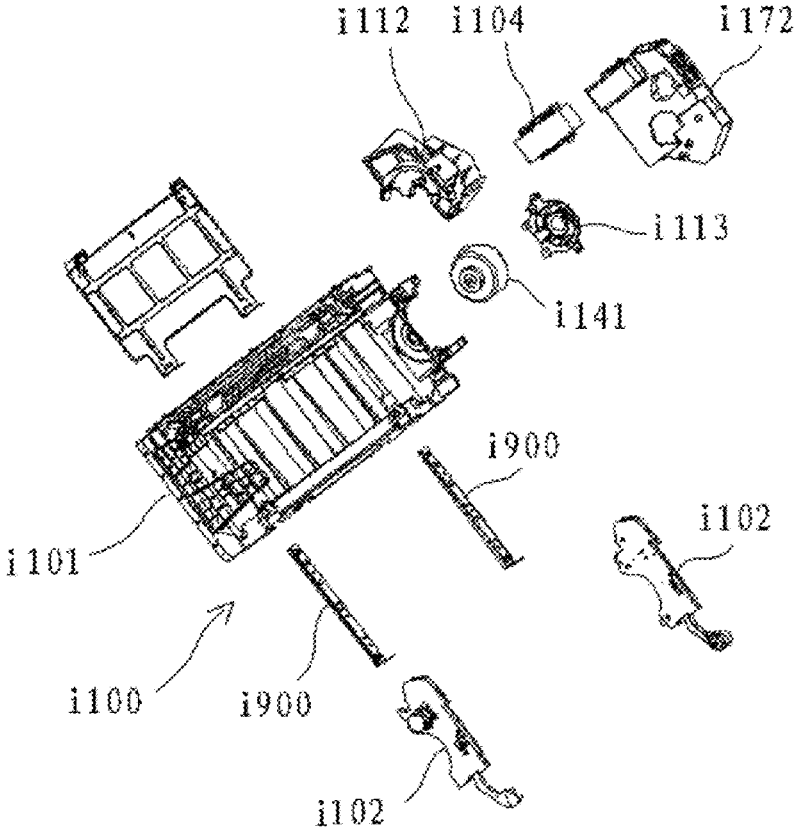
FIG. 2 is a three-dimensional exploded view of a base module of the air conditioner indoor unit shown in FIG. 1.

The base module i100 is configured to be mounted on a hanging support body such as an indoor wall, is also used as a basic part for assembly on a production line. As shown in FIG. 2, the base module i100 includes a base part i101 which is suitable to be mounted on a support.

An electric assembly is detachably mounted on the base part i101. The electrical assembly includes a fan motor i141, and an air guide poking box i102 and an electrical box i172 which are detachably mounted on the base part i101 respectively. In such a manner, the electric assembly may be disassembled directly to be overhauled and replaced. The specific mounting position of the electric assembly on the base part i101 may have a variety of situations. In the embodiment, the electric assembly is detachably mounted on one end of the base part i101, and then, when needing to be overhauled or replaced, the electric assembly may be directly disassembled from the end of the base part i101; so it is very convenient to overhaul and replace the electric assembly.

In the embodiment, the electrical assembly further includes a concentrator i104. Each load terminal of the air conditioner indoor unit is electrically connected with the concentrator i104. The concentrator i104 is electrically connected with the electrical box i172. The concentrator i104 is first connected with each load terminal of the air conditioner indoor unit, and then connected with the electrical box i172. Compared with directly connecting each load terminal of the air conditioner indoor unit with the electrical box i172, the connection line between the concentrator i104 and the electrical box i172 and the connection line between each load terminal of the air conditioner indoor unit and the electrical box i172 are much simpler, so convenience is brought to assembling and disassembling the electrical box i172, and overhauling and replacing the electrical box i172.

The electrical box i172 and the mating concentrator i104 are arranged close to the end of the base part i104. The electrical box i172 is closer to the end compared with the concentrator i104, and the electrical box i172 is detachably mounted on the base part i101. When needing to be overhauled or replaced, the electrical box i172 may be directly disassembled from the end of the base part i101 conveniently.

The air guide poking box i102 is arranged at the position, corresponding to the air guide module i430, on the base part i101.

One or two or three of a power cord, an electrical wire of each electrical load and a connection signal wire of an air conditioner indoor unit and an air conditioner outdoor unit may be fixedly arranged on the base part i101 through a wiring slot fixed on the base part i101. In the embodiment, the power cord, the electrical wire of each electrical load and the connection signal wire of the air conditioner indoor unit and the air conditioner outdoor unit are fixedly arranged on the base part i101 through the wiring slot fixed on the base part i101.

The base module i100 further includes a motor bracket fixed on the base part i101. The motor bracket includes a motor stand, and a motor pressure plate i112 and a motor cover plate i113 which are mounted on the motor stand and configured to fix the fan motor i141. The motor pressure plate i112 and the motor cover plate i113 are detachably mounted on the base part i101 respectively. The motor pressure plate i112 limits the fan motor i141 in a radial direction, and the motor cover plate i113 limits the fan motor i141 in an axial direction When mounted, the fan motor i141 is limited in a radial direction and an axial direction through the motor pressure plate i112 and the motor cover plate i113. When the fan motor i141 needs to be overhauled or replaced, the cover plate i113 of the fan motor i 141 may be disassembled directly, and then the fan motor i141 is disassembled along the axial direction, so the operation is simple and convenient.

Figure 3:
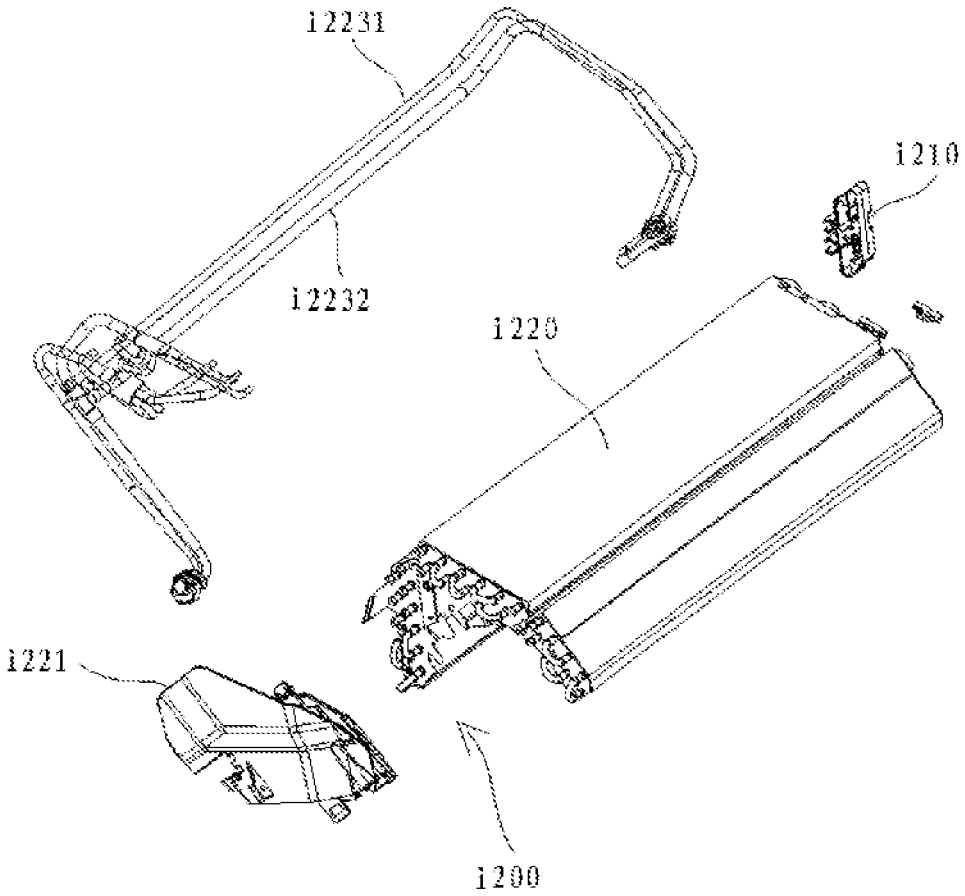
FIG. 3 is a three-dimensional exploded view of a heat exchange module of the air conditioner indoor unit shown in FIG. 1.

Referring to FIG. 3, the heat exchange module i200 is movably mounted on the base module i100, and has a heat exchanger i220 and a connection pipeline for connecting the heat exchanger i220 to the air conditioner outdoor unit. The heat exchanger i220 and the connection pipeline are arranged in such a way that in a mounted state, the heat exchanger i220 module and the connection pipeline are entirely at the same side of the base module i100. Compared with that, in the conventional art, the connection pipeline is bent to the back of the base part i101, and the heat exchanger i220 of the heat exchanger i220 module and the connection pipeline are on different sides of the base module i100, the heat exchanger i220 of the heat exchanger i220 module and the connection pipeline of the disclosure are on the same side of the base module i100. In such a manner, when the heat exchanger i220 is mounted, a working process of bending the connection pipeline is reduced, and convenience is brought to assembling and disassembling the heat exchange module i200. There are multiple ways of mounting the heat exchange module i200 with the base module i100. In the embodiment, the heat exchange module i200 is detachably mounted on the base module i100 through a hanging structure and a threaded connecting piece. As a transformable implementation mode, the heat exchange module i200 may also be detachably on the base module i100 through a buckle structure and the threaded connecting piece.

The connection pipeline has a liquid inlet pipe i2231 and an air collection pipe i2232. In the embodiment, in order to save space, both the liquid inlet pipe i2231 and the air collection pipe i2232 are connected on one side, far away from the motor bracket, of the heat exchanger i220. There are tee structures arranged on both the liquid inlet pipe i2231 and the air collection pipe i2232; with the tee structure, both sides of the heat exchanger i220 are arranged with an outdoor unit connection terminal of the connection pipeline. In such a manner, during the actual installation of the air conditioner indoor unit, it is convenient for the installation personnel to select, according to the actual situation of the user, a connection end of the connection pipeline at one end of the heat exchanger i220 to be connected with the air conditioner outdoor unit, thereby saving the space occupation of installation, and improving the installation efficiency. As a transformable implementation mode, both the liquid inlet pipe i2231 and the air collection pipe i2232 may also be connected on one side, close to the motor bracket, of the heat exchanger i220.

After the liquid inlet pipe i2231 and the air collection pipe i2232 pass through the tee structure, one branch forms a U-shaped bend which bypasses the motor bracket from the side, far away from a back plate of the base part i101, of the motor bracket after extending beyond the length of the heat exchanger i220 at a position close to the back plate of the base part i101, reaches a lower edge of the back plate of the base part i101 in a working and mounting state, and bends, at the position close to the back plate of the base part i101, towards an end of the base part i101 on this side; another branch after the liquid inlet pipe i2231 and the air collection pipe i2232 pass through the tee structure extends to the lower edge of the back plate of the base part i101 in the working and mounting state on this side, and bends, at the position close to the back plate of the base part i101, towards the end of the base part i101 on this side.

In the embodiment, a cross section of the heat exchanger i220 is inverted-U shaped, and its two sides are arranged with a hanging fixing structure for mounting the heat exchanger i220 on the base module i100 in a hanging way; two ends of the heat exchanger i220 are arranged with a sealing part i221, so that an open chamber is formed in the inverted-U shaped interior of the heat exchanger i220; an angular frame i210 is fixed on the heat exchanger i220, and a fixing structure for fixing the connection pipeline is arranged on the angular frame i210.

Figure 4:
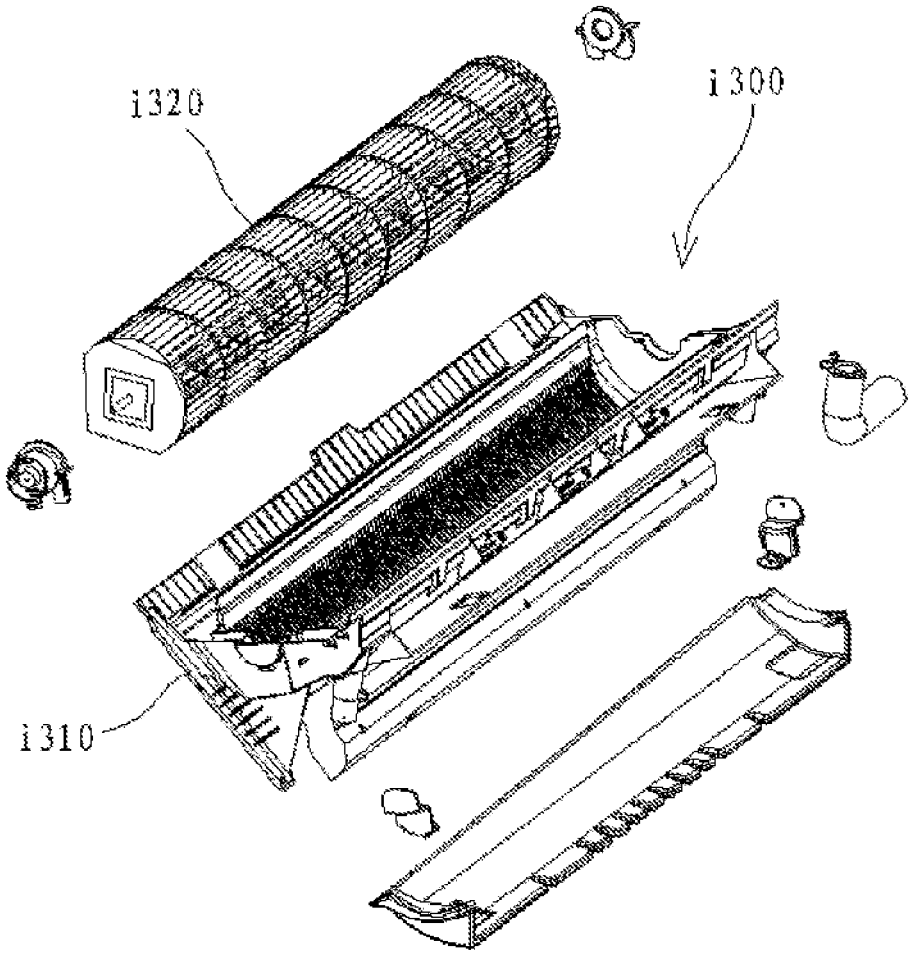
FIG. 4 is a three-dimensional exploded view of an air and water duct module of the air conditioner indoor unit shown in FIG. 1.

Referring to FIG. 4, the air and water duct module i300 is movably mounted on the base module i100, and has a bottom shell i310 and an impeller i320 which is rotationally mounted on the bottom shell i310. An impeller shaft of the impeller i320 is suitable to be, by means of a quick disconnecting and connecting mechanism, connected to and separated from an output shaft of the fan motor i141 through a position movement between them. There can be various specific ways of mounting the air and water duct module i300 with the base module i100. In the embodiment, the air and water duct module i300 is mounted on the base module i100 in a sliding manner through a first guide structure, and its mounted state is limited and locked through the buckle structure and the threaded connecting piece. The first guide structure in the embodiment is a first sliding structure. As a transformable implementation mode, the first guide structure may also be a first guide rail structure.

In the embodiment, both an air duct and a water duct of the air conditioner indoor unit are formed on the bottom shell i310 of the air and water duct module i300. The air duct and the water duct are arranged on the bottom shell i310 of the air and water duct module i300, when the air duct and the water duct need to be cleaned, the air and water duct module i300 may be directly disassembled to clean the air duct and the water duct. Compared with the problem in the conventional art that the air duct and the water duct cannot be cleaned due to arranging the air duct and the water duct on the bottom shell i310 of the base part i101, the disclosure may clean the air duct and the water duct better. Moreover, in the embodiment, the electric assembly is arranged in the base module i100, and the air duct and the water duct are arranged in the air and water duct module i300. In such a manner, the electrical assembly may be disassembled directly to be overhauled and replaced conveniently on one hand, and on the other hand, the air duct assembly i320 and the electrical assembly belong to different modules, and when the air duct, the water duct and the impeller i320 need to be cleaned, the air and water duct module i300 is directly disassembled to be cleaned. Compared with the problem in the conventional art that the air duct assembly cannot be cleaned due to arranging both the air duct and the water duct on the bottom shell i310 of the base part i101, or the performance of the electrical assembly is influenced by wetting when the air duct, the water duct or the impeller i320 are cleaned caused by fixedly mounting the electrical assembly on the bottom shell i310 which is mounted with the air duct and the water duct, the embodiment can not only clean the air duct, the water duct and the impeller i320, but also separate the air duct, the water duct and the impeller i320 from the electrical assembly when disassembling the air duct, the water duct and the impeller i320 from the base module i100, thereby preventing the electric assembly from being damaged by wetting.

Figure 5:
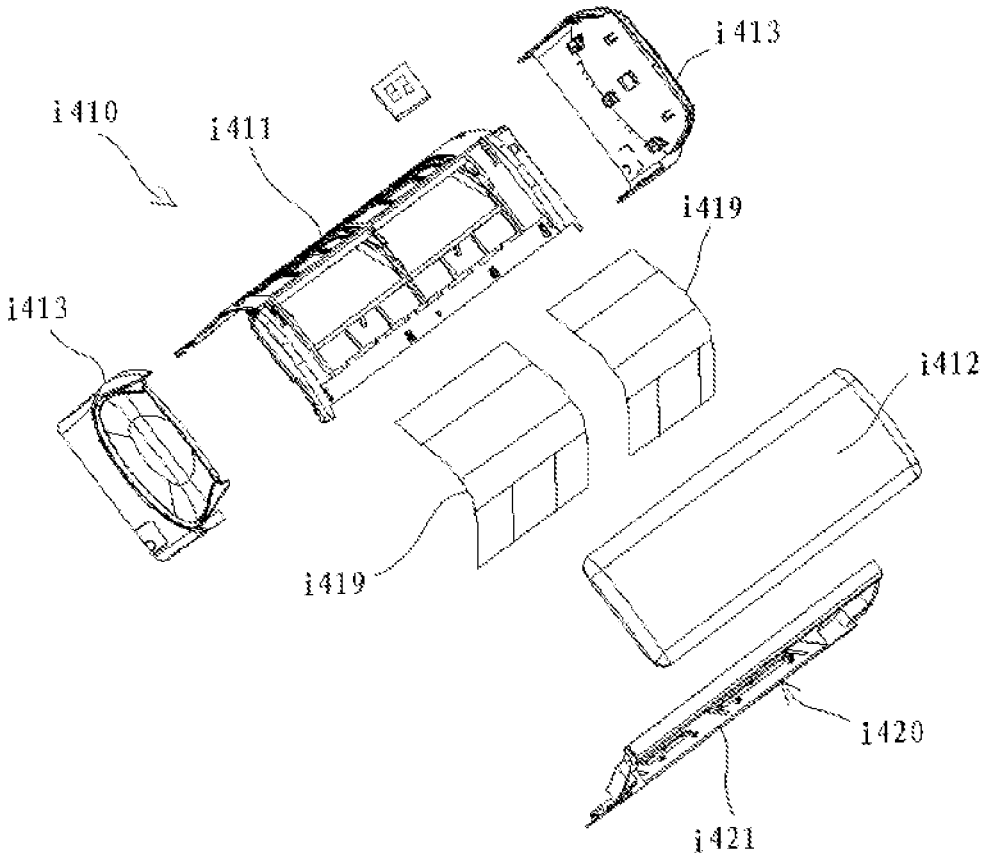
FIG. 5 is a three-dimensional exploded view of a shell module and an air outlet frame module in an exterior module of the air conditioner indoor unit shown in FIG. 1.
Figure 6:
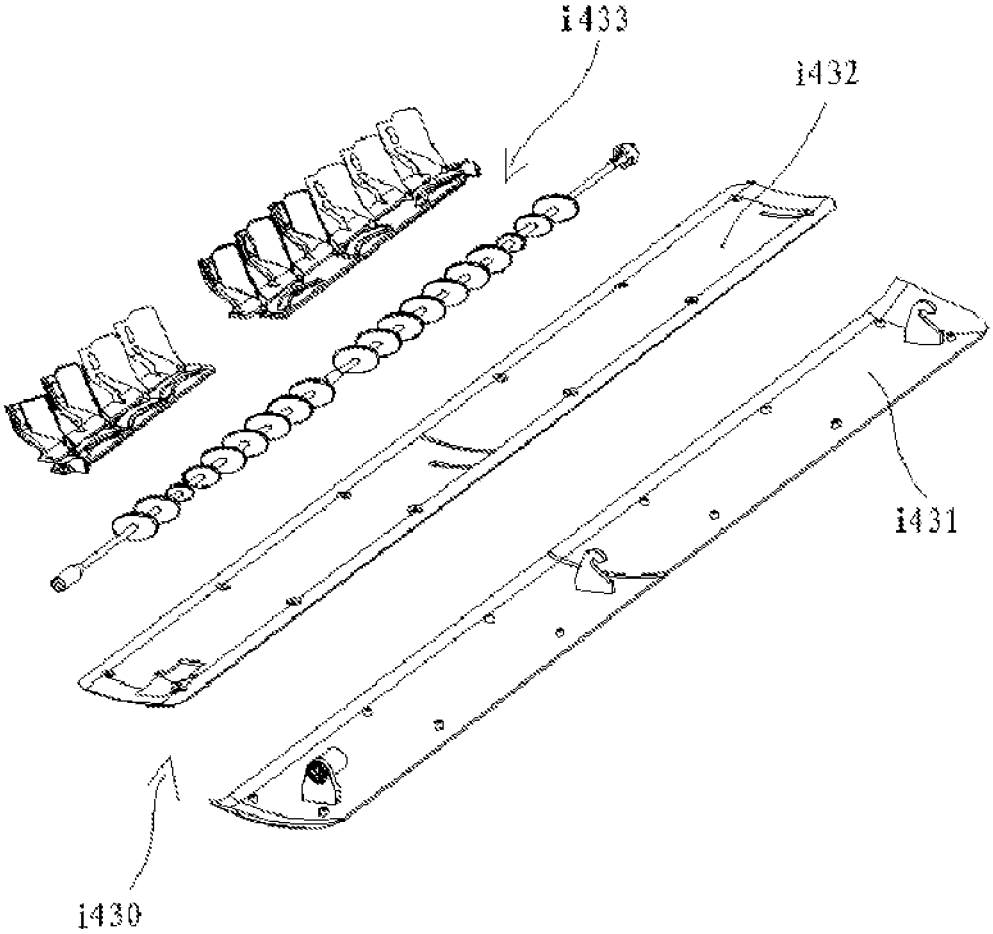
FIG. 6 is a three-dimensional exploded view of an air guide module of the air conditioner indoor unit shown in FIG. 1.

As shown in FIG. 1, FIG. 5 and FIG. 6, the exterior module i400 at least has an air guide module i430 which is detachably mounted on the base module i100, an air outlet frame module i420 which is detachably mounted on the base module i100 and/or the air and water duct module i300, and a shell module i410 which is detachably mounted on the base module i100.

The shell module i410 is detachably mounted on the base module i100, and as shown in FIG. 5, includes a panel i412 body, and a filter screen i419 and a panel i412 which are detachably mounted on the panel i412 body. The panel i412 includes a mounting rack i411, and two side panels i413 which are detachably mounted on two ends of the mounting rack i411 and correspond to two ends of the base part i101. The panel i412 body is divided into the mounting rack i411 and two side panels i413 which are detachably mounted on two ends of the mounting rack i411 and correspond to two ends of the base part i101. In such a manner, when the structure mounted on the end of the base part i101 needs to be disassembled, the side panel i413 on the corresponding end may be disassembled directly, that is, the structure may be disassembled without need of disassembling the mounting rack i411. There are multiple ways of mounting the shell module i410 with the base module i100. In the embodiment, the shell module i410 is detachably mounted on the base module i100 through a buckle structure.

As shown in FIG. 5, there can be various specific ways of mounting the air outlet frame module i420; for example, the air outlet frame module i420 is detachably mounted on the base module i100, or detachably mounted on the air and water duct module i300, or detachably mounted on both the base module i100 and the air and water duct module i300. In the embodiment, the air outlet frame module i420 is detachably mounted on the base module i100 and the air and water duct module i300. Specifically, the air outlet frame module i420 has an air outlet frame i421. The air outlet frame i421 is mounted on the base module i100 in a sliding manner through a second guide structure, and its mounted state is limited and locked through a sliding rail structure and a buckle structure mating with the air and water duct module i300. A part of air outlets are arranged on the air outlet frame i421 at least, and an air sweeping mechanism is arranged at the air outlet. The second guide structure in the embodiment is a second guide rail structure i900. As a transformable implementation mode, the second guide structure may also be a second slide structure. In the embodiment, a part of air outlets are arranged on the air outlet frame i421 at least, and an air sweeping mechanism is arranged at the air outlet.

As shown in FIG. 6, the air guide module i430 is detachably mounted on the base module i100. There are multiple specific ways of mounting the air guide module i430 with the base module i100. In the embodiment, the air guide module i430 is detachably mounted on the base module i100 through the buckle structure. In the embodiment, the air guide module i430 includes an air guide plate assembly which may be detachably connected with an air guide motor on an air guide poking box i102. The air guide plate assembly includes an outer air guide plate i431 and an inner air guide plate i432. An air sweeping mechanism is arranged on the air guide module i430. The air sweeping mechanism is an air sweeping assembly i433 which may be detachably connected with an air sweeping motor on the air guide poking box i102.

The electric assembly is not limited to be mounted on the base part i101 of the base module i100. As a transformable implementation mode, the electric assembly may also be detachably mounted on the bottom shell i310 of the air and water duct module i300; preferably, the electric assembly is detachably mounted on the end of the bottom shell i310. In such a manner, the electric assembly may also be disassembled directly to be overhauled and replaced.

In an assembling process:

first, each part in the base module i100, the air and water duct module i300, the heat exchange module i200, the air outlet frame module i420 and the air guide module i430 is pre-assembled on a corresponding pre-assembly line, so that the base module i100, the air and water duct module i300, the heat exchange module i200, the air outlet frame module i420 and the air guide module i430 form five independent pre-assembly modules respectively;

second, on the general assembly line, the base module i100 is taken as the assembling basis, the heat exchange module i200 and the air and water duct module i300 are respectively assembled with the base module i100. Specifically, first one side, arranged with the motor bracket, of the base module i100 is upwards installed on the assembly line, and a guide rail base of the second guide rail structure i900 is mounted on the base part i101; then, the heat exchange module i200 is assembled on the base module i100 from top to bottom, and after assembly, an opening of a chamber between the back plate of the base module i100 and the heat exchanger i220 faces to a predetermined direction; after that, the air and water duct module i300 is assembled in the part assembled at the last step along the predetermined direction to which the opening of the chamber between the back plate of the base module i100 and the heat exchanger i220 faces;

third, the panel i412 of the shell module i410 is assembled with the base module i100, and the filter screen i419 is assembled on the panel i412 body; after that, the air outlet frame module i420 is mounted on the base module i100 through the second guide rail structure i900; and the panel i412 is assembled with the panel i412 body;

at last, the air guide module i430 is assembled with the base module i100, and the assembly of the whole body of the air conditioner indoor unit is completed.

After the air outlet frame module i420 is mounted, the air guide module i430 is mounted at the air outlet which is on the air outlet frame i421.

In the above assembling process, when the air conditioner is assembled, the base module i100, the air and water duct module i300, the heat exchange module i200, the air outlet frame module i420 and the air guide module i430 are pre-assembled at first, and then parts of the shell module i410 and the above five modules are generally assembled on a general assembly line. By pre-assembling the five modules, the time needed to assemble the whole body is greatly reduced, the assembly efficiency is improved, and the manpower and material cost is saved; moreover, a foundation is laid for the subsequent realization of mechanized and automated production. Meanwhile, when the air conditioner indoor unit is disassembled, the base module i100, the air and water duct module i300, the heat exchange module i200, the air outlet frame module i420 and the air guide module i430 may be disassembled by taking the module as a unit. In such a manner, the disassembly efficiency may be greatly improved, and convenience is brought to cleaning or maintaining, and replacing a certain structure of the air conditioner indoor unit. Moreover, in design, each structure in the air conditioner indoor unit may be designed in a form of the six modules, namely the base module i100, the air and water duct module i300, the heat exchange module i200, the air outlet frame module i420, the air guide module i430 and the shell module i410, thereby simplifying a product design process of designers, and improving the design efficiency.

The assembling process in the above embodiment may be replaced as:

first, each part in the base module i100, the air and water duct module i300, the heat exchange module i200, the shell module i410, the air outlet frame module i420 and the air guide module i430 is pre-assembled on the corresponding pre-assembly line, so that the base module i100, the air and water duct module i300, the heat exchange module i200, the shell module i410, the air outlet frame module i420 and the air guide module i430 form five independent pre-assembly modules respectively;

second, on the general assembly line, the base module i100 is taken as the assembling basis, the heat exchange module i200 and the air and water duct module i300 are respectively assembled with the base module i100. Specifically, first one side, arranged with the motor bracket, of the base module i100 is upwards installed on the assembly line, and a guide rail base of the second guide rail structure i900 is mounted on the base part i101; then, the heat exchange module i200 is assembled on the base module i100 from top to bottom, and after assembly, an opening of a chamber between the back plate of the base module i100 and the heat exchanger i220 faces to a predetermined direction; after that, the air and water duct module i300 is assembled in the part assembled at the last step along the predetermined direction to which the opening of the chamber between the back plate of the base module i100 and the heat exchanger i220 faces; the impeller i320 is arranged in the heat exchanger i220 of the heat exchange module i200, and is detachably connected with the base module i100; and the impeller shaft of the impeller i320 is is combined with an output shaft of the fan motor i141;

third, the shell module i410 is assembled with the base module i100, and then the air outlet frame module i420 is mounted on the base module i100 through the second guide rail structure i900. Specifically, the shell module i410 is mounted and covered on the parts assembled above by buckling or connecting, through a sliding rail, the side panel i413 with the back plate of the base part i101, and then the air outlet frame module i420 is movably mounted on the base part i101;

at last, the air guide module i430 is assembled with the base module i100, and the assembly of the whole body of the air conditioner indoor unit is completed. Specifically, after the air outlet frame module i420 is mounted, the air guide module i430 is mounted at the air outlet which is on the air outlet frame i421.

In the above assembling process, when the air conditioner indoor unit is assembled, the six modules may be respectively pre-assembled on different assembly lines at the same time, and then the assembly of the whole body of the air conditioner indoor unit may be completed only by generally assembling the six pre-assembled modules on the general assembly line. In such a manner, the general assembly line is greatly shortened, and by pre-assembling the six modules at the same time, the time needed to assemble the whole body is greatly reduced, the assembly efficiency is improved, and the manpower and material cost is saved; moreover, a foundation is laid for the subsequent realization of mechanized and automated production. Through the design manner of the six modules, the air conditioner indoor unit is disassembled by taking the module as a unit, so the disassembly efficiency may be greatly improved, and convenience is brought to cleaning or maintaining, and replacing a certain structure of the air conditioner indoor unit. Moreover, by using the design manner of dividing the structures in the air conditioner indoor unit into the base module i100, the air and water duct module i300, the heat exchange module i200, the shell module i410, the air outlet frame module i420 and the air guide module i430, a product design process of designers is simplified, the design efficiency is improved, the development cost of the whole body of the air conditioner is further reduced, and it is convenient for the designers to adjust the structure of a part of modules aiming at requirements of different occasions, different users and different usable areas.

The modules are respectively described below.

Embodiment 2

A modular air conditioner includes a base module, a heat exchange module, an air duct part and an exterior module.

As shown in the drawings FIG. 7 to FIG. 15, the base module is configured to be mounted on a hanging support body such as an indoor wall, is also used as a basic part for assembly on a production line. The base module includes a base part g330 suitable to be mounted on the support body, a motor bracket fixedly arranged on the base part g330, a motor assembly and an electrical control part.

The motor bracket is arranged at a position close to one end of the base part g330 in a length direction, and an axis of an output shaft of a supported motor g220 extends in the length direction of the base part g330. In the embodiment, the motor bracket consists of a motor stand d51, a motor pressure plate g250 and a motor end cover.

The motor stand d51 is formed integrally with the base part g330 by, for example, injection molding. The motor pressure plate g250 is fastened to the motor stand d51 and fixed by screws to limit movement of the motor g220 in the motor assembly in a radial direction of a rotating shaft and form a chamber for accommodating and circumferential embracing the motor g220 in the motor assembly. The side, close to an adjacent end portion of the base part g330, of the chamber forms a mounting end that allows the motor g220 to be axially embedded into and withdrawn from the chamber, and the side far away from the end portion of the base part g330 forms a limiting end that limits further movement of the motor g220 embedded into the chamber towards the end portion, from which it is far away, of the base part g330. The motor end cover g240 may be fixedly mounted at the mounting end to limit movement of the motor g220 mounted in the chamber towards a direction of withdrawal from the chamber, as shown in FIG. 2.

In the embodiment, the electrical control part includes an electrical box r172 in which a main board and other control elements such as a transformer are placed together. The electrical box r172 is inserted into the base part g330 through two horn buckles at a bottom end, and then is detachably fixed on the base part g330 in a screw fixing manner. An internal structure of the electrical box r172 is fixedly provided with the main board. A terminal board of the electrical box r172 is fixed in the electrical box r172 in parallel with the main board. The main board is mounted in the electrical box r172 in a state of being perpendicular to the axis of the output shaft of the motor g220. For avoiding mechanical interference between the electrical box r172 and another part on a path of moving out of the base part g330 in an axial direction of the output shaft of the motor g220, the electrical box r172 is designed with a stepped contour according to a through section on the path. In addition, the internal structure of the electrical box r172 is designed with lug bosses. The lug bosses are arranged to avoid the external motor assembly on one hand and, on the other hand, strength structural strength of the electrical box r172. Each component of the main board is mounted with one side facing an inner side of the electrical box r172, so that the components of the main board may be arranged by full use of spaces between multiple lug bosses, and a structural form of the electrical box r172 is more advantageous in space occupation.

Besides the motor g220, the motor assembly further includes an extension and retraction motor, air guide motor and air sweeping motor poking an air guide module in the exterior module to act. In the embodiment, a pair of air guide poking boxes are fixedly mounted on two sides of the base part g330 in the length direction, the air guide poking box on the side far away from the motor bracket is fixed on a bracket structure on the corresponding side of the base part g330 by screws, and the air guide poking box on the side close to the motor bracket is clamped on the motor bracket through a buckle at a bottom end and fixed by screws. A connecting rod assembly is arranged in each air guide poking box in a sliding manner, and a head of the connecting rod assembly telescopically extends out along an extension opening on one side of the air guide poking box. The air guide motor includes the extension and retraction motor arranged on the air guide poking box, an air guide motor arranged at a head end of the connecting rod assembly on one side and the air sweeping motor arranged at a head end of the connecting rod assembly on the other side. The connecting rod assembly is connected with an output shaft of the extension and retraction motor through a gear and rack mechanism. An output shaft of the air guide motor drives an air guide plate, and an output shaft of the air sweeping motor drives an air sweeping plate. Wires connected with the air guide motor and the air sweeping motor penetrate through the corresponding connecting rod assemblies respectively.

Electrical wires connecting each load, such as an electrical component like a display, the motor, a wifi box and a cold plasma, in an indoor unit are fixedly arranged on the base part g330 through a wiring slot fixedly formed in the base part g330. The other end of each electrical wire is connected to a concentrator, and is electrically connected with the electrical box r172 through the concentrator in a pluggable manner. The concentrator is inserted into a limiting hole in the base part g330 through a horn buckle at the bottom end, and then is fixed on the base part g330 or the motor pressure plate g250 by screws. A pin interface is formed in the concentrator, a connecting pin is arranged at a mounting position corresponding to the pin interface on the electrical box r172, a line concentration box is arranged at the corresponding connecting pin in the electrical box r172, and terminal blocks, corresponding to each electrical component load, of the main board are arranged in the line concentration box in a centralized manner. Arrangement of the line concentration box corresponding to the concentrator in the electrical box r172 is favorable for centralized wiring and bundling of the component wires, and thus the electrical box r172 may be disassembled as an independent structure. The concentrator mates with the electrical box r172 through a limiting rib and the limiting hole. Devices corresponding to high voltage and devices corresponding to low voltage are regionally arranged in the electrical box r172 to reduce interference between each electrical device.

The electrical box r172, as an electrical control portion of the air conditioner, is a frequently disassembled part of the air conditioner, and whether it is mounted in place or not is crucial for whether the air conditioner may be used normally or not. In the embodiment, a mounting protection function for the electrical box r172 is set to implement error reporting control and prompting for whether the electrical box r172 is butted with the contractor well or not by logical control if the condition that the patch panel in the contractor and the main board in the electrical box r172 are disconnected and not connected in place occurs when the electrical box r172 is butted with the concentrator.

A logical control function is analyzed as follows: when the electrical box r172 or the concentrator is not mounted in place to cause an air conditioner indoor unit to fail at a control function end, disconnection or not-in-place connection is detected, and if it is detected after maintenance that the air conditioner works normally, maintenance work is finished.

The mounting protection function for the electrical box r172 is designed and developed to ensure that the electrical box r172 is mounted in place and improve a modular design degree of the air conditioner.

In addition, finned rib plates, i.e., a water retaining rib plate and a pipe retaining rib plate, are designed on two sides of the motor pressure plate g250 respectively. A connecting pipeline of a heat exchanger is arranged through a horizontal slot between the two finned rib plates, so that leftward and rightward collision of the connecting pipeline of the heat exchanger is limited, and the phenomenon that the air guide poking boxes are collided and further dislocated to affect extension and retraction accuracy of the air guide plate is avoided. Meanwhile, the water retaining rib plate guides condensed water on the heat exchanger to a bottom shell to realize a water guide function.

The finned rib plates close to the two sides of the motor pressure plate g250 are both provided with screw mounting columns, the motor pressure plate g250 mates with a pipe pressure plate, and the pipe pressure plate is fixed on the motor pressure plate g250 by mating of screws and the screw mounting columns to firmly fix the connecting pipeline of the heat exchanger in the horizontal slot formed between the two finned rib plates on the motor pressure plate g250 and fix the connecting pipeline of the heat exchanger in a direction perpendicular to a wall surface. The motor pressure plate g250 has a function of arranging the pipeline and limiting the pipeline. The connecting pipeline of the heat exchanger is arranged on the motor pressure plate g250, so that a utilization rate of an internal space of the air conditioner is increased. Meanwhile, a wiring clamping groove for the loads is arranged on the pipe pressure plate, so that more standard and reasonable wiring in the air conditioner is ensured.

During assembling, screw holes in the motor bracket and the motor pressure plate g250 are aligned, and the motor pressure plate g250 is fixed on the motor bracket by screws. The connecting pipeline of the heat exchanger is placed in the horizontal slot between the two finned rib plates of the motor pressure plate g250. The finned rib plates not only have a function of guiding the condensed water on the heat exchanger into a drainage system on the bottom shell but also have a function of limiting the connecting pipeline of the heat exchanger. The finned rib plates further have both the function of limiting the connecting pipeline of the heat exchanger and a collision prevention function: during transportation or a drop test, the connecting pipeline of the heat exchanger may sway leftwards and rightwards, and the finned rib plates limit leftward and rightward sway thereof to avoid the phenomenon that the connecting pipeline of the heat exchanger collides and further dislocates the air guide poking boxes to affect the extension and retraction accuracy of the air guide poking boxes poking the air guide plate to cause vibration or inclination of the air guide plate during running. In the embodiment, the motor pressure plate g250 implements arrangement of the connecting pipeline at an upper portion of the motor pressure plate g250, and mates with the pipe pressure plate to limit movement of the connecting pipeline of the heat exchanger in the direction perpendicular to the wall surface and optimize an occupation rate of the internal space of the air conditioner.

The screw mounting columns are designed on the motor pressure plate g250 for firm fixation and also for fixation of the pipe pressure plate, so that movement of the connecting pipeline of the heat exchanger in the direction perpendicular to the wall surface is limited.

Figure 11:
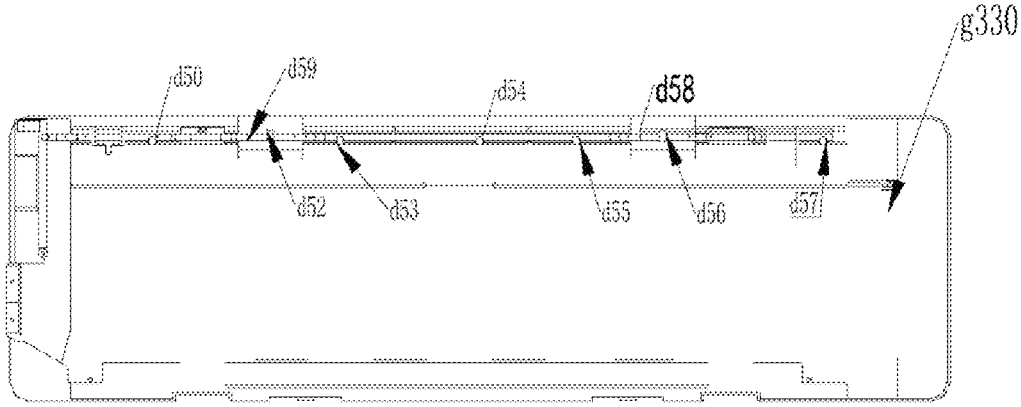
FIG. 11 is a schematic diagram of wiring of a base part according to an embodiment of the disclosure.

The base part g330 is provided with a wiring slot and wiring buckles corresponding to a poking module wire and an ambient temperature wrap wire. Specifically, during mounting on a production assembling line, the ambient temperature wrap wire, after being led out of the concentrator, is placed in the wiring slot shown in FIG. 1 at first, and the ambient temperature wrap wire is clamped with a fifth buckle d55, a sixth buckle d56 and a seventh buckle d57; and a poking box wire on a left side, after being led out of the concentrator, is clamped into the wiring slot, and the left poking box wire is clamped with a first buckle d50, a second buckle d52, a third buckle d53, a fourth buckle d54, the fifth buckle d55, the sixth buckle d56 and the seventh buckle d57, to complete wiring arrangement on the base, as shown in FIG. 11.

In the embodiment, the base is movably connected with an air outlet frame of an air outlet assembly d42 of the air conditioner through a sliding rail device d52 to enable the air outlet assembly d42 to slide out of the base along the sliding rail device d52, so that the air outlet assembly d42 may be conveniently disassembled and cleaned.

Figure 8:
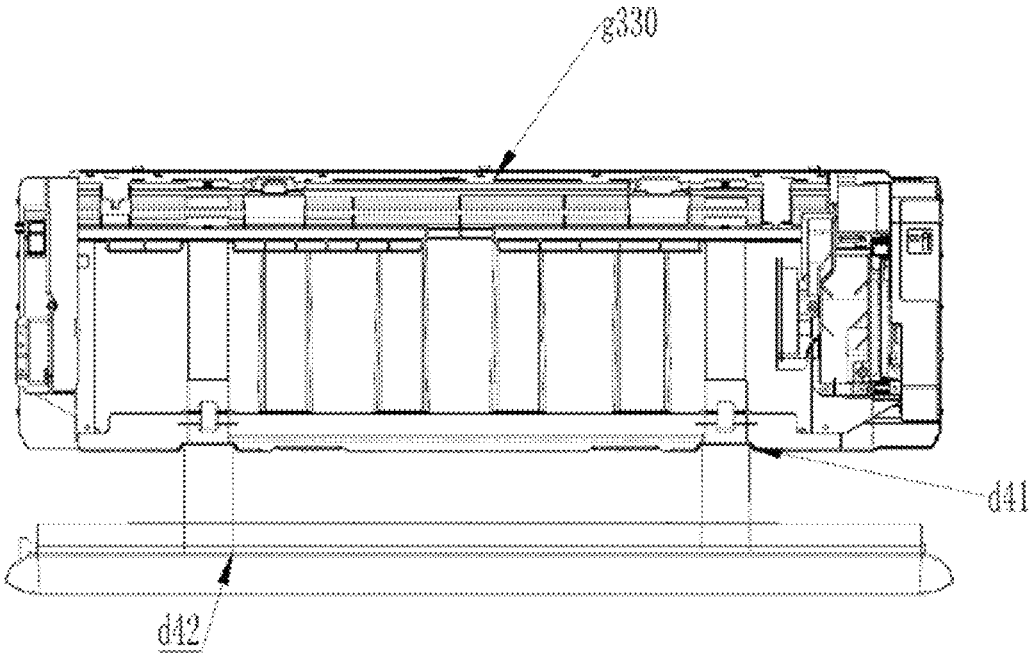
FIG. 8 is a mating schematic diagram of an air outlet assembly and a base part according to an embodiment of the disclosure.
Figure 15:
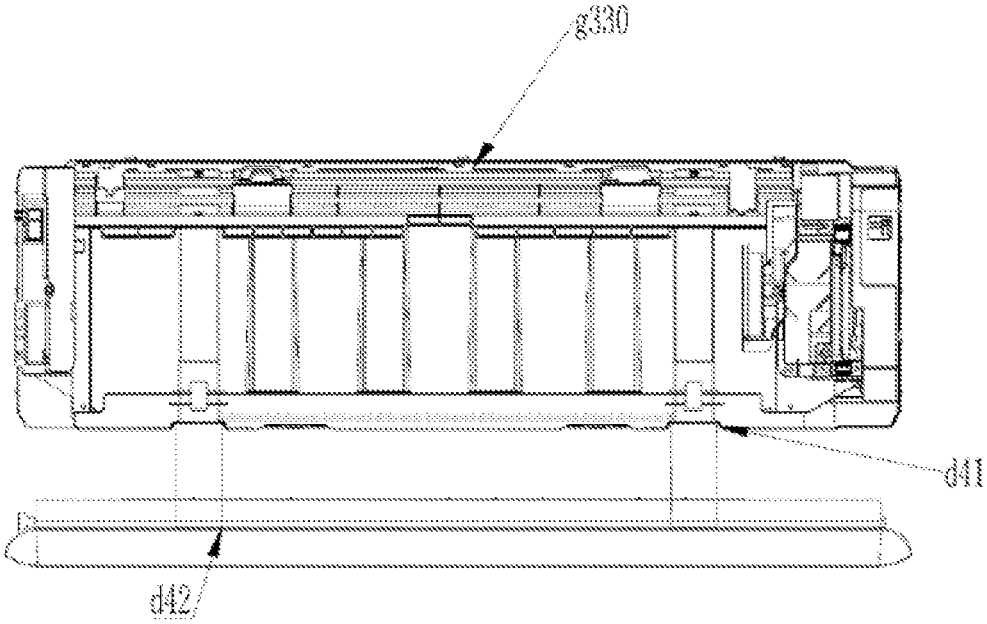
FIG. 15 is another mating schematic diagram of an air outlet assembly and a base part according to an embodiment of the disclosure.

Specifically, the sliding rail device d52 includes a sliding rail base vertically fixed on the base in a working state, a sliding rack mounted in a sliding chute of the sliding rail base in the sliding manner and a sliding rail end rod of which one end is fixedly mounted on the sliding rack, the other end of the sliding rail end rod being fixedly connected with the air outlet frame. A clamping hook is formed on the sliding rail end rod, and the clamping hook is connected with a clamping groove formed in the air outlet frame in an inserting and mating manner, as shown in FIG. 8 and FIG. 15.

Figure 9:
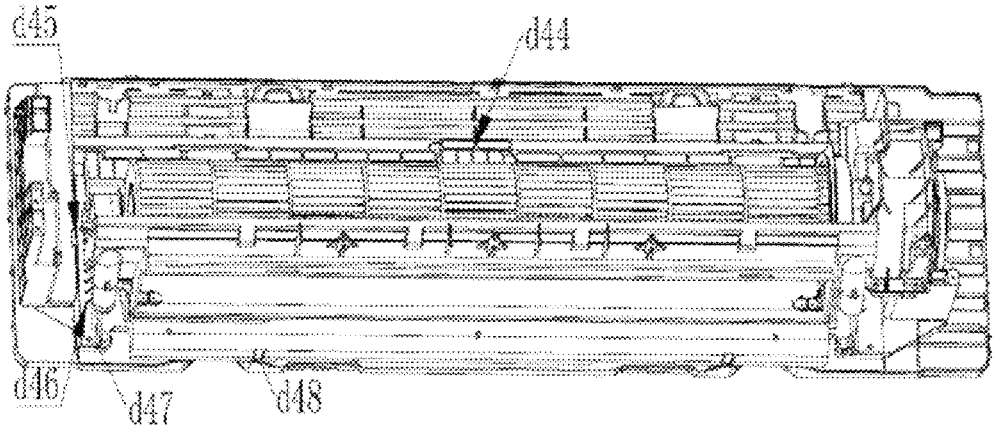
FIG. 9 is a mating schematic diagram of an air duct part and a base part according to an embodiment of the disclosure.
Figure 10:
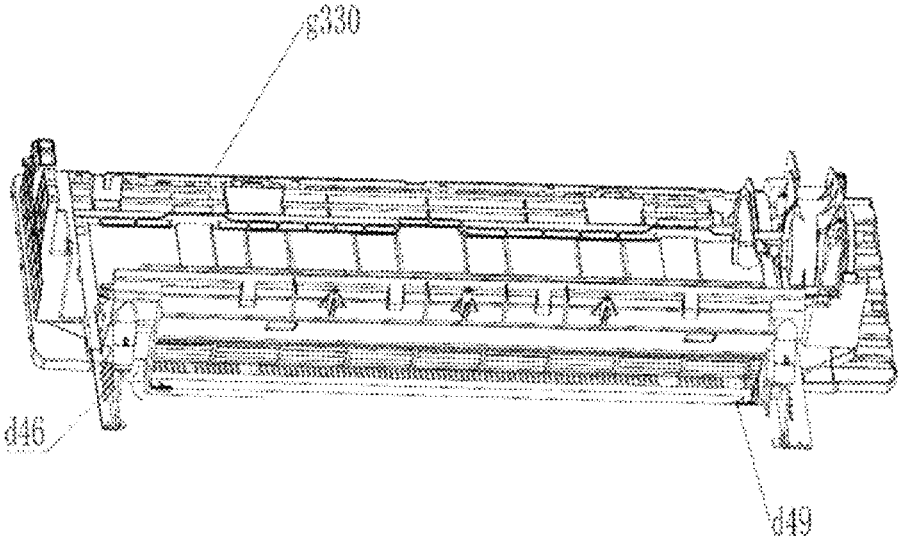
FIG. 10 is an assembling schematic diagram of an air duct part and a base part according to an embodiment of the disclosure.

To conveniently disassemble and assemble the air duct part, the mounting structure includes a limiting structure formed on the base to limit the air duct assembly in the working state in a vertical direction and a direction perpendicular to the base and sliding bridge structures d46 configured to guide the air duct assembly to slide into a base mounting position. Making the air duct part slide out along the sliding bridge is convenient to clean the air duct part, as shown in FIG. 9 and FIG. 10.

Figure 14:
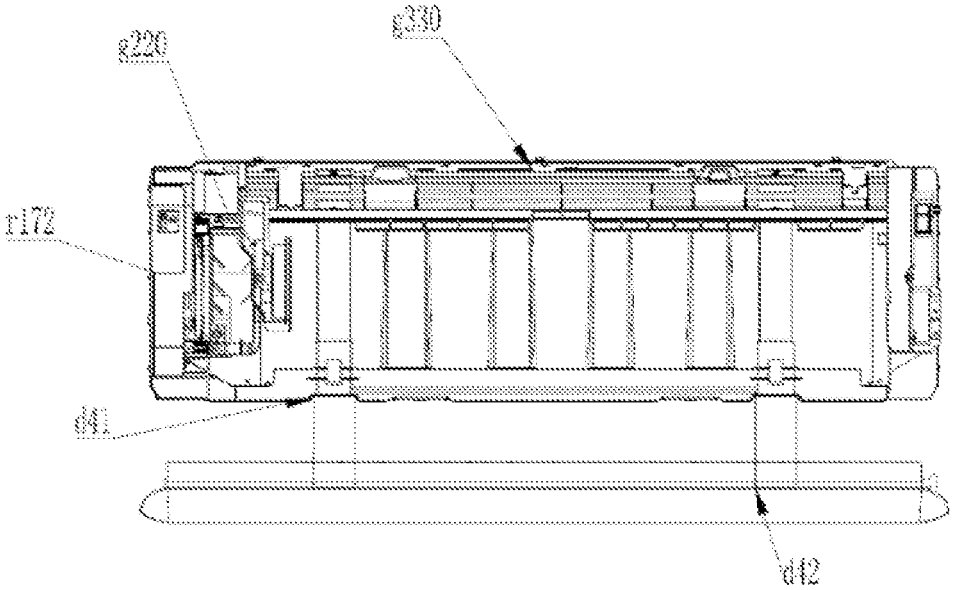
FIG. 14 is a schematic diagram that all of a base part, a motor and an electrical box are on a left side according to an embodiment of the disclosure.

The limiting structure includes limiting hooks d44 which are formed on a back plate of the base part g330 in columns on left and right and of which opening directions are consistent with an opening direction of the open chamber, first limiting stages d47 and second limiting stages d48 formed in columns on left and right and corresponding to a bottom shell lower edge of the bottom shell of the air duct part, embedded pieces d44 fixedly arranged at an upper portion of the bottom shell and correspondingly suitable to be embedded into the limiting hooks d44 after being mounted along the open chamber, second fixing holes suitable to support the bottom shell lower edge of the bottom shell on the two limiting stages when the embedded pieces are embedded into the limiting hooks d44, formed in columns on left and right in a lower portion of the bottom shell and axially perpendicular to the back plate of the base part g330, second screw holes formed in the base part g330 and corresponding to the second fixing holes at a mounting position of the bottom shell and second screws configured to penetrate through the second fixing holes to form screwed connection with the second screw holes, as shown in FIG. 14.

In the embodiment, the mounting structure further includes an indication structure d45 arranged at a position corresponding to a bottom shell side edge of the air duct assembly on the base and mating with the bottom shell side edge to assist in-place positional assembling. Specifically, the indication structure d45 is a buckle structure, the buckle structure functions to assist in-place positional assembling, and during disassembling or assembling, a sound "Da" represents that the bottom shell has been arranged in place. The limiting stages arranged in columns on the lower edge of the bottom shell have a lifting function, and may prevent the air duct part from sliding off after screws on sliding bridges are disassembled. During disassembling, the air duct part is slightly lifted in the direction perpendicular to the wall surface to separate the air duct assembly from the two limiting stages, and the air duct part is manually pulled to slide downwards along the sliding bridges to complete disassembling, as shown in FIG. 10.

In the abovementioned embodiment, the motor assembly and the electrical box r172 are both arranged on the right side of the base, and the electrical box r172 is located on an outer side of the motor g220. During overhauling, the electrical box r172 is disassembled from the right side of the base, the motor assembly is exposed after the electrical box r172 is disassembled, and then the motor assembly is disassembled from the right side of the base.

Figure 12:
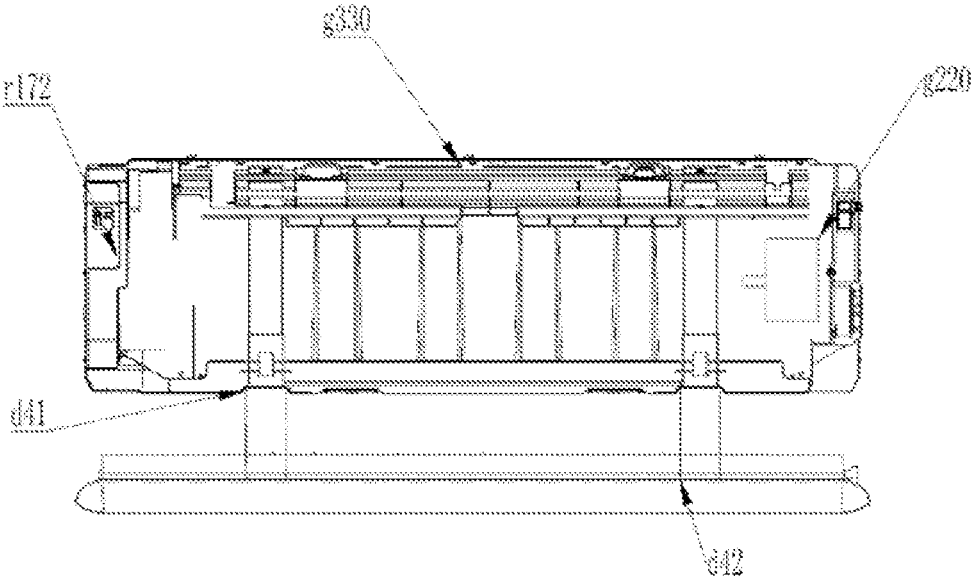
FIG. 12 is a schematic diagram of wiring of a base part according to an embodiment of the disclosure.
Figure 13:
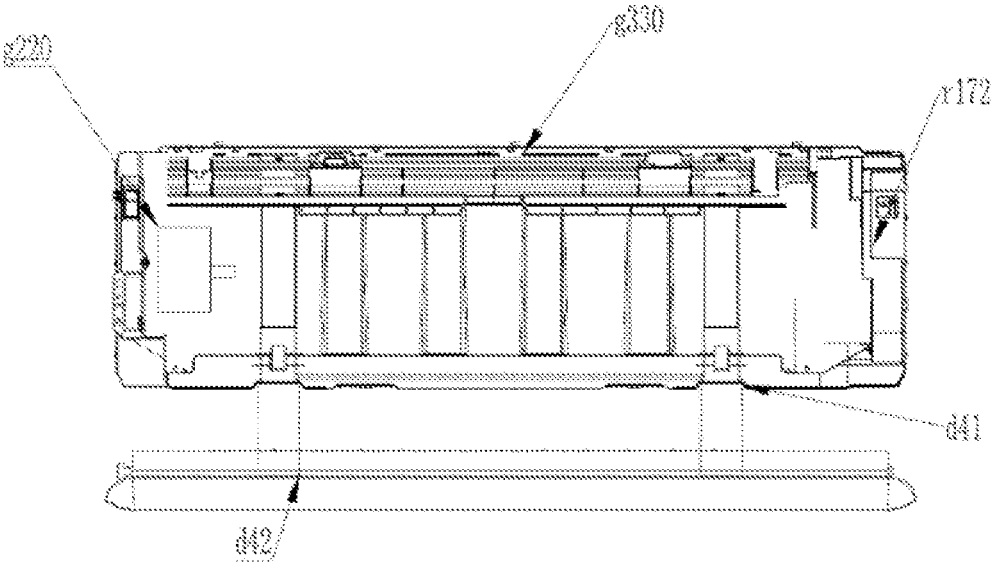
FIG. 13 is a schematic diagram that a base part and a motor are on a left side and an electrical box is on a right side according to an embodiment of the disclosure.

As a transformable embodiment, the motor assembly and the electrical box r172 may also be arranged on different sides of the base in the length direction. For example, the electrical box r172 is arranged on the right side of the base, the motor assembly is arranged on the left side of the base, and the electrical box r172 and the motor assembly are disassembled from corresponding side portions of the base respectively. For example, the electrical box r172 is arranged on the left side of the base, and the motor assembly is arranged on the right side of the base. For example, the electrical box r172 and the motor assembly may both be arranged on the left side of the base, as shown in FIG. 12, FIG. 13 and FIG. 14.

The above-described contents are overall introductions about the base module of the air conditioner in the embodiment of the disclosure. Each specific part in the base module will be elaborated below according to the drawings.

First of all, a specific implementation mode that the motor part is disassembled from one side of the base will be introduced according to the drawings.

As shown in FIG. 41 to FIG. 44, the air conditioner motor assembly according to the embodiment of the disclosure includes: a motor stand g210, arranged on the base part g330 on the air conditioner; a motor g220, mounted on the motor stand g210, a quick release connecting structure configured to implement quick release of a motor shaft and a fan blade shaft in the air conditioner being arranged on a motor shaft of the motor g220; and a limiting assembly, configured to limit the motor g220. The motor g220 has a working position where transmission connection is formed with the fan blade shaft through the quick release connecting structure and limiting is implemented through the limiting assembly and a quick release position where quick release from the fan blade shaft is implemented through the quick release connecting structure and limiting is released through the limiting assembly. In such a manner, it is ensured that the motor g220 may run normally and stably at the working position; and meanwhile, when the motor g220 requires after-sales maintenance, it is only necessary to release limiting of the limiting assembly in the motor assembly and implement quick release of the motor shaft and the fan blade shaft in the air conditioner through the quick release connecting structure, then the motor g220 may be directly taken out of the air conditioner, and since it is unnecessary to disassemble the motor shaft and the fan blade shaft and screw the screws in the air conditioner, time and labor are saved, and the after-sales service cost and time are reduced.

Figure 45:
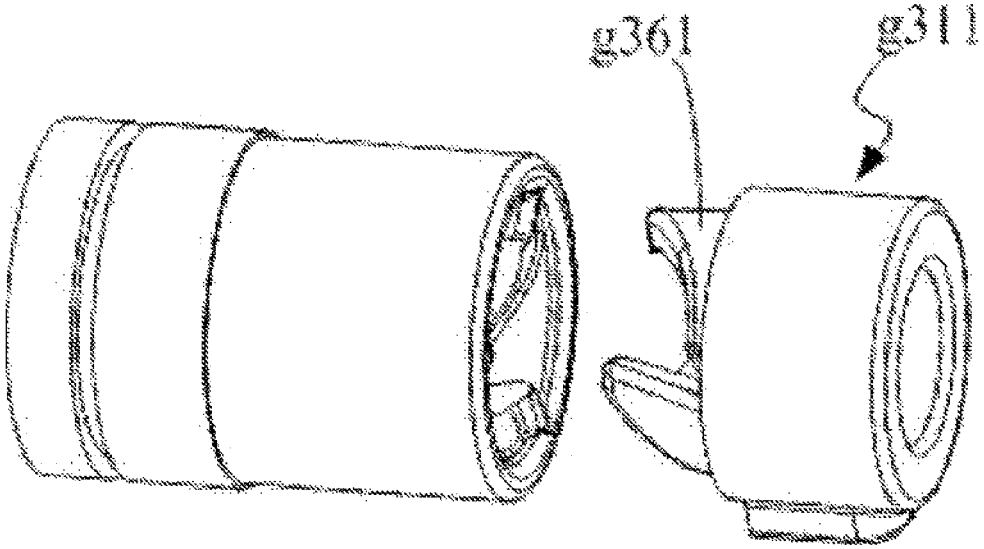
FIG. 45 is a structure diagram of a motor shaft sleeve in the motor assembly shown in FIG. 41.
Figure 46:
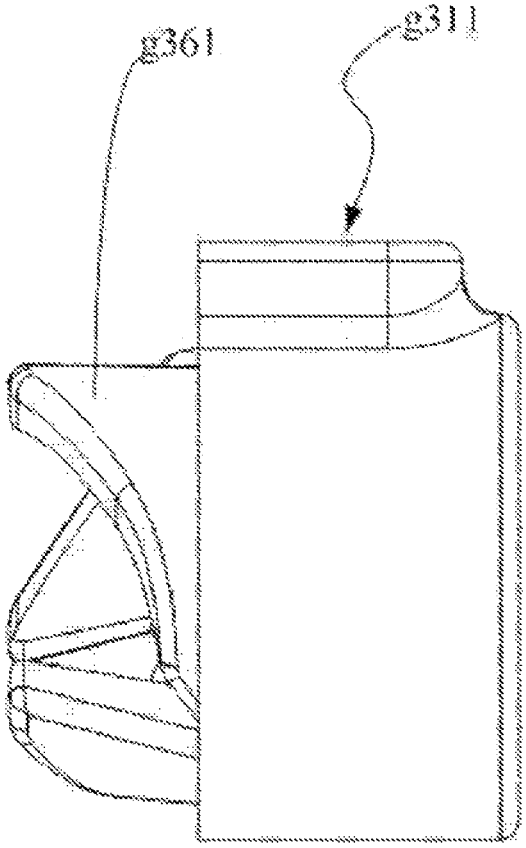
FIG. 46 is a structure diagram of the motor shaft sleeve in another direction in the motor assembly shown in FIG. 41.

As shown in FIG. 45 and FIG. 46, specifically, the quick release connecting structure in the embodiment of the disclosure includes a clamping claw arranged on the motor shaft and a clamping groove correspondingly formed in the fan blade shaft in the air conditioner and mating with the clamping claw. At the working position of the motor g220, the clamping claw on the motor g220 in the motor assembly extends into the clamping groove, and the motor shaft rotates to drive the fan blade shaft to rotate. At the quick release position of the motor g220, when the motor g220 is disassembled after the motor g220 is unlocked, the clamping claw is extracted from the clamping groove, and then the motor g220 may be quickly disassembled for subsequent maintenance. It can be understood that the quick release connecting structure may also include a clamping groove formed in the motor shaft and a clamping claw correspondingly arranged on the fan blade shaft and mating with the clamping groove, and the purpose of quickly disassembling and connecting the motor shaft and the fan blade shaft may also be achieved.

Preferably, in the embodiment of the disclosure, the clamping claw arranged on the motor shaft in the motor assembly is a helical clamping claw g361, and the corresponding clamping groove is a helical clamping groove g370, so that the motor shaft may rotate at the working position of the motor g220 to make the helical clamping claw g361 and the helical clamping groove g370 get close to each other under the action of a helical surface, the motor shaft and the fan blade shaft are unlikely to separate in a rotating process, and it is ensured that the motor g220 at the working position may run stably.

Specifically, in the embodiment of the disclosure, the helical clamping claw g361 is arranged on a motor shaft sleeve g311, the motor shaft sleeve g311 is mounted on the motor shaft, motor shaft sleeve mounting holes are formed in both the motor shaft sleeve g311 and the motor shaft, and the motor shaft sleeve g311 and the motor shaft may be detachably mounted through screws penetrating through the motor shaft sleeve mounting holes. In a transformed embodiment not shown in the figures, the motor shaft sleeve g311 is formed integrally with the motor shaft.

Preferably, in the embodiment of the disclosure, the motor stand g210 is formed integrally with the base part g330 of the motor assembly. More specifically, the motor stand g210 and the base part g330 are formed integrally in an injection molding manner. Therefore, the motor stand g210 is not required to be manufactured and mounted independently in a production and manufacturing process of the air conditioner, manufacturing efficiency of an air conditioner product is improved, and meanwhile, abnormal noises, caused by improper mounting of the motor stand g210 and the base part g330, of the air conditioner in a using process may be avoided.

Specifically, for the limiting assembly configured to implement stable running of the motor assembly at the working position in the embodiment, the limiting assembly in the embodiment includes: a motor pressure plate g250, configured to mate with the motor stand g210 to limit the motor g220 in a radial direction of the motor g220; and a motor end cover, configured to mate with the motor stand g210 to laterally limit the motor g220 in an axial direction of the motor g220. Therefore, the motor g220 may be limited in multiple directions, and movement stability of the motor g220 at the working position is ensured.

Therefore, when the motor g220 in the embodiment is maintained and serviced, a side panel in the air conditioner and the motor end cover configured to laterally limit the motor g220 are disassembled at first, and then the motor pressure plate g250 is disassembled after the screws fixing the motor pressure plate g250 are disassembled. Due to existence of a helical structural form of the motor shaft sleeve g311, the motor g220 may be quickly separated from the fan blade shaft at the quick release position, and in such case, the motor g220 may be manually pulled rightwards to be disassembled.

Then, the wiring structure in the air conditioner of the embodiment of the disclosure will be elaborated according to the drawings.

Figure 29:
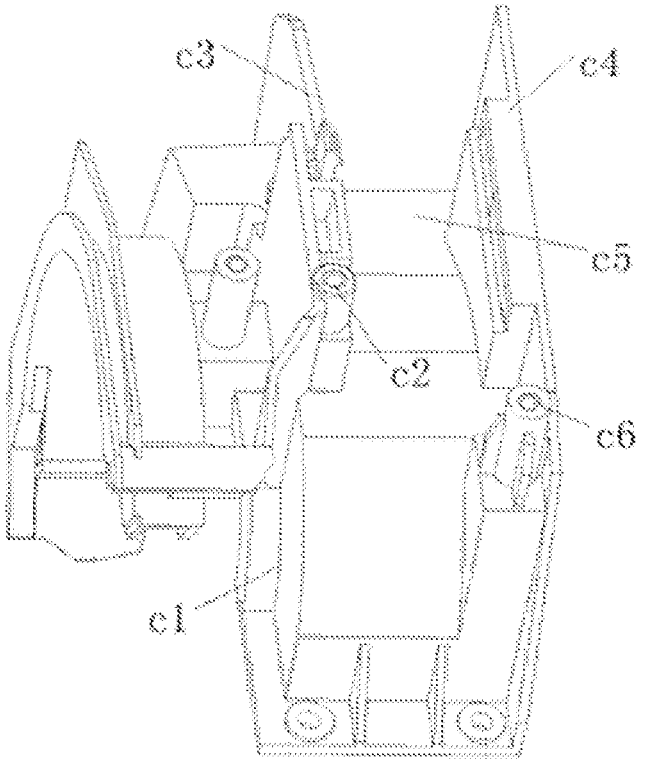
FIG. 29 is a structure diagram of a motor pressure plate according to the disclosure.

FIG. 29 is a structure diagram of a motor pressure plate. The motor pressure plate includes a pressure plate body c1. The side, facing the motor, of the pressure plate body c1 has a mating structure mating with the motor. The motor pressure plate mates with the motor stand to fix the motor. A first reinforcing wall c3 and a second reinforcing wall c4 are arranged in parallel on the side, back on to the motor, of the pressure plate body c1. The first reinforcing wall c3 and the second reinforcing wall c4 extend in the same direction and are spaced by a set distance, and a region therebetween is a fixing groove c5. A connecting pipe of the heat exchanger is positioned at a top of the motor pressure plate and arranged in the fixing groove c5 between the first reinforcing wall c3 and the second reinforcing wall c4.

Positioning the connecting pipe at the top of the motor pressure plate optimizes mounting positions of the components in the air conditioner and increases the utilization rate of the internal space of the air conditioner. Formation of the fixing groove c5 may effectively prevent leftward and rightward collision of the connecting pipe and avoid the phenomenon that poking modules are collided and further dislocated to affect the extension and retraction accuracy of the air guide plate.

The condensed water may be produced on a surface of the heat exchanger in a working process. The first reinforcing wall c3 is a water retaining structure configured to guide the condensed water on the heat exchanger to a water groove on the bottom shell to facilitate water groove and realize a flow guide function.

The motor pressure plate and the motor stand are integrally formed by an integration process respectively, for example, casting forming and injection molding.

According to the above descriptions, it can be seen that the first reinforcing wall c3 not only has a water guide function of guiding the condensed water on the heat exchanger into the water groove on the bottom shell but also has the function of limiting the connecting pipe. The second reinforcing wall c4 not only has the function of limiting connecting pipe but also may have the collision prevention function. During transportation or a drop test, the connecting pipe of the heat exchanger may sway leftwards and rightwards. The second reinforcing wall c4 limits leftward and rightward sway of the connecting pipe.

Compared with a motor pressure plate in the conventional art, the motor pressure plate in the application is not only endowed with additional functions and functionally diversified, but also fully uses the internal space of the air conditioner, increases the occupation rate of the internal space of the air conditioner and achieve higher adaptability to a modular design requirement of the air conditioner.

As a transformable embodiment, the fixing groove includes a first fixing groove and a second fixing groove formed corresponding to the connecting pipe respectively. That is, three parallel reinforcing walls are arranged on the side, back on to the motor, of the pressure plate body c1, and a fixing groove is formed between every two adjacent reinforcing walls. The two fixing grooves correspond to the connecting pipe respectively, and are configured to limit leftward and rightward sway of the connecting pipe respectively. In such an arrangement manner, a relatively good limiting effect may be ensured.

As a transformable embodiment, the first reinforcing wall c3 and a second reinforcing wall c4 may be substituted with simple protruding structures, and may also be substituted with ordinary platy structures. Extension lengths of the protruding structures or platy structures forming the fixing groove c5 should be designed based on such a standard that leftward and rightward sway of the connecting pipe may be limited. The reinforcing walls, protruding structures and platy structures forming the fixing groove c5 are collectively referred to as a first bump and second bump forming the fixing groove c5.

The pressure plate body c1 is buckled with a pipe pressure plate corresponding to at top end of the fixing groove c5. The pipe pressure plate is fixedly arranged on the pressure plate body c1, and is configured to limit the connecting pipe in upward and downward directions, thereby preventing the connecting pipe from being separated from the top end of the fixing groove c5. The pressure plate body c1 mates with the pipe pressure plate to firmly limit the connecting pipe in the fixing groove c5 of the motor pressure plate. The motor pressure plate and the pipe pressure plate have the function of arranging the pipe and limiting the pipe.

Figure 30:
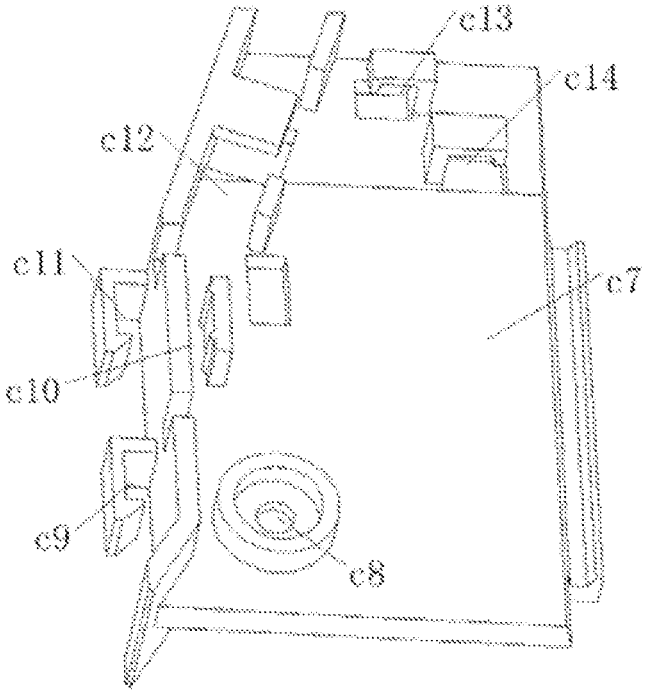
FIG. 30 is a structure diagram of a pipe pressure plate according to the disclosure.

From FIG. 29 and FIG. 30, it can be seen that the pressure plate body c1 is provided with a first mounting hole c2. A second mounting hole c8 corresponding to the first mounting hole c2 is formed in the pipe pressure plate. When the pressure plate body c1 and the pipe pressure plate are mounted, the first mounting hole c2 is opposite to the second mounting hole c8, and a first threaded connecting pipe is arranged therein in a penetration manner. Fixed mating of the pipe pressure plate and the pressure plate body c1 is implemented through the first threaded connecting piece.

The pressure plate body c1 is provided with a third mounting hole c6 corresponding to a middle frame structure of the air conditioner. The pressure plate body c1 is connected with the middle frame structure through a second threaded connecting piece arranged in the third mounting hole c6 in the penetration manner. By such a design, the motor pressure plate further has a function of fixing the middle frame structure, and is more functionally diversified, and the overall reliability is higher.

For limiting movement of the connecting pipe in the upward and downward directions in the fixing groove c5, as an alternative implementation mode, the fixing groove c5 includes a first lateral surface and second lateral surface that are opposite to each other, the first lateral surface and/or the second lateral surface are/is provided with a limiting bump corresponding to a top-end position, and an extension direction of the limiting bump is perpendicular to the other lateral surface. The limiting bump is arranged to limit the movement of the connecting pipe in the upward and downward directions in the fixing groove c5.

As a transformable embodiment, an extending plate is arranged at the top end of the fixing groove c5, and the extending plate is configured to limit the movement of the connecting pipe in the upward and downward directions in the fixing groove c5.

The pipe pressure plate includes a pipe pressure plate body c7, the pipe pressure plate body c7 is a platy structure, and a wiring structure is arranged on the side, far away from the motor pressure plate, thereof. The wiring structure includes a wiring slot and wiring buckles. The wiring slot extends according to a load line design circuit. The wiring buckles are configured to limit load lines in the wiring slot. The load lines, such as the ambient temperature wrap wire, a display line c152, a ground wire c155, a wifi box wire c151 and a cold plasma or mosquito repeller wire c153, of the air conditioner are all required to be limited by the wiring structure. Arrangement of the wiring structure ensures more standard and reasonable load wiring and improves convenience for after-sales maintenance and inspection.

Referring to FIG. 30 and FIG. 31, in the embodiment, the wiring structure on the pipe pressure plate c7 includes a first wiring structure c12, a second wiring structure c10, a third wiring structure c11, a fourth wiring structure c9, a fifth wiring structure c13 and a sixth wiring structure c14. The first wiring structure c12 includes a first side plate and second side plate which are arranged in parallel and spaced by a set distance. Extension directions of the first side plate and the second side plate are parallel and both perpendicular to the pipe pressure plate body c7. The first side plate is a continuous platy structure, and the second side plate includes a first sub-plate and second sub-plate of which extension directions are consistent. An opening of a set distance is formed between the first sub-plate and the second sub-plate. A baffle plate extending towards the second side plate is arranged at a top end of the first side plate. For conveniently assembling and disassembling the load line, the baffle plate is arranged corresponding to a position of the opening. The load line is arranged along a region between the first side plate and the second side plate, and is limited by the baffle plate. The region between the first side plate and the second side plate is the wiring slot, and the baffle plate is the wiring buckle. The second side plate may also be a continuous platy structure.

The second wiring structure c10 includes a first side plate and second side plate which are arranged in parallel. Extension directions of the first side plate and the second side plate are parallel and both perpendicular to the pipe pressure plate body c7. A buckling bump extending towards the second side plate is arranged on the lateral surface, facing the second side plate, of the first side plate, and the buckling bump is arranged close to a top end of the first side plate. The load line is arranged along a region between the first side plate and the second side plate, and is limited by the buckling bump. That is, the region between the first side plate and the second side plate is the wiring slot, and the buckling bump is the wiring buckle.

It is apparent that buckling bumps may be arranged on both the first side plate and the second side plate. The buckling bumps on the two may be opposite, and may also be staggered.

The third wiring structure c11, the fourth wiring structure c9, the fifth wiring structure c13 and the sixth wiring structure c14 are the same, and all of them are I-shaped structures. One end of the I-shaped structure is fixedly connected with the pipe pressure plate body c7, and mates with the pipe pressure plate body c7 to form a wiring slot limiting a movement direction of a wire. A buckling bump extending towards the pipe pressure plate body c7 is arranged at the other end of the I-shaped structure, and the buckling bump is a wiring buckle. The pipe pressure plate body c7 is a mounting structure of the I-shaped structure.

The wiring slot may also be a groove structure formed in the pipe pressure plate body c7.

Figure 32:
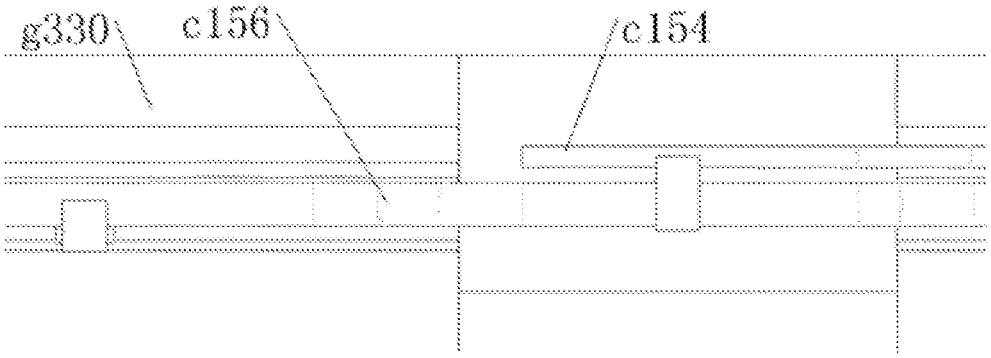
FIG. 32 is a structure diagram of wiring of a base part according to the disclosure.

A wiring structure is further arranged on the base part g330, and also includes a wiring slot and a wiring buckle. As shown in FIG. 32, the base part g330 includes a seventh wiring structure and eighth wiring structure configured to limit the poking module wire c156 and the ambient temperature wrap wire 157. The specific structure may be the same as the wiring structure on the pipe pressure plate, and will not be elaborated.

Figure 33:
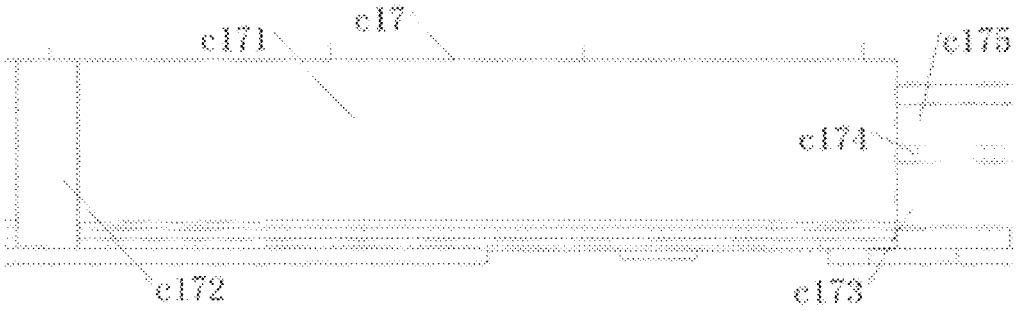
FIG. 33 is a structure diagram of a wiring structure at another position of a base part according to the disclosure.
Figure 34:
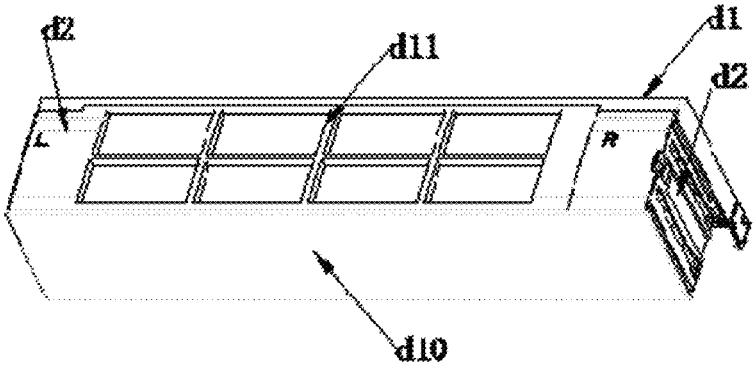
FIG. 34 is an assembling schematic diagram of an air conditioner frame structure, a panel and a filter screen according to the disclosure.

FIG. 33 is a structure diagram of a wiring structure at another position on the base part g330. The base part g330 includes a ninth wiring structure c17, configured to limit an indoor and outdoor unit connecting wire c173, a signal wire c174 and a power cord c175. The ninth wiring structure c17 includes a wiring slot and a wire clamping plate c172 buckled to the wiring slot. The wire clamping plate c172 is a platy structure extending in an extension direction of the wiring slot by a set length. The extension length of the wire clamping plate c172 is set according to a practical requirement, and a width of the platy structure should cover the wiring slot. A plate clamping groove is formed on two sides of the wiring slot, and the wire clamping plate c172 is clamped in the plate clamping groove to fix the load line arranged in the wiring slot. The wire clamping plate c172 is a wiring buckle of the wiring slot.

As a transformable embodiment, a wire clip c171 configured to fix the wire clamping plate c172 is arranged at a top end of the fixing groove. The wire clip c171 may also mate with a wire clamping groove.

During mounting on the production assembling line, the ambient temperature wrap wire c154, after being led out of the concentrator r104, is placed in the eighth wiring structure of the base part g330 at first; the poking module wire c156, after being led out of the concentrator r104, is clamped into the seventh wiring structure; and the power cord c175, the indoor and outdoor unit connecting wire c173 and the signal wire c174 are clamped in the ninth wiring structure c17, to complete wiring arrangement on the base part g330.

During mounting on the production assembling line, the cold plasma or driver wire is led out of the concentrator r104 and sequentially clamped into the first wiring structure c12 and the third wiring structure c11 at first; the ambient temperature wrap wire c154 and the ground wire c155 are led out of the concentrator r104 and sequentially clamped into the first wiring structure c12, the second wiring structure c10 and the fourth wiring structure c9; the display line c152 is led out of the concentrator r104 and clamped onto the pipe pressure plate through the fifth wiring structure c13, and a display is placed on a panel; and the wifi box wire c151 is led out of the concentrator r104 and clamped onto the pipe pressure plate through the sixth wiring structure c14, and a wifi box is placed on the panel or a panel body.

In the embodiment, the specific structure of the wiring structure corresponds to different load line types. It is apparent that a proper wiring structure recorded in the technical solution may be selected according to a practical condition. The same wiring structure may be selected for different wires.

With arrangement of the wiring structure, the wires in the air conditioner may be arranged according to a specifically designed wiring structure, more standard and reasonable wiring is ensured, probable interference is avoided, the assembling efficiency and the post maintenance efficiency are greatly improved, and higher personal safety of a worker is achieved. In addition, the wires may be fixed by the wiring structure in a decentralized manner, and the wiring structure mates with the wiring buckle to fix the wires more firmly and solve the problem of noises produced by collision of the wires and a shell.

Next, a specific solution of a concentrator structure in the air conditioner base module of the embodiment of the disclosure will be elaborated according to the drawings.

Figure 47:
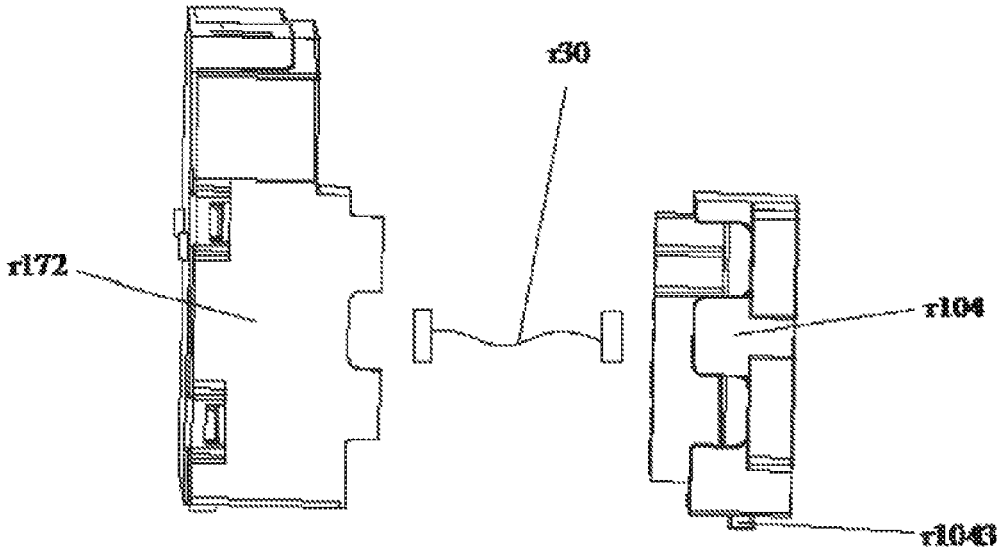
FIG. 47 is a structure diagram that a concentrator of a line concentration structure according to embodiment 1 of the disclosure is connected with an electrical box.
Figure 48:
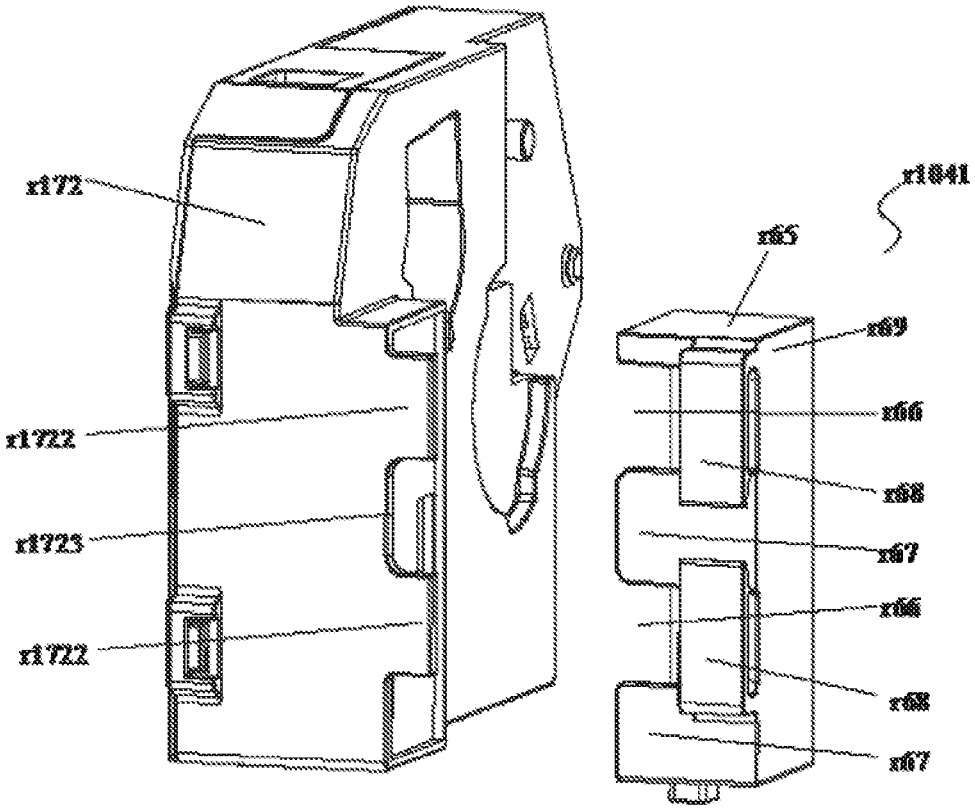
FIG. 48 is a three-dimensional structure diagram that the concentrator in FIG. 47 mates with the electrical box.
Figure 49:
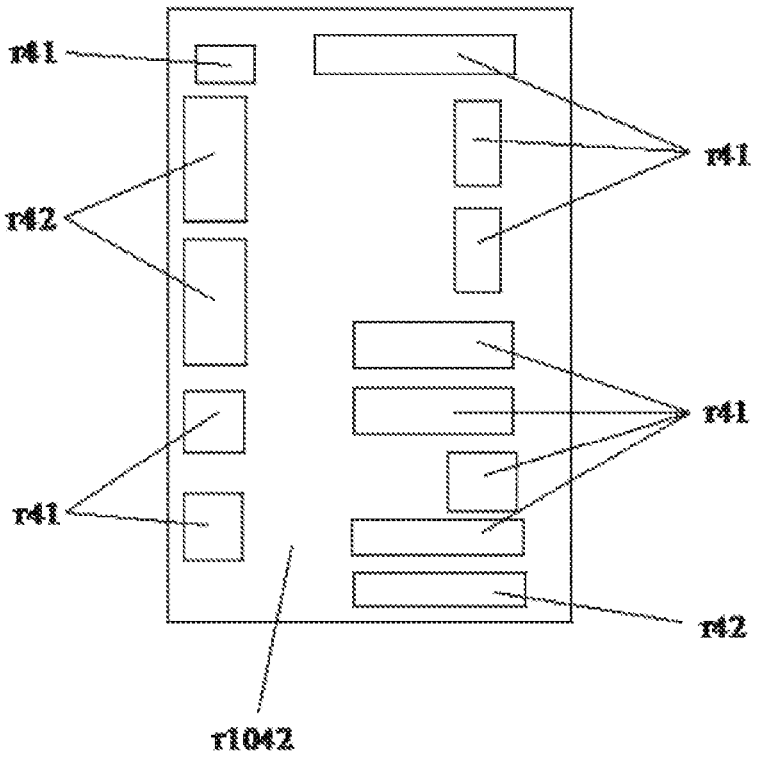
FIG. 49 is a schematic diagram of a patch panel of the concentrator in FIG. 48.

As shown in FIG. 47 to FIG. 49, a line concentration structure configured to connect multiple loads with the electrical box has multiple load terminal blocks r41 and at least one intermediate terminal block r42. The multiple load terminal blocks r41 are configured to be connected with multiple loads in a one-to-one correspondence manner. The at least one intermediate terminal block r42 is electrically connected with the corresponding load terminal block r41, and is configured to be correspondingly detachably connected with at least one main board terminal block r1713 of the electrical box r172 to integrate the multiple load terminal blocks r41 to the line concentration structure to facilitate independent disassembling of the electrical box r172.

With application of the line concentration structure of the embodiment, the load terminal blocks r41 connected with all of the loads are integrated to the concentrator r104, and the intermediate terminal block r42 on the concentrator r104 is detachably connected with the main board terminal block c1713 of the electrical box r172, so that the electrical box may be independently disassembled as a whole, higher modularization degree is achieved, and the air conditioner may be integrated and modularized. Therefore, on one hand, workloads in wire insertion and arrangement during production assembling are greatly reduced, and more standard wiring is ensured; and on the other hand, an after-sales maintenance worker may conveniently disassemble the electrical box for overhauling, and the problems of excessive loads connected in the electrical box and difficulties in assembling, disassembling and maintenance in the conventional art are effectively solved.

In the embodiment, the line concentration structure is a concentrator. The concentrator includes a patch panel r1042, and the multiple load terminal blocks r41 and the at least one intermediate terminal block r42 are formed on the patch panel r1042. The patch panel r1042 is a carrier of the terminal blocks, and the terminal blocks may be conveniently fixed thereon.

In the embodiment, as shown in FIG. 47, the concentrator further includes at least one intermediate connecting wire r30 corresponding to the at least one intermediate terminal block r42, and two ends of the intermediate connecting wire r30 are connected with the intermediate terminal block r42 and the main board terminal block r1713 in an insertion manner respectively. All of the load terminal blocks are inserted into the concentrator r104, the terminal block at one end of the intermediate connecting wire r30 is connected to a corresponding terminal block on the main board f2, and the terminal block at the other end of the connecting wire is connected to the corresponding intermediate terminal block of the concentrator r104. The terminal block on the concentrator is connected with the terminal block on the main board through the intermediate connecting wire, and in a wire flexible connection manner, connection reliability is ensured, not only is control of the main board over the loads implemented, but also a buffer action is achieved for collision between the concentrator and the electrical box. During maintenance and inspection, a side plate assembly is disassembled to expose the electrical box, then the electrical box is pulled out a little to expose the intermediate connecting wire, the terminal block of the intermediate connecting wire inserted into the concentrator is unplugged, and in such case, the electrical box may be wholly pulled out from the lateral surface without unplugging all of the load terminal blocks one by one, so that workloads in maintenance and inspection are greatly reduced. When there are two connecting wires, one is a high-voltage connecting wire, and the other is a low-voltage connecting wire; and when there are three connecting wires, two of them are low-voltage connecting wires and the other is a high-voltage connecting wire. Of course, the number of the connecting wire may also be only one, and in such case, the connecting wire is shared by a high-voltage terminal and a low-voltage terminal. Or, the number of the connecting wire may also not be limited thereto, and may be set to be larger according to a requirement.

In the embodiment, as shown in FIG. 48, the line concentration structure further includes a mounting matrix r1041, the mounting matrix r1041 is configured to be fixed on a machine frame of the air conditioner, and the patch panel r1042 is mounted on the mounting matrix r1041. By the mounting matrix r1041, the patch panel may be conveniently mounted and fixed, the patch panel is prevented from being directly exposed in the air conditioner, safe running of the patch panel is ensured, the workload in arrangement of multiple load connecting wires during disassembling of the electrical box is also reduced, disassembling of the main board and the electrical box is facilitated, the patch panel may be easily mounted with the electrical box, and an overall mounting space occupied by the patch panel and the electrical box is reduced. Meanwhile, the concentrator may be conveniently fixed on the machine frame through the mounting matrix, and convenience for fixation is ensured.

In the embodiment, the mounting matrix r1041 is a groove structure, the patch panel r1042 is mounted in the groove structure, and a size of the groove structure is adapted to a size of the patch panel r1042. The size of the mounting matrix is adapted to the size of the patch panel, so that a space occupied by the concentrator in the air conditioner is maximally reduced.

In the embodiment, the mounting matrix r1041 has an insertion portion forming insertion mating with the electrical box r172. Convenience for disassembling is ensured, and convenience is brought to operation of the maintenance worker.

In the embodiment, as shown in FIG. 48, the insertion portion includes multiple first jacks r66 formed at intervals in one side end of the mounting matrix r1041 in the vertical direction and first plug board r67 formed between every two adjacent first jacks r66. The multiple first jacks r66 and the first plug boards r67 are configured to mate with multiple second plug boards r1722 arranged at intervals on the electrical box r172 in the vertical direction and second jacks r1723 formed between every two adjacent second plug boards r1722 respectively. The mounting matrix is fixed with the electrical box by mating of the jacks and the plug boards, which is implemented by own structure of the mounting matrix without any additional part, so that a small space is occupied, the manner is simple, and connection reliability is ensured.

In the embodiment, as shown in FIG. 48, the groove structure includes a bearing substrate r69 and four rib plates r65 arranged on the bearing substrate r69. The bearing substrate r69 is rectangular, the bearing substrate r69 is vertically placed, the four rib plates r65 are arranged at an edge of the bearing substrate r69, and the multiple first jacks r66 are formed in one rib plate.

In the embodiment, as shown in FIG. 48, a fixing clamping hook r68 is arranged on an outer sidewall of the concentrator structure, and a fixing space configured to fix the load connecting wires is formed between the fixing clamping hook r68 and the outer sidewall of the concentrator. The fixing space is configured to fix the load connecting wires, so that standard wiring is ensured. The fixing clamping hook is fixed on the rib plate with the first jacks. A wiring channel is formed between the second plug board and a bottom wall of the first jack. The load connecting wire, after extending out of the wiring channel, extends out of the fixing space. Preferably, there are two fixing buckles, and the two fixing buckles are arranged oppositely.

Figure 51:
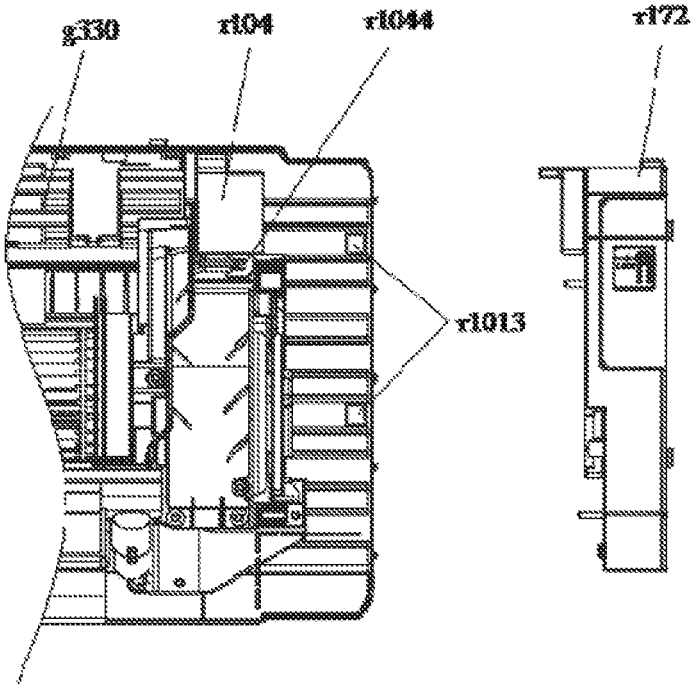
FIG. 51 is a schematic diagram that the concentrator in FIG. 47 mates with the electrical box and a base part.
Figure 52:
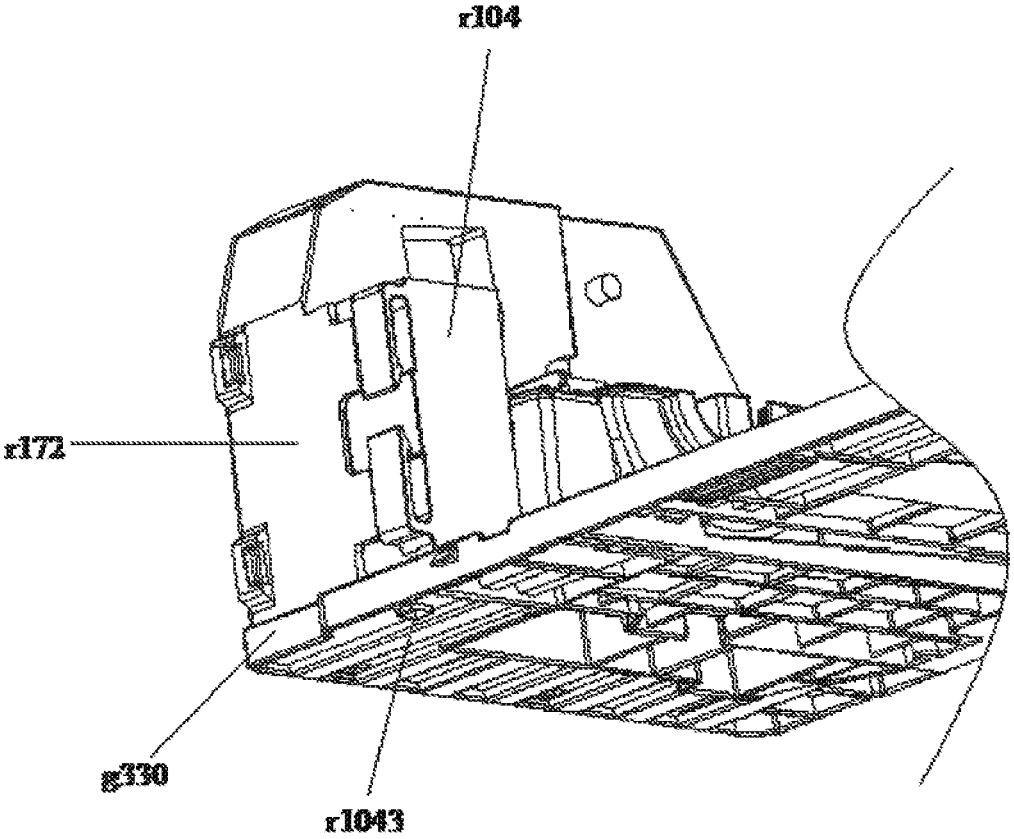
FIG. 52 is a three-dimensional structure diagram that the concentrator in FIG. 51 mates with the electrical box and the base part.

In the embodiment, as shown in FIG. 47, FIG. 51 and FIG. 52, a connecting structure configured to fix the base g330 of the air conditioner is further arranged on the mounting matrix r1041. Therefore, the concentrator may be conveniently mounted, and the assembling efficiency is improved. The connecting structure includes at least one screw hole r1044 formed in the mounting matrix r1041 and a buckle r1043. The concentrator is inserted into a mounting hole in the machine frame through the buckle, and a screw penetrates through the screw hole to form threaded connection with an internal threaded hole in a stud, so that firmer and more reliable connection is ensured, the space occupation rate is maximally reduced, and the assembling efficiency is improved. Of course, the concentrator may also be fixed on the machine frame through two screws, or the concentrator is fixed on the machine frame only through the buckle in an interference fit manner.

In the embodiment, the machine frame is the base part g330, the panel, the panel body, the electrical box r172 or the motor pressure plate. The mounting position of the concentrator r104 is preferably on the base part g330. Of course, the concentrator may also be placed on the panel body, the panel, a bottom of the electrical box and the motor pressure plate or embedded into the electrical box.

In the embodiment, the mounting matrix r1041 is injection-molded, so that convenience is brought to machining, and the manufacturing cost is reduced.

In the embodiment, the multiple loads include the display, the motor, the wifi box, an ambient temperature wrap, a pipe temperature bulb, a cold plasma, a mosquito repeller, the poking box, an auxiliary electrical heating load, a humidity sensor and the ground wire. Of course, in embodiments not shown in the figures, the number of the loads is at least one, and the load is selected according to a requirement.

Figure 50:
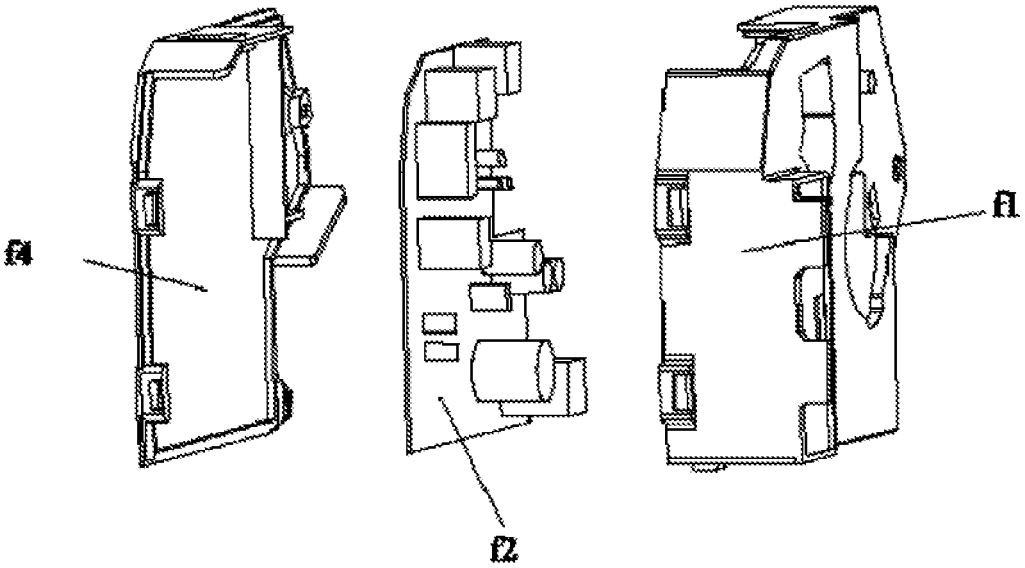
FIG. 50 is an exploded view of the electrical box in FIG. 48.
Figure 53:
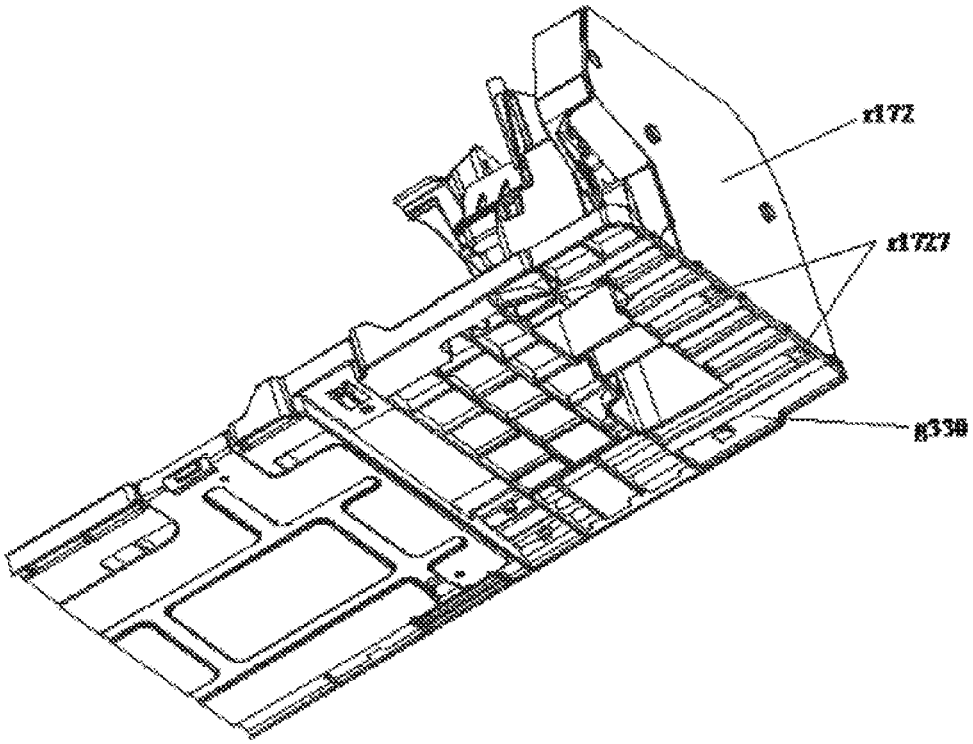
FIG. 53 is a three-dimensional structure diagram that the concentrator in FIG. 52 mates with the electrical box and the base part at another angle.

In the embodiment, as shown in FIG. 50, the electrical box includes a box body f1 and a box cover f4 detachably connected with the box body f1, and the main board f2 is arranged in the box body f1. As shown in FIG. 51 and FIG. 53, a mounting buckle r1727 is arranged on an outer bottom wall of the electrical box, and a mounting hole r1012 mating with the mounting buckle r1727 is formed in the base part.

Figure 54:
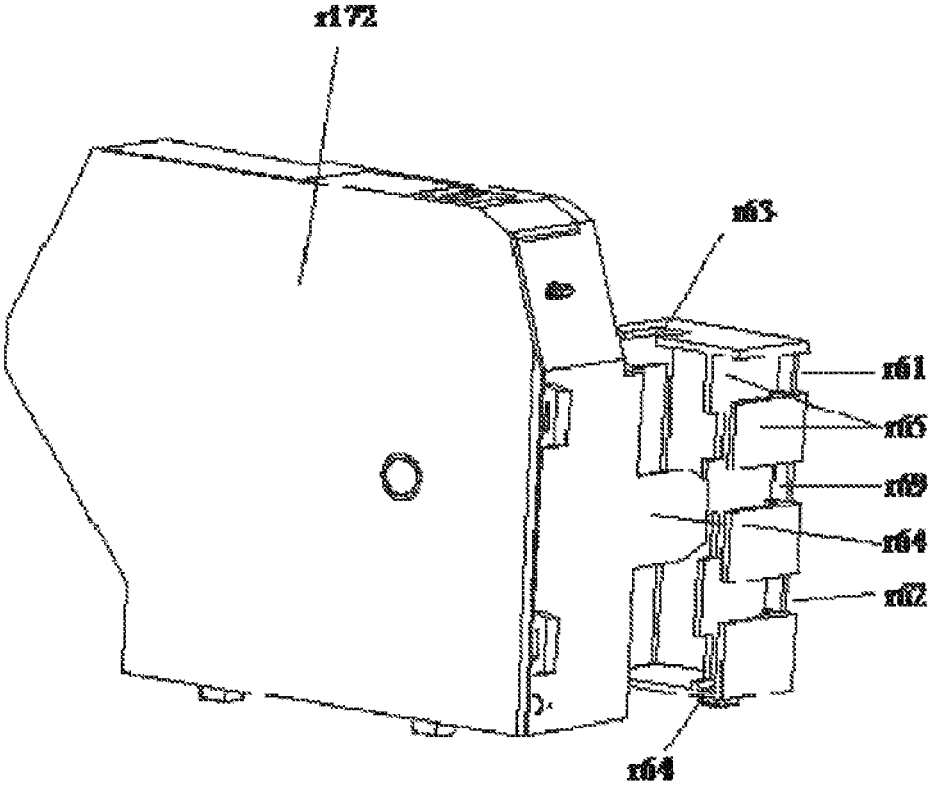
FIG. 54 is a structure diagram that a concentrator of a line concentration structure according to embodiment 2 of the disclosure is connected with an electrical box.
Figure 55:
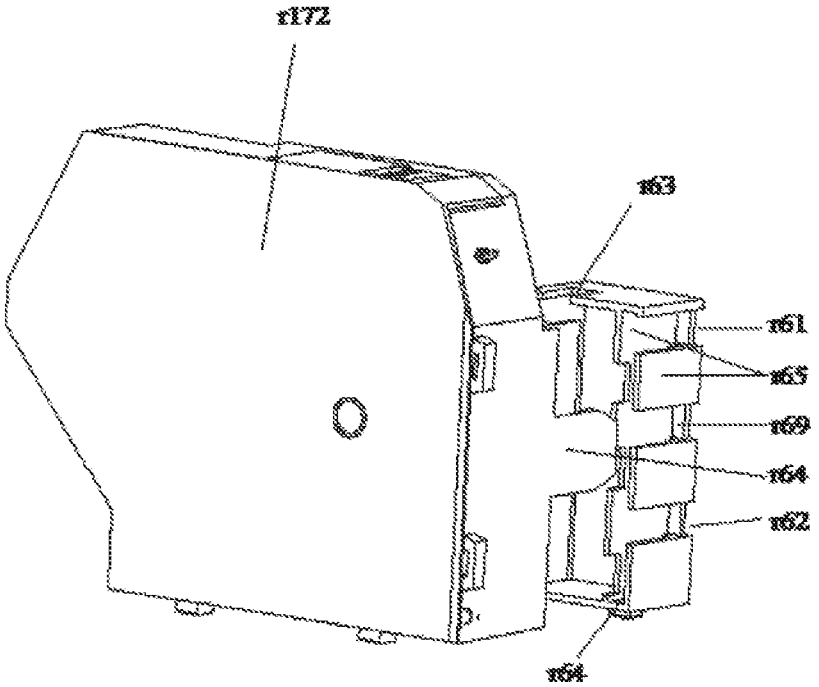
FIG. 55 is a three-dimensional structure diagram of the electrical box in FIG. 54.

As a transformable embodiment, FIG. 54 and FIG. 55 illustrate another line concentration structure. The difference between the line concentration structure of the present embodiment and the line concentration structure of the abovementioned embodiment is that the specific structure of the insertion portion is different. In the embodiment, the insertion portion is a slot r64 configured to mate with a plug board r1721, extending towards the concentrator, of the electrical box r172. The mounting matrix is fixed with the electrical box by mating of the slot and the plug board, which is implemented by own structure of the mounting matrix without any additional part, so that a small space is occupied, the manner is simple, and connection reliability is ensured.

In the transformable embodiment, a plurality of wire passage slots that allow the load connecting wires to pass through are formed in the mounting matrix r1041. Formation of the plurality of wire passage slots in the mounting matrix facilitates connection between multiple loads at different positions and multiple terminal blocks on the patch panel. The plurality of wire passage slots include a high-voltage load wire passage slot r61, low-voltage load wire passage slot r62 and display wire passage slot r63 that are arranged separately, The high-voltage load wire passage slot r61 is arranged at one side end of the mounting matrix r1041, the low-voltage load wire passage slot r62 is arranged at one side end of the mounting matrix r1041, and the display wire passage slot r63 is arranged at the top end of the mounting matrix r1041. Distinguishing the plurality of wire passage slots as the high-voltage load wire passage slot, the low-voltage load wire passage slot and the display wire passage slot maximally reduces intertwining of different load connecting wires.

In the transformable embodiment, the high-voltage load wire passage slot r61 and the low-voltage load wire passage slot r62 are arranged at upper and lower ends of the mounting matrix r1041 respectively. Therefore, a high voltage may be separated from a low voltage, intertwining of a high-voltage load connecting wire and a low-voltage load connecting wire is reduced, and more standard wiring is ensured.

In the transformable embodiment, one side end of the mounting matrix r1041 includes a pair of rib plates r65 arranged at an interval in parallel towards the direction of the electrical box r172, and a space between the pair of rib plates r65 form the slot r64. Simple structure, convenience for manufacturing and low cost are achieved.

In the transformable embodiment, the groove structure includes a bearing substrate r69 and five rib plates r65 arranged on the bearing substrate r69. The bearing substrate r69 is rectangular, and is vertically placed, four rib plates r65 are arranged at an edge of the bearing substrate r69, the other rib plate is arranged in parallel with two rib plates, and the two rib plates at a relatively short distance in the three parallel rib plates form the slot. Preferably, two of the five rib plates are short rib plates, the other three are long rib plates, the middle long rib plate is arranged close to one long rib plate, the slot is formed between the two long rib plates at a relatively short distance, and the wire passage slots are formed in the outer long rib plate in the two long rib plates at the relatively short distance and the bearing substrate. A wire passage groove is formed in the middle long rib plate.

In the transformable embodiment, a wire passage hole r1724 that the intermediate connecting wire r30 passes through is formed in the electrical box.

Figure 56:
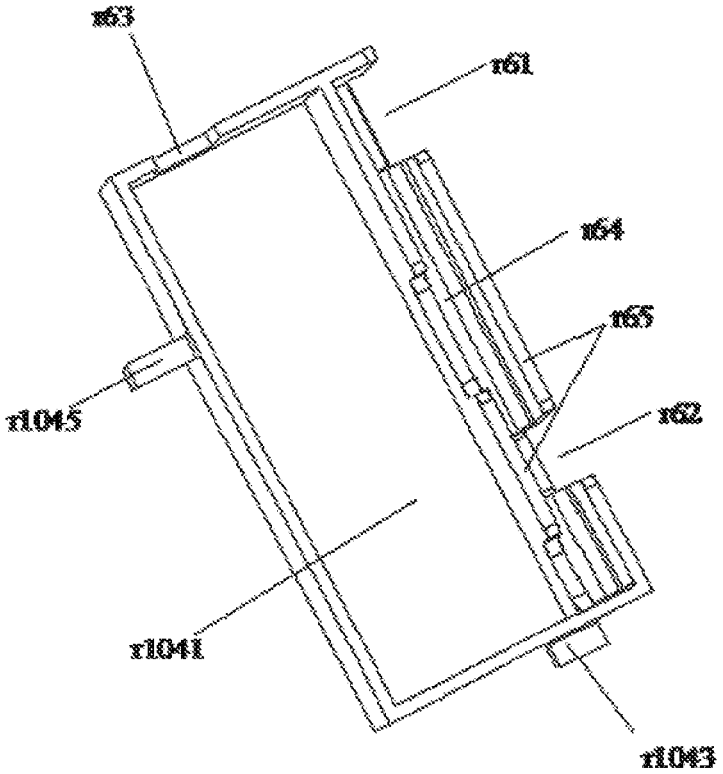
FIG. 56 is a three-dimensional structure diagram of a mounting matrix of a line concentration structure according to embodiment 3 of the disclosure.
Figure 57:
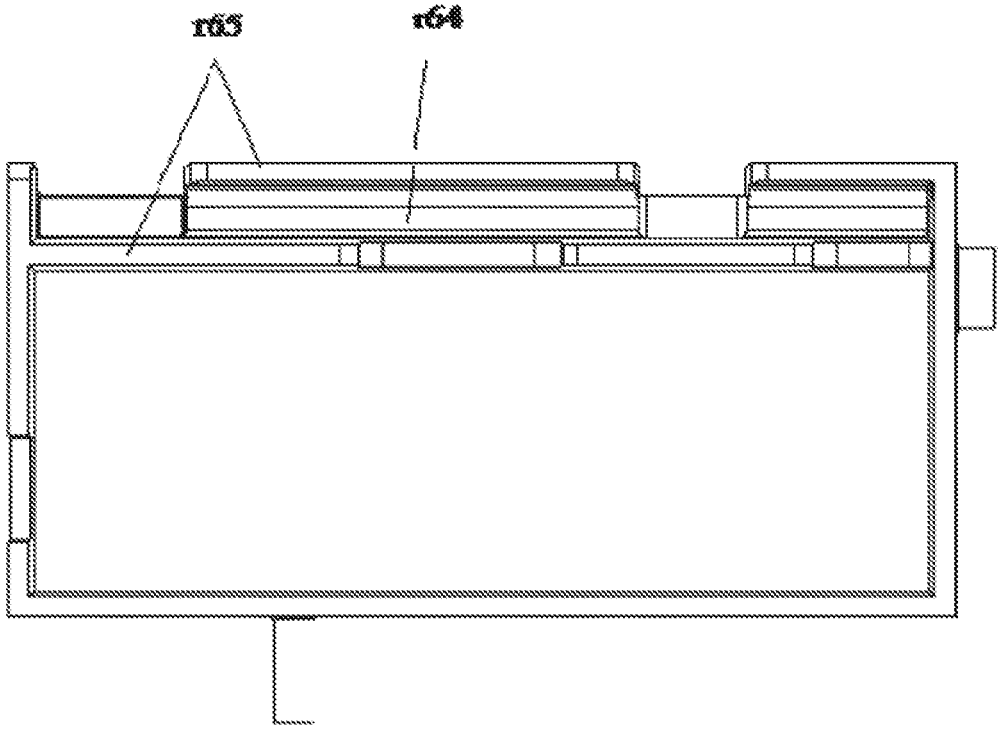
FIG. 57 is a front view of the concentrator structure in FIG. 56.
Figure 58:
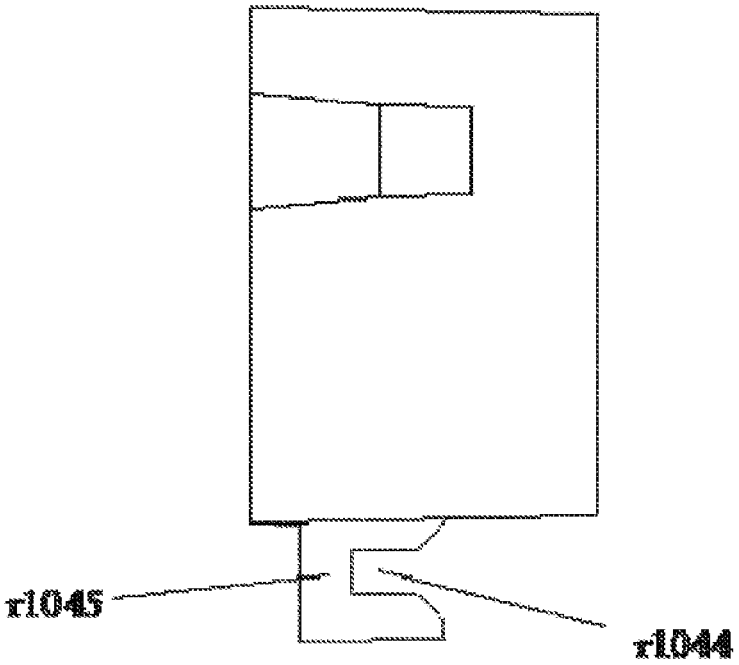
FIG. 58 is a side view of the concentrator structure in FIG. 56.

As a transformable embodiment, FIG. 56 to FIG. 58 illustrate another line concentration structure according to an embodiment of the disclosure. The difference between the line concentration structure of the present embodiment and the concentrator of the abovementioned transformable embodiment is that the numbers of the wire passage slot and the wire passage groove are different. In the transformable embodiment, there are three wire passage slots, one being a high-voltage load wire passage slot and the other two being low-voltage load wire passage slots; and the number of the wire passage groove is also three, one being a high-voltage load wire passage groove and the other two being low-voltage load wire passage grooves. In the transformable embodiment, there two are wire passage slots, one being a high-voltage load wire passage slot and the other being a low-voltage load wire passage slot; and the number of the wire passage groove is also two, one being a high-voltage load wire passage groove and the other being a low-voltage load wire passage groove. Of course, the numbers of the wire passage slot and the wire passage groove are not limited thereto, and are specifically set according to a requirement.

Figure 59:
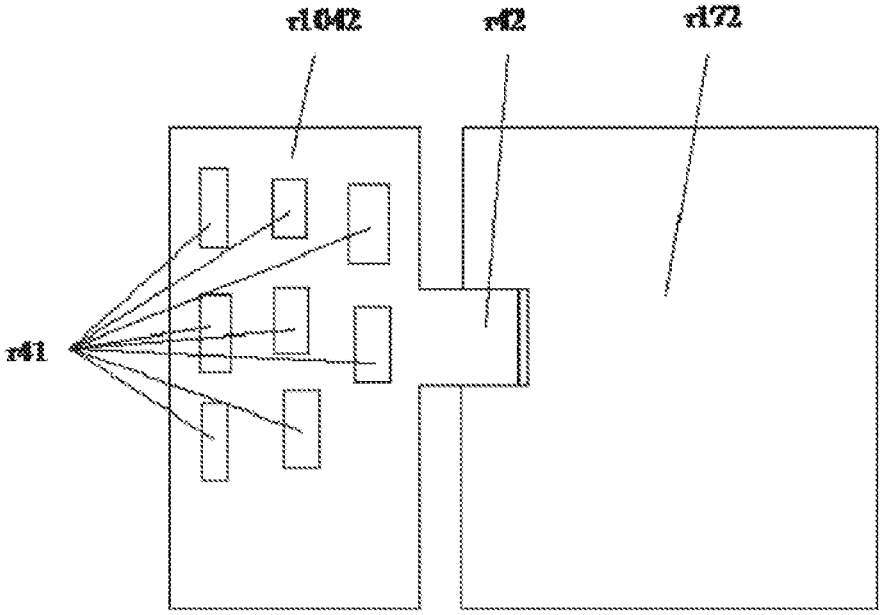
FIG. 59 is a structure diagram that a concentrator of a line concentration structure according to embodiment 4 of the disclosure is connected with an electrical box.

As a transformable embodiment, FIG. 59 illustrates another line concentration structure according to an embodiment of the disclosure. The difference between the line concentration structure of the present transformable embodiment and the concentrator of the embodiment is that a connecting manner for the concentrator and the electrical connector is different. In the transformable embodiment, the intermediate terminal block r42 is connected with the main board terminal block r1713 in the insertion manner. No flexible connecting wire is required by the main board and the patch panel on the concentrator, and the intermediate terminal block is directly connected with the main board terminal block in the electrical box in the insertion manner to implement rigid connection between the concentrator and the electrical box, so that connection reliability is ensured, and convenience is brought to assembling and disassembling. All of the load terminal blocks are integrated to the patch panel, and each load connecting wire is led from the concentrator to be connected with the corresponding load. During maintenance, the side plate assembly is disassembled at first to expose the electrical box, and then the electrical box is pulled out a little for maintenance.

Figure 60:
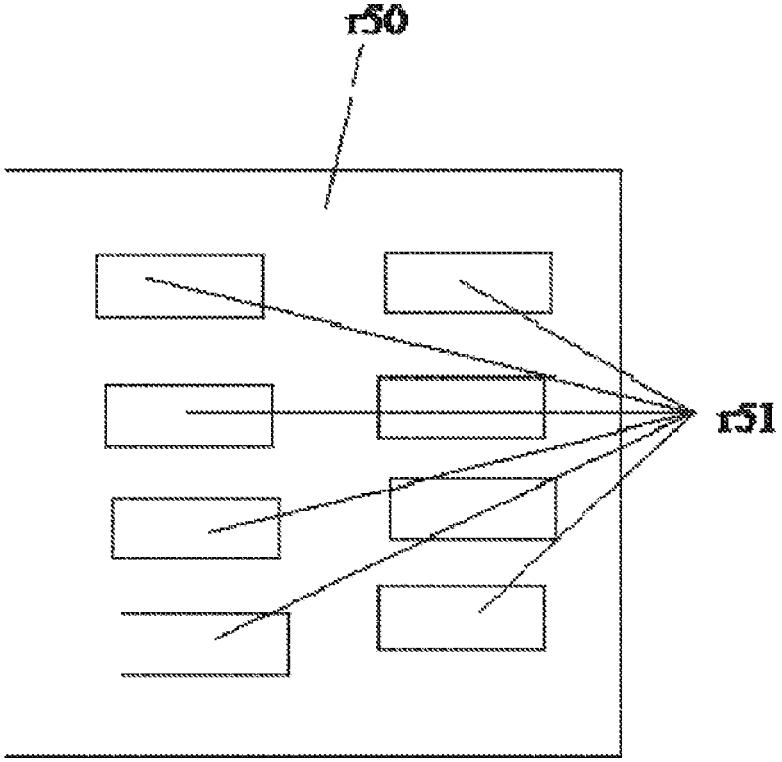
FIG. 60 is a structure diagram of a line concentration structure according to embodiment 5 of the disclosure.
Figure 61:
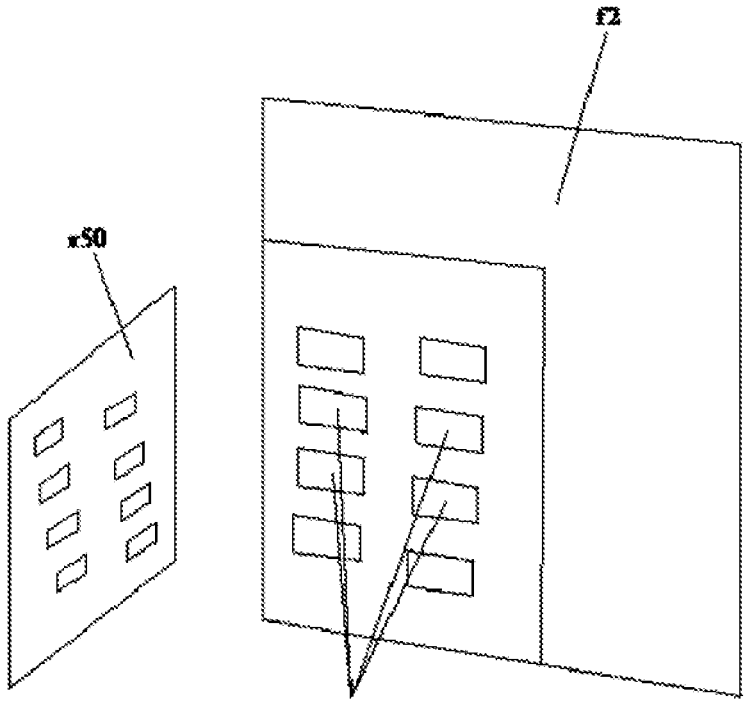
FIG. 61 is a structure diagram that the line concentration structure in FIG. 60 mates with a main board.

As a transformable embodiment, FIG. 60 and FIG. 61 illustrate a line concentration structure. The difference between the line concentration structure and the line concentration structure of the embodiment is that the connecting manner for the concentrator and the electrical box is different. In the transformable embodiment, the line concentration structure includes an injection molding part r50 and multiple load lines. The injection molding part r50 is configured to be fixed on the machine frame of the air conditioner, and multiple through holes r51 are formed in the injection molding part r50. The multiple load lines are arranged corresponding to the multiple through holes r51 one to one. A first end of each load line is connected with a load, and a second end of the load has an intermediate terminal block r42, and is fixed in the through hole r51. The main board terminal block r1713 is inserted into the through hole r51 to be connected with the intermediate terminal block r42 in the insertion manner. The injection molding part is designed with multiple square holes, and the square holes are configured to fix various load terminal blocks. In such a manner, all of the load terminal blocks are integrated to the injection molding part, the corresponding load terminal blocks on the main board are also integrated to a certain region and connected with the load terminal blocks on the injection molding part one to one in the insertion manner, so that connection reliability and convenience for assembling and disassembling are achieved. During maintenance, the side plate assembly is disassembled at first to expose the electrical box, and then the electrical box is pulled out a little for maintenance.

Figure 62:
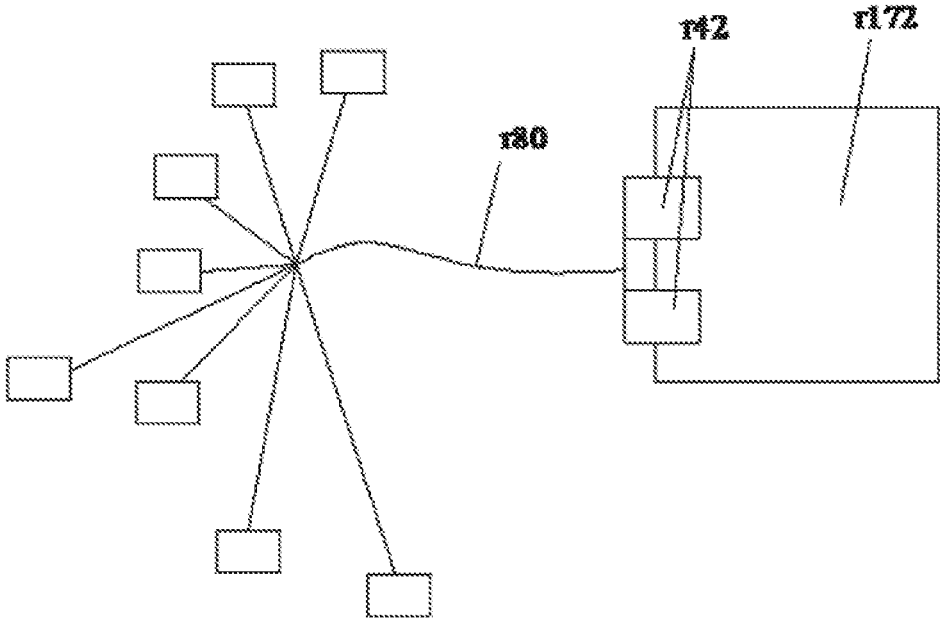
FIG. 62 is a structure diagram of a line concentration structure according to embodiment 6 of the disclosure.

As a transformable embodiment, FIG. 62 illustrates a line concentration structure. The difference between the transformable embodiment and the embodiment is that the connecting manner for the concentrator and the electrical box is different. In the transformable embodiment, the line concentration structure is a transition wire r80. A first end of the transition wire r80 has an intermediate terminal block r42, and the intermediate terminal block r42 is connected with the main board terminal block r1713 in the insertion manner. A second end of the transition wire r80 is divided into multiple strands of load lines, and end portions of the load lines are connected with loads. One end of the transition wire has two terminal blocks directly inserted with the electrical box, and the other end of the transition wire is divided into multiple strands of load lines directly connected with the loads respectively, so that connection reliability and convenience for assembling and disassembling are achieved. The first end of the transition wire has two terminal blocks, one being a high-voltage terminal block and the other being a low-voltage terminal block. Of course, the first end of the transition wire may also have three terminal blocks, two of them being low-voltage terminal blocks and the other being a high-voltage terminal block. Or, the first end of the transition wire may also have only one terminal block, namely the high-voltage terminal block and the low-voltage terminal block are integrated into one terminal block. Or the number of the terminal block of the first end of the transition wire is also not limited thereto, and may be set to be larger according to a requirement. The number of the transition wire is at least one, and the number of the transition wire is selected according to a requirement. The side plate assembly is disassembled at first to expose the electrical box, and then the electrical box is pulled out a little for maintenance.

The electrical box r172 is connected with multiple loads through a line concentration structure, the line concentration structure being the abovementioned line concentration structure. The load terminal blocks r41 connected with all of the loads are integrated to the concentrator r104, and the intermediate terminal block r42 on the concentrator r104 is detachably connected with the main board terminal block r1713 of the electrical box r172, so that the electrical box may be independently disassembled as a whole, higher modularization degree is achieved, and the air conditioner may be integrated and modularized. Therefore, on one hand, workloads in wire insertion and arrangement during production assembling are greatly reduced, and more standard wiring is ensured; and on the other hand, the after-sales maintenance worker may conveniently disassemble the electrical box for overhauling, and the problems of excessive loads connected in the electrical box and difficulties in assembling, disassembling and maintenance in the conventional art are effectively solved.

Later on, an arrangement manner for the terminal blocks of the line concentration structure in the base module of the embodiment of the disclosure will be elaborated according to the drawings.

Figure 68:
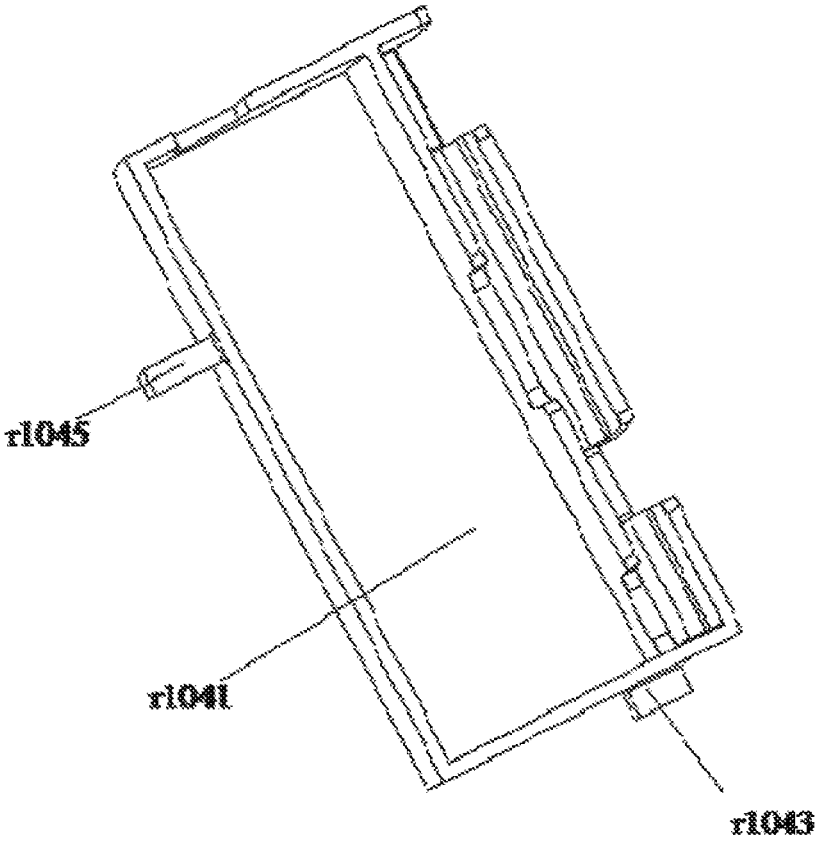
FIG. 68 is a three-dimensional structure diagram of a mounting matrix of a concentrator according to an embodiment of the disclosure.
Figure 71:
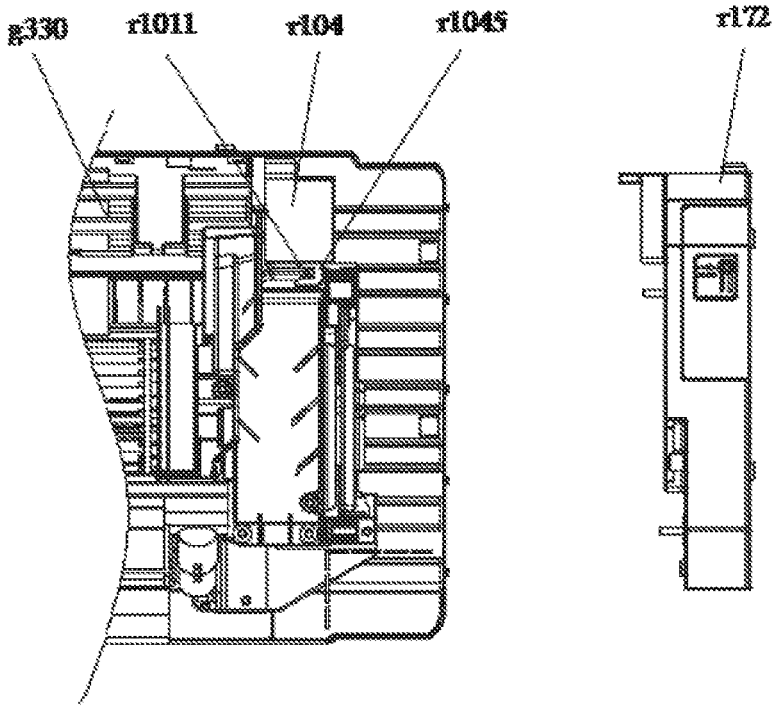
FIG. 71 is a structure diagram that the concentrator in FIG. 68 mates with a base part and an electrical box.
Figure 72:
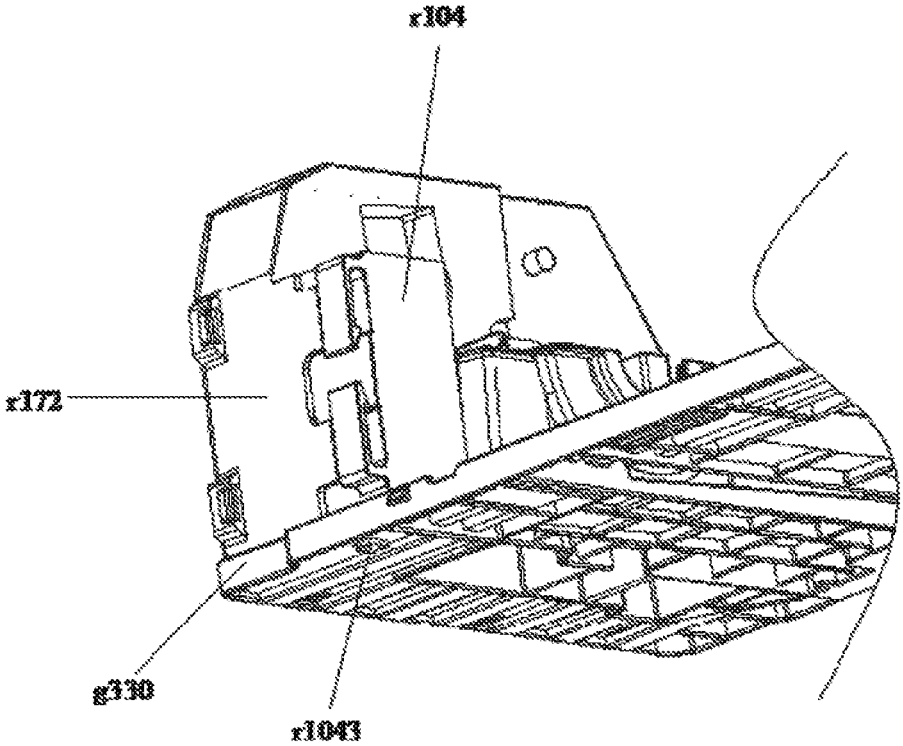
FIG. 72 is a structure diagram that the concentrator in FIG. 71 mates with the base part and the electrical box at another angle.

As shown in FIG. 68 and FIG. 71, the concentrator of the embodiment has a high-voltage terminal block group and low-voltage terminal block group that are arranged separately. The high-voltage terminal block group is configured to be connected with a high-voltage load and the main board f2 of the electrical box, and the low-voltage terminal block group is configured to be connected with a low-voltage load and the main board f2, to separate the high voltage from the low voltage.

The concentrator has the high-voltage terminal block group and low-voltage terminal block group that are arranged separately, so that the high-voltage terminal block group and the low-voltage terminal block group are independent, an anti-electromagnetic interference capability is enhanced, and Electro Magnetic Compatibility (emc) may be optimized.

The concentrator r104 includes a patch panel r1042, the high-voltage terminal block group and the low-voltage terminal block group are integrated to an insertion surface of the patch panel r1042, and the high-voltage terminal block group and the low-voltage terminal block group are close to an edge of the insertion surface on the insertion surface respectively. The patch panel is a carrier of the terminal blocks, and the terminal blocks may be conveniently fixed thereon.

The insertion surface is a rectangle. The high-voltage terminal block group is arranged at an included angle between a first side and second side, which are adjacent, of the rectangle, terminal blocks in the low-voltage terminal block group are distributed at edges of the first side and a third side, opposite to the first side, of the rectangle, and the terminal blocks, located at the edge of the first side, in the low-voltage terminal block group are arranged in sequence with the high-voltage terminal block group in an extension direction of the first side. The high-voltage terminal block group and low-voltage terminal block group on the patch panel are arranged in a relatively good state, so that an occupied space of the concentrator is minimized, optimal spatial arrangement is implemented, the structural size of the whole concentrator is optimized, and the space of the whole machine is occupied more effectively and reasonably. Meanwhile, connection between all of the loads and the electrical box is also facilitated, and convenience for insertion is ensured. Of course, the terminal blocks in the low-voltage terminal block group may also be distributed at edges and middle portions of a fourth side, opposite to the second side, and second side of the rectangle, and the terminal blocks, located at the edge of the second side, in the low-voltage terminal block group are arranged in sequence with the high-voltage terminal block group in an extension direction of the second side. From the above description, it can be seen that, when the high-voltage terminal block group is located at the included angle of the first side and second side which are adjacent, the terminal blocks in the low-voltage terminal block group may be distributed at the edges of the four sides, and the terminal blocks, located on the first side and the second side, in the low-voltage terminal block group are required to be arranged in sequence with the high-voltage terminal block group in the extension directions of the first side and the second side respectively.

The high-voltage terminal block group includes a high-voltage load terminal r11 and high-voltage intermediate terminal r12 which are spaced, the high-voltage load terminal r11 is configured to be connected with a high-voltage load, and the high-voltage intermediate terminal r12 is configured to be connected with the main board f2. The low-voltage terminal block group includes multiple low-voltage load terminals r21 and a low-voltage intermediate terminal r22, the low-voltage load terminals r21 are spaced from the low-voltage intermediate terminal r22, the low-voltage load terminal r21 is configured to be connected with a low-voltage load, and the low-voltage intermediate terminal r22 is configured to be connected with the main board f2.

The concentrator r104 further includes a high-voltage connecting wire r31 and a low-voltage connecting wire r32. One connecting terminal of the high-voltage connecting wire r31 is connected with the high-voltage intermediate terminal r12 in the insertion manner, and the other connecting terminal of the high-voltage connecting wire r31 is connected with a high-voltage terminal r1711 of the main board f2. One connecting terminal of the low-voltage connecting wire r32 is connected with the low-voltage intermediate terminal r22 in the insertion manner, and the other connecting terminal of the low-voltage connecting wire r32 is connected with a low-voltage terminal r1712 of the main board f2. The high-voltage terminal r1711 and low-voltage terminal r1712 on the main board f2 are arranged separately. The high-voltage terminal and low-voltage terminal on the main board of the electrical box are separated, the connecting wire connecting the electrical box and the concentrator is also divided into the high-voltage connecting wire and the low-voltage connecting wire, and the high-voltage connecting wire and the low-voltage connecting wire are inserted into the high-voltage and low-voltage terminals of the main board respectively and then connected with the high-voltage and low-voltage intermediate terminals on the concentrator, so that the high and low voltages may further be effectively separated, the anti-electromagnetic interference capability is enhanced, and the emc is optimized.

The high-voltage load terminal r11 is a motor terminal. The multiple low-voltage load terminals r12 include at least one of a display terminal, a wifi box terminal, an ambient temperature wrap terminal, a pipe temperature bulb terminal, a cold plasma terminal, a mosquito repeller terminal, a poking box terminal, an auxiliary electrical heating load terminal and a ground wire terminal.

Figure 65:
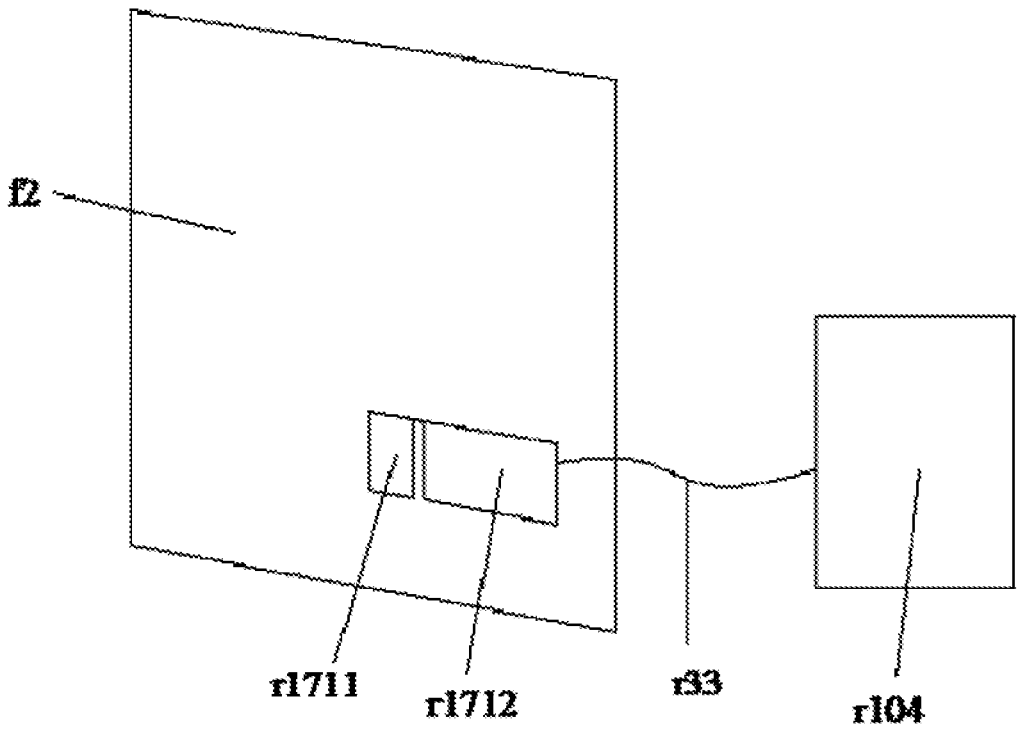
FIG. 65 is a schematic diagram that a concentrator according to embodiment 2 of the disclosure is connected with a main board of an electrical box.
Figure 66:
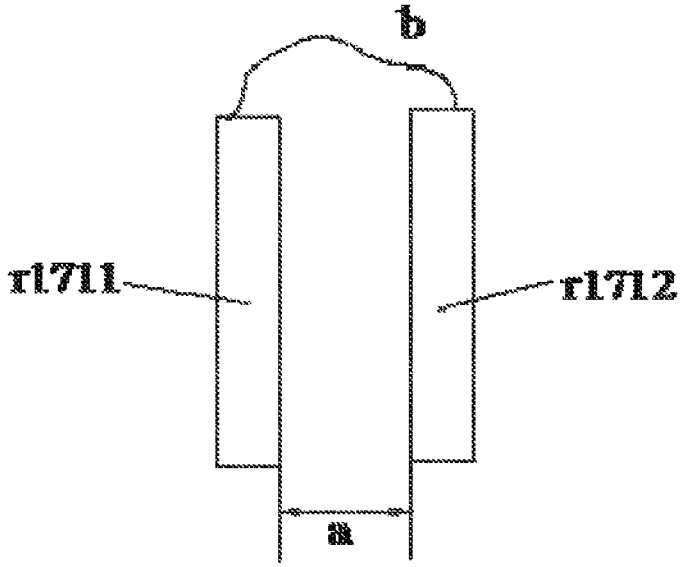
FIG. 66 is a schematic diagram of a high-voltage terminal and low-voltage terminal of the main board in FIG. 65.

As a transformable embodiment, FIG. 65 and FIG. 66 illustrate another line concentration structure of the disclosure. The difference between the line concentration structure and the abovementioned embodiment is a distance between the high-voltage intermediate terminal r12 and the low-voltage intermediate terminal r22. In the abovementioned embodiment, the distance between the high-voltage intermediate terminal r12 and the low-voltage intermediate terminal r22 is relatively long. While in the transformable embodiment, a safety distance between the high-voltage intermediate terminal r12 and the low-voltage intermediate terminal r22 is at least 3 mm, and in such case, a safety distance a between the high-voltage terminal r1711 and the low-voltage terminal r1712 is also at least 3 mm. Therefore, more terminal blocks may be arranged on the patch panel, and the size of the patch panel is also reduced.

In the transformable embodiment, the concentrator further includes a connecting wire r33. One connecting terminal of the connecting wire r33 is connected with the high-voltage intermediate terminal r12 and the low-voltage intermediate terminal r22 in the insertion manner, and the other connecting terminal of the connecting wire r33 is configured to be connected with the main board f2. That is, two ends of the connecting wire r33 are connected with the patch panel and the main board respectively. When the safety distance between the high-voltage and low-voltage terminals is sufficient, the high-voltage and low-voltage terminals may be arranged to share the same terminal block on the connecting wire, so that connecting wires may be saved, and cost may be reduced to a certain extent. The safety distance refers to a shortest distance between two wire parts or between a conductive part and an accessible surface of an appliance, and a creepage distance b refers to a shortest path measured along an insulating material surface between the two wire parts or between the conductive part and the accessible surface of the appliance.

In the transformable embodiment, the creepage distance b between the high-voltage intermediate terminal r12 and the low-voltage intermediate terminal r22 is at least 4 mm.

Figure 67:
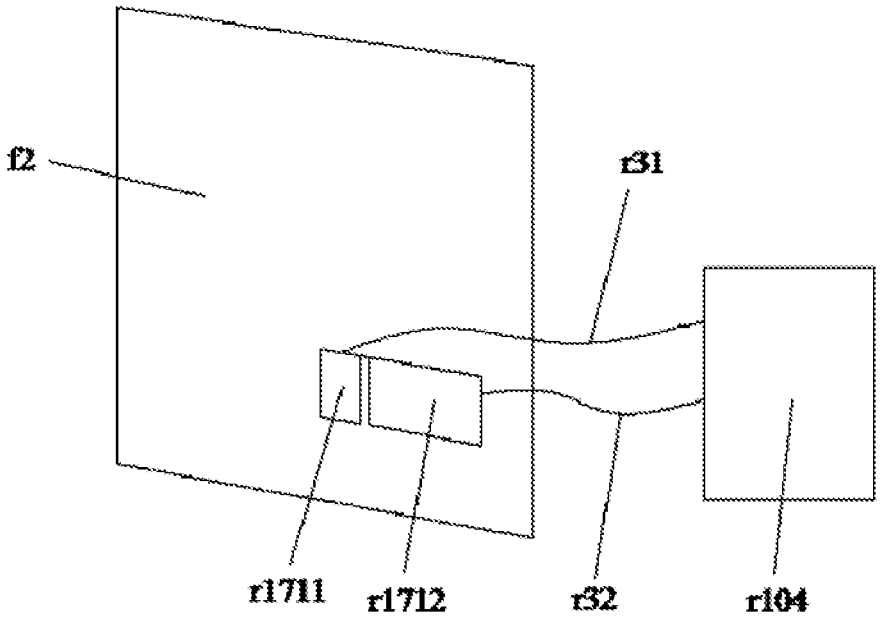
FIG. 67 is a schematic diagram that a concentrator according to embodiment 3 of the disclosure is connected with a main board of an electrical box.

As another transformable embodiment, FIG. 67 illustrates a concentrator structure. The difference between the concentrator structure and the concentrator structure of the abovementioned transformable embodiment is that the number of the connecting wire for the patch panel and the main board is different. In the first transformable embodiment, one connecting terminal of the connecting wire r33 is connected with the high-voltage intermediate terminal r12 and the low-voltage intermediate terminal r22 in the insertion manner, and the other connecting terminal of the connecting wire r33 is configured to be connected with the main board f2, that is, the patch panel is connected with the main board through one connecting wire. While in the transformable embodiment, the patch panel is connected with the main board through two connecting wires. Specifically, the concentrator further includes a high-voltage connecting wire r31 and a low-voltage connecting wire r32. One connecting terminal of the high-voltage connecting wire r31 is connected with the high-voltage intermediate terminal r12 in the insertion manner, and the other connecting terminal of the high-voltage connecting wire r31 is connected with the high-voltage terminal r1711 of the main board f2. One connecting terminal of the low-voltage connecting wire r32 is connected with the low-voltage intermediate terminal r22 in the insertion manner, and the other connecting terminal of the low-voltage connecting wire r32 is connected with the low-voltage terminal r1712 of the main board f2.

As a transformation, the arrangement manner for the high-voltage terminal blocks and the low-voltage terminal blocks may also be as follows: the high-voltage terminal block group is arranged at the edge of one side of the rectangle and the terminal blocks in the low-voltage terminal block group are distributed at the edge of at least one of the other three sides of the rectangle, or, the high-voltage terminal block group is arranged at the edge of one side of the rectangle and the terminal blocks in the low-voltage terminal block group are distributed at the edge and middle portion of one side of the other three sides of the rectangle. Of course, the arrangement manner for the high-voltage terminal block group and the low-voltage terminal block group is also not limited thereto if the high and low voltages may be separated in this arrangement manner.

Then, a mounting manner for the concentrator in the base module of the embodiment of the disclosure will be elaborated according to the drawings.

Figure 63:
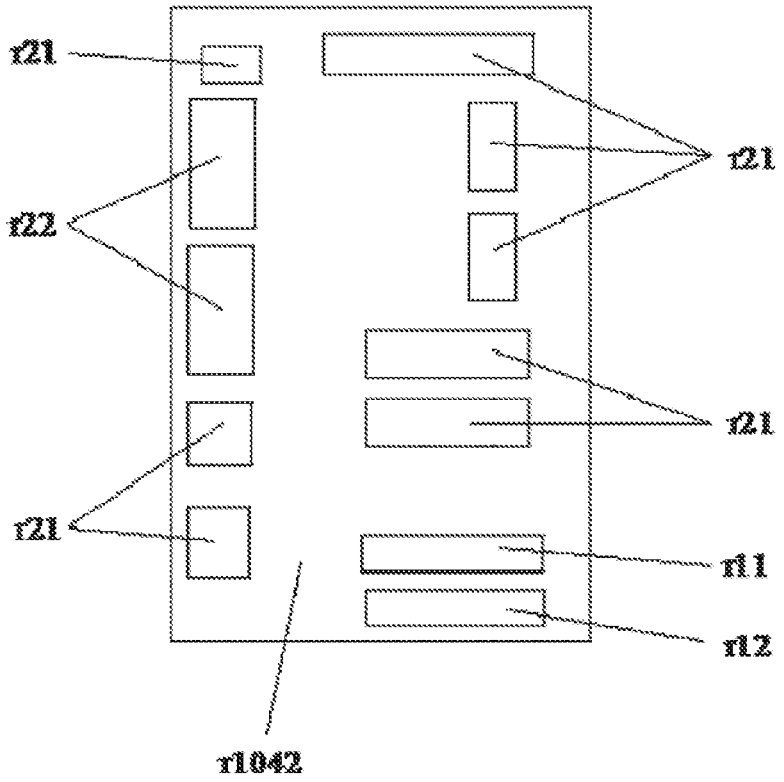
FIG. 63 is a structure diagram of a patch panel of a concentrator according to embodiment 1 of the disclosure.
Figure 64:
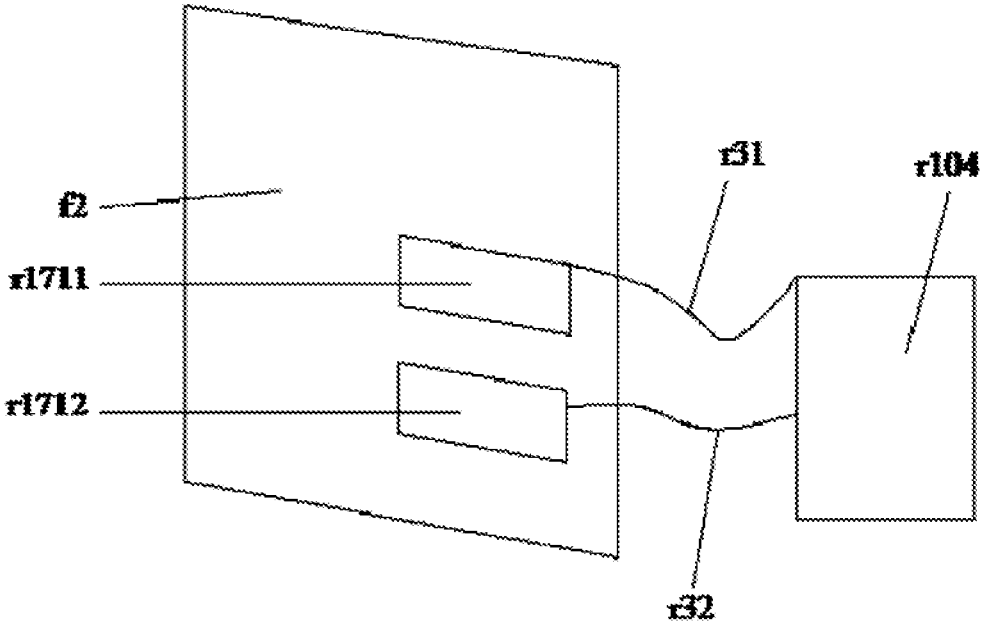
FIG. 64 is a schematic diagram that the concentrator in FIG. 63 is connected with a main board of an electrical box.

As shown in FIG. 63 and FIG. 66, the concentrator of the embodiment has multiple terminal blocks connected with multiple loads in a one-to-one correspondence manner, the concentrator has at least one mounting portion, the mounting portion is configured to be fixed on the machine frame of the air conditioner, and the concentrator is configured to be detachably connected with the electrical box r172 to integrate the multiple terminal blocks connected with the multiple loads to the concentrator to facilitate independent disassembling of the electrical box r172.

With application of the concentrator of the embodiment, the terminal blocks connected with all of the loads are integrated to the concentrator r104, the concentrator r104 is fixed on the machine frame of the air conditioner, and the concentrator r104 is detachably connected with the electrical box r172, so that the electrical box r172 may be independently disassembled as a whole, higher modularization degree is achieved, and the air conditioner may be integrated and modularized. Therefore, on one hand, workloads in wire insertion and arrangement during production assembling are greatly reduced, and more standard wiring is ensured; and on the other hand, the after-sales maintenance worker may conveniently disassemble the electrical box r172 for overhauling, and the problems of excessive loads connected in the electrical box r172 and difficulties in assembling, disassembling and maintenance in the conventional art are effectively solved. Moreover, the concentrator r104 is mounted on the machine frame of the air conditioner through at least one mounting portion, so that the concentrator r104 may be mounted conveniently, and the assembling efficiency is improved.

In the embodiment, as shown in FIG. 68, FIG. 69, FIG. 71 and FIG. 72, the number of the mounting portion is two, the two mounting portions being a buckle r1043 and a screw hole r1044 respectively, a limiting hole that the buckle r1043 is inserted into is formed in the machine frame, and a stud r1011 or threaded hole mating with the screw hole r1044 is arranged on the machine frame. That is, the concentrator r104 is inserted into a mounting hole in the machine frame through the buckle r1043, and a screw penetrates through the screw hole r1044 to mate with the stud r1011 or the threaded hole, so that firmer and more reliable connection is ensured, the space occupation rate is maximally reduced, and the assembling efficiency is improved. Of course, the concentrator r104 may also be fixed on the machine frame through two screws, and in such case, two studs or threaded holes corresponding to the two screw holes one to one are arranged on the machine frame. Or, the concentrator r104 may also be fixed on the machine frame only through the buckle r1043 in the interference fit manner.

Figure 70:
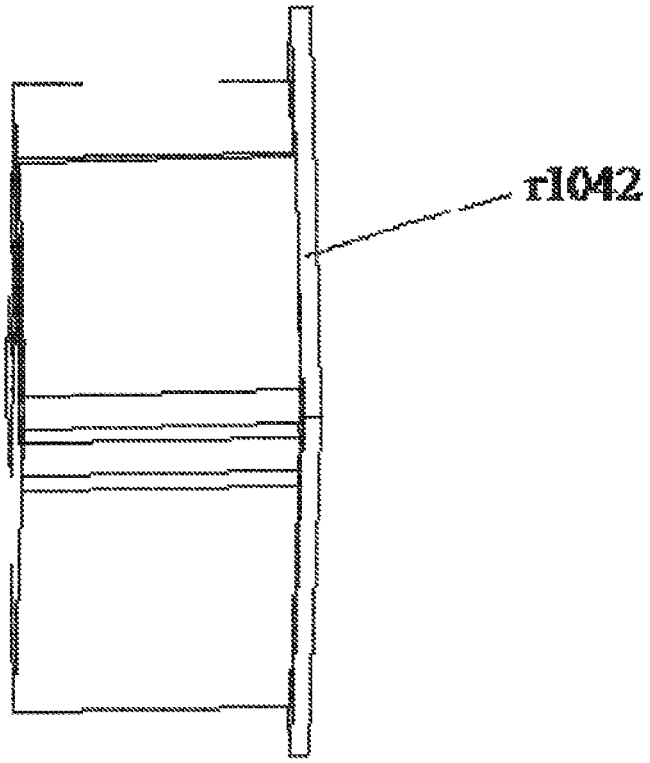
FIG. 70 is a structure diagram of a patch panel of the concentrator in FIG. 68.

In the embodiment, as shown in FIG. 68 and FIG. 70, the concentrator has a mounting matrix r1041 and a patch panel r1042, the patch panel r1042 is formed with a terminal block, and the buckle r1043 and the screw hole r1044 are formed on the mounting matrix r1041. The terminal block may be conveniently fixed on the patch panel r1042, the patch panel r1042 may be conveniently mounted and fixed through the mounting matrix r1041, and the concentrator r104 may also be conveniently fixed on the machine frame through the mounting matrix r1041, so that convenience for fixation is ensured.

In the embodiment, as shown in FIG. 68, a protruding column that protrudes outwards is arranged on the outer bottom wall of the mounting matrix r1041, and the protruding column forms the buckle r1043. The protruding column is simple in structure and convenient to manufacture. When the concentrator is fixed on the machine frame through the screw hole and the protruding column, the protruding column may form interference fit or clearance fit with the limiting hole; and when the concentrator is fixed on the machine frame through the protruding column, the protruding column forms interference fit with the limiting hole.

Figure 69:
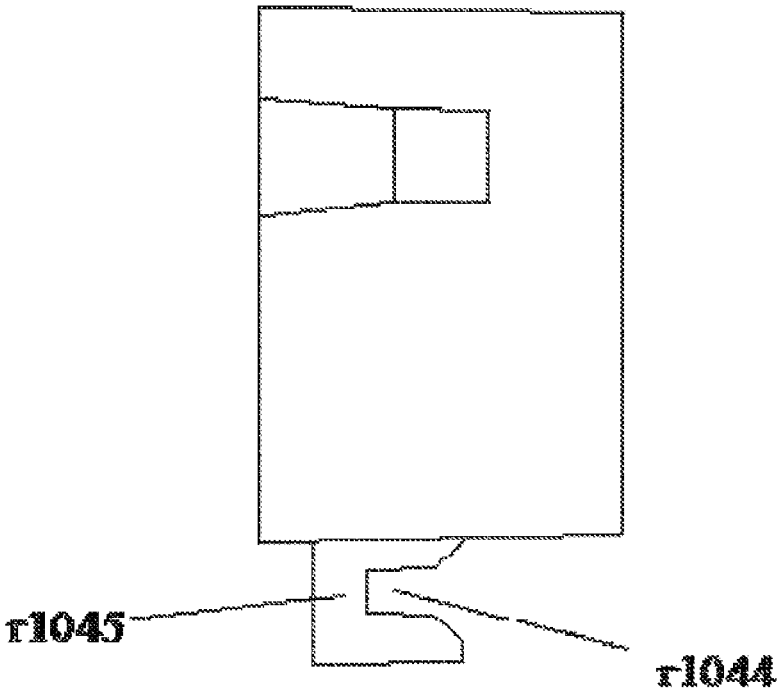
FIG. 69 is a side view of the mounting matrix in FIG. 68.

In the embodiment, as shown in FIG. 69, a mounting lug r1045 that extends outwards is arranged on the outer sidewall of the mounting matrix r1041, and the screw hole r1044 is formed in the mounting lug r1045. The mounting lug r1045 that extends outwards is arranged on the outer sidewall of the mounting matrix r1041, and the screw hole r1044 is formed in the mounting lug r1045, so that convenience is brought to operation of a mechanical hand, and the structure of the concentrator is simplified. The screw hole is preferably a notch, and of course, the screw hole may also be a round hole.

In the embodiment, the machine frame is the base part g330, the panel, the panel body, the electrical box r172 or the motor pressure plate. The mounting position of the concentrator is preferably on the base part g330. Of course, the concentrator may also be placed on the panel body, the panel, the bottom of the electrical box and the motor pressure plate or embedded into the electrical box.

In the embodiment, the multiple loads include the display, the motor, the wifi box, the ambient temperature wrap, the pipe temperature bulb, the cold plasma, the mosquito repeller, the poking box and the like.

The electrical wires connecting each load, such as an electrical component like the display, the motor, the wifi box and the cold plasma, in the indoor unit are fixedly arranged on the base part g330 through the wiring slot fixedly formed in the base part g330. The other end of each electrical wire is connected to the terminal block on the patch panel. A terminal block connected with the main board of the electrical box is further arranged on the patch panel.

In the embodiment, the electrical box r172 is connected with the concentrator in the pluggable electrical connection manner. When maintenance is required, the side plate assembly of the air conditioner is disassembled at first, and then the electrical box is pulled out, so that the electrical box is conveniently disassembled.

Figure 35:
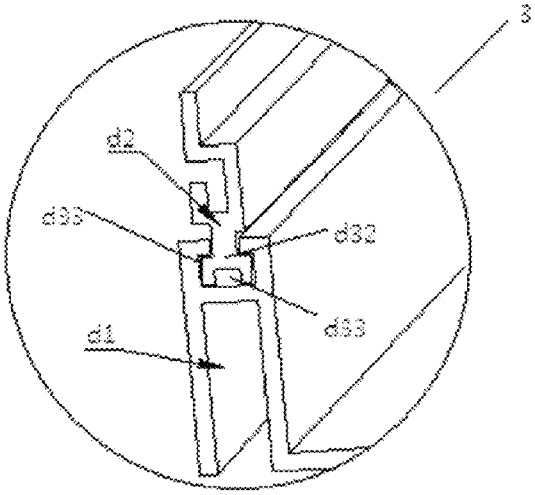
FIG. 35 is a structure diagram of a sliding rail of an air conditioner frame structure according to the disclosure.

As an extended embodiment of the disclosure, as shown in FIGS. 35 to 2-30, an air conditioner frame structure includes a back plate d1 of a base and two side mounting frames d2.

Figure 36:
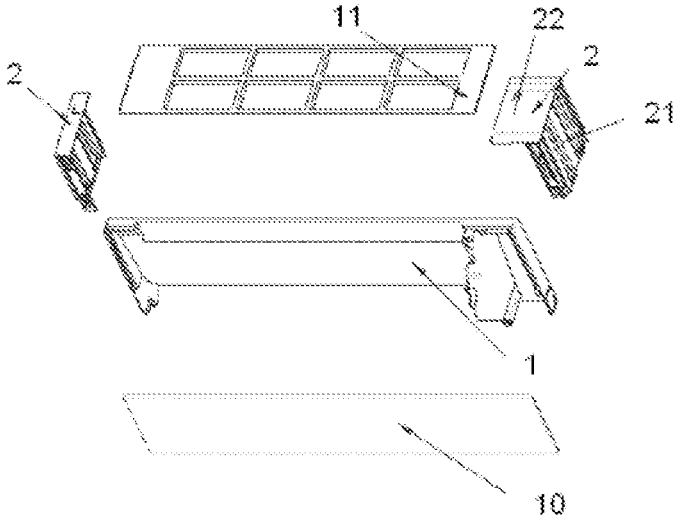
FIG. 36 is an exploded view of an air conditioner frame structure, a panel and a filter screen according to the disclosure.

One side mounting frame d2 is arranged at one end of the back plate d1 of the base in a length direction, and the other side mounting frame d2 is arranged at the other end of the back plate d1 of the base in the length direction. The side mounting frames d2 and the back plate d1 of the base are mounted in a drawable mating manner through a sliding rail structure d3 that extending in a vertical direction. The sliding rail structure d3 includes a guide rail d31 arranged on the side mounting frames d2 and a guide groove d32 arranged on the back plate of the base part, as shown in FIG. 36. Screw-free assembling is implemented, simple structure and convenience for disassembling are achieved, and assembling and disassembling efficiency is further improved. The guide rail d31 is arranged close to a side end of the back plate d1 of the base along the side mounting frames d2, and the guide groove d32 of the back plate d1 of the base is arranged at a position, corresponding to side ends of the side mounting frames d2, of the back plate d1 of the base. A cross section of the guide rail d31 is shaped like a Chinese character "Tu", a cross section of the guide rail d32, adapted thereto, is also shaped like the Chinese character "Tu", and the guide rail d31 shaped like the Chinese character "Tu" mates with the guide groove d32 shaped like the Chinese character "Tu" to form a limiting surface d33 that prevents the side mounting frames d2 from being separated from a direction perpendicular to the back plate d1 of the base, as shown in FIG. 36.

The side mounting frames d2 are inserted into the back plate d1 of the base from top to bottom for assembling through the sliding rail structure d3, and after assembling, the two side mounting frames d2 and the back plate d1 of the base form a basic frame configured to mount air conditioner panels d10, a filter screen d11 and an air outlet frame part. Specifically, the side, facing a user, of a front lateral surface of the basic frame is configured to mount a front panel d10, an upper side of the basic frame is configured to detachably mount the filter screen d11, an axial outer side of the basic frame is configured to detachably mount a side panel d10, and a bottom of the basic frame is configured to detachably mount an air outlet frame part, as shown in FIG. 35 and FIG. 36. The side mounting frames d2 are mounted at the back plate d1 of the base, the side mounting frame d2 has a mounting portion for the side panel d10, and the mounting portion for the side panel d10 is detachably connected with the corresponding side panel d10 through a buckle structure. In the embodiment, structures such as the air conditioner panels d10, the filter screen d11 and the air outlet frame part may be disassembled from the side mounting frames d2 to clean each component only by lightly pushing the side mounting frames d2 upwards. After the components such as the panel d10 and the air outlet frame part are disassembled from the mounting frames, a heat exchanger part mounted in the basic frame may also be exposed, so that the heat exchanger part may be conveniently disassembled and cleaned. In addition, with adoption of such a frame structural form that the back plate d1 of the base mates with the two mounting frames, a size of the back plate d1 of the base in a width direction may be reduced to a certain extent, so that a size of a component of the back plate d1 of the base is reduced. Also, an overall size of a mold is reduced, and cost of the mold is reduced. Meanwhile, using the mounting frames reduces protruding structures on the component of the back plate d1 of the base, and avoids the phenomenon in a transportation swaying process of an air conditioner that the protruding structures on the component of the back plate d1 of the base collide with adjacent components to cause structural damages to the air conditioner and a failure of the air conditioner.

At least one side mounting frame d2 in the two side mounting frames d2 is a frame consisting of a vertical plate d21 and a transverse plate d22, and the transverse plate d22 is arranged at a top of the vertical plate d21 and extends towards an inner side of the back plate d1 of the base in a horizontal direction as a filter screen d11 support surface that supports the filter screen d11.

For ensuring firmness of the assembled basic frame structure, in the abovementioned embodiment, the side mounting frames d2 are fixed with the back plate d1 of the base through the buckle structure.

In the abovementioned embodiment, arrangement positions of the guide rail d31 and the guide groove d32 may be substituted in a manner that the guide groove d32 is arranged at side ends of the side mounting frames d2 and the guide rail d31 is arranged at a position, corresponding to the side ends of the side mounting frames d2, of the back plate d1 of the base.

In the abovementioned embodiment, the guide groove d32 shaped like the Chinese character "Tu" and the guide rail d31 shaped like the Chinese character "Tu" may be substituted into a cylindrical guide groove d32 and a cylindrical guide rail d31 or substituted with a rectangular guide groove d32 and a rectangular guide rail d31, and at least one limiting bump that mates with the rectangular guide rail d31 to prevent the rectangular guide rail d31 from being separated from the rectangular guide groove d32 is arranged at the edge, far away from a slot bottom, of the rectangular slot d32. Shapes of the guide groove d32 and the guide rail d31 are not specifically limited in the disclosure.

In the disclosure, a mounting manner of insertion from top to bottom through the guide rail d31 is preferably adopted for the side mounting frames d2 and the back plate d1 of the base. A mounting position of the air conditioner is relatively high, so that the abovementioned embodiment may be substituted in a manner that an insertion direction of the side mounting frames d2 relative to the back plate d1 of the base is insertion from the top or insertion from the bottom or insertion from a front end or insertion from an axial outer side of the back plate d1 of the base in the length direction. It is to be noted that, when the side mounting frames d2 include the transverse plates d22, insertion into the back plate d1 of the base from the bottom may be subjected to interference of a component on the inner side of the back plate d1 of the base and thus a mounting manner of insertion from the bottom may not be adopted.

Figure 37:
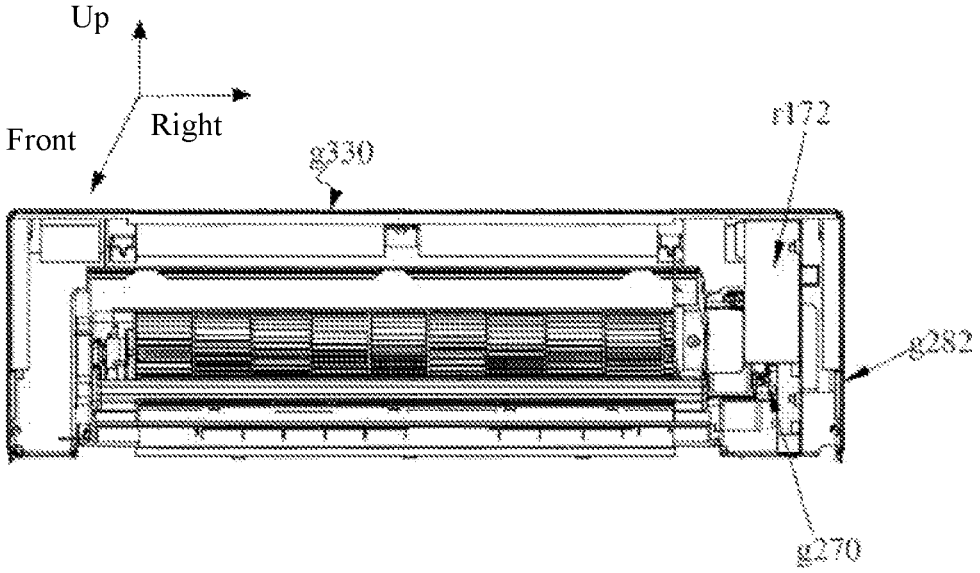
FIG. 37 is a schematic diagram of a mounting structure of an air conditioner according to an embodiment of the disclosure.
Figure 38:
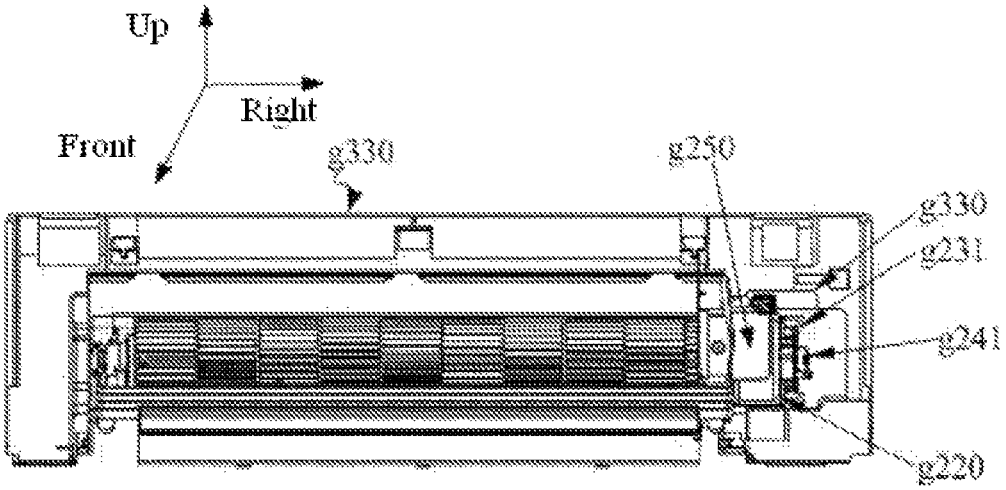
FIG. 38 is a structure diagram of a motor mounting structure in the mounting structure of the air conditioner in FIG. 37.

As an extended embodiment of the disclosure, as shown in FIG. 37 and FIG. 38, for the problem that it is inconvenient to disassemble a motor assembly in an existing air conditioner for after-sales maintenance, an embodiment of the disclosure provides a motor mounting structure for an air conditioner, which includes a motor assembly. The motor assembly includes a motor stand g210 arranged on a base part g330 and a motor g220 mounted on the motor stand g210. A mating structure drawably mating with the base part g330 is arranged on the motor stand g210, and the motor stand g210 is drawably mounted at the base part g330 through the mating structure. In such a manner, the motor stand g210 in the motor assembly of the motor mounting structure may be drawably assembled and disassembled relative to the base part g330, and when the motor assembly in the air conditioner requires after-sales maintenance, the motor assembly at a working position is only required to be drawn out of the air conditioner for disassembling after a right side plate g282 is disassembled, and the motor assembly is not required to be disassembled in the air conditioner, so that difficulties in after-sales maintenance of the motor assembly in the air conditioner are reduced, and after-sales maintenance cost is reduced.

The motor mounting structure in the embodiment is more specifically applied to an air conditioner of which a motor shaft and a driven part may be quickly disassembled, for example, an air conditioner of which a motor shaft and a fan blade shaft are quickly connected and disassembled through a helical clamping claw and a helical clamping groove. Since the motor shaft and fan blade shaft in the motor assembly may be separated without screwing when the motor stops working, the motor stand g210 may drawably mate with the stand part g330 in a rail form, and during after-sales maintenance of the motor g220, the motor g220 may be reliably separated from a fan blade through a quick release structure only by sliding the motor stand g210 out along a sliding rail g211. Therefore, the purpose of conveniently assembling and quickly maintaining the motor g220 is achieved.

Specifically, a mating structure in the embodiment of the disclosure is a sliding chute g231, and the sliding rail g211 mating with the sliding chute g231 is arranged on the base part g330, so that the structure for implementing drawable mating of the motor stand g210 and the base part g330 is simple. The sliding chute g231 is preferably formed integrally with the motor stand g210, and the sliding chute g211 is preferably formed integrally with the base part g330. It can be understood that the mating structure may also be the sliding rail (not shown in the figures), and the sliding chute mating with the sliding rail is arranged on the base. In the abovementioned manners, drawable disassembling of the motor assembly on the base may be implemented.

Figure 39:
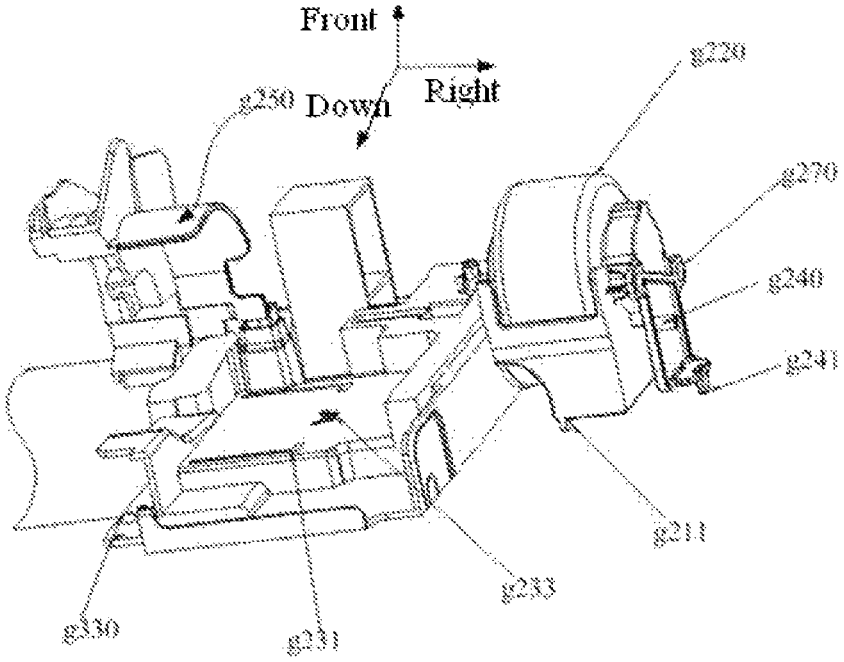
FIG. 39 is a structure diagram of another motor mounting structure in the mounting structure of the air conditioner in FIG. 37.

Preferably, as shown in FIG. 39, a section of the sliding rail g211 is I-shaped and a section of the sliding chute g231 is inverted I-shaped, so that the sliding rail g211 may be meshed with the sliding chute g231 to realize a limiting function.

As shown in FIG. 38, in the embodiment, the sliding rail g211 and the sliding chute g231 extend in a length direction of the air conditioner, and extension directions of the sliding rail g211 and the sliding chute g231 may specifically be determined according to an arrangement position and manner of the motor g220.

Preferably, the motor mounting structure for the air conditioner in the embodiment further includes a locking mechanism configured to lock the motor g220 at the working position and the motor stand g210 on the base part g330, so that positional stability of the motor g220 in a working state, for example, the motor g220 in a working process of poking a fan blade to rotate, may be ensured, and stability of the motor g220 in an operation process is improved.

Figure 40:
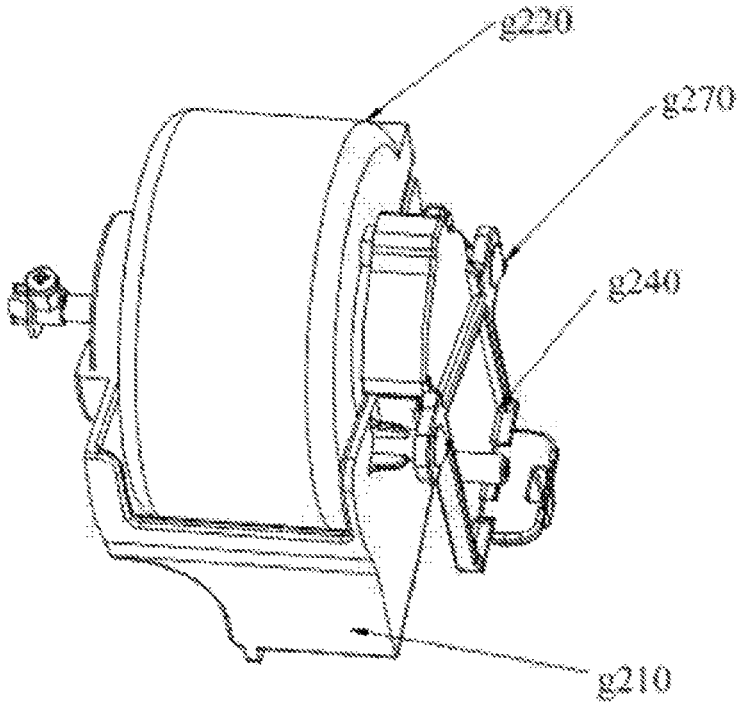
FIG. 40 is a structure diagram of a motor assembly in the mounting structure of the air conditioner in FIG. 37.

Furthermore, referring to FIG. 39 and FIG. 40, the locking mechanism in the embodiment specifically includes a motor end cover. One end of the motor end cover is fixedly connected with the motor assembly, while the other end is clamped with the base part g330. The motor end cover is configured to limit the motor assembly in the length direction (left-right direction in the figures) of the air conditioner. More specifically, a mounting hole is formed in the motor end cover, a mating hole mating with the mounting hole is correspondingly formed in the motor assembly, a screw g270 penetrates through the mounting hole and the mating hole to connect the motor end cover with the motor assembly, an end cover buckle g241 is formed on the motor end cover, and a clamping groove g233 mating with the end cover buckle g241 is formed in the base part g330.

In the embodiment, the locking mechanism further includes a motor pressure plate g250 arranged at the end, far away from the motor end cover, of the motor assembly, and the motor pressure plate g250 mates with the motor g220 to limit the motor assembly in a front-back direction of the air conditioner, namely implementing limiting in a normal direction of a base shell of the air conditioner.

Maintenance and serving work of the air conditioner with the motor mounting structure of the embodiment will be described below in combination with FIG. 37 to FIG. 40. The right side plate g282 in the air conditioner is manually slid out at first. In the embodiment, an electrical box r172 and the base part g330 are assembled in a guide rail form, the screw g270 for fixing the electrical box r172 is disassembled at first and then the electrical box r172 is manually pulled to slide till sliding out in an extension direction of the guide rail. Then, the screw g270 of the motor end cover is disassembled, the motor end cover is disassembled, and in such case, the motor g220 and the motor stand g210 may be manually pulled out in the extension direction of the rail to complete disassembling work. By the above operating flow, the motor g220 may be safely and reliably separated from the fan blade, and the motor g220 is pulled out and exposed to achieve the purpose of quickly maintaining and servicing the motor g220. According to reverse operations of the flow, assembling after maintenance is completed to achieve the purpose of conveniently assembling and quickly maintaining the motor g220.

As a transformable embodiment, the locking mechanism is formed integrally with the base. Specifically, the locking mechanism may be an elastic end cover buckle formed integrally with the base, and a clamping groove adapted to the elastic end cover buckle is correspondingly arranged on the motor assembly. The clamping groove may specifically be arranged on the motor stand. When the motor assembly is at the working position, the elastic end cover buckle mates with the clamping groove to lock the motor assembly on the base to ensure stability of the motor at the working position.

Moreover, a specific solution of disassembling the electrical box of the air conditioner of the embodiment of the disclosure from one side of the base part will be elaborated according to the drawings.

Figure 16:
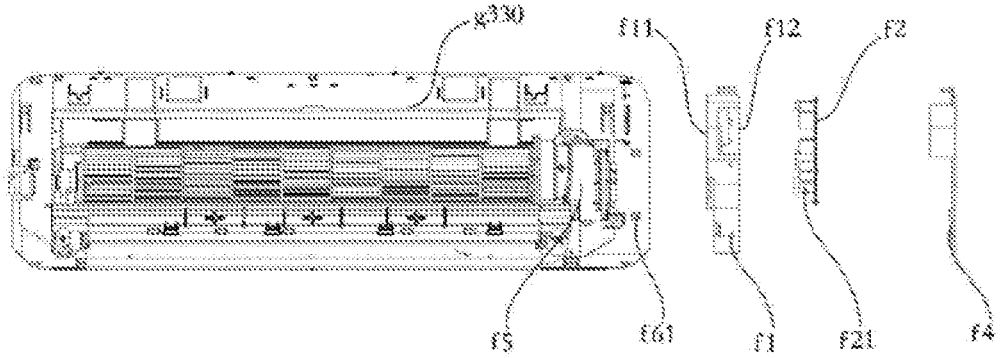
FIG. 16 is an assembling schematic diagram of an electrical box and a base part according to an embodiment of the disclosure.
Figure 17:
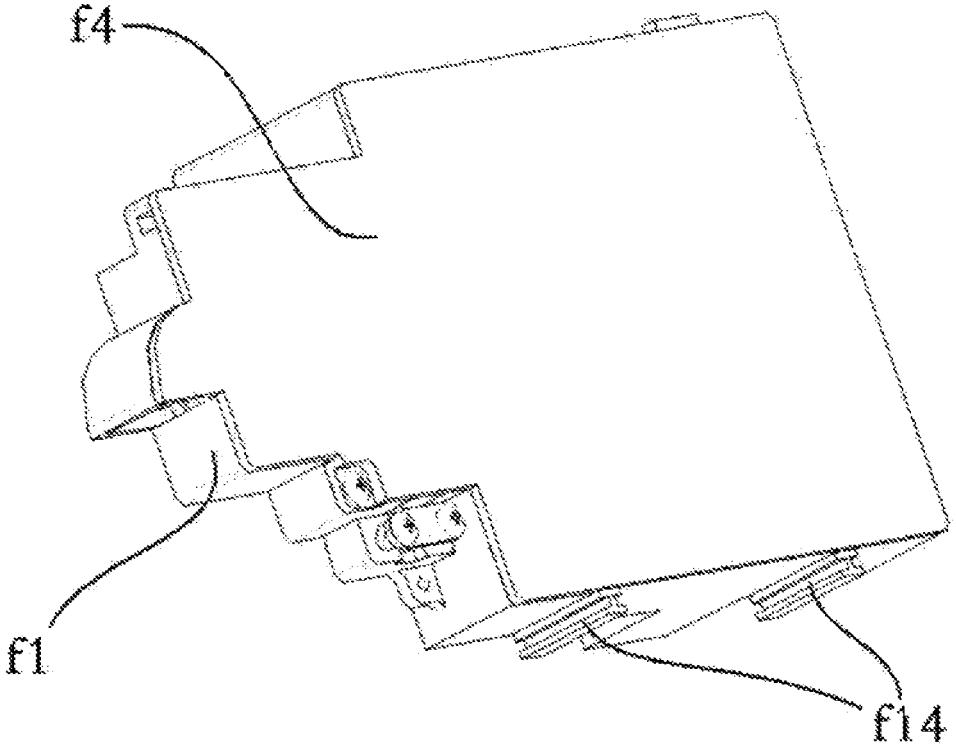
FIG. 17 is a three-dimensional view of the electrical box in FIG. 16.
Figure 18:
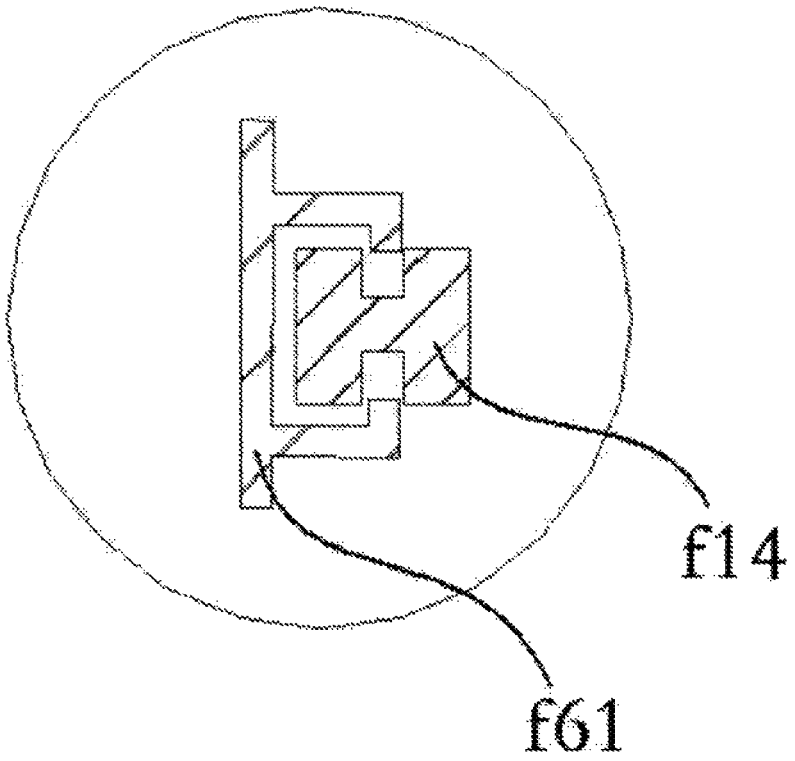
FIG. 18 is a mating sectional view of a sliding structure and guide rail structure in FIG. 16.
Figure 19:
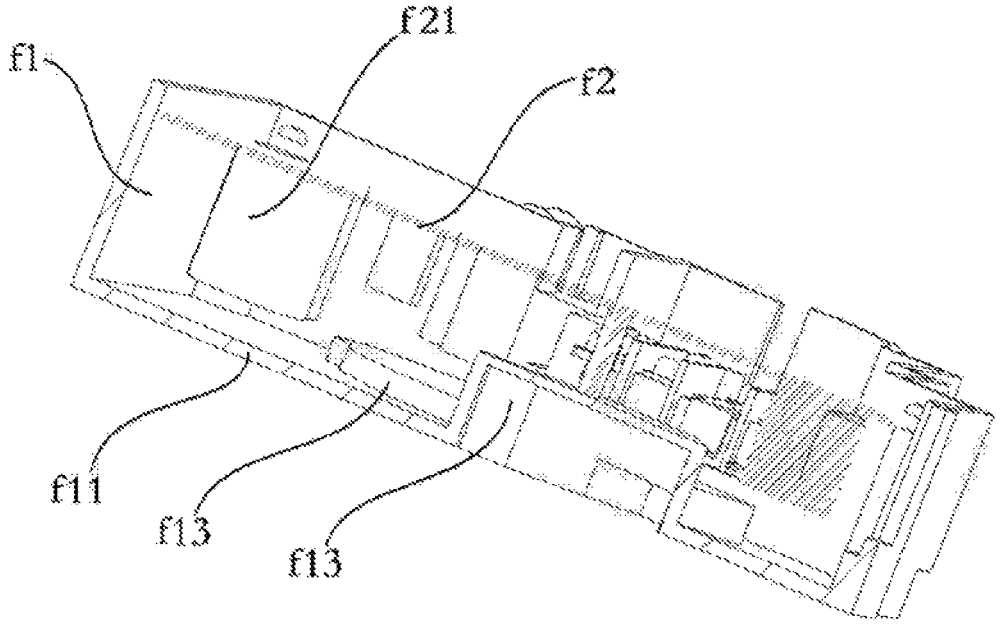
FIG. 19 is a sectional view of the electrical box in FIG. 18.
Figure 20:
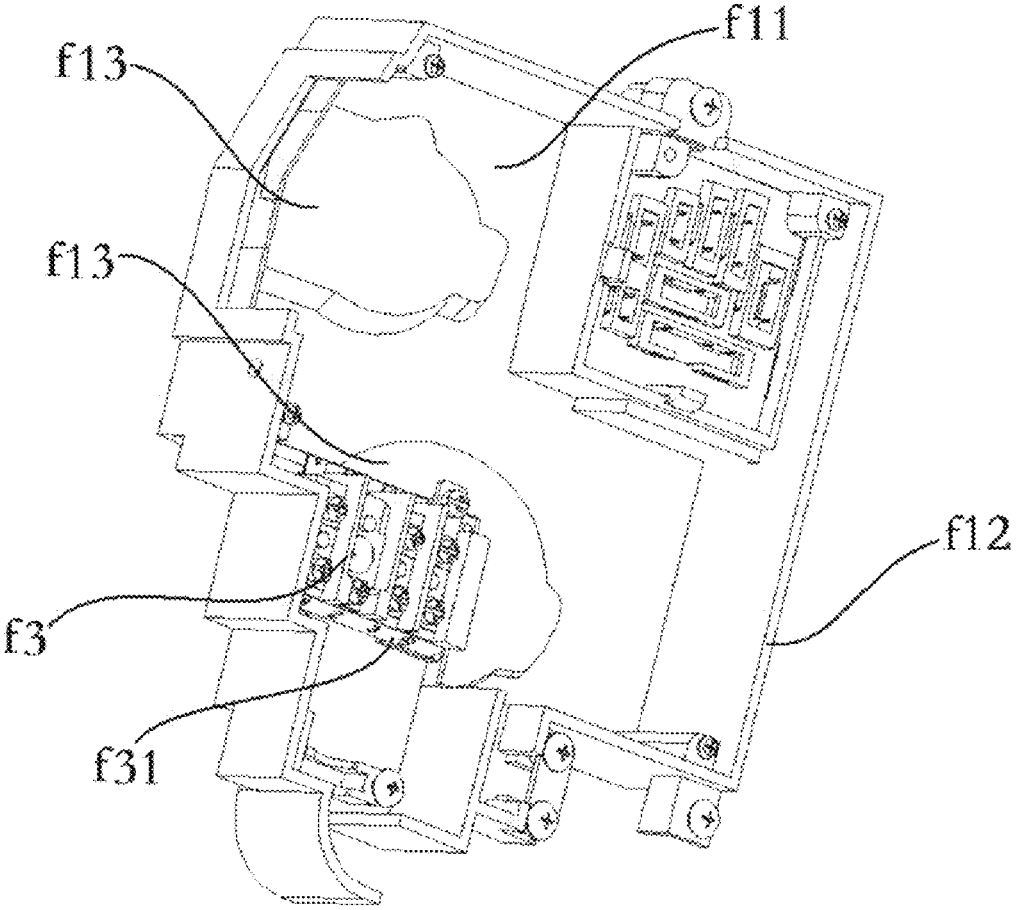
FIG. 20 is an internal structure diagram of a box body of the electrical box in FIG. 18.

As an extended embodiment of the disclosure, FIG. 16 is an assembling schematic diagram of an electrical box and a base according to an embodiment of the disclosure. FIG. 17 is a three-dimensional view of the electrical box in FIG. 16. FIG. 18 is a mating sectional view of a sliding structure and guide rail structure in FIG. 16. FIG. 19 is a sectional view of the electrical box in FIG. 18. FIG. 20 is an internal structure diagram of a box body of the electrical box in FIG. 18.

As shown in FIG. 16 to FIG. 20, the embodiment provides an electrical box for an air conditioner, which is an electrical box for an air conditioner indoor unit and includes a box body f1. A sliding structure f14 in sliding fit with a base part g330 of the air conditioner is arranged on the box body f1. The box body f1 may be pulled out of or pushed into the base part g330 through the sliding structure f14. The sliding structure f14 includes two slide blocks arranged in parallel on the side, facing the base part g330, of the box body f1. The slide block is transverse H-shaped. A guide rail structure f61 is arranged on the base part g330, and the guide rail structure f61 includes two sliding chutes corresponding to the two slide blocks. Bottoms of the transverse H-shaped slide blocks are suitable to be inserted into the sliding chutes, and openings of the sliding chutes are adapted to vertical portions of the transverse H-shaped slide blocks, so that the openings of the sliding chutes may limit the bottoms of the transverse H-shaped slide blocks to prevent the slide blocks from being separated from the sliding chutes. Quick and convenient assembling and disassembling is ensured, the phenomenon that small components such as screws are repeatedly assembled and disassembled and thus probably lost is avoided, mounting and maintenance of the electrical box are simplified, and improvement of overhauling efficiency is facilitated.

A fixing structure in immovable fit with the base part g330 is further arranged on the box body f1. The fixing structure includes a screw hole formed in the box body f1, and another screw hole is correspondingly formed in the base part g330. After the box body f1 is pushed to a specified position of the base part g330, the two screw holes are overlapped, and a screw may be tightened to fix a position of the box body f1 to prevent the electrical box from being loosened in a long-term use or transportation process and achieve higher safety and reliability. During mounting, each slide block is inserted into one end of the corresponding sliding chute to push the electrical box into the base part g330 along the sliding chutes, and the screw is tightened to fix the position of the electrical box. During disassembling, the screw is disassembled at first, and then the electrical box is drawn along the sliding chutes.

The box body f1 is mounted at one end of the base part g330 in a length direction, a mounting cavity of the box body f1 has an opening f12, and the opening f12 faces the exterior of the air conditioner in the length direction of the base part g330. In such an arrangement manner, mating with the air conditioner of which an end plate at one end in the length direction may be independently disassembled may be formed, and the interior of the electrical box may directly be viewed from the opening f12 of the mounting cavity by disassembling the end plate at the end of the air conditioner conveniently and quickly. A bottom surface f11 of the box body f1 is opposite to the opening f12, the bottom surface f11 is perpendicular to the length direction of the base part g330, a main board f2 is mounted in the mounting cavity through the opening f12, a plurality of components f21 are arranged on one side of the main board f2, and the side, with the components f21, of the main board f2 faces the bottom surface f11, that is, the main board f2 faces a load side of the air conditioner, so that a length of a load connecting cable connected to the main board f2 may be conveniently reduced, and clearer and more ordered wiring is ensured. A terminal board f3 is arranged on the side, facing the mounting cavity, of the bottom surface f11 of the box body f1, and the terminal board f3 is also perpendicular to the length direction of the base part g330. In such an arrangement manner, a sufficient space in the width direction of the whole body of the air conditioner is fully utilized, reduction in a length of the whole body of the air conditioner is facilitated, and attractive exterior, lightweight and convenience for mounting and transportation are achieved.

The box body f1 is provided with an inwards-sunken avoiding groove f13 configured to avoid a motor assembly f5 of the air conditioner. The motor assembly f5 partially extends into the avoiding groove f13. By the avoiding groove f13, structural strength of the electrical box may also be strengthened. Gaps between lug bosses formed in the mounting cavity by the avoiding groove f13 may be fully utilized for arrangement of the electrical components on the main board f2, so that structural compactness and reasonability of the electrical box are enhanced.

A box cover f4 is detachably connected to the opening f12 of the mounting cavity to protect a component f21 in the electrical box, proof a fire and dust and achieve higher safety and reliability.

For avoiding mechanical interference between the electrical box and another part on a path of moving out of the base part g330 in an axial direction of an output shaft of the fan motor, the electrical box is designed with a stepped contour according to a through section on the path.

As a transformable embodiment, the sliding structure of the electrical box is a sliding chute formed on the side, facing the base part, of the box body, and the guide rail structure of the base part is a slide block corresponding to the sliding chute and in sliding fit with the sliding chute.

As a transformable embodiment, the sliding structure of the electrical box includes two rows of opposite rollers arranged on the box body, the guide rail structure of the base part is a sliding chute corresponding to the two rows of rollers, and the rollers reciprocally move along the sliding chute to assemble and disassemble the electrical box.

As a transformable embodiment, the guide rail structure of the base part is arranged in a height direction of the base part, and may mate with an air conditioner of which a top plate or bottom plate at one end of the base part in the height direction may be independently opened to independently open the top plate or the bottom plate or independently open part of the top plate or part of the bottom plate, that is, the electrical box may be independently drawn out in the height direction of the air conditioner for inspection and maintenance.

As a transformable embodiment, the guide rail structure of the base part is arranged in a width direction of the base part, and may mate with an air conditioner of which a front panel of the base part or part of the front panel may be independently opened to independently open the front panel, that is, the electrical box may be independently drawn out along the front of the air conditioner for inspection and maintenance.

As a transformable embodiment, the fixing structure on the box body includes a buckle arranged on the box body, and a clamping groove in clamping fit with the buckle is arranged on the base part.

As a transformable embodiment, the terminal board is arranged on the sidewall, connected with the bottom surface, of the box body, and the terminal board is perpendicular to the length direction of the base part.

As a transformable embodiment, the box body is provided with an inwards-sunken avoiding groove configured to avoid another part, adjacent to the box body, of the air conditioner.

Figure 21:
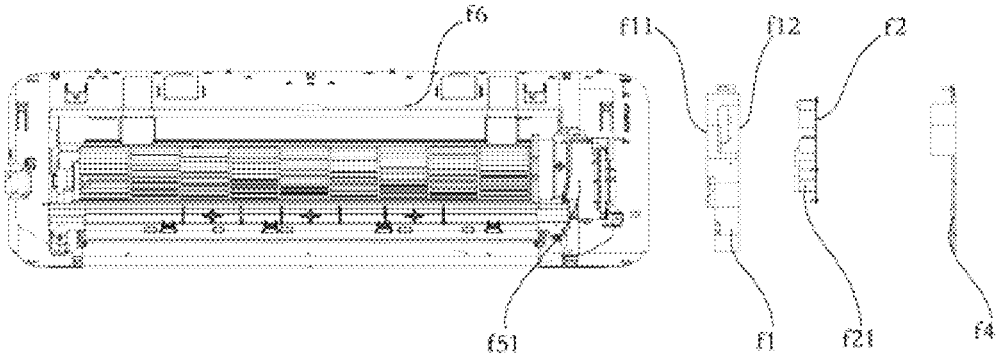
FIG. 21 is an assembling schematic diagram of an electrical box and an air conditioner according to an embodiment of the disclosure.
Figure 22:
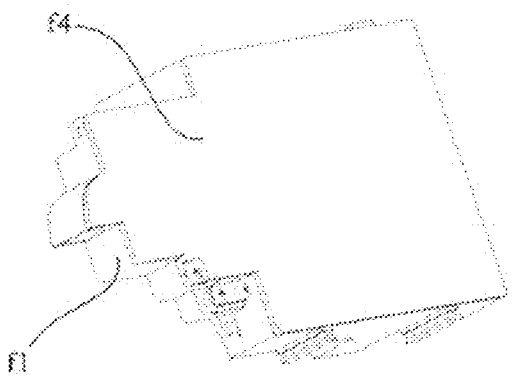
FIG. 22 is a three-dimensional view of the electrical box in FIG. 21.
Figure 23:
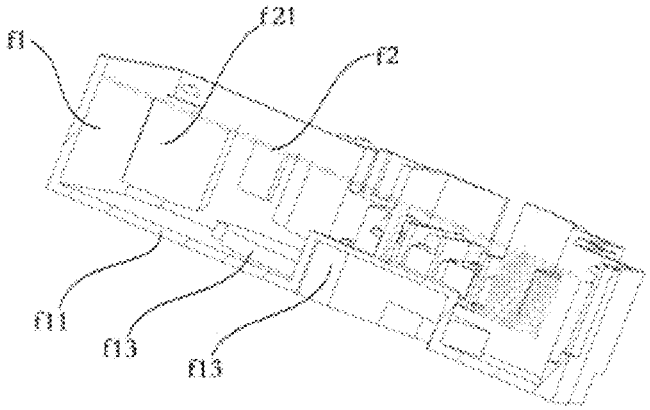
FIG. 23 is a sectional view of the electrical box in FIG. 22.
Figure 24:
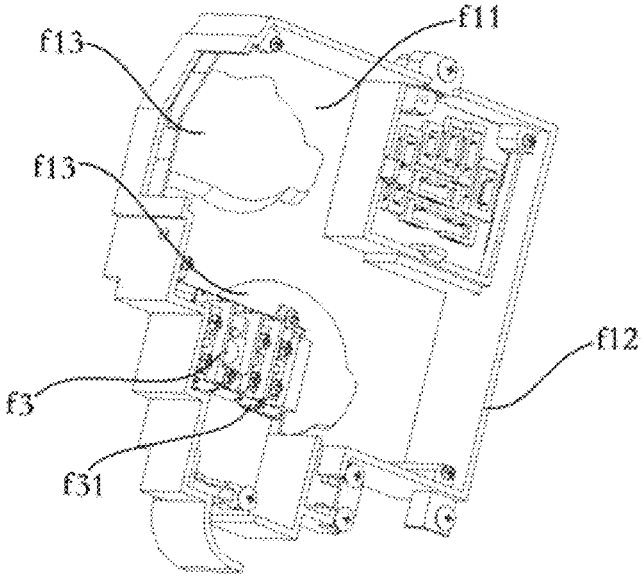
FIG. 24 is an internal structure diagram of a box body of the electrical box in FIG. 22.

As an extended embodiment of the disclosure, FIG. 21 is an assembling schematic diagram of an electrical box and an air conditioner according to an embodiment of the disclosure. FIG. 22 is a three-dimensional view of the electrical box in FIG. 21. FIG. 23 is a sectional view of the electrical box in FIG. 21. FIG. 24 is an internal structure diagram of a box body of the electrical box in FIG. 22.

As shown in FIGS. 21 to 2-18, the embodiment provides an electrical box for an air conditioner, which is an electrical box for an air conditioner indoor unit, is arranged at one end in the air conditioner in a length direction of a body f6 and includes a box body f1 with a mounting cavity. An opening f12 of the mounting cavity is opposite to a bottom surface f11 of the box body f1, the bottom surface f11 is perpendicular to the length direction of the body f6 of the air conditioner, and the opening f12 faces the outside in the length direction of the body f6 of the air conditioner. In such an arrangement manner, mating with the air conditioner of which an end plate at one end in the length direction may be independently disassembled may be formed, and the interior of the electrical box may directly be viewed from the opening f12 of the mounting cavity by disassembling the end plate at the end of the air conditioner conveniently and quickly. A main board f2 and a terminal board f3 are both arranged in the mounting cavity, a plurality of components f21 are arranged on the main board f2, the main board f2 is connected with a power cord or a signal wire through the terminal board f3, and the side, with the components f21, of the main board f2 faces the bottom surface f11 of the box body f1, that is, the main board f2 faces a load side of the air conditioner, so that a length of a load connecting cable connected to the main board f2 may be conveniently reduced, and clearer and more ordered wiring is ensured. Moreover, the main board f2 is parallel to the bottom surface f11 of the box body f1, which is also favorable for reducing the length of the body f6 of the air conditioner. The terminal board f3 includes a substrate f31, as well as an input end and output end arranged on the substrate f31. The substrate f31 is arranged on the bottom surface f11 of the box body f1 such that the substrate 31 is also perpendicular to the length direction of the body f6 of the air conditioner. The terminal board f3 is arranged in the mounting cavity of the electrical box, so that independent arrangement of a fireproof and dustproof cover at the terminal board f3 is eliminated. Moreover, the substrate f31 of the terminal board f3 is perpendicular to the length direction of the body f6 of the air conditioner, so that a sufficient space in a width direction of the body f6 of the air conditioner is fully utilized, a space occupied in the length direction of the body f6 is reduced, reduction in the length of the body f6 of the air conditioner is facilitated, lightweight and attractive exterior are achieved and, meanwhile, transportation, assembling and disassembling are facilitated.

A board surface of the main board f2 is smaller than the opening f12 of the mounting cavity of the electrical box, and the terminal board f3 is staggered with the main board f2 such that the terminal board f3 may be exposed to the opening f12 of the mounting cavity.

As shown in FIG. 24, the box body f1 is provided with an inwards-sunken avoiding groove f13 configured to avoid a motor assembly f5 of the air conditioner. The motor assembly f5 partially extends into the avoiding groove f13. By the avoiding groove f13, structural strength of the electrical box may also be strengthened. Gaps between lug bosses formed in the mounting cavity by the avoiding groove may be fully utilized for arrangement of the electrical components on the main board f2, so that structural compactness and reasonability of the electrical box are enhanced.

A box cover f4 is detachably connected to the opening f12 of the mounting cavity to protect the component f21 in the electrical box, proof a fire and dust and achieve higher safety and reliability.

As shown in FIG. 21 and FIG. 22, for avoiding mechanical interference between the electrical box and another part on a path of moving out of a base part in an axial direction of an output shaft of a fan motor, the electrical box is designed with a stepped contour according to a through section on the path.

For the air conditioner with the electrical box, a space occupied by the terminal board f3, the main board f2 and the like in the length direction of the body f6 is reduced, reduction in the length of the body f6 of the air conditioner is facilitated, lightweight and attractive exterior are achieved and, meanwhile, transportation, assembling and disassembling are facilitated.

As a transformable embodiment, the terminal board is arranged on the sidewall, connected with the bottom surface, of the box body, and the substrate of the terminal board is perpendicular to the length direction of the body of the air conditioner.

As a transformable embodiment, the box body is provided with an inwards-sunken avoiding groove configured to avoid another part, adjacent to the box body, of the air conditioner.

As a transformable embodiment, the side, with the components, of the main board faces the opening of the mounting cavity of the electrical box.

Figure 25:
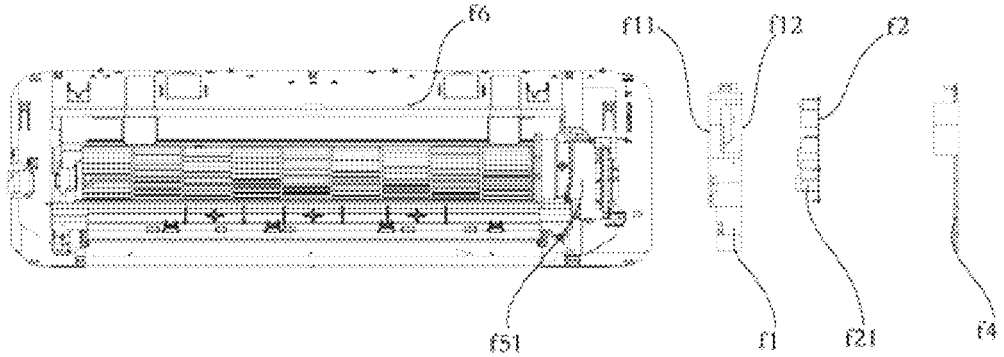
FIG. 25 is an assembling schematic diagram of an electrical box and an air conditioner according to another embodiment of the disclosure.
Figure 26:
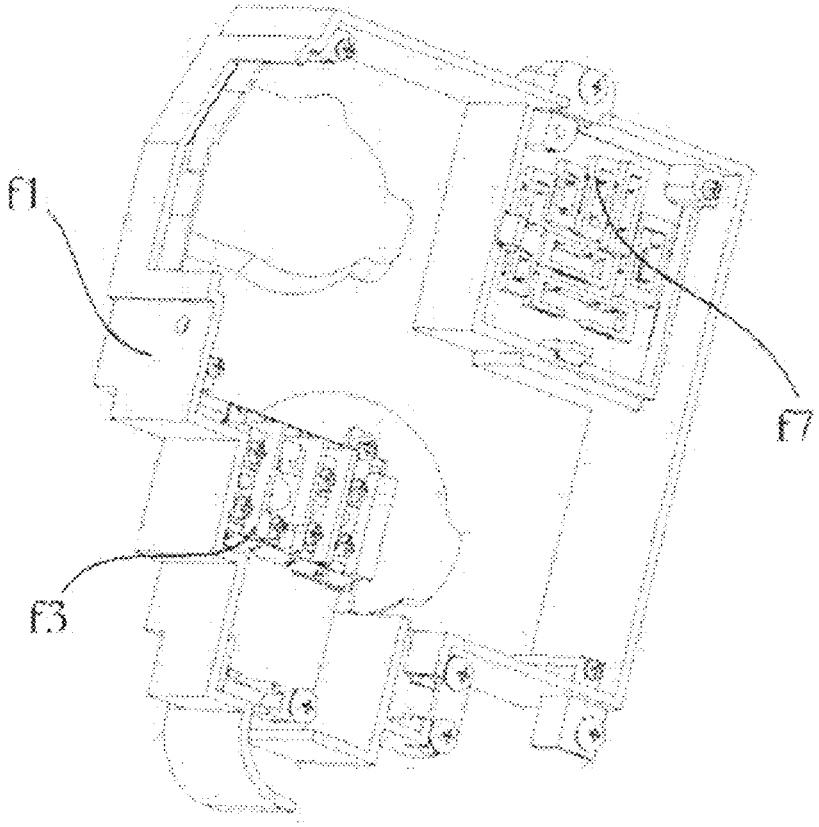
FIG. 26 is an internal structure diagram of a box body of the electrical box in FIG. 25.
Figure 27:
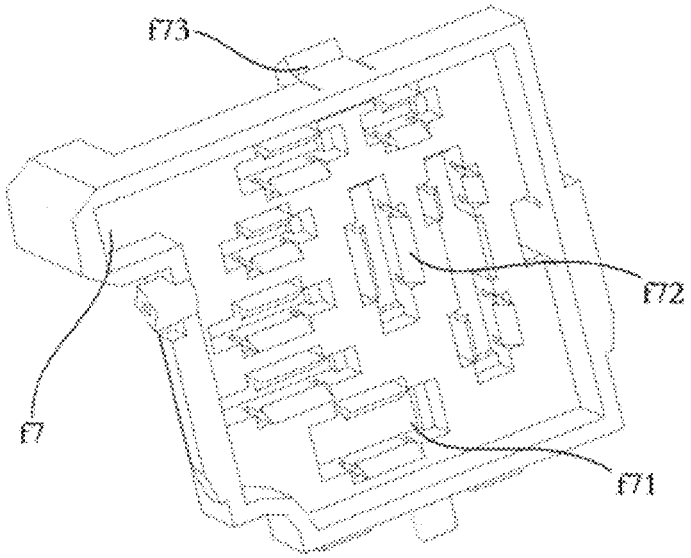
FIG. 27 is a structure diagram of the side, facing a load, of a line concentration structure in FIG. 26.
Figure 28:
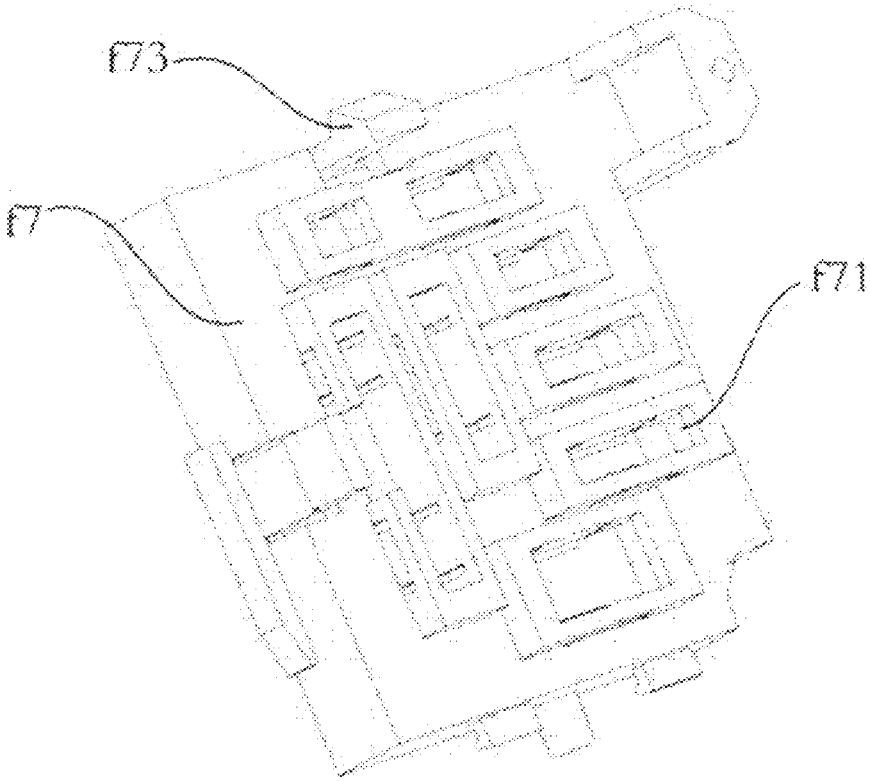
FIG. 28 is a structure diagram of the side, facing a main board, of the line concentration structure in FIG. 26.

As an extended embodiment of the disclosure, FIG. 25 is an assembling schematic diagram of an electrical box and an air conditioner according to another embodiment of the disclosure. FIG. 26 is an internal structure diagram of a box body of the electrical box in FIG. 25. FIG. 27 is a structure diagram of the side, facing a load, of a line concentration structure in FIG. 26. FIG. 28 is a structure diagram of the side, facing a main board, of the line concentration structure in FIG. 26.

As shown in FIGS. 25 to 2-22, the embodiment provides a line concentration structure for an electrical box of an air conditioner, which is a line concentration structure of an electrical box of an air conditioner indoor unit. The line concentration structure is a platy injection molding part, and includes a structural body f7 in which multiple insertion through holes f71 are formed. Each insertion through hole f71 corresponds to a terminal block of a main board f2 in the electrical box, and each insertion through hole f71 is provided with an elastic clamping structure f72. The elastic clamping structure f72 includes at least two opposite elastic clamping pins arranged on the side, back on to the main board f2, of the insertion through hole f71, and may elastically clamp or release the terminal block of a load to avoid an air conditioner failure caused by separation of the terminal block of the load during transportation or long-term use.

An embodiment also provides an electrical box for an air conditioner, which includes a box body f1 with a mounting cavity, a box cover f4 detachably connected to an opening of the mounting cavity and a main board f2 arranged in the mounting cavity. A plurality of components f21 and terminal blocks are arranged on the main board f2. A mounting opening is formed in the side, corresponding to a load in the air conditioner, of the box body f1. The side, with the terminal block, of the main board f2 faces the mounting opening. A shape of the mounting opening is adapted to a shape of a line concentration structure. The line concentration structure is mounted at the mounting opening through a fixing structure f73 in a manner that insertion through holes f71 of the line concentration structure are close to the corresponding terminal blocks of the main board. In such an arrangement manner, an operator may be guided to connect terminal blocks of loads to the terminal blocks of the main board f2, then the operator may insert the terminal blocks of the loads to the terminal blocks of the main board f2 through the insertion through holes f71 on the premise of not opening the electrical box, and convenient alignment and quick insertion are implemented. Meanwhile, when the electrical box is disassembled, the operator is also not required to open the electrical box and may disassemble the loads and the main board f2 directly by extracting the terminal blocks of the loads from the insertion through holes f71, so that convenience is brought to operation, and assembling and disassembling efficiency of the electrical box is improved. In addition, the line concentration structure is arranged on the side, corresponding to the loads, of the box body f1, so that reduction in lengths of connecting wires between the loads and the main board f2 is facilitated, and material waste and enlarged occupied space caused by line winding caused by excessive lengths of the connecting wires are avoided.

A fixing structure f73 includes an elastic buckle arranged at the line concentration structure and a clamping groove arranged at the mounting opening of the electrical box and connected with the elastic buckle of the line concentration structure. The fixing structure f73 further includes a fastening piece that connects the line concentration structure with the box body f1, the fastening piece being a screw or a stud. A terminal board f3 is also arranged in the mounting cavity of the electrical box, and the terminal board f3 is perpendicular to a length direction of a body f6 of the air conditioner, so that reduction in an overall length of the indoor unit is facilitated, and convenience is brought to transportation, assembling and disassembling.

An embodiment also provides an air conditioner, which includes a plurality of electrical load components f51 and the abovementioned electrical box. Terminal blocks of the electrical load components f51 include a motor terminal, a display terminal, a wifi box terminal, a poking box terminal, a pipe temperature bulb terminal, an ambient temperature wrap terminal, an auxiliary electrical heating terminal, a humidity sensor terminal, a ground wire terminal, a cold plasma terminal, a mosquito repeller terminal and a human body sensing module terminal. Rich functions are realized, high assembling and disassembling efficiency of the electrical box and high after-sales maintenance efficiency of the air conditioner are achieved, and a good product experience is provided.

As a transformable embodiment, a plurality of insertion through holes are formed in a line concentration structure, some insertion through holes correspond to one terminal block on a main board, and some insertion through holes correspond to multiple terminal blocks on the main board.

As a transformable embodiment, an elastic clamping structure includes elastic insulating openings arranged in each insertion through hole, and the elastic insulating openings are expanded or contracted to loosen or clamp terminal blocks of loads.

As a transformable embodiment, multiple mounting openings are formed in the box body, a plurality of loads in an air conditioner indoor unit are separately arranged in multiple mounting regions, a plurality of terminal blocks of the main board are separately arranged in multiple control regions, each control region corresponds to a mounting opening, a line concentration structure is mounted at each mounting opening, and the mounting regions correspond to the control regions one to one, that is, load terminals in a certain mounting region are inserted into the corresponding line concentration structure in a centralized manner and electrically connected with the corresponding control region, so that clear wiring is ensured, and convenience is brought to bundling and wire arrangement.

As a transformable embodiment, a fixing structure includes a clamping groove arranged at the line concentration structure and an elastic buckle arranged at the mounting opening of the electrical box and connected with the elastic buckle of the line concentration structure.

As a transformable embodiment, the line concentration structure is fixed at the mounting opening of a box body of the electrical box through a screw.

As a transformable embodiment, the line concentration structure is arranged on any side of the box body of the electrical box.

As a transformable embodiment, the line concentration structure is formed integrally with the box body of the electrical box, so that convenience is brought to production, meanwhile, assembling and disassembling steps may be simplified, and assembling and disassembling time is saved.

As a transformable embodiment, the terminal blocks of the electrical load components include one or more of the motor terminal, the display terminal, the wifi box terminal, the poking box terminal, the pipe temperature bulb terminal, the ambient temperature wrap terminal, the auxiliary electrical heating terminal, the humidity sensor terminal, the ground wire terminal, the cold plasma terminal, the mosquito repeller terminal and the human body sensing module terminal, and may further include other function module terminals in the air conditioner.

Embodiment 3

Figure 73:
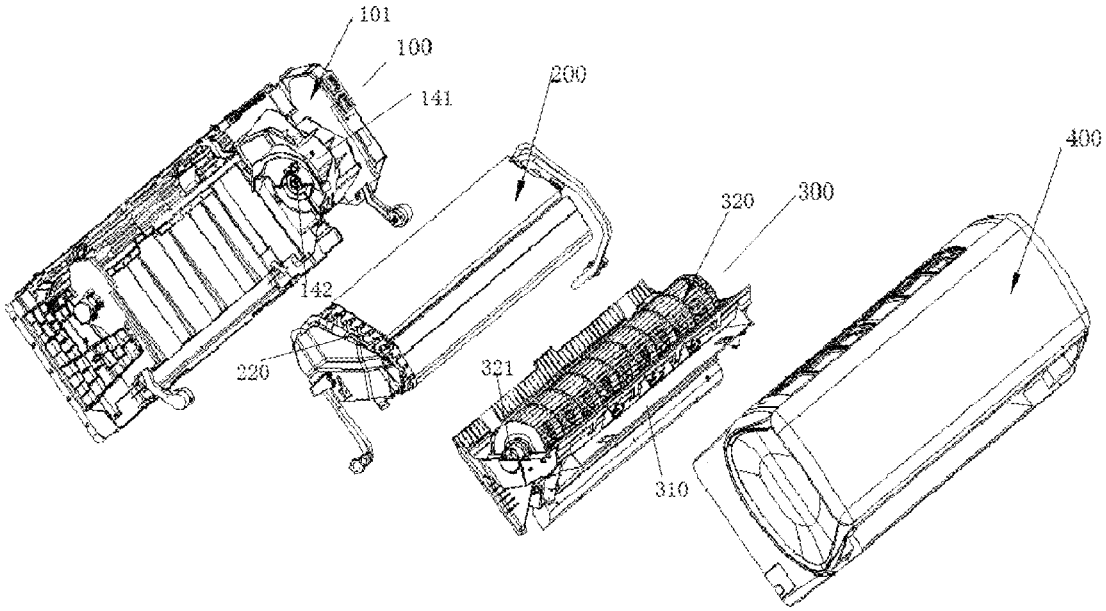
FIG. 73 is an exploded view of an air conditioner according to the disclosure.

FIG. 73 shows an air conditioner indoor unit of the disclosure. The air conditioner indoor unit includes: a base module 100, a heat exchange module 200, an air and water duct module 300 and an exterior module 400.

Figure 74:
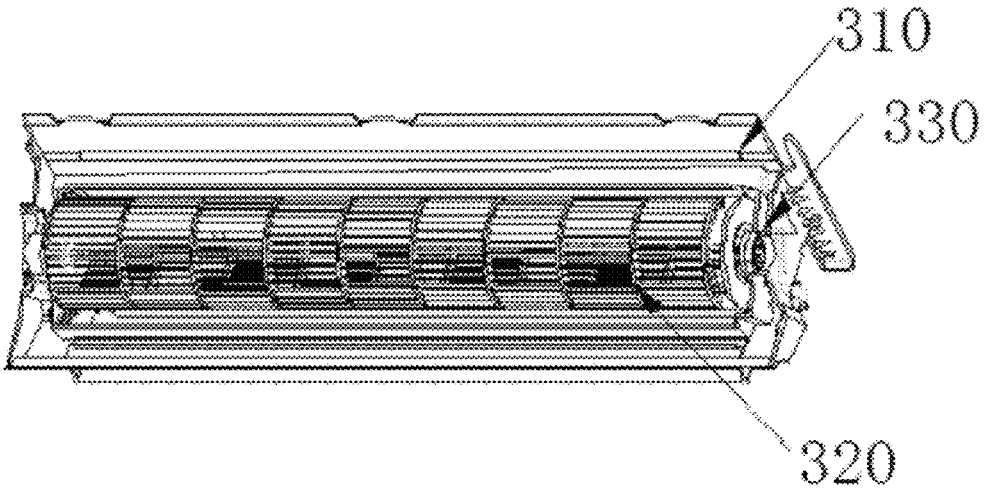
FIG. 74 is a structure diagram of an air duct assembly according to an embodiment of the disclosure.
Figure 91:
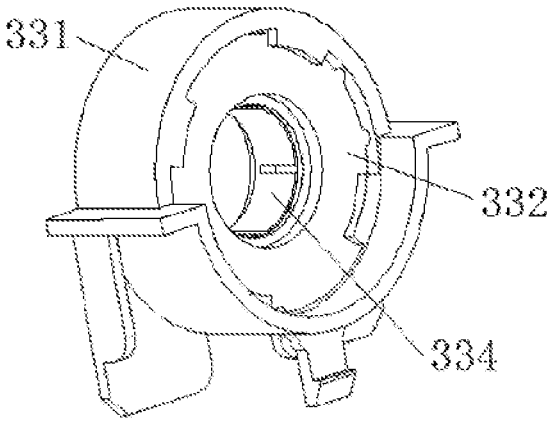
FIG. 91 is a structure diagram of a bearing rubber base assembly in an implementation mode of the disclosure.
Figure 96:
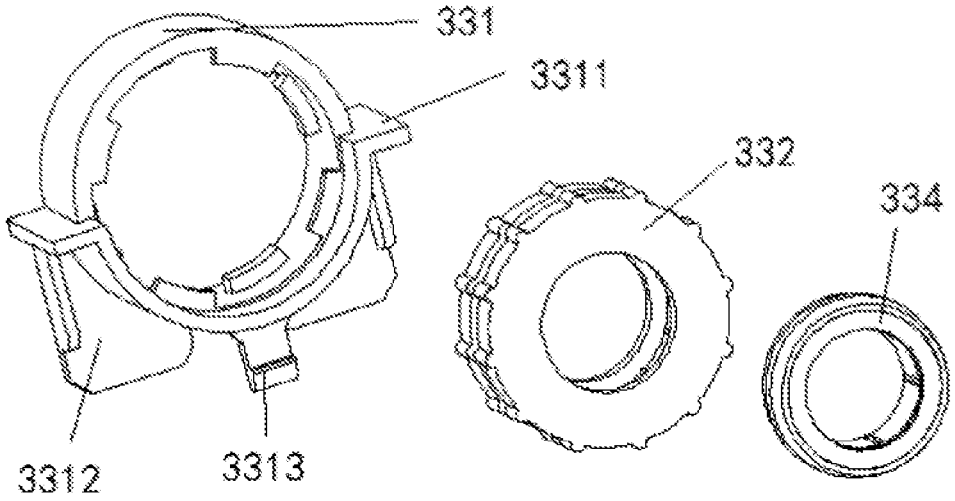
FIG. 96 is an exploded drawing of a bearing rubber base assembly of the disclosure.
Figure 97:
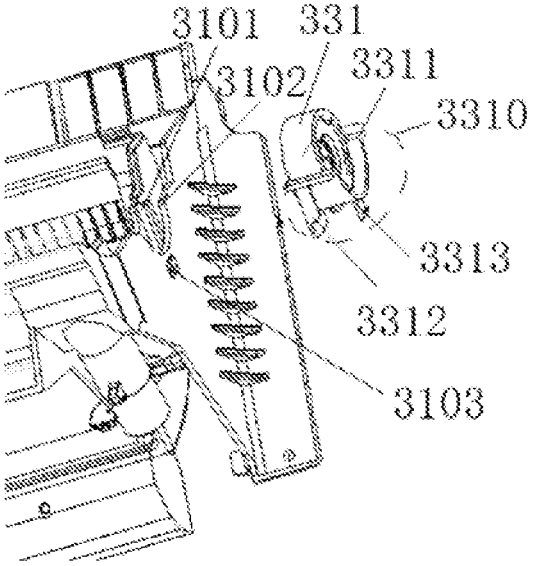
FIG. 97 is an assembly structure diagram of a support shaft sleeve and a bottom shell.

The air and water duct module 300 includes an air duct assembly 301, as shown in FIG. 74. The air duct assembly has a bottom shell 310. A fan support 311 is arranged on the bottom shell 310. There is a centering device arranged between the fan support 311 and the impeller shaft 321 of the impeller 320. The centering device is a bearing rubber base assembly 330. One impeller 320 is mounted on the fan support 311. Specifically, the impeller is arranged, at the side which is close to the fan motor 141 of the impeller shaft 321, on the fan support 311 of the bottom shell 310 through the bearing rubber base assembly 330, as shown in FIG. 91 and FIG. 96.

As shown in FIG. 74, an impeller assembly 3011 in the air duct assembly 301 includes the impeller 320 having the impeller shaft 321. One end, close to the fan motor 141, of the impeller shaft 321 is in transmission connection with the fan motor 141, and another end is rotationally arranged on the bottom shell 310. The end, close to the fan motor 141, of the impeller shaft 321, is also sheathed with the bearing rubber base assembly 330. The bearing rubber base assembly is suitable to be fixed on the bottom shell 310. The bearing rubber base assembly 330 provided by the embodiment includes: a support shaft sleeve 332 and a rubber base bracket 331. The inner loop surface of the support shaft sleeve 332 is sheathed on the outer surface of the impeller shaft 321. The rotation shaft is in transmission connection with the output shaft of the fan motor 141. The rubber base bracket 331 is fixedly connect ion with the support shaft sleeve 332, and is suitable to be fixedly mounted on the support. There is also an impeller bearing 334 arranged between the inner loop surface of the support shaft sleeve 332 and the impeller shaft 321 of the impeller. The support shaft sleeve 332 and the rubber base bracket 331 are formed integrally. The support shaft sleeve is a self-lubricating rubber gasket. A bracket insertion portion 3310 mating with the bottom shell 310 is arranged on the rubber base bracket 331. The bracket insertion portion 3310 includes: a bracket limiting portion 3311 for limiting an insertion depth with the bottom shell 310, and a bracket guide portion 3312 mating with the guide structure 3102 on the side wall of the bottom shell 310. The support shaft sleeve 332 is a self-lubricating elastic rubber gasket. There is also the impeller bearing 334 arranged in the support shaft sleeve 332. The impeller bearing 334 rotationally mates with the impeller shaft 321. The bottom shell 310 has a side face facing towards the heat exchange module 200. A water groove for collecting and draining the condensed water from the heat exchange module 200 is formed on the side face. The impeller 320 is in the water groove after being mounted on the fan support 311.

The bearing rubber base assembly 330 is mounted on the support, and arranged on the end, close to the fan motor 141, of the impeller 320, thereby solving the problem of hanging connection between the impeller shaft and a motor output shaft. In the conventional art, when disassembled, the impeller 320 moves towards the direction fay away from the fan motor 141. The bearing rubber base assembly 330 provided by the embodiment is configured to support the impeller shaft sleeve close to the end of the fan motor 141, thereby preventing the impeller 320 from damage caused by inclining or dropping in the assembling or disassembling process. That is, after an operator pushes the impeller 320 far away from the fan motor 141 to clean, the impeller 320 may be supported by the bearing rubber base assembly 330. After the impeller 320 is cleaned, and before the impeller 320 is butted with the fan motor 141, the impeller 320 is connected with the fan motor 141 in an alignment way by means of the bearing rubber base assembly 330. The support shaft sleeve 332 is an elastic shaft sleeve, and has a certain elasticity. In the case of misalignment happening when the rotation shaft is butted with the fan motor 141 in the beginning, according to the positions of the rotation shaft and the fan motor 141, an adaptive adjustment may be made through the elasticity of the support shaft sleeve 332 to counteract the misalignment, thereby reducing the wear of the rotation shaft and the output shaft, and prolonging the service life of the rotation shaft and its products. The rubber base bracket 331 is sheathed on the outer side of the support shaft sleeve 332, that is, does not interfere with the rotation shaft on the inner loop surface of the support shaft sleeve 332. The sheathed connection also enables the support shaft sleeve 332 not to move relative to the rubber base bracket 331. An oil groove is formed on the inner wall of the impeller bearing 334, so that the space between the inner wall of the impeller shaft 334 and the outer wall of the rotation shaft may be full of lubricating oil, thereby reducing a frictional force in the relative movement of them, and improving the rotation efficiency. The rubber base bracket 331 is fixed on an axial side wall of the support shaft sleeve 332, and has an axially extending arc-shaped portion, so that the bearing rubber base assembly 330 is effectively supported in the axial direction, thereby preventing the deflection of an angle between the rotation shaft and the rubber base assembly, and reducing the degree of wear of the rotation shaft.

The bracket insertion portion 3310 mating with the bottom shell 310 is arranged on the rubber base bracket 331. The bracket insertion portion 3310 includes: the bracket limiting portion 3311 for limiting the insertion depth with the bottom shell 310, and the bracket guide portion 3312 mating with the guide structure 3102 on the side wall of the bottom shell 310. The bracket limiting portion 3311 limits an insertion position of the rubber base bracket 331. The bracket guide portion 3312 guides the insertion. The combination of limiting and guiding locates and mounts the rubber base bracket 331 accurately, thereby realizing accurate assembly of the bearing rubber base assembly 330.

The bracket limiting portion 3311 is of a plate-type structure, being symmetrically formed on the rubber base bracket 331 and extending axially, and is configured to press against an opening edge 3101 on the fan support 311 of the bottom shell 310, so as to achieve the limit. The bracket guide portion 3312 is formed on the lower surface of the bracket limiting portion 3311, that is, guiding is prior to limiting in an inserting process. The bracket limiting portion 3311 is vertical to the bracket guide portion 3312, so that the bracket limiting portion 3311 is uniformly forced, and the rubber base bracket 331 is not easy to incline. The bracket insertion portion 3310 further includes a bracket barb 3313 which is hooked with a through hole 3103 on the side wall of the bottom shell 310, thereby preventing the rubber base bracket 331 from separating from the bottom shell 310 due to vibration.

As a transformable embodiment, as shown in FIG. 91, FIG. 96 to FIG. 101, a bearing rubber base assembly 330 provided by the embodiment includes: a support shaft sleeve 332 and a rubber base bracket 331. The inner loop surface of the support shaft sleeve 332 is sheathed on the outer surface of the impeller shaft 321. The rotation shaft is in transmission connection with the output shaft of the fan motor 141. The rubber base bracket 331 is fixedly connected with the support shaft sleeve 332, and is suitable to be fixedly mounted on the support.

The bearing rubber base assembly 330 is mounted on the support, and arranged on the end, close to the fan motor 141, of the impeller 320, thereby solving the problem of hanging connection between the impeller shaft and a motor output shaft. In the conventional art, when disassembled, the impeller 320 moves towards the direction fay away from the fan motor 141. The bearing rubber base assembly 330 provided by the embodiment is configured to support the impeller shaft sleeve close to the end of the fan motor 141, thereby preventing the impeller 320 from damage caused by inclining or dropping in the assembling or disassembling process. That is, after an operator pushes the impeller 320 far away from the fan motor 141 to clean, the impeller 320 may be supported by the bearing rubber base assembly 330. After the impeller 320 is cleaned, and before the impeller 320 is butted with the fan motor 141, the impeller 320 is connected with the fan motor 141 in an alignment way by means of the bearing rubber base assembly 330.

A supporting portion is arranged between the inner loop surface and the outer loop surface of the support shaft sleeve 332 to support the inner loop surface and the outer loop surface of the support shaft sleeve, thereby preventing the support shaft sleeve from being squeezed and twisted to be unable to rotationally mate with the rotation shaft of the impeller 320. The rubber base bracket 331 is fixed on an axial side wall of the support shaft sleeve 332, and has an axially extending arc-shaped portion, so that the bearing rubber base assembly 330 is effectively supported in the axial direction, thereby preventing the deflection of an angle between the rotation shaft and the rubber base assembly, and reducing the degree of wear of the rotation shaft.

Figure 98:
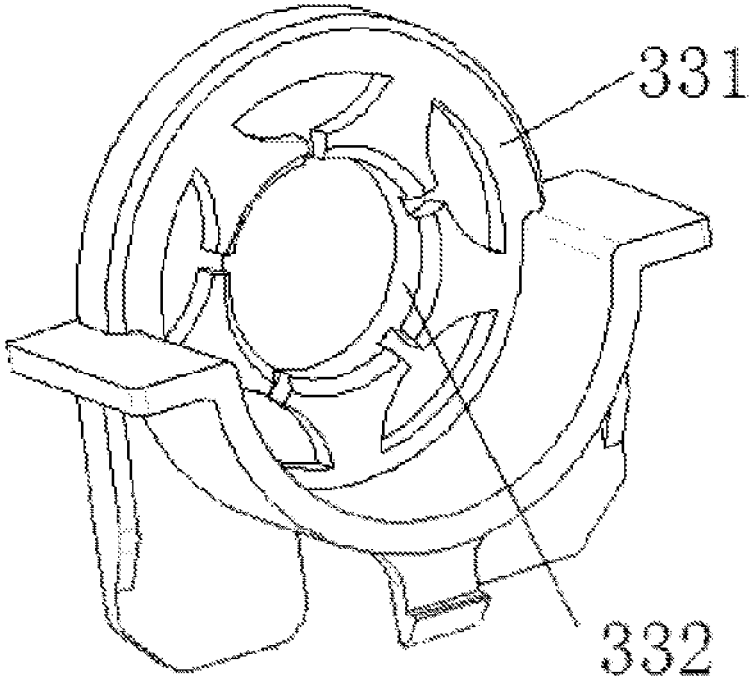
FIG. 98 is a structure diagram of another implementation mode of a bearing rubber base assembly of the disclosure.

As shown in FIG. 98, the support shaft sleeve 332 and the rubber base bracket 331 are formed integrally in an injection molding manner, so the number of parts is reduced, and the product assembly process is simplified.

The support shaft sleeve 332 is a self-lubricating shaft sleeve, so the frictional force between it and the rotation shaft is reduced. The bearing rubber base assembly 330 and the support are formed on the bottom shell 310. The bracket insertion portion 3310 mating with the bottom shell 310 is arranged on the rubber base bracket 331, that is, the rubber base bracket 331 is fixed on the bottom shell 310 in a quick insertion manner, so as to realize quick mounting.

Figure 99:
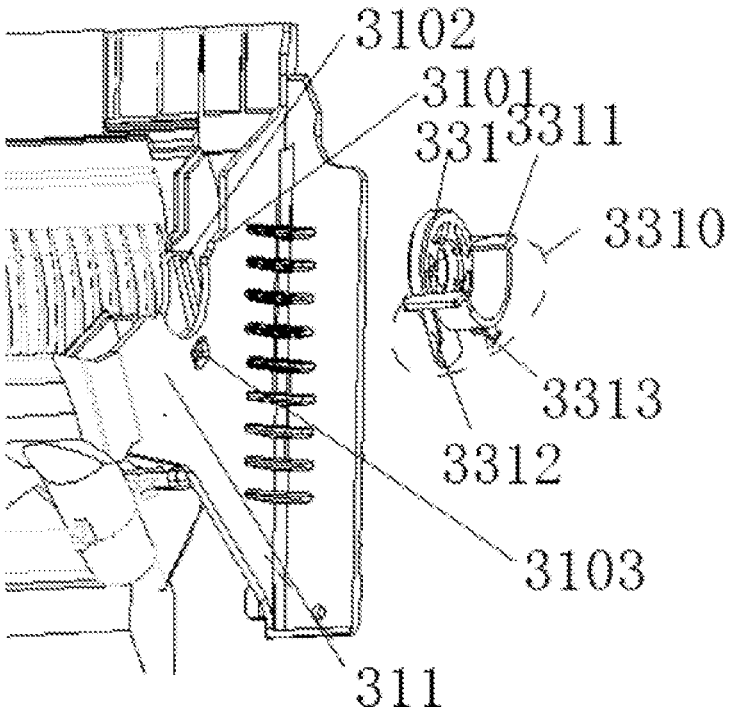
FIG. 99 is an assembly structure diagram of another support shaft sleeve and a bottom shell.

As shown in FIG. 99, as the bracket insertion portion 3310, the bracket insertion portion 3310 includes: a bracket limiting portion 3311 for limiting an insertion depth with the bottom shell 310, and a bracket guide portion 3312 mating with the guide structure 3102 on the side wall of the bottom shell 310.

Figure 100:
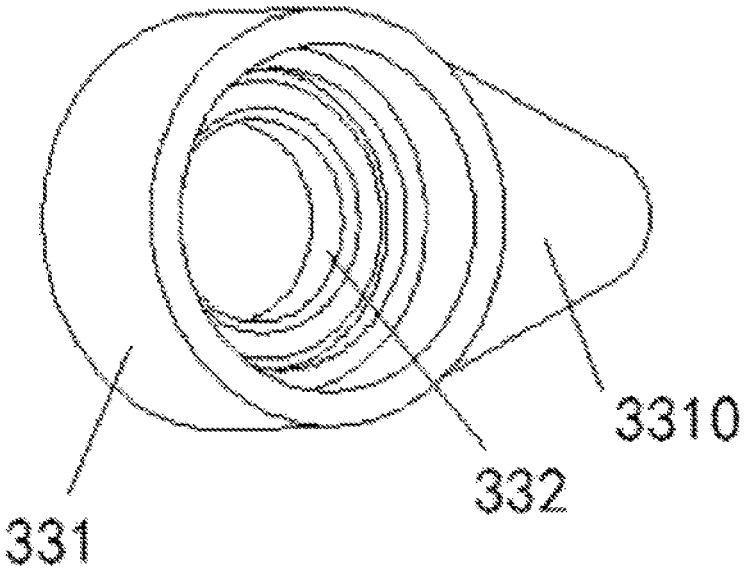
FIG. 100 is a structure diagram of yet another implementation mode of a bearing rubber base assembly of the disclosure.
Figure 101:
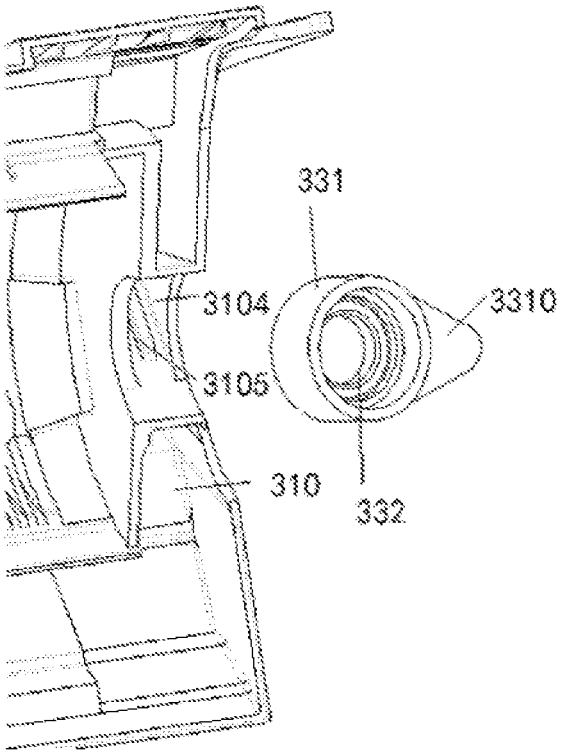
FIG. 101 is an assembly structure diagram of yet another support shaft sleeve and a bottom shell.

As a transformable embodiment, as shown in FIG. 100, a bearing rubber base assembly 330 provided by the embodiment includes: a support shaft sleeve 332 and a rubber base bracket 331. The inner loop surface of the support shaft sleeve 332 is sheathed on the outer surface of the impeller shaft 321. The rotation shaft is in transmission connection with the output shaft of the fan motor 141. The rubber base bracket 331 is fixedly connected with the support shaft sleeve 332, and is suitable to be fixedly mounted on the support. The bearing rubber base assembly 330 is mounted on the support, and arranged on the end, close to the fan motor 141, of the impeller 320, thereby solving the problem of hanging connection between the impeller shaft and a motor output shaft. In the conventional art, when disassembled, the impeller 320 moves towards the direction fay away from the fan motor 141. The bearing rubber base assembly 330 provided by the embodiment is configured to support the impeller shaft sleeve close to the end of the fan motor 141, thereby preventing the impeller 320 from damage caused by inclining or dropping in the assembling or disassembling process.

As shown in FIG. 100, the bracket insertion portion 3310 is of a triangular flange structure, corresponding to the inverted-triangle-shaped groove 3104 at the opening edge of the bottom shell 310. The triangular flange is inserted in the inverted-triangle-shaped groove 3104 to connect the support shaft sleeve 332 with the bottom shell 310. The bracket limiting portion 3311 is a root of the triangular flange. The bracket guide portion 3312 is a strip-shaped groove formed on a side edge of the triangular flange, corresponding to a strip-shaped bump 3105 in the inverted-triangle-shaped groove 3104. The bearing rubber base assembly 330 is accurately fixed on the bottom shell 310 through the bracket limiting portion 3311 and the bracket guide portion 3312.

In the mounted state, the impeller 320 is in the inverted-U-shaped open chamber of the heat exchanger 220. The air and water duct module 300 is connected with the base module 100 through a mounting structure.

Figure 90:
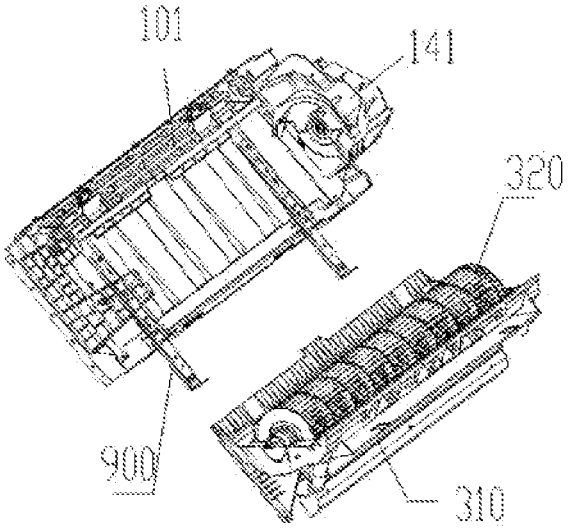
FIG. 90 is a structure diagram of an air duct assembly and a base part in an implementation mode of the disclosure.

The bottom shell 310 has a rear top edge which extends, on the mounting position, to approach the side, close to the back plate of the base part 101, of the heat exchanger 220. A combining slot whose opening faces towards the opening direction of the open chamber is formed at the rear top edge, corresponding to the mounting position of the bottom shell 310, of the base part 101. The rear top edge is suitable to be embedded in the combining slot after the open chamber is mounted in the edge of the impeller 320. Thus an isolation chamber is formed between the bottom shell 310 and the base part 101. The isolation chamber prevents the low temperature in the inverted-U-shaped open chamber of the heat exchanger 220 from transferring to the base part 101, which causes the formation of condensed water on the base part 101. A sliding structure 102 mating with the air duct assembly 301 is arranged on the base part 101. The air duct assembly 301 is suitable to be pulled out from or pushed in the base part 101 through the sliding structure 102, as shown in FIG. 90.

Figure 110:
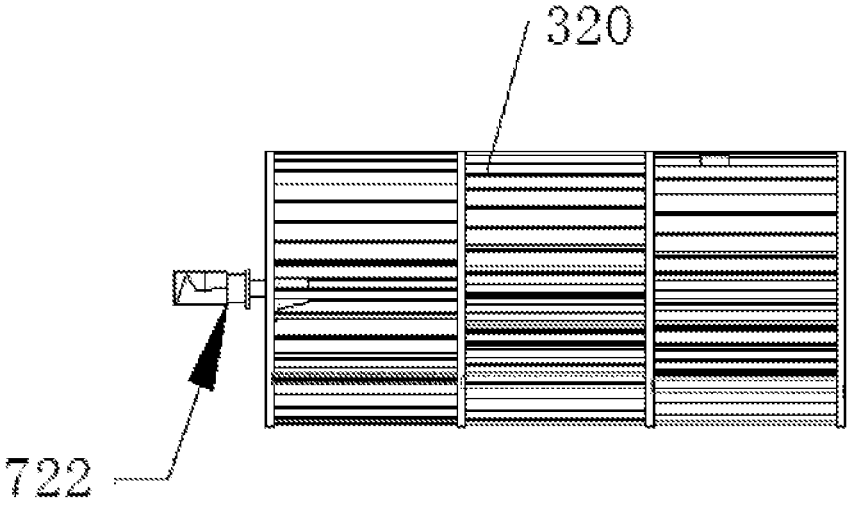
FIG. 110 is a structural installation diagram of a reset spring and an impeller in an implementation mode of the disclosure.

The quick connection manner adopted between the impeller 320 mounted on the bottom shell 310 and the fan motor 141 includes a quick release connecting structure 700 which is arranged between the output shaft 142 of the fan motor 141 and the impeller shaft 321, and is disassembled without using tools, as shown in FIG. 76 to FIG. 79. In the embodiment, the quick release connecting structure 700 includes a fan nest 710 fixedly mounted on the impeller shaft 321 and a motor shaft sleeve 720 fixedly mounted on the output shaft 142 of the fan motor 141. There are several fan meshing portions 711, which are uniformly distributed in all directions, formed on the fan nest 710, correspondingly, there are a corresponding number of motor meshing portions 721, which are suitable to mate with the fan meshing portions 711, arranged on the motor nest 720. The fan meshing portion 711 and the impeller 320 having the fan nest 710 may enter, through an axial movement, a state of interlocking with the motor nest 721, so that the impeller shaft 321 and the output shaft 142 of the fan motor 141 are connected each other, and transmission side faces on the motor shaft sleeve and the fan nest extend at a completely axially overlapping part when they are nested. The transmission side face is a meshing surface. The whole side face at the transmission side of the fan meshing portion is the meshing surface. In the embodiment, the number of the motor meshing portions 721 and the number of the fan meshing portions 711 are 3. The fan meshing portion 711 is a groove, and the motor meshing portion 721 is a protruding claw. As shown in FIG. 76 to FIG. 79. The meshing surface of the motor meshing portion 721 on the motor shaft sleeve 720 is a helical curved surface, the meshing surface corresponding to the fan meshing portion 711 is also a correspondingly mating helical curved surface, and the helical direction of the two mating helical curved surfaces enables the fan motor 141 to drive, when poking the impeller 320 to work, the impeller 320 to axially move towards the direction of the fan motor 141. Along a transmission direction in which the fan motor drives the impeller to rotate, the fan nest has a guiding-in surface contrary to the transmission side face, which is suitable to guide the fan in the fan nest in a nesting manner. The fan shaft sleeve is fixed connected with the output shaft 142 of the fan motor through the screws or buckles. The quick release connecting structure 700 further includes a reset spring 722 arranged on the end of the impeller 320. The reset spring 722 applies a bias force, towards the fan motor 141, on the impeller 320. One end of the reset spring 722 is fixed on the fan support 311 which is on the bottom shell 310, and the other end presses against the impeller shaft 321, as shown in FIG. 110.

As a transformable embodiment, on the basis of the above embodiments, the fan meshing portion 711 is the protruding claw, the motor meshing portion 721 is the groove, and the meshing surface of the motor meshing portion 721 on the motor shaft sleeve 720 is the helical curved surface. The fan nest is formed integrally with the impeller. The motor shaft sleeve is formed integrally with the output shaft 142 of the fan motor.

Figure 76:
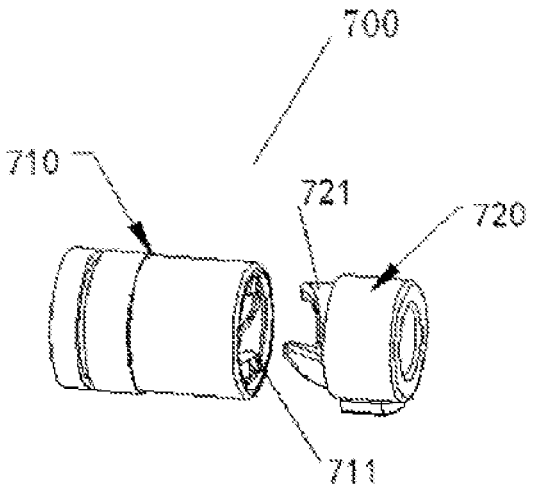
FIG. 76 is a schematic diagram of a quick release connecting structure according to an embodiment of the disclosure.
Figure 77:
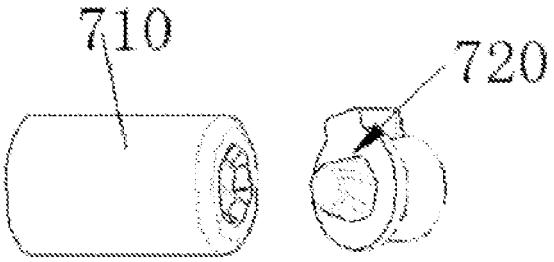
FIG. 77 is a schematic diagram of another quick release connecting structure according to an embodiment of the disclosure.
Figure 78:
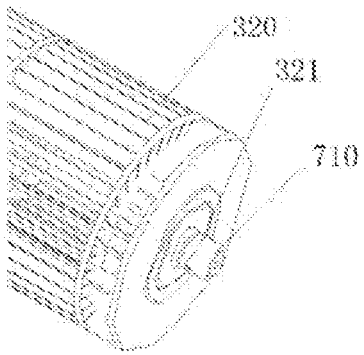
FIG. 78 is a structure diagram of a fan nest and an impeller in a quick release connecting structure in an implementation mode of the disclosure.
Figure 79:
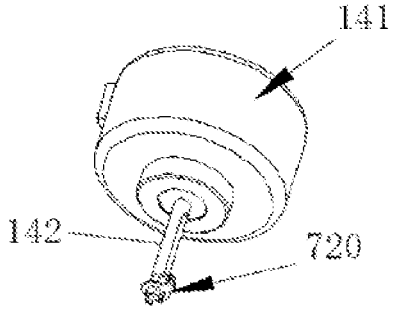
FIG. 79 is a structure diagram of a fan motor and a motor shaft sleeve in a quick release connecting structure in an implementation mode of the disclosure.

As a transformable embodiment, in the embodiment, the quick release connecting structure 700 includes a fan nest 710 fixedly mounted on the impeller shaft 321 and a motor shaft sleeve 720 fixedly mounted on the output shaft 142 of the fan motor 141. There are several fan meshing portions 711, which are uniformly distributed in all directions, formed on the fan nest 710, correspondingly, there are a corresponding number of motor meshing portions 721, which are suitable to mate with the fan meshing portions 711, arranged on the motor nest 720. The fan meshing portion 711 may enter, through an axial movement, a state of interlocking with the motor nest 721, so that the impeller shaft 321 and the output shaft 142 of the fan motor 141 are connected each other, and transmission side faces on the motor shaft sleeve and the fan nest extend at a completely axially overlapping part when they are nested. The transmission side face is a meshing surface. The whole side face at the transmission side of the fan meshing portion is the meshing surface. In the embodiment, the number of the motor meshing portions 721 and the number of the fan meshing portions 711 are 3. The fan meshing portion 711 is a groove, and the motor meshing portion 721 is a protruding claw. As shown in FIG. 76 and FIG. 77. The meshing surface of the motor meshing portion 721 on the motor shaft sleeve 720 is a helical curved surface, the meshing surface corresponding to the fan meshing portion 711 is also a correspondingly mating helical curved surface, and the helical direction of the two mating helical curved surfaces enables the fan motor 141 to drive, when poking the impeller 320 to work, the impeller 320 to axially move towards the direction of the fan motor 141. Along a transmission direction in which the fan motor drives the impeller to rotate, the fan nest has a guiding-in surface contrary to the transmission side face, which is suitable to guide the fan in the fan nest in a nesting manner. The fan shaft sleeve is fixed connected with the output shaft 142 of the fan motor through the screws or buckles.

Figure 82:
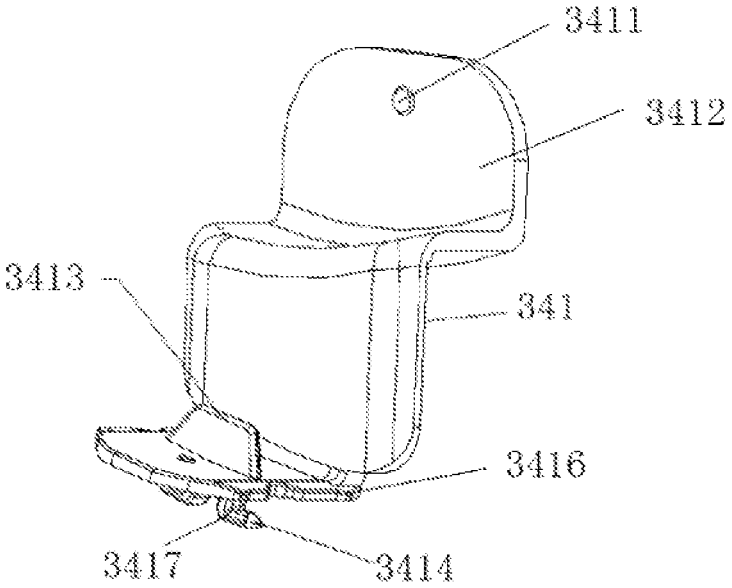
FIG. 82 is a structure diagram of a poking in an implementation mode of the disclosure.

A clutch actuating mechanism is configured to drive the impeller shaft 321 to axially move relative to the output shaft of the fan motor 141. The clutch actuating mechanism includes the poking pieces, which are respectively mounted on the bottom shell 310 movably to apply an acting force on the impeller 320, at two sides of the impeller 320. As shown in FIG. 82 to FIG. 88, the poking piece 341 consists of four folding surfaces which are connected being vertical to each other and of which spacing segments are not opposite, and has a poking piece pushing portion 3412 with a poking piece protruding point 3411 arranged on the top, a poking piece driving portion 3413 which is arranged on the upper surface of the lowest folding surface and is suitable for manual poking, and a poking piece limiting portion 3414 which is arranged on the lower surface of the lowest folding surface, as shown in FIG. 82. The poking piece driving portion 3413 is fixedly connected with the poking piece pushing portion 3412. The poking piece protruding point 3411 is arranged at the position close to the rotation shaft of the impeller 320. The poking piece limiting portion 3414 mates with a bottom shell limiting groove 342 which is formed on the bottom shell 310 and has a bevel. When the impeller 320 moves to the position, where it is separated from the fan motor 141, along the direction far away from the fan motor 141, the poking piece limiting portion 3414 is locked from the bottom shell 310. When the bevel moves in the direction close to the fan motor 141, the poking piece limiting portion 3414 is unlocked from the bottom shell 310. The poking piece protruding point 3411 has a function of making the poking piece 341 contact the impeller 320. The poking piece driving portion 3413 makes it convenient to manually operate the poking piece 341. The limiting buckle of the poking piece limiting portion 3414 enables the poking piece 341 to be connected in the bottom shell limiting groove 342 which is formed on the bottom shell 310 in a sliding manner. By limiting a stroke length of the bottom shell limiting groove 342, the stroke of the poking piece 341 is limited. A guide flange 3416, which is connected in a sliding manner with the bottom shell guide portion 322 formed on the bottom shell 310, is also formed on the poking piece, so that the poking piece limiting portion 3414 slides along the direction parallel to the axis of the impeller to prevent a beat generating in the sliding process, as shown in FIG. 82.

The motor poking the impeller to rotate is mounted on the base module, that is, the impeller shaft is connected with the motor shaft, and there is the poking piece 341, which is configured to disassemble the impeller from the motor, at the side, close to the motor, of the impeller shaft.

Figure 75:
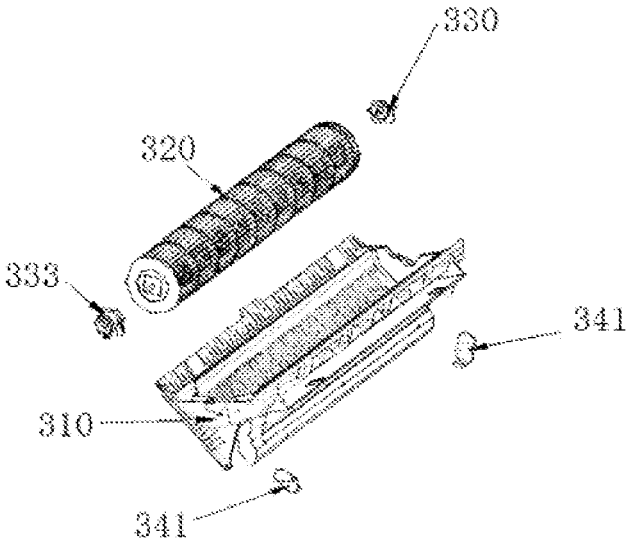
FIG. 75 is an exploded view of an air duct assembly according to an embodiment of the disclosure.

As shown in FIG. 75, the poking piece 341 is movably mounted on the part adjacent to the impeller 320, and includes: the poking piece pushing portion 3412 and the poking piece driving portion 3413. The poking piece pushing portion 3412 is suitable to contact the impeller 320, and is configured to drive the impeller 320 to axially move. The poking piece driving portion 3413 is fixedly connected with the poking piece pushing portion 3412, and is at the position where it can be contacted through a gap from the outside. The poking piece driving portion 3413 of the poking piece 341 in the embodiment can be contacted from the gap, then the operators drives, through the poking piece driving portion 3413 at the gap, the poking piece pushing portion 3412 to push the impeller 320 to axially move, thereby it is convenient to disassemble the impeller 320 from the motor. The poking piece 341 in the embodiment also has the poking piece limiting portion 3414 which is formed on the poking piece driving portion 3413. The poking piece limiting portion 3414 is fixedly connected with the poking piece pushing portion 3412. The poking piece is locked with the mounted part at the position where the impeller 320 is separated from the motor, that is, after the impeller 320 is separated from the motor, the position of the poking piece is locked, then the impeller 320 is limited at the position where it is separated from the motor, and will not be combined with the shaft sleeve of the motor again.

Figure 80:
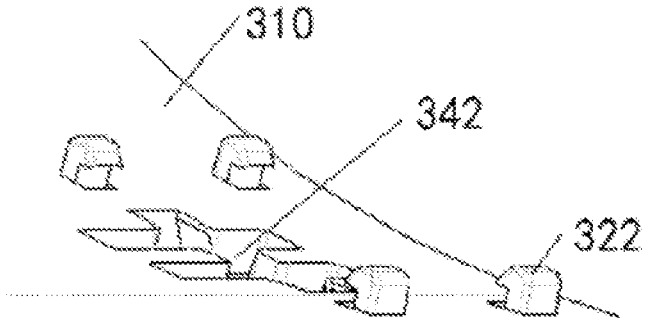
FIG. 80 is a structure diagram of a bottom shell limit slot in an implementation mode of the disclosure.
Figure 83:
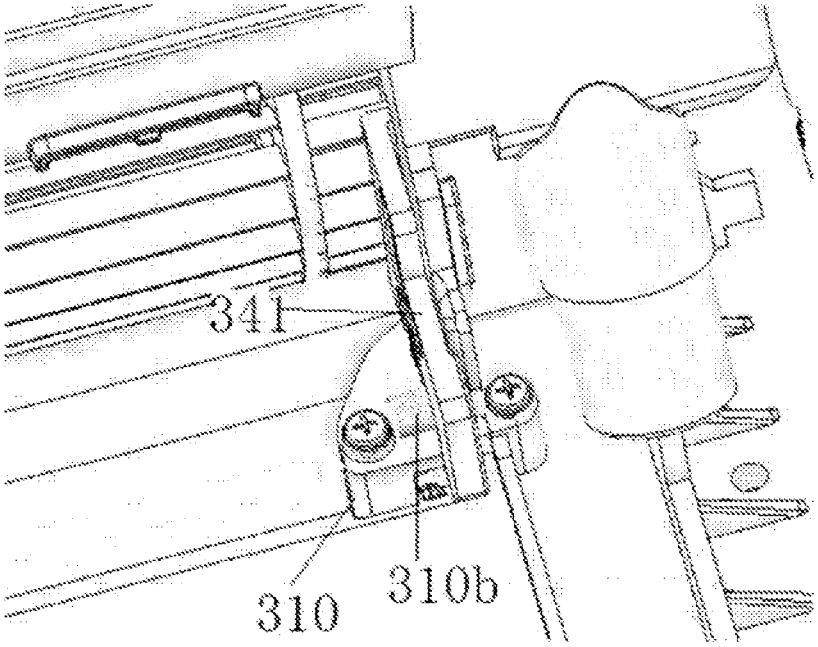
FIG. 83 is a schematic diagram of an implementation mode of another poking piece of the disclosure.
Figure 84:
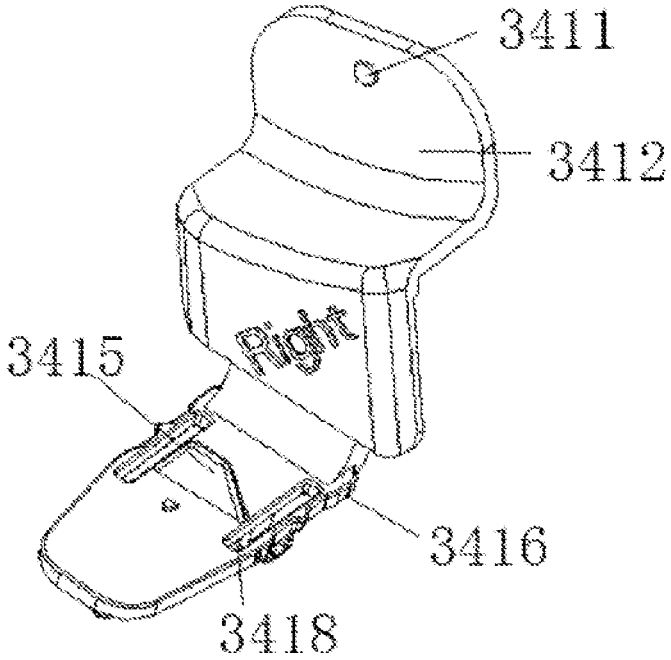
FIG. 84 is a schematic diagram of an implementation mode of yet another poking piece of the disclosure.
Figure 85:
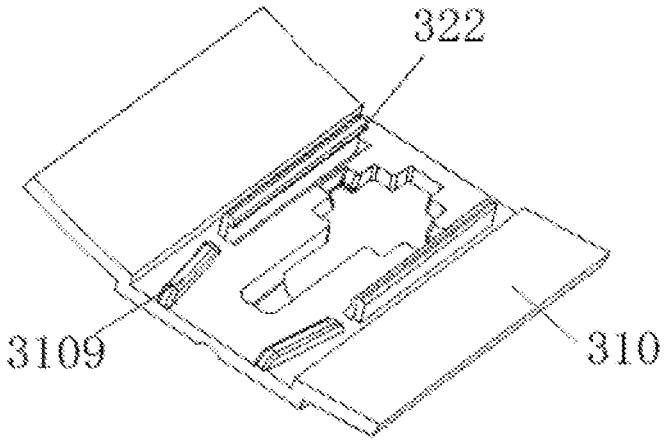
FIG. 85 is a structure diagram of a bottom shell mating with the poking piece in FIG. 84.

The poking piece is movably mounted on the bottom shell 310 of the air conditioner. The poking piece moves relative to the bottom shell 310 of the air conditioner to push the impeller 320. The mounting position of the poking piece of the bottom shell 310 is as shown in FIG. 80 and FIG. 83. The poking piece limiting portion 3414 mates with the bottom shell limiting groove 342 which is formed on the bottom shell 310 and has a bevel. The poking piece limiting portion 3414 mates with the bevel. When the impeller 320 moves to the position where it is separated from the motor along the direction far away from the motor, the poking piece limiting portion 3414 is locked with the bottom shell 310, so that the impeller 320 is limited at the position where it is separated from the motor after moving to the position, and will not be combined with the shaft sleeve of the motor. When the impeller moves along the direction close to the motor, the poking piece limiting portion 3414 is unlocked from the bottom shell 310, that is, when the impeller 320 and the motor are mounted and connected, the poking piece may move freely, and the impeller 320 is not limited to move towards the motor.

As shown in FIG. 75, when the number of the poking pieces configured to disassemble the impeller 320 from the motor is 2, the two poking pieces are respectively arranged on two axial ends of the impeller 320, and poke the impeller 320 in opposite directions. That is, there are the poking pieces arranged on both two end faces of the impeller 320. The poking piece on the left end face may poke the impeller 320 rightwards to drive the impeller 320 to move rightwards, and the poke piece on the right end face may poke the impeller 320 leftwards to drive the impeller 320 to move leftwards. The poking piece which pokes the impeller 320 in the direction far away from the motor has the poking piece limiting portion 3414, for example, if the right end face of the impeller 320 is arranged with the motor, that is, the poking piece on the left end face may drive the impeller 320 to go away and separate from the motor, then the poking piece on the right end face has the poking piece limiting portion 3414, so that the impeller 320 is limited at the position where it is separated from the motor after moving to the position.

As a deformation, when the number of the poking pieces configured to disassemble the impeller 320 from the motor is 1, the poking piece is arranged on the end of the impeller 320, and the reset spring is arranged on the other end of the impeller 320. The reset spring applies the bias force, towards the motor, on the impeller 320. The reset spring and the poking piece may be arranged on the same end of the impeller 320, or they are respectively arranged on two different ends of the impeller 320. The reset spring may avoid the problem that the impeller 320 cannot mate with the motor shaft effectively due to human causes during carrying and assembling the whole body, and then the motor cannot work normally in a no-load case after being powered on. When the reset spring and the poking piece are respectively arranged on two ends of the impeller 320, one end of the reset spring presses against the impeller 320 support of the bottom shell 310, and the other end presses against the impeller 321 shaft. The reset spring pressing against the impeller 321 shaft is on the axis where the acting forces of the end face of the impeller 320 are concentrated, so an axial offset of the impeller 320 relative to the motor is reduced.

As shown in FIG. 82, the poking piece protruding point 3411 is formed on a contact surface of the poking piece pushing portion 3412 and the impeller 320. The impeller 320 and the motor are connected in a mating manner by means of a threaded sleeve, so when the impeller 320 is dissembled from the motor, an action of rotating around the motor shaft also forms in the process that the impeller 320 is separated from the motor, and sliding wear generates between the poking piece and the impeller 320. Therefore, the poking piece protruding point 3411 configured to contact the end face of the impeller 320 is arranged on the poking piece pushing portion 3412 to reduce the contact area between the end face of the impeller 320 and the poking piece, that is, frictional resistance is reduced, so as to reduce damages to the impeller 320 and abnormal noises to the greatest extent. The poking piece protruding point 3411 is close to the position of the rotation shaft of the impeller 320, so as to make a force bearing point on the end face of the impeller 320 as close as possible to the position of the rotation, and reduce the axial offset when the impeller 320 is separated from the motor. The poking piece limiting portion 3414 includes: a guide flange 3416, which is connected in a sliding manner with the bottom shell guide portion 322 formed on the bottom shell 310, is also formed on the poking piece, so that the poking piece limiting portion 3414 slides along the direction parallel to the axis of the impeller 320 to prevent a beat generating in the sliding process. The poking piece limiting portion 3414 further includes: a poking piece hook 3417 which is hooked with the bottom shell limiting groove 342 in the bottom shell 310. The poking piece limiting portion 3414 slides in the bottom shell limiting groove 342, so that the poking piece limiting portion 3414 slides along the direction parallel to the axis of the impeller 320 to prevent a beat generating in the sliding process. There is also a poking position 3415 which is formed on the poking piece 341 of the embodiment and is configured to apply an external force to poke the poking piece conveniently. The poking piece consists of four folding surfaces which are connected being vertical to each other and of which spacing segments are not opposite. The poking piece pushing portion 3412 is the folding surface arranged on the top. The poking piece driving portion 3413 is on the upper surface of the lowest folding surface, so it facilitates operation to make the poking piece to move.

Figure 86:
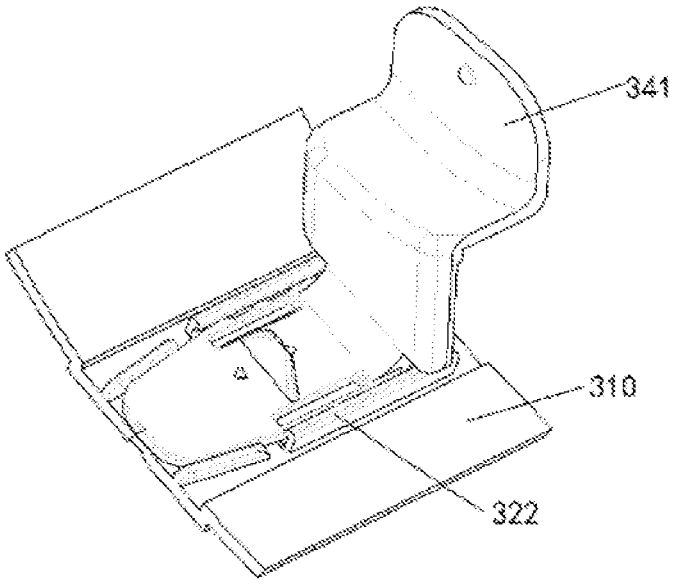
FIG. 86 is a partial schematic diagram of assembly of the poking piece in FIG. 84.
Figure 87:
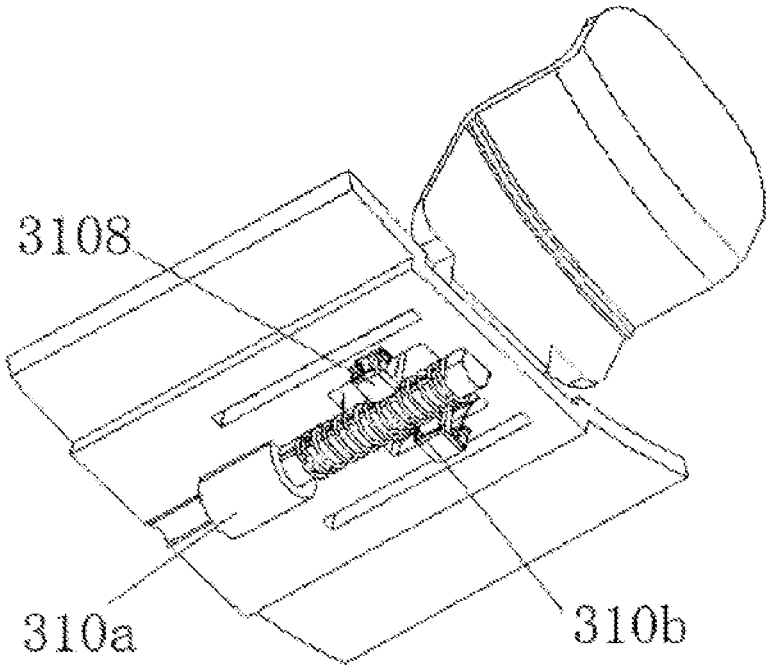
FIG. 87 is a partial schematic diagram of assembly of the poking piece in FIG. 84.
Figure 88:
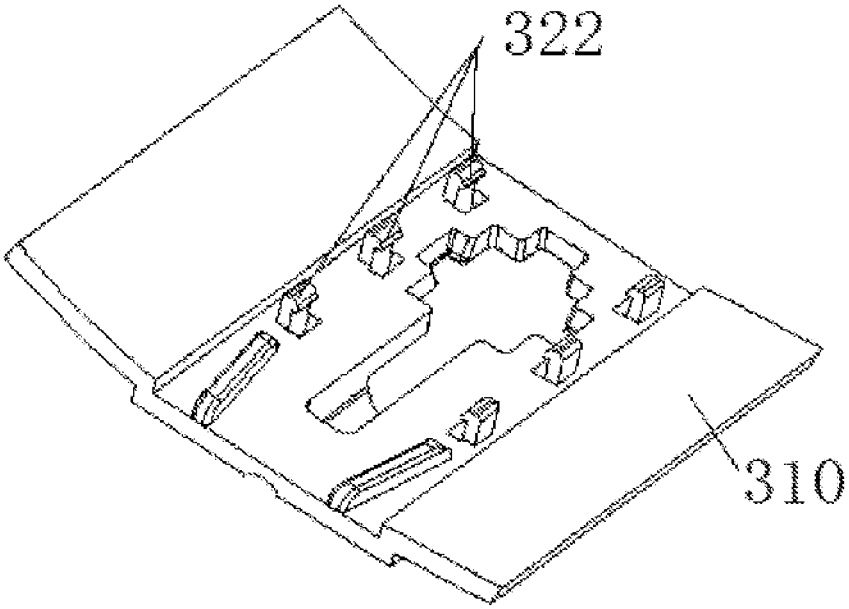
FIG. 88 is a structure diagram of another bottom shell mating with the poking piece in FIG. 84.

As a transformable embodiment, for the poking piece which is configured to disassemble the impeller 320 from the motor, the mounting position of the poking piece on the bottom shell 310 goes down, and the spring is arranged on the surface, far away from the poking piece, of the bottom shell 310. The guide control to the poking piece is realized through a helical spring **310*b* and a spring column 310*a*. A deformation slot 3418 is formed on the poking piece. When the poking piece is squeezed downwards to enter the mounting position of the poking piece on the bottom shell 310, the deformation slot 3418 enables the guide flange 3416 to squeeze and deform towards the center to be pressed in the bottom shell guide portion 322 on the bottom shell 310. On the edge of the bottom shell guide portion 322, the deformation slot is formed on the shell. When the poking piece is squeezed downwards to the mounting position of the poking piece on the bottom shell 310, the deformation slot 3418 on the shell may enable the bottom shell guide portion 322 to expand outwards, and then the guide flange 3416 is pressed in the bottom shell guide portion 322; later, the deformation slot 3418 restores, and the bottom shell guide portion 22 is clamped with the guide flange 3416. That is, guiding and limiting of the poking piece driving portion 3413 of the poking piece on the mounting position of the poking piece on the bottom shell is realized through the mating between the guide flange 3416 and the bottom shell guide portion 322. The poking piece limiting portion 3414 which is configured to be hooked with a lower buckle 3108 of the bottom shell 310 is formed on the poking piece. A rib which is configured to limit may also be arranged on the bottom shell 310 to further limit a moving stroke of the poking piece. The bottom shell guide portion 322 of the mounting position of the poking piece on the bottom shell 310 may be strip-shaped as shown in FIG. 86. As a deformation slot, as shown in FIG. 88, the bottom shell guide portion 322 on the bottom shell 310 may consist of three buckles, which are respectively the first buckle, the second buckle and the third buckle from left to right. When the guide flange 3416 is locked with the first buckle, the impeller 320 is pushed to the position where it is separated from the motor. When the guide flange 3416 is pushed to be locked with the second buckle from the position where it is locked with the first buckle, the poking piece pushing portion 3412 of the poking piece is between the impeller 320 and the motor without interfering the assembly of the impeller 320 and the motor. When squeezed to be mounted on the bottom shell 310, the poking piece is connected with the third buckle on the bottom shell 310 in a locking manner. By setting the first buckle, the second buckle and the third buckle, the position of the poking piece pushing portion 3412** may be figured out, that is, whether it interferes the mating between the fan blade and the motor.

As a transformable embodiment, when the number of the poking pieces is 1, the poking piece is arranged on the end of the impeller 320, and the reset spring is arranged on the other end of the impeller 320. The reset spring applies the bias force, towards the motor, on the impeller 320. When the reset spring and the poking piece are respectively arranged on two ends of the impeller 320, one end of the reset spring presses against the impeller 320 support of the bottom shell 310, and the other end presses against the impeller 321 shaft. When the impeller 320 is mounted to mate with the motor, the reset spring directly acts to push the impeller 320 to the direction of the motor.

The air and water duct module is connected with the base part 101 module through a second mounting structure. In a working state, the second mounting structure includes second fixing holes arranged on the bottom shell 310 in columns on left and right, a second screw holes formed on the base part 101 and corresponding to the second fixing holes at a mounting position of the bottom shell 310 and second screws configured to penetrate through the second fixing holes to form screwed connection with the second screw holes. When the bottom shell 310 is connected on the base part 101, the bottom shell 310 is fixed on the base part 101 by means of an assembling and disassembling structure at first, and then the bottom shell 310 is fastened on the base part 101 by means of the second screw. When the bottom shell 310 is disassembled from the bottom shell 310, first the second screw is disassembled to release the fastened connection between the bottom shell 310 and the base part 101, and then they are separated through the assembling and disassembling structure, as shown FIG. 92 to FIG. 94.

The assembling and disassembling structure includes: the base part 101 and the bottom shell 310 detachably mounted on the base part 101. A locking structure is also arranged between the bottom shell 310 and the base part 101 to be configured to lock or unlock the bottom shell 310 when the bottom shell 310 is assembled or disassembled. After releasing the fasten connection between the bottom shell 310 and the base part 101, the operator may poke the poking plate 343 while holding the bottom shell 310, and then take down the bottom shell 310 from the base part 101, so as to prevent the problem that the bottom shell 310 may be separated from the base part 101 to fall after the fasten connection between the bottom shell 310 and the base part 101 in the air conditioner is released, thereby protecting the operator and preventing the parts on the bottom shell 310 from falling to be damaged. The locking structure includes: a poking plate 343 arranged on the bottom shell 310 in a sliding manner, and a locking groove arranged on the base part 101. The poking plate 343 is suitable to partially extend into the locking groove to lock the bottom shell 310 with the base part 101. When the poking plate 343 does not extend into the locking groove, the bottom shell 310 is unlocked from the base part 101.

Figure 92:
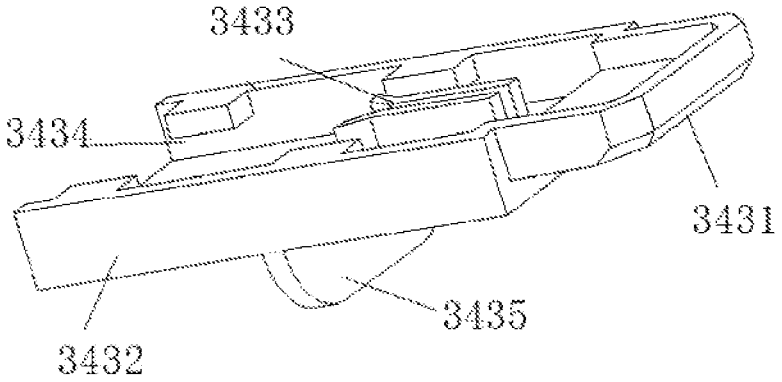
FIG. 92 is a structure diagram of a drive plate in an assembling and disassembling structure of the disclosure.

As a deformation, the locking structure includes: a poking plate 343 arranged on the bottom shell 101 in a sliding manner, and a locking groove arranged on the base part 310. The poking plate 343 is suitable to partially extend into the locking groove to lock the bottom shell 310 with the base part 101. When the poking plate 343 does not extend into the locking groove, the bottom shell 310 is unlocked from the base part 101. The bottom shell 310 and the base part 101 have the assembling and disassembling structure. As shown in FIG. 92, the poking plate 343 includes: the poking plate driving portion 3432 mating with the bottom shell 310 in a sliding manner and a poking plate pushing portion 3431 fixed on the poking plate driving portion 3432. The poking plate driving portion 3432 is suitable to drive the poking plate pushing portion 3431 to extend into the locking groove. By applying an external force on the poking plate driving portion 3432, the poking plate pushing portion 3431 is driven to extend into or extend out of the locking groove. When extending into the locking groove, the poking plate pushing portion 3431 is locked with the locking groove. When extending out from the locking groove, the poking plate pushing portion 3431 is separated from the locking groove to be unlock. A locking bevel mating with the locking groove is formed on the poking plate pushing portion 3431. Through the wedge-shaped bevel, when the poking plate pushing portion 3431 extends into the locking groove, they are locked together.

Figure 93:
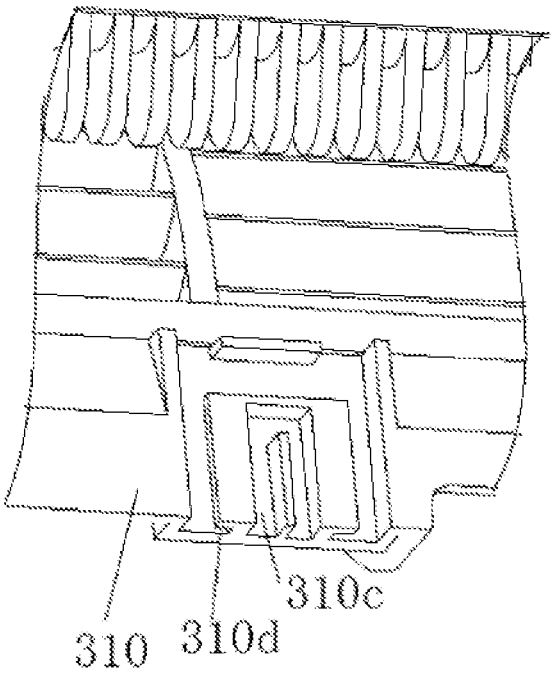
FIG. 93 is a structure diagram of a bottom shell in an assembling and disassembling structure of the disclosure.

As shown in FIG. 93, a guide groove 310*c* and a guide bar 310*d* are formed on the bottom shell 310. A sliding bar 3433, which mates with the guide groove 310*c* on the bottom shell 310 in a sliding and limiting manner, is formed on the poking plate driving portion 3432, so as to guide and limit the poking plate driving portion 3432. A sliding chute 3434, which mates with the guide bar 310*d* on the bottom shell 310 in a sliding and limiting manner, is formed on the poking plate driving portion 3432, so as to guide and limit the poking plate driving portion 3432. It is feasible to select one of the sliding bar 3433 and the sliding chute 3434 to be arranged on the poking plate driving portion 3432. In order to improve the assembly accuracy, both the sliding bar 3433 and the sliding chute 3434 may be arranged.

Two ends of the sliding bar 3433 and the sliding chute 3434 along the sliding direction are correspondingly arranged with bevels mating with the guide groove 310*c* or the guide bar 310*d*, so that the poking plate 343 mates with the bottom shell 310 in a clamping manner when it is on a locked position or an unlocked position. That is, when the poking plate pushing portion 3431 of the poking plate 343 extends into the locking groove, the poking plate 343 mates with the bottom shell 310 in a clamping manner, and the poking plate 343 achieves the aim of locking the bottom shell 310 and the base part 101. When the poking plate pushing portion 3431 of the poking plate 343 extends out from the locking groove, the poking plate 343 still mates with the bottom shell 310 in a clamping manner, and will not fall off from the bottom shell 310. A pushing position 3435 suitable to push the poking plate 343 is formed on the poking plate driving portion 3432, which is convenient for the operator to drive the poking plate driving portion 3432.

Figure 94:
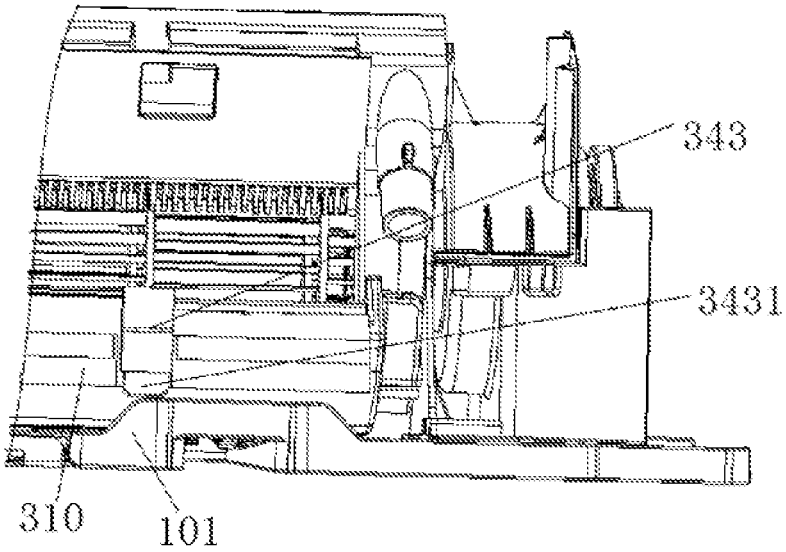
FIG. 94 is a schematic diagram of an assembling and disassembling structure of the disclosure.

There are two locking structures, and they are symmetrically arranged at the joint of the lower part of the bottom shell 310 and the edge of the base part 101. The two locking structures may effectively lock the bottom shell 310 with the base part 101, and it is convenient for the operator to push by two hands the poking plates 343 of the two locking structures at the same time when disassembling the bottom shell 310 and the base part 101. As shown in FIG. 94, the moving direction of the poking plate 343 is vertical to the long side direction of the base part 101. Locking and unlocking between the bottom shell 310 and the base part 101 is realized by vertically pushing the poking plate 343 up and down. Of course, the moving direction of the poking plate 343 may also be parallel to the long side direction of the base part 101. Locking and unlocking between the bottom shell 310 and the base part 101 is realized by horizontally pushing the poking plate 343 leftwards and rightwards.

Figure 111:
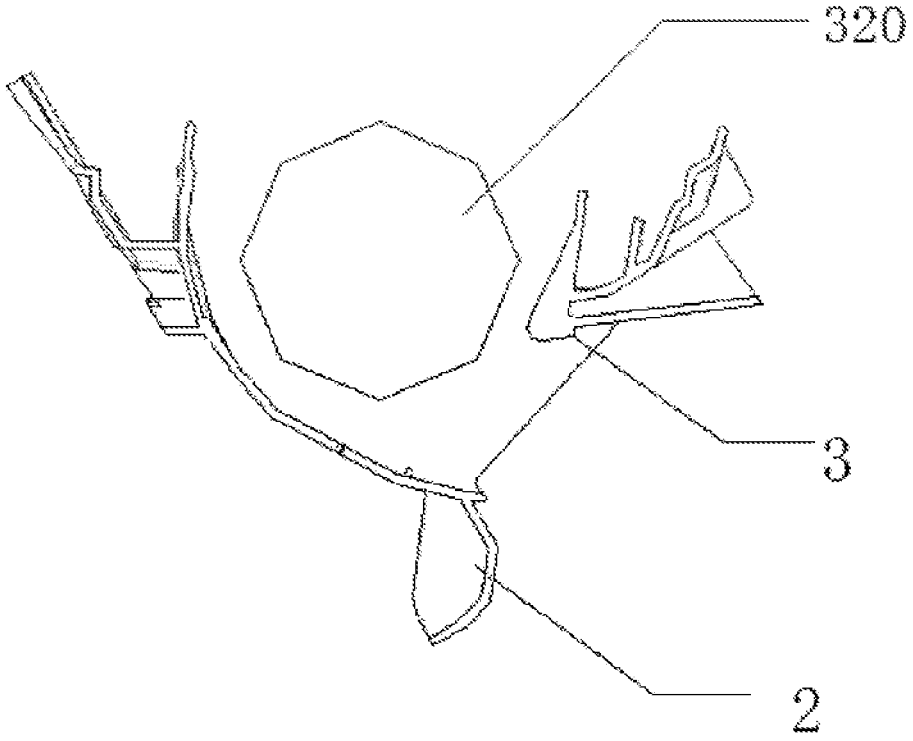
FIG. 111 is a structure diagram of a bottom shell of an air conditioner provided by the disclosure.

As shown in FIG. 111, a bottom shell structure includes: the bottom shell 310 with an air outlet passage 2 and a volute tongue 3. The impeller 320 is detachably mounted on the bottom shell 310. An air outlet structure is arranged on the air outlet passage 2. The volute tongue 3 is arranged in the air outlet passage 2, and is configured to eliminate a vortex generating in the air outlet passage. The volute tongue 3 is formed integrally on the bottom shell 310, and the projects, along the vertical direction of the mounting state, of the air outlet structure and the volute tongue 3 do not overlap.

Through the bottom shell structure of the air conditioner provided by the disclosure, because the volute tongue 3 is formed integrally on the bottom shell 310, vibration generating between the volute tongue 3 and the bottom shell 310 in a working condition is avoided.

Meanwhile, as shown in FIG. 81 to FIG. 111, the projects, along the vertical direction of the mounting state, of the air outlet structure and the volute tongue 3 do not overlap, so when the bottom shell 310 is ejected from a mold, the air outlet structure and the volute tongue 3 do not influence each other, which is beneficial to forming integrally the volute tongue 3 and the bottom shell 310.

In the embodiment, the sliding structure mating with the base part 101 in a sliding manner is arranged on the bottom shell 310. The bottom shell 310 is detachably mounted on the base part 101 through the sliding structure.

Specifically, the air duct and the water duct are formed on the bottom shell 310. When the air duct, the water duct and the impeller 320 need to be cleaned, the bottom shell 310 is directly disassembled from the base assembly. Compared with the problem in the conventional art that the air duct and the water duct cannot be cleaned due to arranging the air duct and the water duct on the bottom shell 310 of the base part 101, or the performance of the fan motor 141 is influenced by wetting when the air duct, the water duct or the impeller 320 are cleaned caused by fixedly connecting the fan motor 141 with the impeller 320 or fixedly mounting the fan motor 141 on the bottom shell 310 formed with the air duct and the water duct, the embodiment can not only clean the air duct, the water duct and the impeller 320, but also prevent the fan motor from being damaged by wetting.

In the embodiment, a top limiting structure 6 mating with the limiting portion on the base part 101 is formed on the top of the bottom shell 310. So the position of the bottom shell 310 on the base part 101 is limited.

In the embodiment, the impeller 320 with the impeller shaft is mounted on the bottom shell 310. The impeller shaft is arranged at a bobbin of the impeller 320 in a penetration manner. One end of the impeller shaft is rotationally mounted in the bottom shell 310, and the other end is in transmission connection with the fan motor 141. As shown in FIG. 110, the end, far away from the motor assembly, of the impeller shaft is also arranged with the reset spring 722. The reset spring 722 applies the bias force, towards the fan motor 141, on the impeller 320. The reset spring 722 applies a constant bias force on the impeller 320 to make the impeller 320 closely lean on the fan motor 141 which is on one side of the impeller 320, thereby preventing a gap generating between the impeller 320 and the fan motor 141 during dissembling. Meanwhile, after the impeller 320 is disassembled or assembled, the impeller 320 may be squeezed to a working position through the reset spring 722, thereby preventing whistling sound of the air conditioner caused by the asymmetry between the position of the impeller 320 and the air outlet of the air conditioner.

Figure 81:
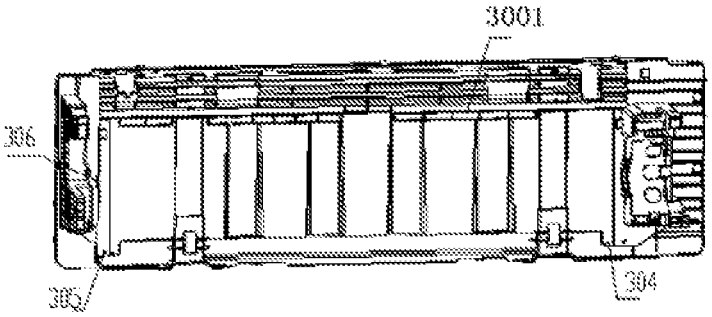
FIG. 81 is a structure diagram of a base part provided by the disclosure.
Figure 103:
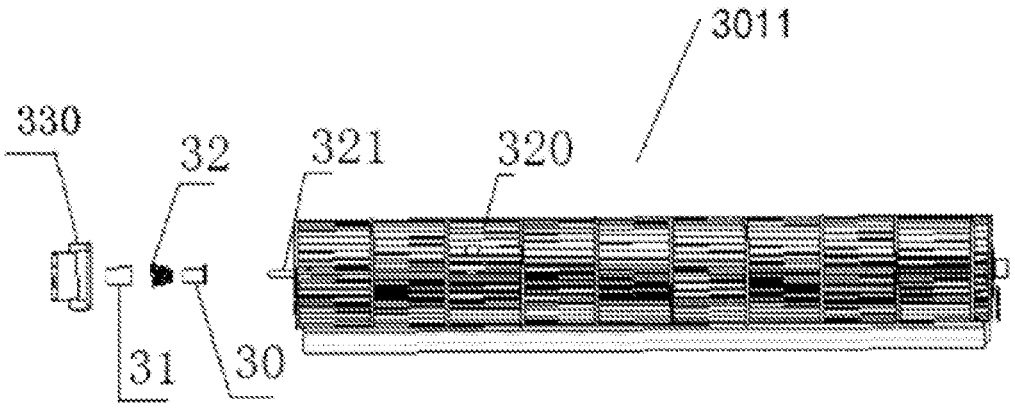
FIG. 103 is an exploded view between a bias piece and an impeller provided by the disclosure.

As shown in FIG. 103, a bias piece is arranged on the end of the impeller shaft 321. The bias piece is the reset spring 722, and includes: a first connecting piece 30 and a spring 32. One end of the first connecting piece 30 is mounted on the end of the impeller shaft, and the other end is connected with the spring 32. The end, far away from the first connecting piece 30, of the spring 32 is connected on the bearing rubber base assembly. The spring 32 is configured to generate the bias force. In the embodiment, as shown in FIG. 81, the bias piece further includes: a second connecting piece 31 arranged between the spring 32 and the bearing rubber base assembly 330. The second connecting piece 31 is connected integrally or detachably on the bearing rubber base assembly 330.

Meanwhile, an inner diameter of the second connecting piece 31 is greater than an outer diameter of the first connecting piece 30. The first connecting piece 30 is inserted in the second connecting piece 31. The spring 32 is mounted in a chamber formed between the first connecting piece 30 and the second connecting piece 31. In an actual working condition, the second connecting piece 31 is in a stationary state, and the first connecting piece 30 is in an active state. The spring 32 provides the bias force for separating the first connecting piece 30 from the second connecting piece 31, so that the first connecting piece 30 pushes the impeller 320 to press the fan motor 141 tight.

Specifically, the first connecting piece 30 has a hollow connecting chamber of which the inner diameter is greater than the outer diameter of the impeller shaft 321. Specifically, the impeller shaft is in sliding connection with the connecting chamber. During use, it is needed to mount the connecting chamber on the impeller shaft at first, and they can be in lubricating connection through the lubricating oil.

As a deformation, the first connecting piece 30 and the impeller shaft 321 may be connected in an interference fit manner. The first connecting piece 30 is closely connected on the impeller shaft 321, so that they are stably connected.

In the embodiment, the first connecting piece 30 is plastic, and the second connecting piece 31 is rubber.

In the embodiment, as shown in FIG. 76, a motor shaft sleeve 720 is mounted on the motor shaft of the fan motor. The end, close to the fan motor 141, of the impeller shaft 321 is mounted with a fan nest 710 in transmission mating with the motor. The motor shaft sleeve 720 has a transmission side face mating with the fan nest 710 when rotating along the transmission direction in which the motor drives the impeller 320 to rotate. The transmission side face is configured to apply an axial force, towards the direction of the motor, on the fan nest. So, a function of connecting stably the fan motor 141 with the impeller 320 is realized.

Specifically, the motor nest 720 uses a structure of a helical sleeve. The helical sleeve goes deep into the chamber of the fan nest 710, and then, by means of the axial force, they are connected through the quick release connecting structure.

Meanwhile, as shown in FIG. 81 and FIG. 9, the poking piece 341 is arranged on the impeller 320. The poking piece 341 is suitable to be configured to drive the impeller shaft 321 to move. When the impeller 320 needs to be separated from the fan motor, it is only needed to poke the poking piece 341, and then the poking piece drives the impeller 320 to move to be separated from the fan motor 141, thus the process of disassembling the impeller 320 is completed.

Figure 43:
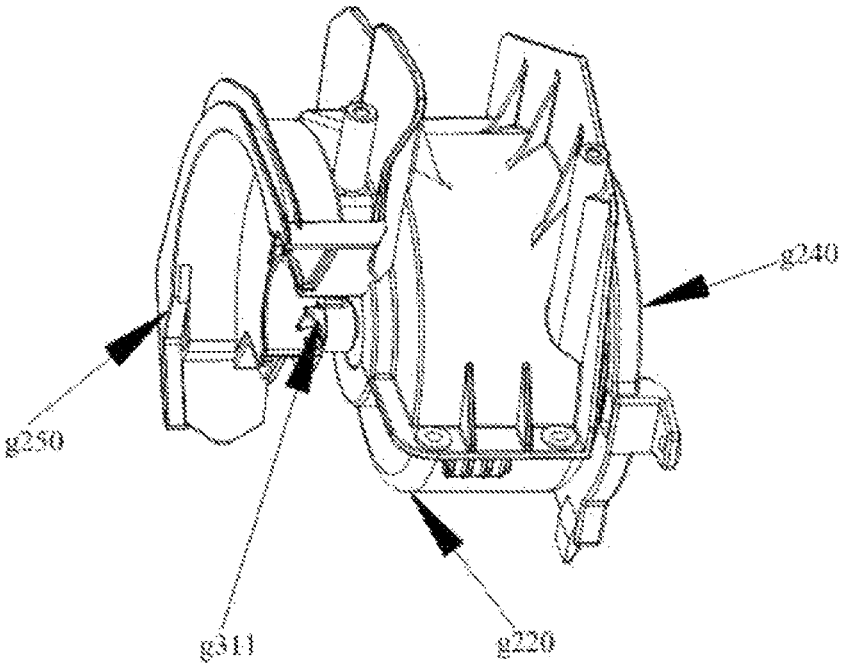
FIG. 43 is a structure diagram of a motor in the motor assembly shown in FIG. 41 and a limiting assembly.
Figure 44:
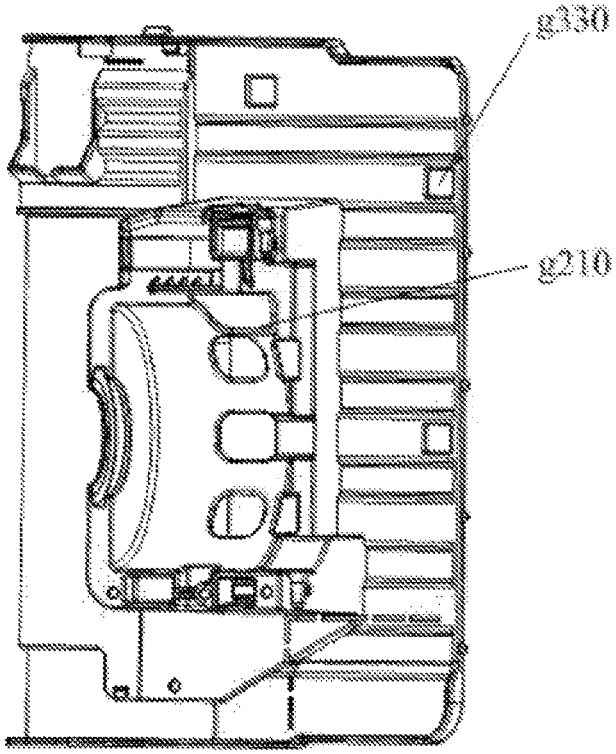
FIG. 44 is a structure diagram of a motor stand in the motor assembly shown in FIG. 41 and a base part.

In the embodiment, as shown in FIG. 81 and FIG. 43, an upper limiting assembly 3001 is a buckle opening downward. An upper clamping structure 302 is fixed on the bottom shell 310 and is suitable to be embedded in the upper limiting assembly 3001. Specifically, the upper limiting assembly 3001 is a U-shaped groove. The upper clamping structure 302 is inserted in the U-shaped groove with good sealing performance. The upper clamping structure on the top of the bottom shell is inserted with good stability in the U-shaped groove with good sealing performance, meanwhile, flowing of airflow from the U-shaped groove is prevented, thereby ensuring the tightness of the air conditioner.

As a deformation, as shown in FIG. 81, the upper limiting assembly 3001 is a clamping chamber of which length is consistent with the length of the upper clamping structure 302. The upper clamping structure 302 is inserted in the clamping chamber with good sealing performance. Adopting a long-distance connection may ensure the stability of the connection while ensuring the sealing performance between the whole bottom shell 310 and the air conditioner.

Meanwhile, as shown in FIG. 81, the lower limiting assembly 304 is a lug boss protruding towards a side of the bottom shell 310. The lower part of the bottom shell 310 is fixed with a lower clamping structure 303 mating with the lug boss. The lower clamping structure 303 is a part of the lower edge, close to the base part 101, of the bottom shell 310. After the upper clamping structure 302 is clamped with the upper limiting assembly 3001 in a mating manner, the lower clamping structure 303 is suitable to be located on the lug boss, thereby preventing the air and water duct module 300 from sliding out from the bottom of the base part 101.

Specifically, a fixedly connecting structure is a combined structure of the lower limiting assembly 304 and the lower clamping structure 303. Meanwhile, in a working state, side limiting assemblies 306 are formed on the positions, corresponding to the left and right sides of the bottom shell 310, of the base part 101. In FIG. 81, the left and right sides of the bottom shell 310 are formed with side clamping structures 307. The side clamping structures 307 may be connected on the side limiting assemblies 306, and are configured to prevent the bottom shell 310 from swaying from side to side in a working state relative to the base part 101.

Specifically, the side clamping structure 307 is an elastic buckle. Two elastic buckles clamp the left and right sides of the bottom shell 310. After the bottom shell 310 is placed in the base part 101, the side clamping structure is squeezed by the bottom shell 310 to move towards the left and right sides. Meanwhile, a threaded hole 305 is formed on the base part 101. A through hole is formed on the position, corresponding to the threaded hole 305, of the bottom shell 310. The bottom shell 310 may be fixed on the base part 101 through the screw, so that the air and water duct module 300 is connected with the base part 101 better.

Figure 89:
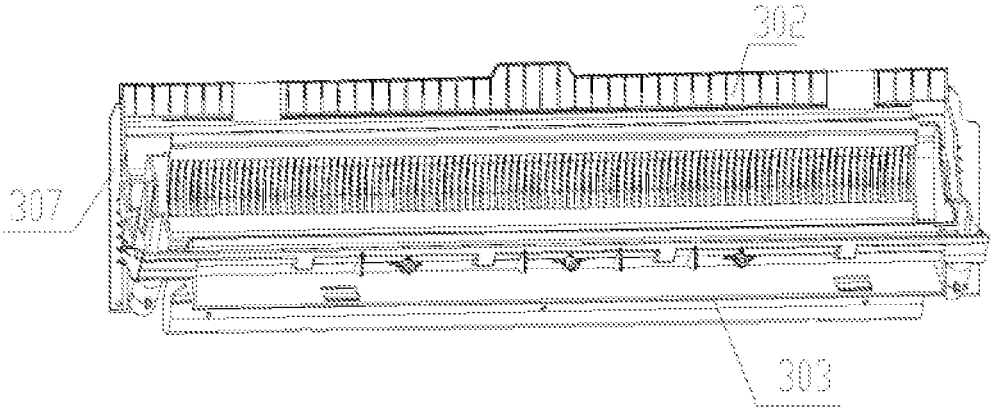
FIG. 89 is a structure diagram of a bottom shell provided by the disclosure.

As shown in FIG. 89, in order to facilitate the disassembly and connection between the base part 101 and the air and water duct module 300, a sliding structure mating with the air and water duct module 300 is arranged on the base part 101. The air and water duct module 300 is suitable to be pulled out from or pushed in the base part 101 through the sliding structure.

Figure 95:
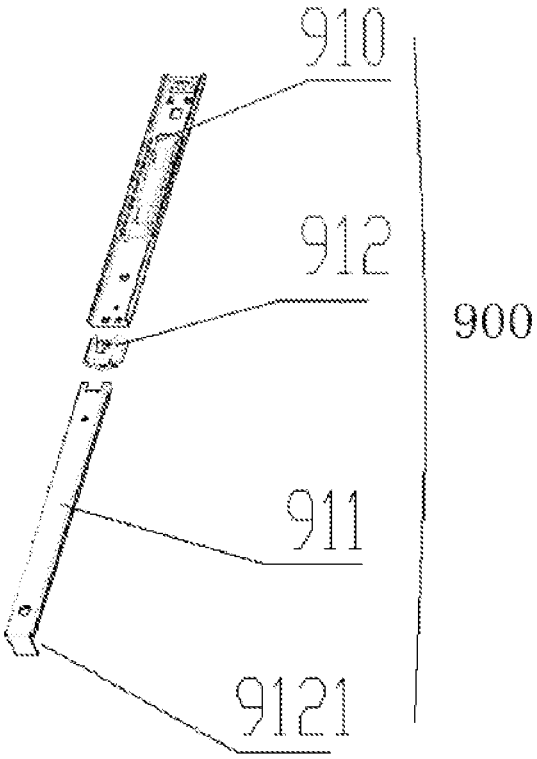
FIG. 95 is a structure diagram of a sliding rail device provided by the disclosure.

In the embodiment, as shown in FIG. 95, the guide structure is a sliding rail device 900. Specifically, the sliding rail device 900 includes a sliding rail base 910 vertically fixed on the base part 101 in a working state, a sliding frame 911 mounted in a sliding chute of the sliding rail base 910 in a sliding manner and a sliding rail end rod of which one end is fixedly mounted on the sliding frame 911. The other end of the sliding rail end rod being fixedly connected with the air and water duct module. A clamping hook is formed on the sliding rail end rod. The clamping hook is connected with the clamping groove formed on the air and water duct module in an inserting and mating manner. A locating block having a function of locating the sliding rail end rod 912 is arranged on the front end of the sliding rail base 910. The locating block has an outward extending expanding structure.

When the air and water duct module 300 needs to be separated from the base part 101, it is only needed to pull the sliding rail device 900 to separate them. When the air and water duct module 300 needs to be mounted on the base part 101, it is only needed to push the sliding rail device 300 in the opposite direction to the base part 101.

Figure 102:
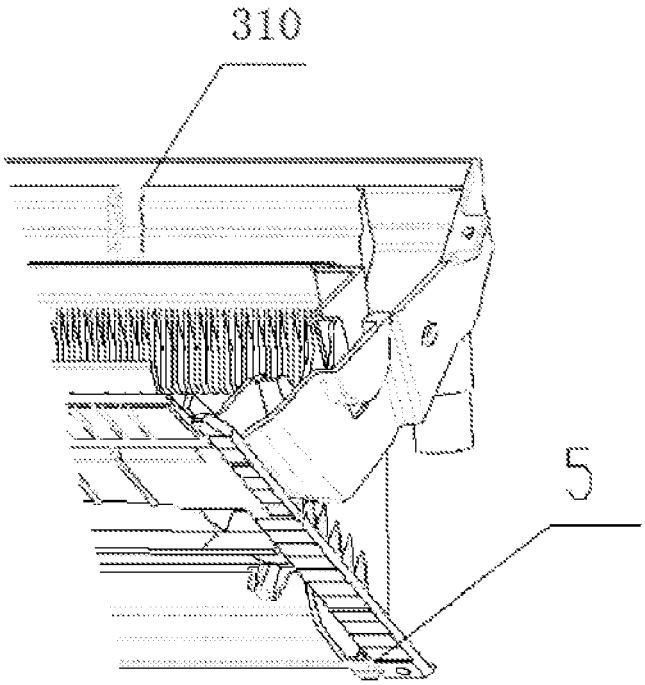
FIG. 102 is a structure diagram of a slide provided by the disclosure.

As a deformation, specifically, as shown in FIG. 102, the sliding structure is a slide 5 which is formed along at least one end of the length direction and is parallel to the width direction. The slide 5 is in line contact with the base part 101. The slide 5 is a curved structure including some groups of arcs which bend towards the same side and are connected each other in order. Convenience is brought to mounting the bottom shell 310 on the base part 101 through the slide.

Through the slide 5 arranged in curved surface, the base part 101 and the bottom shell 310 are in line or surface contact when connected. Compared with the conventional surface contact, such a basic manner can significantly reduce frictional noises between friction surfaces caused by thermal expansion and contraction in industrial control conditions.

Meanwhile, as a deformation, the slide 5 may adopt other shapes, for example, a truss structure, as long as that the base part 101 and the bottom shell 310 are in the line or surface contact when connected is satisfied.

Drain holes from the water groove to the lower side of the bottom shell 310 are formed on two ends of the bottom shell 310, and a water collection groove is arranged on the base part 101. A movable transition water groove is arranged on the water collection groove. A water outlet pipe is arranged on the transition water groove. A water outlet of the water outlet pipe is always in the water collection groove when the transition water groove moves. The transition water groove moves between a ready position and a using position. At the ready position, the whole transition water groove is out of a mounting moving path of the air and water duct module 300, and at the using position, the transition water groove moves to the position where the drain hole is suitable to drain the condensed water in the water groove in the transition water groove. Then, the condensed water is drained in the water collection groove on the base part 101 via the water outlet pipe of the transition water groove, and drained out via the drain pipe connecting to the water collection groove.

Figure 104:
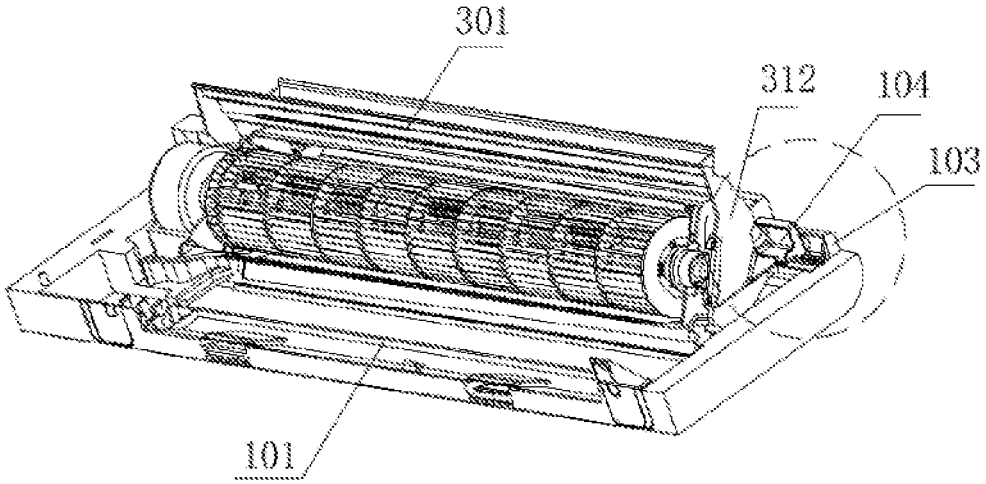
FIG. 104 is a three-dimensional view of an implementation mode of an air conditioner in the disclosure.
Figure 106:
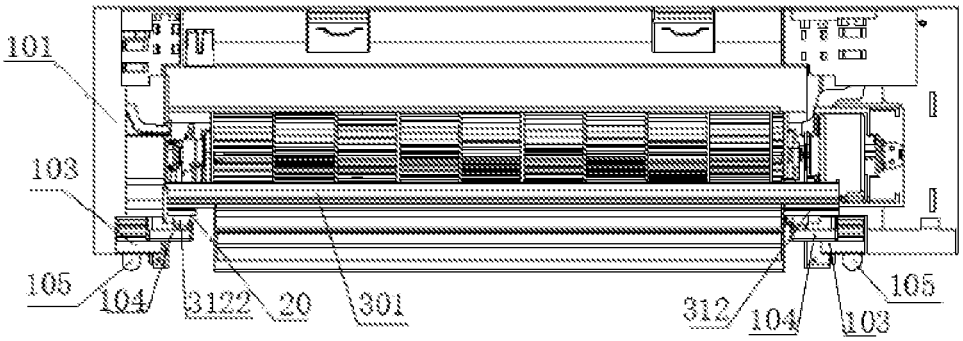
FIG. 106 is a schematic diagram when an air duct assembly of the air conditioner shown in FIG. 104 is in a locked state.

As shown in FIG. 104 and FIG. 106, a specific implementation mode of a water collecting structure of the air conditioner includes a water collecting structure of base 103 and a water passage on bottom shell 312. The water collecting structure of base 103 is arranged on the base part 101 of the air conditioner. A drain pipe 105 is connected on the water collecting structure of base 103. The water passage on bottom shell 312 is arranged on the air duct assembly 301 of the air conditioner, and is configured to collect the condensed water generated by the air duct assembly 301. The water passage on bottom shell 312 is connected with the drain pipe 105 through the water collecting structure of base 103. The water passage on bottom shell 312 mates detachably with the water collecting structure of base 103.

Because the water collecting structure includes the water collecting structure of base 103 on the base part 101 and the water passage on bottom shell 312 arranged on the air duct assembly 301 of the air conditioner, and a drain pipe 105 is connected on the water collecting structure of base 103, when the air duct assembly 301 is mounted on the base part 101, the water passage on bottom shell 312 is connected with the water collecting structure of base 103, and then the air duct assembly 301 is connected with the drain pipe 105. Meanwhile, because the water collecting structure of base 103 mates detachably with the water passage on bottom shell 312, when disassembled, the air duct assembly 301 may be disassembled from the base part 101 through the detachable mating between the water collecting structure of base 103 and the water passage on bottom shell 312 without disassembling the drain pipe 105. In such a manner, when the drain pipe 105 is blocked, the dirt is in the water collecting structure of base 103 or the drain pipe 105, so workloads and difficulties in the disassembling operation are reduced.

Figure 105:
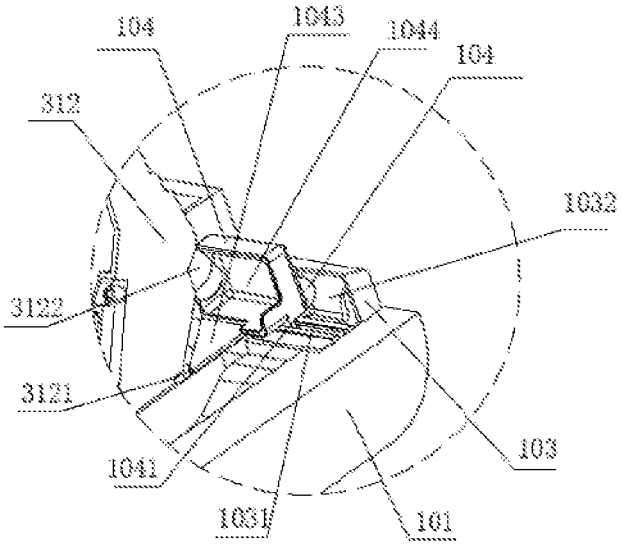
FIG. 105 is a partial enlarged drawing of the air conditioner shown in FIG. 104.

In a manner of realizing the connection between the water passage on bottom shell 312 and the drain pipe 105 through the water collecting structure of base 103, the water collecting structure further includes a sliding water collecting structure 104 which is between the water passage on bottom shell 312 and the water collecting structure of base 103 to connect them. The sliding water collecting structure 104 at least mates detachably with one of the water passage on bottom shell 312 and the water collecting structure of base 103, and then, when the air duct assembly 301 is disassembled, the water passage on bottom shell 312 and the water collecting structure of base 103 may keep a stable connected state through the sliding water collecting structure 104, thereby ensuring that the dirt will not fall out in the disassembling process. As shown in FIG. 104 and FIG. 105, in terms of the connection between the sliding water collecting structure 104 and the water collecting structure of base 103, a first hollow drainage column 1042 is arranged on the bottom of the sliding water collecting structure 104, a first drainage groove 1032 is arranged on the water collecting structure of base 103, and the sliding water collecting structure 104 is connected with the water collecting structure of base 103 through the first drainage column 1042 and the first drainage groove 1032. In terms of the connection between the sliding water collecting structure 104 and the water passage on bottom shell 312, a third hollow drainage column 3122 is arranged on the water passage on bottom shell 312, a third drainage groove 1044 is arranged on the sliding water collecting structure 104 corresponding to the third drainage column 3122, and the water passage on bottom shell 312 is connected with the sliding water collecting structure 104 through the third drainage column 3122 and the third drainage groove 1044.

As a deformed implementation mode, a second hollow drainage column (not shown in the drawing) is arranged on the bottom of the sliding water collecting structure 104, a second drainage groove (not shown in the drawing) is arranged on the water collecting structure of base 103, and the sliding water collecting structure 104 is connected with the water collecting structure of base 103 through the second drainage column and the second drainage groove, so that the connection between the sliding water collecting structure 104 and the water collecting structure of base 103 is realized. Meanwhile, when the sliding water collecting structure 104 moves relative to the water collecting structure of base 103, the second drainage column slides in the second drainage groove adaptively, so as to limit a relative movement between the sliding water collecting structure 104 and the water collecting structure of base 103, and then the relative movement between the sliding water collecting structure 104 and the water collecting structure of base 103 is realized. To sum up, setting the second drainage column and the second drainage groove realizes not only a function of connecting, but also a function of limiting the relative movement, so that the sliding structure and the connecting structure are integrated effectively, and the sliding water collecting structure 104 and the water collecting structure of base 103 are simplified. Meanwhile, in order to ensure that the sliding water collecting structure 104 and the water collecting structure of base 103 keep the connected state in the disassembling process, the sliding water collecting structure 104 is movably arranged on the water collecting structure of base 103. When moving towards a disassembling direction, the water passage on bottom shell 312 pushes the sliding water collecting structure 104 to move relative to the water collecting structure of base 103. Specifically, a first sliding rail 1031 is arranged on the sliding water collecting structure 103, a first slide block 1041 is arranged on the sliding water collecting structure 1041 corresponding to the first sliding rail 1031, and the first slide block 1041 slides movably in the first sliding rail 1031. When the first slide block 1041 slides in the first sliding rail 1031, the first drainage column 1042 slides in the first drainage groove 1032, thereby ensuring the stability of connection between the sliding water collecting structure 104 and the water collecting structure of base 103 when the sliding water collecting structure 104 slides in the water collecting structure of base 103.

In addition, the relative sliding between the sliding water collecting structure 104 and the water collecting structure of base 103 is also implemented in a manner that the sliding water collecting structure 104 moves relative to the base part 101, that is, a second sliding rail (not shown in the drawing) is arranged on the base part 101, a second slide block (not shown in the drawing) is arranged on the sliding water collecting structure 104 corresponding to the second sliding rail, and the second slide block slides movably in the second sliding rail. When a manner of setting the first sliding rail 1031 on the water collecting structure of base 103, setting the first slide block 1041 on the sliding water collecting structure 104 corresponding to the first sliding rail 1031, and meanwhile, setting the second sliding rail on the base part 101, and setting the second slide block on the sliding water collecting structure 104 corresponding to the second sliding rail is adopted, the relative movement between the sliding water collecting structure 104 and the water collecting structure of base 103 is more stable through the mating between the first sliding rail 1031 and the first slide block 1041 and the mating between the second sliding rail and the second slide block.

Figure 107:
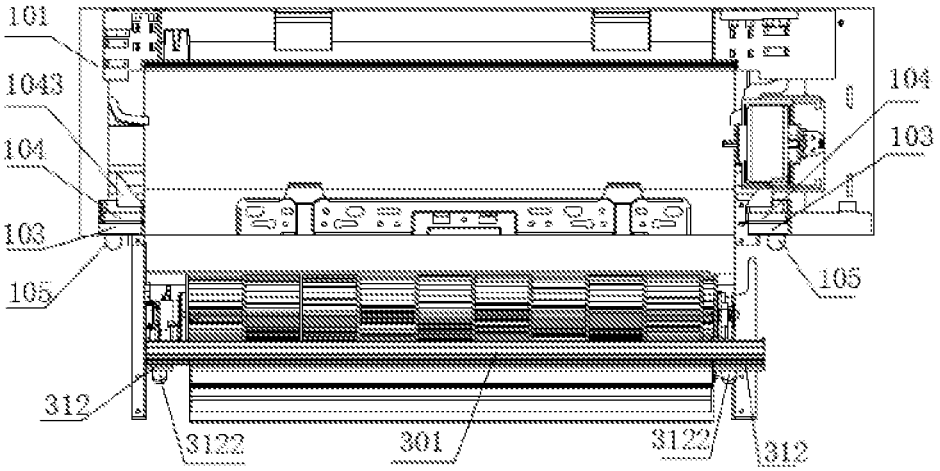
FIG. 107 is a schematic diagram that an air duct assembly of the air conditioner shown in FIG. 104 is in a disassembled state.
Figure 108:
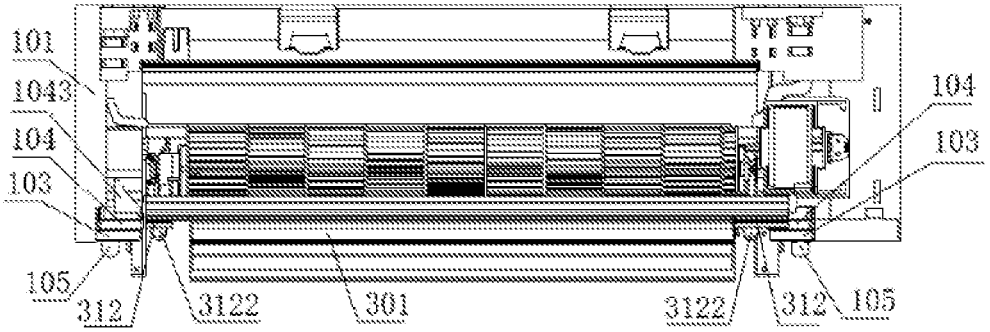
FIG. 108 is another schematic diagram that after an air duct assembly of the air conditioner shown in FIG. 104 is mounted in place, a water collecting structure on the left is not locked, and a water collecting structure on the right is locked.
Figure 109:
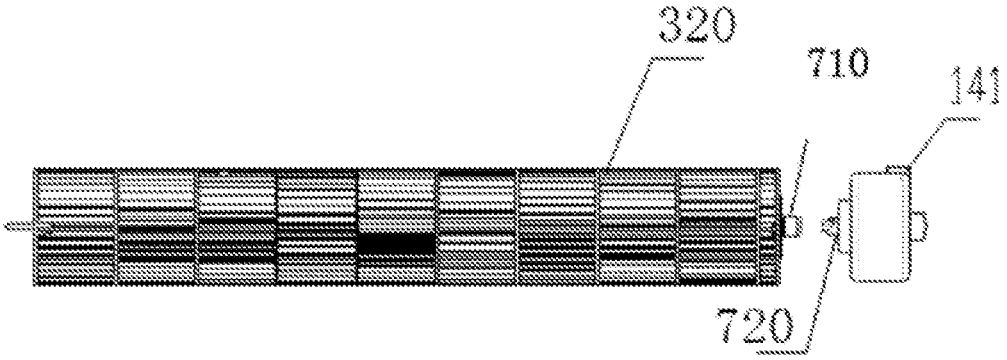
FIG. 109 is a schematic diagram of connection between a poking piece and an impeller provided by the disclosure.

As shown in FIG. 106 to FIG. 108, the assembling and disassembling direction of the air duct assembly 301 is different from the sliding direction of the first slide block 1041 in the first sliding rail 1031, so in the process of disassembling the water passage on bottom shell and the water collecting structure of base 103, a guiding structure is arranged between a sliding drain structure and the water passage on bottom shell 312. The guiding structure converts the acting force of the water passage on bottom shell 312 along the disassembling direction into the acting force of the sliding water collecting structure 104 along the sliding direction. Specifically, the guiding structure includes a poking structure 3121 fixedly arranged on the water passage on bottom shell 312 and a guiding block 1043 fixedly arranged on the sliding water collecting structure 104. The guiding block 1043 has a guiding bevel. When the water passage on bottom shell 312 is disassembled, the poking structure 3121 pushes the guiding bevel, so that the first slide block 1041 of the sliding water collecting structure 104 fixedly arranged with the guiding block 1043 slides in the first sliding rail 1031; and then in the process of disassembling the air duct assembly 301, the poking structure 3121 pushes the guiding bevel to decompose the force applied on the guiding bevel into the force along the first sliding rail 1031, so that the first slide block 1041 of the sliding water collecting structure 104 fixedly arranged with the guiding block 1043 slides in the first sliding rail 11. That is, movements in two directions may be implemented only by applying the acting force in one direction, so the disassembling operation becomes simpler and more efficient.

In addition, a self-locking structure (not shown in the drawing) is arranged on the sliding water collecting structure 104. When the water passage on bottom shell 312 is assembled in place, the sliding water collecting structure 104 is fixed in the water collecting structure of base 103 through the self-locking structure, and limits the water passage on bottom shell 312 to move on the base part 101, so that the air duct assembly 301 is assembled in place through the self-locking structure on the sliding water collecting structure 104 without adding the locking structure.

As an alternative implementation mode, there are two groups of water collecting structures. The water passages on bottom shell 312 of the two groups of water collecting structures are fixedly arranged on the left and right sides of the air duct assembly 301 respectively, and the water collecting structure of base 103 and the sliding water collecting structure 104, mating with their own water passages on bottom shell 312, in the two groups of water collecting structures are arranged on the left and right sides of the base part 101 respectively and correspondingly.

Embodiment 4

The embodiment provides an evaporator, and a connected structure of the evaporate and a bottom shell. The connected structure mainly includes the bottom shell a310 and the evaporator arranged on the bottom shell a310.

The evaporator is an important component of a heat exchange module in an air conditioner. The heat exchange module includes a fin a220 which is entirely supported by angular frames on two ends and cross section of which is inverted-U-shaped. Two ends of the fin a220 are arranged with sealing parts, so an open chamber 222 is formed in the inverted-U-shaped inside of the fin a220. The pipeline in the fin a220 is connected with an outdoor unit through connection pipelines consisting of a liquid inlet pipe a2231 and an air collection pipe a2232. In the embodiment, there are tee structures a2233 and a2234 arranged on both the liquid inlet pipe a2231 and the air collection pipe a2232. Both sides of the fin a220 are arranged with outdoor unit connection terminals of the connection pipelines through the tee structures a2233 and a2234.

In the embodiment, both the liquid inlet pipe a2231 and the air collection pipe a2232 are connected on the side, far away from a motor bracket 110, of the fin a220. One branch passing through the tee structures a2233 and a2234 forms a U-shaped bend which bypasses the motor bracket 110 from the side, far away from a back plate of a base part a101, of the motor bracket after extending beyond the length of the fin a220 at a position close to the back plate of the base part a101, reaches a lower edge of the back plate of the base part a101 in a working and mounting state, and bends, at the position close to the back plate of the base part a101, towards an end of the base part a101 on this side. Another branch passing through the tee structures a2233 and a2234 extends to the lower edge of the back plate of the base part a101 in the working and mounting state on this side, and bends, at the position close to the back plate of the base part a101, towards the end of the base part a101 on this side. A fixing structure is arranged on the angular frame 210. In the embodiment, the fixing structure is a connection pipe clamping groove 211 formed on the angular frame 210. The extending parts of the connection pipelines are clamped in the connection pipe clamping groove 211 to realize a fixing function. The fixing structure fixes the position of the extending parts of the connection pipelines, thereby improving the security of the pipeline during running.

The above embodiment may adjust arrangement of the connection pipelines (namely a combination of the liquid inlet pipe a2231 and the air collection pipe a2232) according to needs. When the outdoor unit connection terminal needs to be arranged on only one side aiming at a particular user, it is only needed to connect the pipeline of the fin a220 with the liquid inlet pipe a2231 and the air collection pipe a2232 at the proper position of the corresponding side of the fin a220.

When it is needed to arrange the outdoor unit connection terminals on two sides, both the connection pipelines in the above embodiment may also be connected on the side, close to the motor bracket 110, of the fin a220. In such a manner, convenient assembly and disassembly may be realized. However, in this case, if one branch passing through the tee structures a2233 and a2234 still extends beyond the length of the fin a220 from the position close to the back plate of the base part a101, and reaches the end, far away from the motor bracket 110, of the base part a101, it is needed to arrange four side-by-side pipelines on the side close to the motor bracket 110, which increases the length of the heat exchange module, and then increases the whole length of the indoor unit. However, if a solution that one branch passing through the tee structures a2233 and a2234 extends beyond the length of the fin a220 from the position, far away from the base part a101, of the fin a220 is adopted, there is no such problem. But after the exterior module 400 is opened, the inside looks messy.

Figure 113:
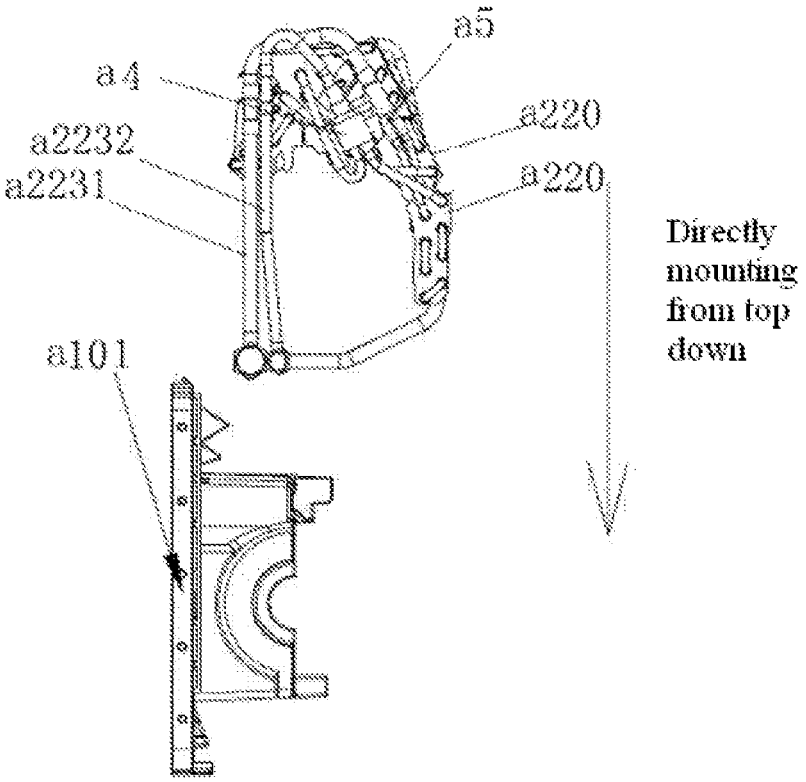
FIG. 113 is a left view of FIG. 112.
Figure 114:
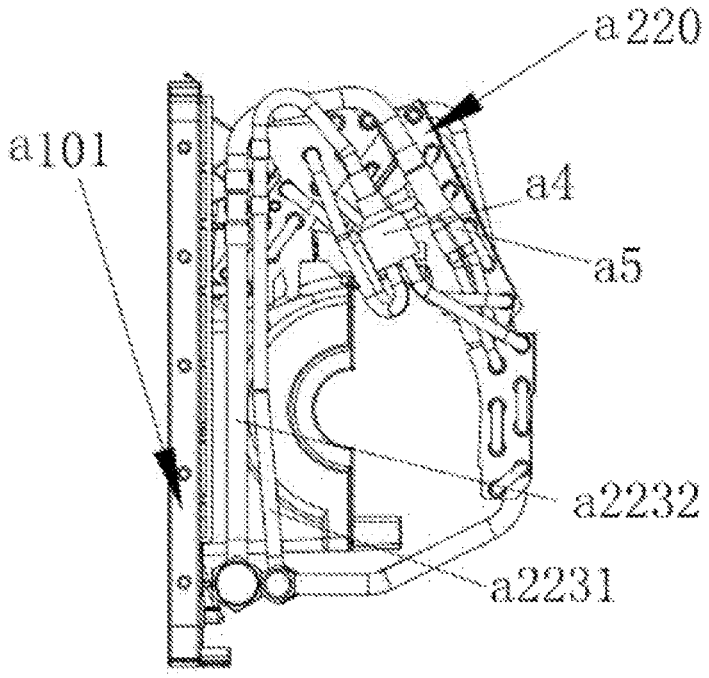
FIG. 114 is a structure diagram after the evaporator and the base part in FIG. 112 are mounted.
Figure 115:
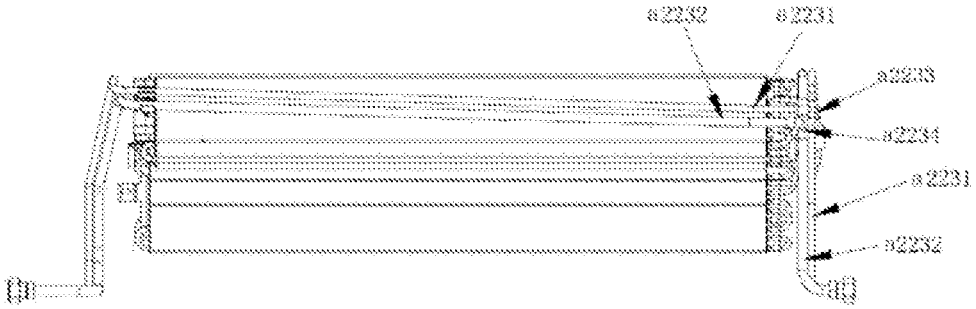
FIG. 115 is a structure diagram of an implementation mode that two sides of an evaporator respectively extend out of a liquid inlet pipe and an air collection pipe.
Figure 116:
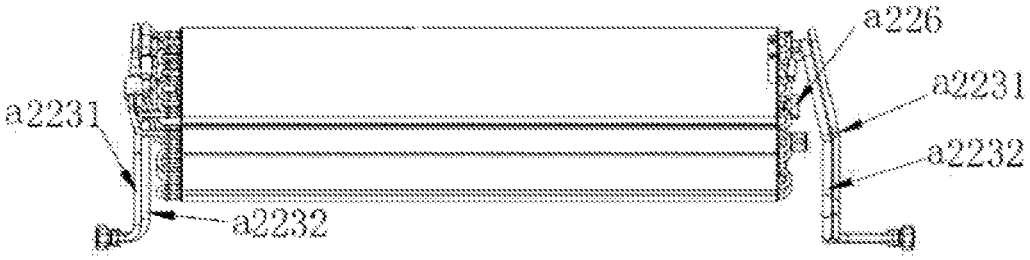
FIG. 116 is a rear view of FIG. 115.
Figure 117:
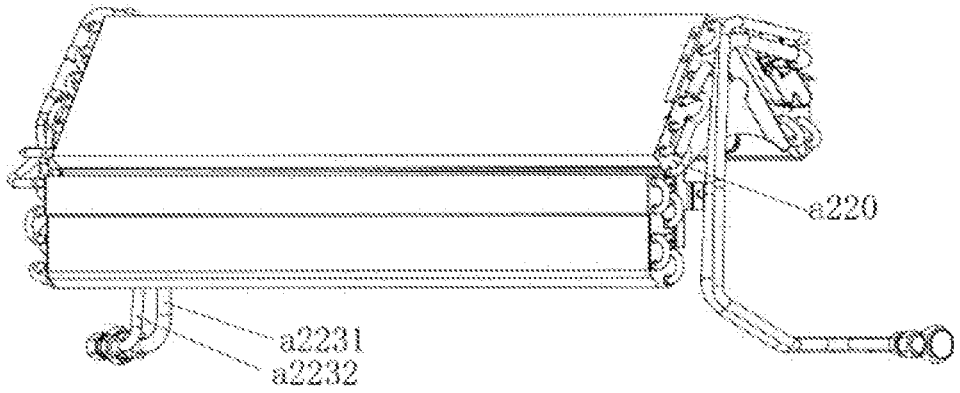
FIG. 117 is a three-dimensional view of FIG. 116.

The evaporator of the embodiment mainly consists of the fin a220 formed with a number of refrigerant flow channels. The refrigerant flow channel are connected in order through U-shaped pipes therebetween. An open end of the U-shaped pipe is detachably arranged with an elbow to form a complete refrigerant flow channel. The refrigerant flow channel includes a refrigerant inlet and a refrigerant outlet arranged on the first side of the fin a220, and further includes the liquid inlet pipe a2231 and the air collection pipe a2232 respectively connected with the refrigerant inlet and the refrigerant outlet. A number of liquid inlet pipes a2231 and a number of air collection pipes a2232 are respectively combined into a header liquid inlet pipe a2231 and a header air collection pipe a2232 through a liquid separating head a4 and an air collecting head a5. In the embodiment, the fin a220 and the liquid inlet pipe a2231 and the air collection pipe a2232 arranged thereon are preferentially arranged on the same side of the base part a101, so that the fin a220 may be assembled on the base part a101 from the top down. The significance of arranging the fin a220 and the liquid inlet pipe a2231 and the air collection pipe a2232 arranged thereon on the same side of the base part a101 lies in: after the fin a220 and the liquid inlet pipe a2231 and the air collection pipe a2232 are formed into an assembly, and the assembly is assembled with the bottom shell a310, there is no need to bend the liquid inlet pipe a2231 and the air collection pipe a2232 to another side of the bottom shell a310, so that the mounting steps are simplified. Specifically, there is no need to manually bend the liquid inlet pipe a2231 and the air collection pipe a2232 and manually bend them back to design angles after assembling is completed, so this manner is suitable to use mechanized automated assembly, helps to improve the production efficiency and reduce the production cost. Specifically, referring to FIG. 112, FIG. 113 and FIG. 114, the evaporator may be directly assembled on the bottom shell a310 from the top down.

Figure 112:
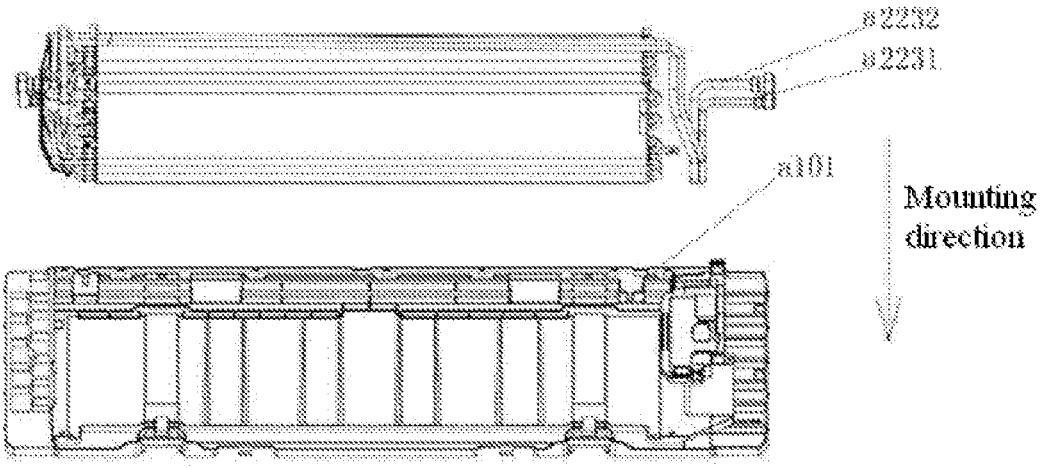
FIG. 112 is a split diagram of an evaporator and a base part according to an embodiment of the disclosure, and also shows a mounting direction.

It is to be noted that assembling the evaporator on the bottom shell a310 from the top down is that after the base part a101 is fixed, the evaporator may be directly mounted on the base part a101 from the front side of the base part a101. For example, when the base part is arranged horizontally in a form as shown in FIG. 112, the evaporator is assembled from the top down as shown in the drawing; when the base part is vertically arranged, the evaporator may be mounted horizontally on the base part a101.

On the other hand, when the existing air conditioner is mounted, the joint where the liquid inlet pipe a2231 and the air collection pipe a2232 are connected with the outdoor unit is on the rear side of the base part a101, it is needed to keep the base part a101 in a forward supported state to complete the connection of the pipes in the process of mounting the air conditioner. In the above implementation mode, obviously the liquid inlet pipe a2231 and the air collection pipe a2232 are on the front side of the base part a101 together with the evaporator, so there is no need to support forward the base part a101 in the process of mounting the air conditioner.

In the embodiment, water grooves a312 are arranged on the front end and the back end, corresponding to the evaporator, of the bottom shell a310. The liquid inlet pipe a2231 and the air collection pipe a2232 are connected on the evaporator (namely the fin a220). The liquid inlet pipe a2231 and the air collection pipe a2232 are bent and arranged in the water groove a312. Thus, in the running process of the air conditioner, after the evaporator contacts with air carrying water vapor, the water vapor condenses on the surface of the evaporator, and gather in the water groove a312 along the surface of the evaporator, and after extending in the water groove a312, the liquid inlet pipe a2231 and the air collection pipe a2232 may keep cool by means of the water in the water groove, thereby preventing unnecessary heat exchange between the outside and the refrigerant in the liquid inlet pipe a2231 and the air collection pipe a2232, and helping to improving an Energy Efficiency Ratio (EER) of the air conditioner. Furthermore, the water vapor has a relatively low temperature after condensing, so an effect of keeping the liquid inlet pipe a2231 and the air collection pipe a2232 cool is further improved; at the same time, there is always condensed water in the water groove a312, so the effect of keeping the liquid inlet pipe and the air collection pipe cool is not decreased in a long-term use.

In the embodiment, the liquid inlet pipe a2231 and the air collection pipe a2232 are connected on the fin a220. There are two groups of liquid inlet pipes a2231 and the air collection pipes a2232, and they extend, towards the two sides of the fin a220, out from the evaporator shell Through the above implementation mode, the liquid inlet pipe a2231 and the air collection pipe a2232 may be connected with an outdoor unit connection pipe on both sides of the evaporator, so it is beneficial to reducing the step of bending the pipe during mounting the air conditioner. Specifically, when mounting the air conditioner, the operator may select the proper side to directly connect the pipes with the outdoor unit connection pipe, so the step of bending the connection pipe to the other side of the air conditioner is eliminated.

It is to be noted that the liquid inlet pipe a2231 and the air collection pipe a2232 may be arranged in one group or two groups. When the liquid inlet pipe a2231 and the air collection pipe a2232 are arranged in one group:

as a preference of the above implementation mode, the liquid inlet pipe a2231 and the air collection pipe a2232 are connected on the first side of the fin a220, and extend out of the evaporator shell from the first side of the fin a220; the liquid inlet pipe a2231 and the air collection pipe a2232 may also be connected on the first side of the fin a220, and extend out of the evaporator shell from the second side of the fin a220 after being bent.

Specifically, there are following two forms of making pipe out about that the liquid inlet pipe a2231 and the air collection pipe a2232 are connected on the first side of the fin a220, and extend out of the evaporator shell from the first side of the fin a220:

1. the liquid inlet pipe a2231 and the air collection pipe a2232 are connected on the first side of the fin a220 and bent upwards along the contour of the fin a220 to approach the bottom shell a310, and then, they are bent downwards along the contour of the bottom shell a310 and bent towards the first side of the fin a220, so as to extend out of the evaporator shell;

2. as an alternative of the above implementation mode, the liquid inlet pipe a2231 and the air collection pipe a2232 are bent downwards along the contour of the fin a220 to be far away from the bottom shell a310, and bent towards the first side of the fin a220.

Because the inside of the chamber formed between the base part a101 and the evaporator shell may be configured to arrange the motor and other parts, by adopting the above two forms of making pipe out, that is, the liquid inlet pipe a2231 and the air collection pipe a2232 are arranged along the contours of the base part a101 and the evaporator shell, the liquid inlet pipe a2231 and the air collection pipe a2232 are prevented from occupying available space, and structure design of the air conditioner is optimized.

When the liquid inlet pipe a2231 and the air collection pipe a2232 are arranged in two groups:

As a preferred implementation mode, the first group of liquid inlet pipes a2231 and air collection pipes a2232 are connected on the first side of the fin a220; the tee structures a2233 and a2234 are respectively arranged on the first group of liquid inlet pipes a2231 and air collection pipes a2232; the second group of liquid inlet pipes a2231 and air collection pipes a2232 are respectively connected with two tee structures a2233 and a2234, so that the second group of liquid inlet pipes a2231 and air collection pipes a2232 are connected with the first group of liquid inlet pipes a2231 and air collection pipes a2232. In such case, the first group of liquid inlet pipes a2231 and air collection pipes a2232 extend out of the evaporator shell towards the first side of the fin a220, and the second group of liquid inlet pipes a2231 and air collection pipes a2232 extend towards the second side of the fin a220 from the joint, and extend out of the evaporator shell from the second side of the fin a220.

Specifically, there are several forms of arranging pipes for the second group of liquid inlet pipes a2231 and air collection pipes a2232. The different forms of arranging pipes may achieve different effects, which are illustrated below by giving examples in combination with the drawings FIG. 115, FIG. 116, FIG. 117, FIG. 118, FIG. 119 and FIG. 120.

Specifically, the fin a220 is formed by connecting a number of folding fins in order. The first folding fin is arranged close to the base part a101, and the last folding fin is farthest from the base part a101. After extending to the second side of the fin a220, the liquid inlet pipe a2231 and air collection pipe a2232 extend out towards the second side of the fin a220 after being bent.

Figure 118:
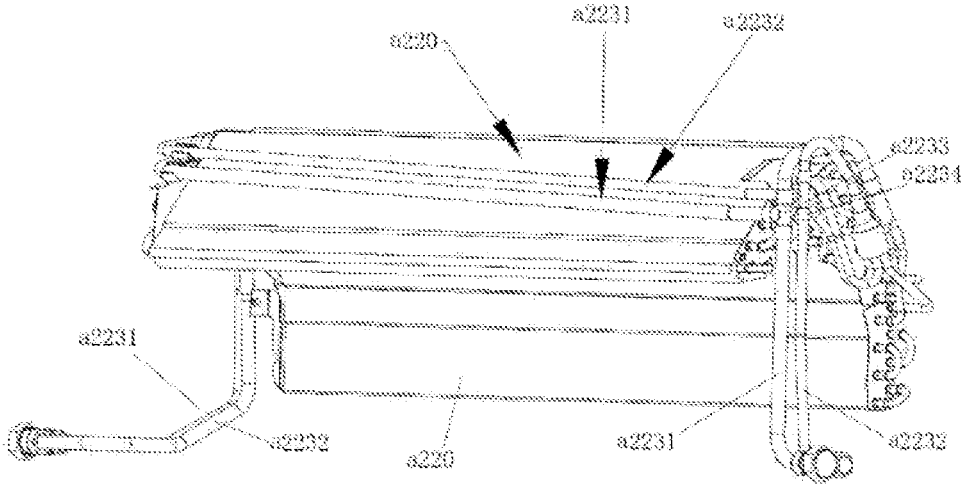
FIG. 118 is a rear view of FIG. 117.
Figure 119:
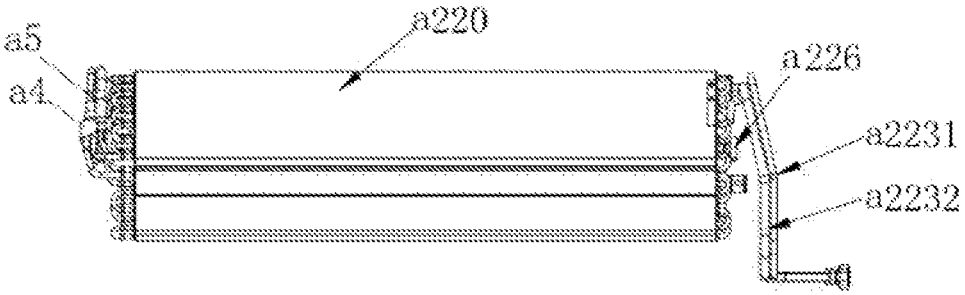
Figure 120:
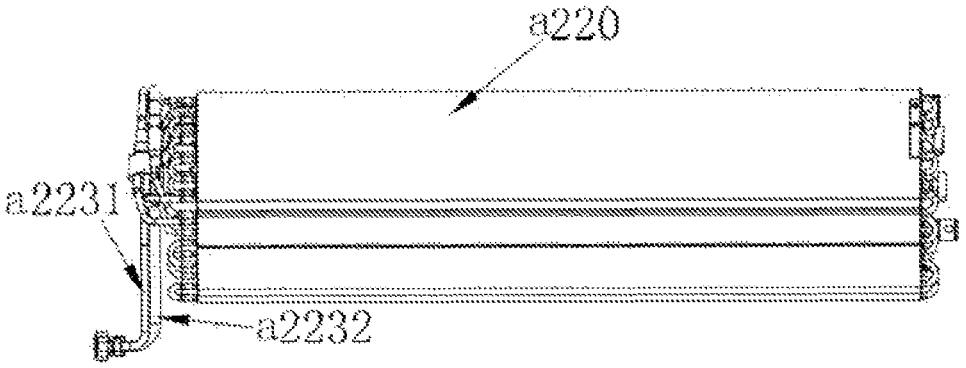

As a preferred implementation mode, the second group of liquid inlet pipes a2231 and air collection pipes a2232 extend from the upper part of the fin a220 (especially the upper part of the first folding fin) to the second side of the fin a220. Preferably, the parts, across the top of a first folding evaporator, of the second group of liquid inlet pipes a2231 and air collection pipes a2232 are arranged slantwise along the top surface of the evaporator, and an included angle between an inclined direction and a horizontal direction is 0-10 degrees. Specifically, as shown in FIG. 118, the second group of liquid inlet pipes a2231 and air collection pipes a2232 may extend on the top surface of the evaporator at angles of inclination 0 degree, namely horizontally, 1 degree, 2 degrees, 3 degrees, 4 degrees, 5 degrees, 6 degrees, 7 degrees, 8 degrees, 9 degrees, and 10 degrees. The angle of inclination is the included angle between the second group of liquid inlet pipes a2231 and air collection pipes a2232 and the bottom shell a310.

As a preferred implementation mode, the second group of liquid inlet pipes a2231 and air collection pipes a2232 are bent upwards along the contour of the fin a220 to approach the bottom shell a310 on the second side of the fin a220 at first, and then, they are bent downwards along the contour of the bottom shell a310 and bent towards the first side of the fin a220, so as to extend out from the evaporator shell.

As an alternative of the above implementation mode, the second group of liquid inlet pipes a2231 and air collection pipes a2232 are bent downwards along the contour of the fin a220 to be far away from the bottom shell a310 on the second side of the fin a220 at first, and then, they are bent towards the first side of the fin a220. The beneficial effects of the above two forms of arranging the pipes in a bending manner have been elaborated in the above implementation mode, so they will not be repeated here.

Figure 121:
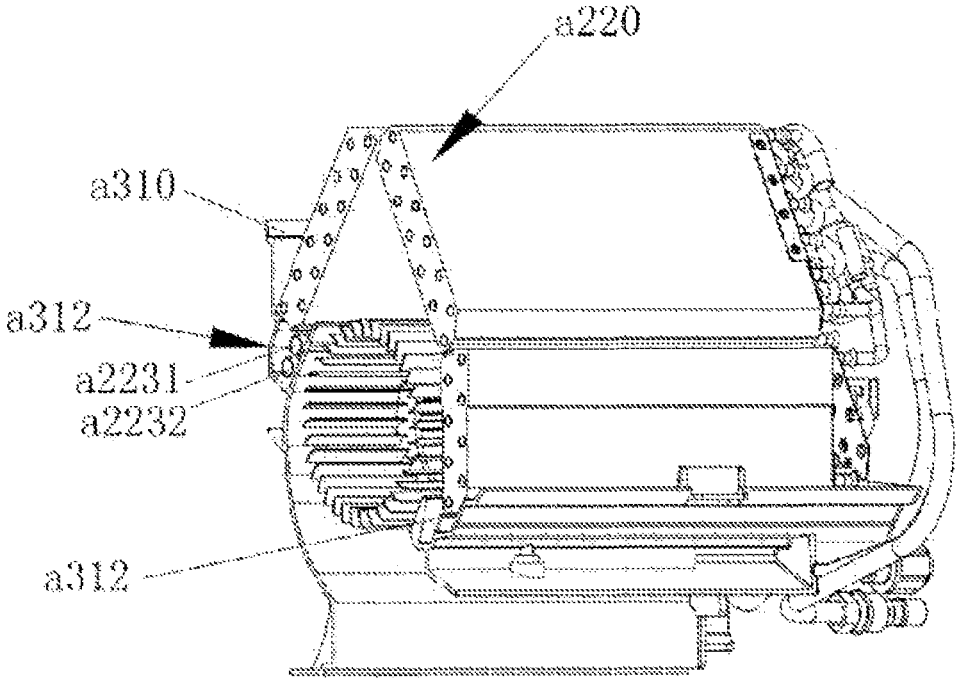

As an alternative of the above implementation mode, referring to FIG. 121, the front end or the rear end of the bottom shell a310 is arranged with the water groove a312. The second group of liquid inlet pipes a2231 and air collection pipes a2232 may extend from the first side of the fin a220 to the second side of the fin a220 through any water groove. The beneficial effect of setting the liquid inlet pipe a2231 and the air collection pipe a2232 in the water groove a312 has been elaborated in the above implementation mode, so it will not be repeated here.

Figure 122:
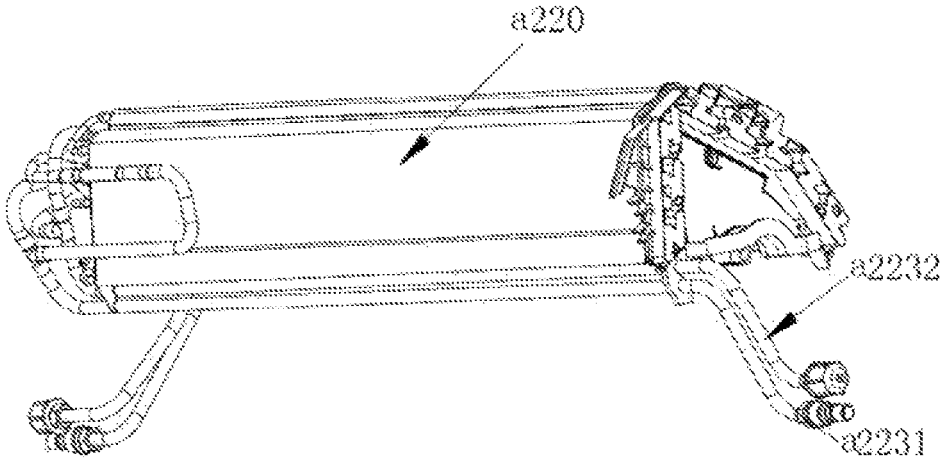
Figure 123:
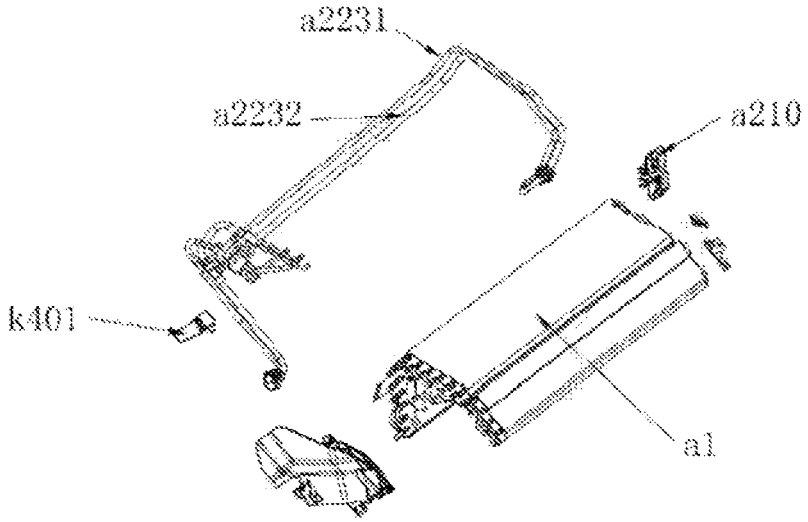
Figure 124:
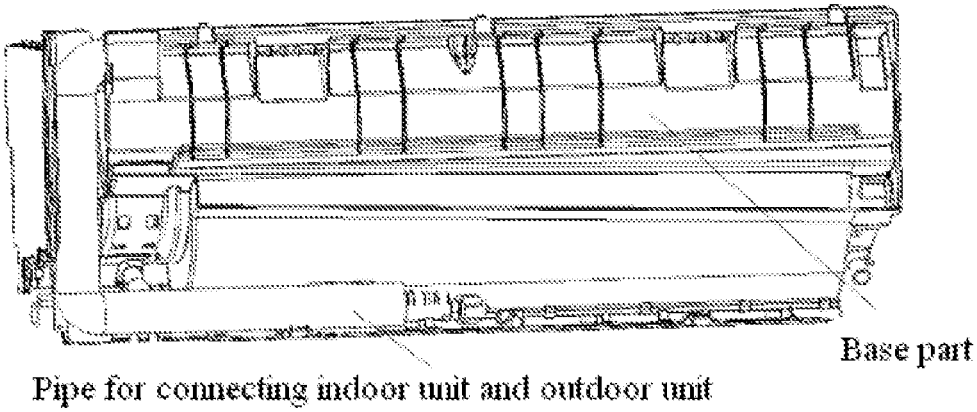
Figure 125:
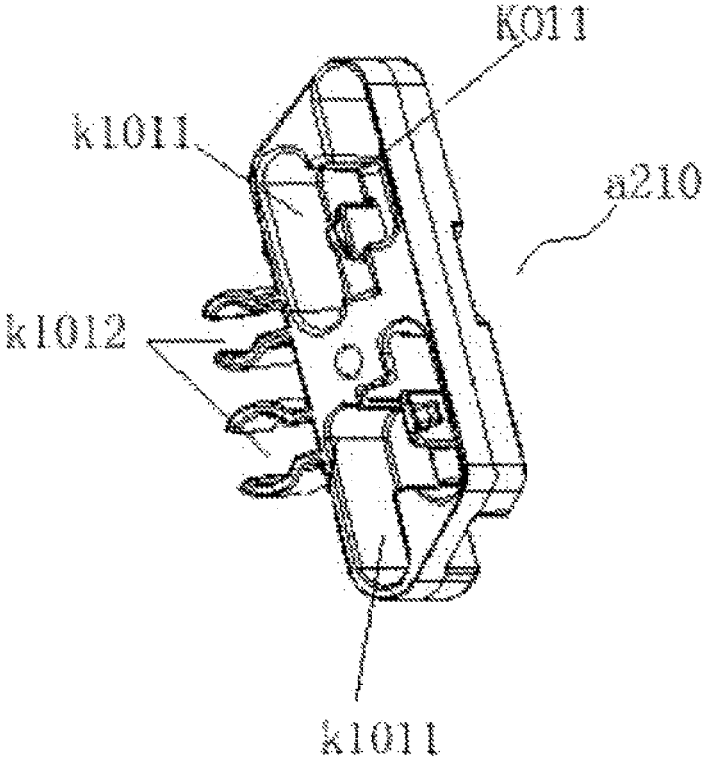
Figure 126:
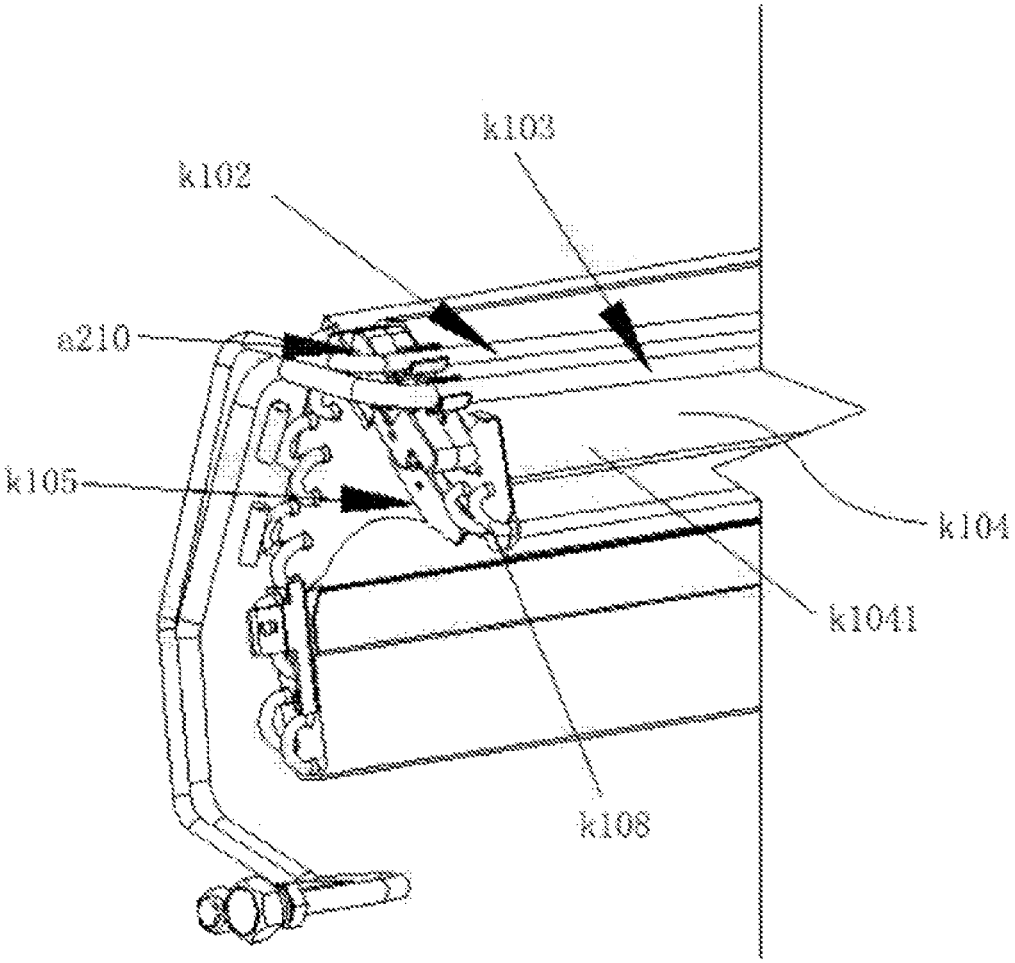
Figure 127:
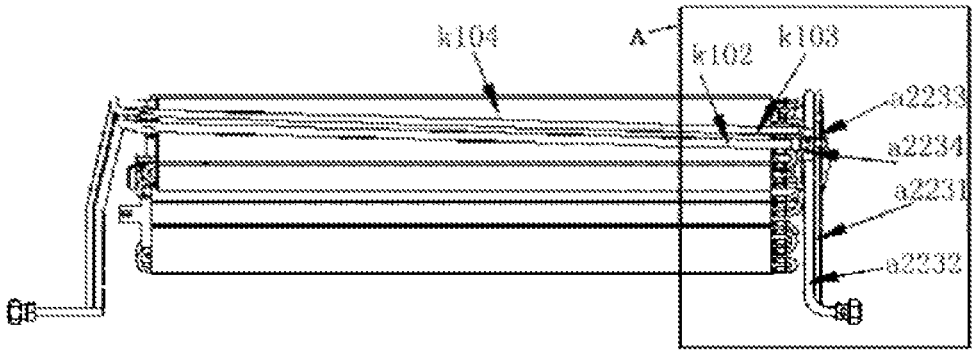
Figure 128:
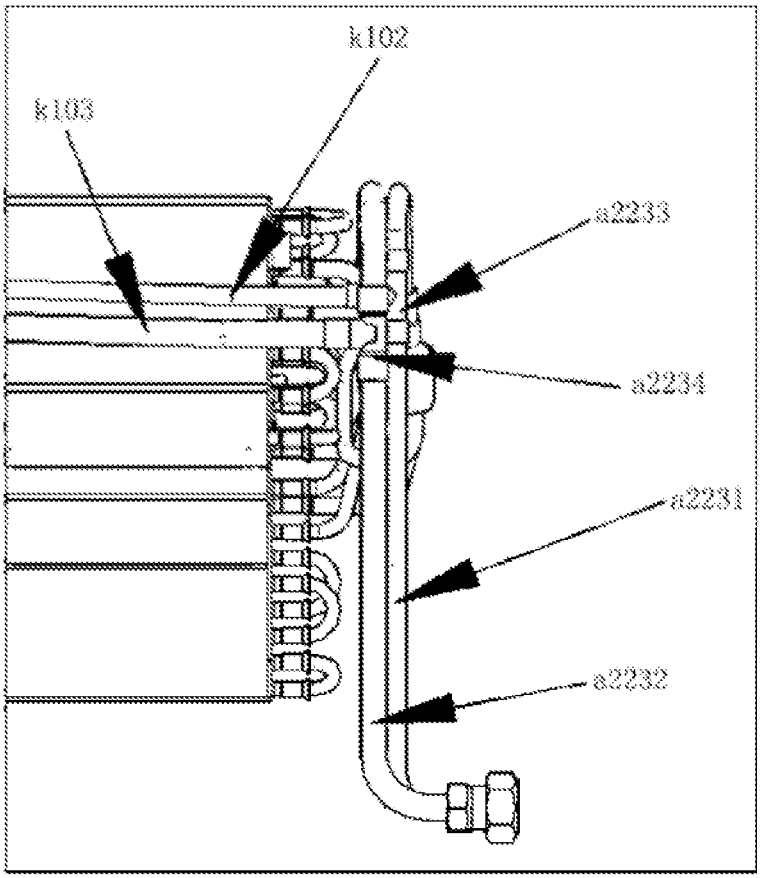

As an alternative of the above implementation mode, referring to FIG. 122, the second group of liquid inlet pipes a2231 and air collection pipes a2232 may extend to the second side of the fin a220 through the lower end of the first folding fin. Or, the second group of liquid inlet pipes a2231 and air collection pipes a2232 may extend to the second side of the fin a220 through the lower end of any folding fin.

It is to be noted that, in the above implementation mode, the upper part of the fin a220 is the position above the upper surface, and preferably, the pipe is arranged from the position above the top surface of the first folding fin as shown in FIG. 118 and close to the fin a220. The lower end of the first folding fin is the position below the lower surface of the first folding fin, and preferably, the pipe is arranged from the position below the lower surface of the first folding fin and close to the fin a220. In such a manner, the liquid inlet pipe a2231 and the air collection pipe a2232 are arranged in the evaporator without occupying the mounting space of other parts. Specifically, the lower end of the fin a220 is the position below the inner surface of the fin a220. The position may be set close to the surface of the fin a220 or away from the surface for a certain distance, and may be located by means of the fin a220 or the angular frame and other structure, which will not be limited or elaborated here. Those skilled in the art may design and implement, according to the above description, the form of arranging the liquid inlet pipe a2231 and the air collection pipe a2232 relative to the fin a220.

The first group of liquid inlet pipes a2231 and air collection pipes a2232 and the second group of liquid inlet pipes a2231 and air collection pipes a2232 are not limited to be connected on the same side of the fin a220, and they may be respectively connected on two sides of the fin a220. When the first group of liquid inlet pipes a2231 and air collection pipes a2232 and the second group of liquid inlet pipes a2231 and air collection pipes a2232 are respectively connected on the two sides of the fin a220, the first group of liquid inlet pipes a2231 and air collection pipes a2232 extend out of the evaporator shell on the first side, and the second group of liquid inlet pipes a2231 and air collection pipes a2232 extend out of the evaporator shell on the second side.

Preferably, the parts, outside the water groove a312, of the liquid inlet pipe a2231 and the air collection pipe a2232 are arranged with an insulated structure. The insulated structure is an insulated cotton layer covered on the outer diameters of the liquid inlet pipe a2231 and the air collection pipe a2232.

As a preferable implementation mode, the second group of liquid inlet pipes a2231 and air collection pipes a2232 are connected with the first group of liquid inlet pipes a2231 and air collection pipes a2232. The tee structures a2233 are respectively arranged on the first group of liquid inlet pipes a2231 and air collection pipes a2232, and the second group of liquid inlet pipes a2231 and air collection pipes a2232 are respectively connected with two tee structures a2234, so that the second group of liquid inlet pipes a2231 and air collection pipes a2232 are connected with the first group of liquid inlet pipes a2231 and air collection pipes a2232. Because the liquid separating head a4 and the air collecting head a5 which occupy more space, and a certain pipe bending structure are arranged between the liquid inlet pipe a2231 and the air collection pipe a2232 and the heat exchanger k104, connecting the first group of liquid inlet pipes a2231 and air collection pipes a2232 with the second group of liquid inlet pipes a2231 and air collection pipes a2232, and bending the second group of liquid inlet pipes a2231 and air collection pipes a2232 to the second side of the fin a220 may save the inner space of the fin a220 effectively, and reduce the assembling step. In addition, the refrigerant flow channel in the fin a220 consists of the U-shaped pipe and the bend, and the bend may be detachably connected on the U-shaped pipe, so taking the side with the bend of the fin a220 as the first side facilitates assembly. That is, according to the needs of spatial arrangement of the air conditioner, the air collecting head a5 connected integrally with a number of air collecting branch pipes k103 and the liquid separating head a4 connected integrally with a number of liquid inlet branch pipes k102 are arranged on the right side or the left side of the evaporator, and then the liquid separating head a4 and the air collecting head a5 are connected with the liquid inlet pipe a2231 and the air collection pipe a2232. A number of liquid inlet branch pipes k102 and a number of air collecting branch pipes k103 are respectively connected integrally through the liquid separating head a4 and the air collecting head a5, so the inner space of the air conditioner is saved.

As a preferred implementation mode, the left side of the heat exchanger k104 arranged on the bottom shell 310 is arranged with a number of liquid inlet branch pipes k102 and air collecting branch pipes k103, the liquid separating head a4 of which one end is connected integrally with a number of the inlet branch pipes k102, the air collecting head a5 of which one end is connected integrally with a number of the air collecting branch pipes k103, and the liquid inlet pipe a2231 connected with the other end of the liquid separating head a4 and the air collection pipe a2232 connected with the other end of the air collecting head a5.

As a preference of the above implementation mode, the liquid inlet pipe a2231 and the air collection pipe a2232 on the left side of the heat exchanger k104 are arranged in parallel. Meanwhile, the liquid inlet pipe a2231 and the air collection pipe a2232 extending to the right side of the heat exchanger k104 are arranged in parallel. A liquid inlet header pipe and an air collection header pipe have an advantage of optimizing the spatial arrangement of the evaporator by being arranged in parallel.

The evaporator, the heat exchanger k104, the liquid inlet header pipe, the air collection header pipe and a T-branch pipe are arranged on the same side of the bottom shell of the air conditioner. During mounting, there is no need to arrange the pipes on two sides of the bottom shell, so the difficulty of assembling and disassembling the evaporator is reduced, a foundation is laid for mechanized and automated production, and the efficiency of assembling and disassembling the air conditioner is improved.

The embodiment also provides an air conditioner. The air conditioner has all technical features of the above evaporator part, so it also has the beneficial effects of the evaporator part.

Embodiment 5

The embodiment also provides a simplified angular frame structure. As shown in FIG. 125 to FIG. 128, the simplified angular frame structure includes a simplified angular frame body a210. The simplified angular frame body a210 is suitable to be fixed on a side plate k105 of the heat exchanger kk104, and has a simplified angular frame limiting portion k1012 configured to limit the connection pipe arranged on the heat exchanger k104.

The simplified angular frame structure of the embodiment not only has a simple structure, but also may make the connection pipe arranged above the heat exchanger k104 more stable. The connection pipe is less likely to sway when the air conditioner indoor unit is transported, so it will not collide with the part, out of the side plate k105, the radiating pipe k108.

There are two simplified angular frame limiting portions k1012. Those skilled in the art may also arrange more simplified angular frame limiting portions or integrate them into one according to needs.

The simplified angular frame limiting portions k1012 are two clamping pieces arranged opposite to each other on the simplified angular frame body a210. A clamping space for clamping the connection pipe is formed between the two clamping pieces. The clamping space opening up formed by the two clamping pieces is convenient to be assembled and disassembled, is easy to be produced automatically, and has a good limiting effect.

The clamping piece has elasticity. When the connection pipe enters into the clamping space, the clamping piece deforms elastically, and clamps the connection pipe elastically. The middle parts of the two clamping pieces are bent in an arc shape towards the directions away from each other, so a space suitable to clamp the connection pipe is formed.

As a deformed design solution, the simplified angular frame limiting portion k1012 is a circular gap formed on the simplified angular frame body a210. The gap is suitable for the connection pipe to be embedded and located.

At least one protection space k1011 configured to accommodate an arc-shaped bent part, on the outer side of the side plate k105, of the radiating pipe k108 is arranged on the simplified angular frame body a210. Such setting may protect the arc-shaped bent part of the radiating pipe k108, and prevent it from colliding with other parts.

A through hole is arranged on the simplified angular frame body a210, and a threaded hole is arranged on the side plate k105 facing the through hole. A fixing bolt penetrates through the through hole to form threaded connection with the threaded hole, so the simplified angular frame body a210 is fixed on the side plate k105.

Embodiment 6

The embodiment provides a heat exchanger. The heat exchanger includes: the heat exchanger body k1040, the radiating pipe k108, the side plate k105, the liquid inlet pipe a2231, the air collection pipe a2232, the liquid inlet branch pipe k102 and the air collecting branch pipe k103. The heat exchanger body k1040 has the fin of which the upper part faces the lower part to form a mounting space. The radiating pipe k108 is mounted in the mounting space. The side plate k105 is fixed on at least one side of the heat exchanger body k1040 to support and seal the heat exchanger body k1040, and has a mounting hole for supporting the radiating pipe k108. The liquid inlet pipe a2231 is on one side of the heat exchanger body k1040 and connected with the inlet of the radiating pipe k108, and is configured to accept the refrigerant from the outside. The air collection pipe a2232 is on one side of the heat exchanger body k1040 and connected with the outlet of the radiating pipe k108, and is configured to accept and convey the refrigerant to the outdoor unit. The liquid inlet branch pipe k102 and the air collecting branch pipe k103 are respectively connected with the liquid inlet pipe a2231 and the air collection pipe a2232 through the tee parts a2233 and a2234, and extend out from another side of the heat exchanger body k1040. The heat exchanger further includes the simplified angular frame in embodiment 1.

In the embodiment, the radiating pipe k1085 consist of a number of U-shaped pipes which are connected in series by a welded elbow.

On the basis of the original liquid inlet pipe a2231 and air collection pipe a2232, the heat exchanger in the embodiment is added with the liquid inlet branch pipe k102 and the air collecting branch pipe k103 connected with the original liquid inlet pipe a2231 and air collection pipe a2232, and the liquid inlet branch pipe k102 and the air collecting branch pipe k103 extend to the other side of the air conditioner indoor unit, so that convenience is brought to mounting, and the liquid inlet pipe a2231 and the air collection pipe a2232 are prevented from being bent because the air conditioner indoor unit does not correspond to the position of indoor unit. In addition, the heat exchanger of the embodiment also adopts the simplified angular frame structure in embodiment 1, so that the positions of the liquid inlet branch pipe k102 and the air collecting branch pipe k103 are more stable, and they will not collide with the arc-shaped bent part, on the outer side of the side plate k105, of the radiating pipe k108 when transported.

Embodiment 7

The embodiment provides an air conditioner indoor unit, including the heat exchanger in embodiment 2.

Due to adopting the heat exchanger, the air conditioner indoor unit of the embodiment has all the advantages brought by adopting the heat exchanger.

Embodiment 8

Figure 129:
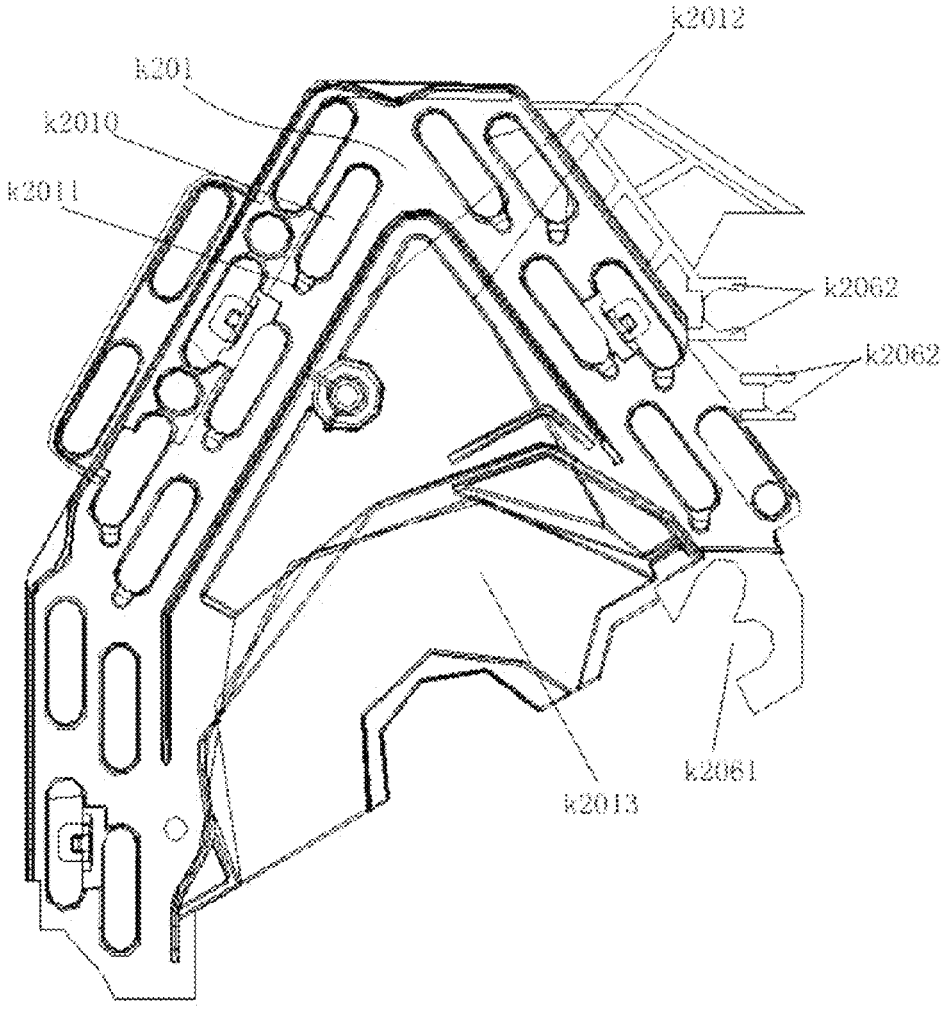

The embodiment provides an angular frame structure. As shown in FIG. 129 to FIG. 131, the angular frame structure includes an angular frame body k201 and an angular frame limiting portion k206. The angular frame body k201 is suitable to be fixed on the side plate k105 of the heat exchanger a1, and has an accommodating space k2010 configured to accommodate the arc-shaped bent part, outside of the side plate k105, of the radiating pipe. The angular frame limiting portion k206 is configured to limit the connection pipe k205 in the condensed water passage k204 which is arranged on the heat exchanger a1 or the bottom shell.

The angular frame structure of the embodiment can not only limit the connection pipe k205 to make it connected with the heat exchanger a1 more stably, but also protect the arc-shaped bent part, outside of the side plate k105, of the radiating pipe 5 to isolate this part from the connection pipe k205, so collision between the connection pipe k205 and the radiating pipe is prevented.

The angular frame limiting portion k206 is a limiting clamping piece formed on the angular frame body k201. A hollow gap k2061 is arranged on the limiting clamping piece. The limiting clamping piece extends to the arranged position of the connection pipe k205, so that the hollow gap k2061 is suitable for the connection pipe k205 to be embedded and located. For the angular frame limiting portion k206 of the embodiment, a limiting clamping piece structure is added on the angular frame body k201, and the limiting clamping piece structure extends to the arranged position of the connection pipe k205, so that convenience is brought to locating the connection pipe k205 and mounting the hollow gap k2061, and the assembling efficiency during production is improved.

FIG. 132 and FIG. 133 show a situation where the connection pipes k205 are respectively arranged in two different condensed water passages k204 of the bottom shell.

As a deformed design solution, the angular frame limiting portion k206 is two limiting pieces k2062 arranged opposite to each other on the angular frame body k201. A clamping space for clamping the connection pipe k205 is formed between the two limiting pieces k2062. When the angular frame in the embodiment is produced, those skilled in the art may adopt either the structure of the hollow gap k2061 or the structure of two limiting pieces k2062, and may also adopt the two structures (as shown in FIG. 129). In addition, because the connection pipe k205 is usually arranged on the heat exchanger a1 or in the condensed water passage k204 in practical applications, in practical production, the angular frame may also be arranged with only one angular frame limiting portion k206, and the angular frame limiting portion may adopt either the structure of hollow gap k2061 or the structure of two limiting pieces k2062.

The accommodating space k2010 is an inner chamber structure of which one side is open, and the other side is closed. Such a structure may prevent the arc-shaped bent part, outside of the side plate k105, of the radiating pipe from contacting with the air outside in a large area, so that the generation of condensed water may be reduced.

A fluid guide pore k2011 is also arranged on the angular frame body k201. The fluid guide pore k2011 is connected with the accommodating space k2010, so as to guide out the condensed water generating on the connection pipe k205 which is in the accommodating space k2010. The fluid guide pore k2011 is arranged on the angular frame body k201. The fluid guide pore k2011 is connected with the accommodating space k2010, and is configured to guide out the condensed water in the accommodating space k2010, so as to prevent the condensed water from flowing to other positions to cause failure or decrease user experience. Furthermore, a fluid guide flange k2012 is also arranged on one side face of the angular frame body k201. The outer side face of the fluid guide flange k2012 accepts and guides the condensed water.

A hermetically connecting plate which is configured to hermetically connect the fan motor and the inner space of the heat exchanger is also arranged on the angular frame body k201. The hermetically connecting plate which is configured to hermetically connect the fan motor and the heat exchanger a1, so that all air from the fan motor enters into the inner space of the heat exchanger a1 without leakage, and then the heat exchange efficiency is improved.

Embodiment 9

The embodiment provides a heat exchanger, including the angular frame structure in embodiment 5.

Due to having the angular frame structure, the heat exchanger of the embodiment has all the advantages brought by having the angular frame structure.

Embodiment 10

The embodiment provides an air conditioner indoor unit, including the heat exchanger in embodiment 2.

Due to adopting the heat exchanger, the air conditioner indoor unit of the embodiment has all the advantages brought by having the heat exchanger.

Embodiment 11

The embodiment provides a sealed waterproof structure. As shown in FIG. 134 to FIG. 136, the sealed waterproof structure is suitable to be mounted on one side of the heat exchanger k104, and includes a pipe protecting plate k302, an inner side plate k303, and a baseplate k304 connecting the pipe protecting plate k302 and the inner side plate k303 to form a water guide space k3010. The water guide space k3010 is configured to accommodate the part, on the outer side of the side plate k105, of the radiating pipe k108 and/or the part of the connection pipe k205 extending out from the side of the heat exchanger k104. The water guide space k3010 is configured to accept and guide the condensed water.

The sealed waterproof structure of the embodiment fills the technical gap, and may be mounted on the side, arranged with a T-junction and the connection pipe k205, of the heat exchanger k104, so that the condensed water generating on the arc-shaped part, on the outside of the side plate k105, of the radiating pipe and the connection pipe k205.

A bent structure is formed on the pipe protecting plate k302, and is configured to mate with the part, on the outside of the side plate k105, of the radiating pipe k108 and the part, extending out from the side of the heat exchanger k104, of the connection pipe k205. The setting of such a structure is beneficial to improving compactness of devices and enhancing a flow guiding effect.

The pipe protecting plate k302 includes a first pipe protecting plate k3021 of which one side is connected with the baseplate k304, a step plate k3020 connected with the other side of the first pipe protecting plate k3021, and a second pipe protecting plate k3022 connected with the side, far away from the first pipe protecting plate k3021, of the step plate k3020. Along the vertical direction from the first pipe protecting plate k3021 to the second pipe protecting plate k3022, the step plate k3020 is arranged slantwise and outwards, so that the water guide space k3010 of which the open end is big and the closed end is small is formed.

In the sealed waterproof structure of the embodiment, a connection position relationship of the first pipe protecting plate k3021, the step plate k3020 and the second pipe protecting plate k3022 forms a water guide space k3010 with a big open end and a small closed end. The sealed waterproof structure may match with the structure of the connection pipe k205 which is arranged from above and far from the heat exchanger k104, thereby improving the compactness of devices and enhancing the effect of guiding the condensed water.

As shown in FIG. 134, a number of reinforcing plates k3023 are included, and are configured to connect the first pipe protecting plate k3021 and the step plate k3020, and/or configured to connect the step plate k3020 and the second pipe protecting plate k3022. A clamping gear k3031 is arranged on the inner side plate k303, and is suitable to be mounted with the clamping groove arranged on the heat exchanger k104 in a clamping manner.

The baseplate k304 is arranged in an arc shape. When mounted to the heat exchanger k104, one of two arc-shaped ends of the baseplate k304 is upward, and the other is downward. The upward end of the baseplate k304 is opposite to the connected part of the connection pipe k205 and the radiating pipe k108, and the downward end of the baseplate k304 is opposite to the end, extending out, of the connection pipe k205.

The outside of the upward end of the baseplate k304 is arranged with a water retaining plate k3041 which may prevent the condensed water from outflowing from the position.

As shown in FIGS. 137 to 4-28, a wind-proof structure is also formed on the back of the baseplate k304, and is configured to form a mating seal with the heat exchanger k104, so that the motor k309 is hermetically connected with the inner space of the heat exchanger k104. The structure may ensure that all air generated by the motor k309 enters into the inner space of the heat exchanger, and then the air supply efficiency is improved. A first mating portion k3033 of the wind-proof structure mates with the corresponding part on the bottom shell a320 to hermetically mount the motor shaft sleeve k3091. A second mating portion k3034 of the wind-proof structure mates with the corresponding part on the bottom shell a320 to hermetically mount a part of the motor k309.

A hermetically sealing slot k3032 is also arranged on the outside of the inner side plate k303, and is configured to be hermetically connected with the heat exchanger k104 to prevent air leakage.

Embodiment 12

The embodiment provides a heat exchanger, including the sealed waterproof structure in embodiment 8.

Due to including the sealed waterproof structure, the heat exchanger of the embodiment has all the advantages brought by including the sealed waterproof structure.

Embodiment 13

The embodiment provides an air conditioner indoor unit, including the heat exchanger in embodiment 9.

Due to including the heat exchanger, the air conditioner indoor unit of the embodiment has all the advantages brought by including the heat exchanger.

Embodiment 14

The embodiment provides a sealing cup. As shown in FIGS. 140 to 4-32, the sealing cup includes a sealing cup body k401 and a guide structure. The sealing cup body k401 is suitable to be sheathed on the connection pipe k205, and closely contacts with the outer wall of the connection pipe k205 to accept the condensed water falling from the outer wall of the connection pipe k205. The flow guide structure is configured to guide the condensed water received by the sealing cup body k401 to a set position.

The sealing cup of the embodiment includes a sealing cup body k401 and the guide structure. The sealing cup body k401 is suitable to be sheathed on the connection pipe k205, and closely contacts with the outer wall of the connection pipe k205 to accept the condensed water falling from the outer wall of the connection pipe k205. The flow guide structure is configured to guide the condensed water received by the sealing cup body k401 to the set position. The sealing cup of the embodiment may solve the problem of condensed water dripping from the connection pipe k205 which is a special position, thereby dramatically improving user experience.

A waterproof connection hole k4011 configured to be sheathed on the outside of the connection pipe k205 is arranged on the sealing cup body k401. The waterproof connection hole k4011 has a certain axial length. A contact area between the inner wall of the waterproof connection hole k4011 with a certain axial length and the outer wall of the connection pipe k205 is relatively large, which may effectively prevent the condensed water from leaking from the position where the connection pipe k205 contacts with the waterproof connection hole k4011, thereby enhancing the waterproof effect.

The sealing cup body k401 is in sheathed connection with the connection pipe k205 through the waterproof connection hole k4011 in the interference fit manner. The connection manner of interference fit may further strengthen the joint degree of the position where the waterproof connection hole k4011 contacts with the connection pipe k205, thereby enhancing the waterproof effect.

The guide structure includes the drain hole k4012 formed on the sealing cup body k401. The drain hole k4012 is configured to drain the water received by the sealing cup body k401. The guide structure further includes a guide pipe k4013 which may guide the water received by the sealing cup body k401 to the set position, thereby convenience is brought to controlling the flow direction of the condensed water.

A water collecting chamber k4010 is formed on the sealing cup body k401. The water collecting chamber k4010 is connected with the guide structure, so that the received condensed water is drained out through the guide structure. A circle of flange structures k4014 are formed on the sealing cup body k401. The circle of flange structures k4014 form the water collecting chamber k4010. A gap k4015 is also arranged on the flange structure k4014, so as to prevent interference with the radiating pipe or the elbow.

In the embodiment, the sealing cup is rubber. Those skilled in the art may also adopt other materials to produce the sealing cup according to actual needs.

Embodiment 15

The embodiment provides a heat exchanger, including the sealing cup in embodiment 11.

Due to having the sealing cup, the heat exchanger of the embodiment has all the advantages brought by including the sealing cup.

Embodiment 16

The embodiment provides an air conditioner indoor unit, including the heat exchanger in embodiment 12.

Due to including the heat exchanger, the air conditioner indoor unit of the embodiment has all the advantages brought by including the heat exchanger.

Embodiment 17

The embodiment provides an assembling structure. As shown in FIG. 144, the assembling structure includes: two side plates k105 and two assembling pieces k503. The two side plates k105 are respectively suitable to be fixedly mounted on two sides in the length direction of the heat exchanger part k1041. Both the two side plates k105 have a first assembling portion k5011. The two assembling pieces k503 are respectively suitable to be fixedly arranged on the base part a101 corresponding to the side plate k105. Both the two assembling pieces k503 have a second assembling portion k5031 correspondingly assembled with the first assembling portion k5011 in a mating manner. When the heat exchanger part k1041 is assembled on the base part a101, at least two first assembling portions k5011 are directly assembled with the second assembling portion k5031 at the same time in a clamping manner.

In the assembling structure of the embodiment, when the heat exchanger part k1041 is assembled on the base part a101, two first assembling portions k5011 are directly assembled with the second assembling portion k5031 at the same time in a clamping manner. Compared with the conventional art, the assembling process is greatly simplified, the assembling efficiency may be improved, and the realization of automated production is facilitated.

In the embodiment, as shown in FIGS. 145 to 4-35, the second assembling portion k5031 is a bearing plate arranged on the assembling piece k503. An assembling opening k5030 with one side open is arranged on the bearing plate. The first assembling portion k5011 enters into the assembling opening k5030 from an open position to be directly assembled with the second assembling portion k5031 in a clamping manner. The first assembling portion k5011 is a folding side plate arranged on the side plate k105. The folding side plate includes a vertical side plate k5012 which may be inserted in the assembling opening k5030, and a transverse side plate which is connected with the vertical side plate k5012, and is configured to contact with the bearing plate to bear the heat exchanger part k1041.

In the assembling structure of the embodiment, the second assembling portion k5031 is the bearing plate arranged on the assembling piece k503, and the assembling opening k5030 with one side open is arranged on the bearing plate. During assembling, the first assembling portion k5011 enters in the assembling opening k5030 directly from the open position of the assembling opening k5030, and then is assembled with the second assembling portion k5031 in a clamping manner. The setting of such a structure facilitates the production of automated assembly line in factories, and has a high assembling speed. The first assembling portion k5011 is the folding side plate arranged on the side plate k105. The folding side plate can not only be inserted in the assembling opening k5030 conveniently from the open position of the assembling opening k5030, but also mate with the bearing plate to realize contact connection, so as to bear the heat exchanger part k1041.

In the embodiment, as shown in FIGS. 145 and 4-35, the two folding side plates respectively arranged on two sides in the length direction of the heat exchanger part k1041 are respectively connected with bearing plate parts, on the outer sides of the two assembling openings k5030, of the two bearing plates. The setting of such a structure may prevent the relative movement, along the length direction of the heat exchanger part, between the assembled heat exchanger part and base assembly, so the fastness is good after assembling.

As a deformed design solution, the two folding side plates respectively arranged on two sides in the length direction of the heat exchanger part k1041 may also be respectively connected with the bearing plate parts, on the inner sides of the two assembling openings k5030, of the two bearing plates, and the basically the same technical effect may be achieved.

As shown in FIG. 147, the side plate k105 includes the side plate body k5010 and the folding side plate connected with the side plate body k5010 and outwards extending to be assembled with the bearing plate in a clamping manner. The vertical side plate k5012 and the side plate body k5010 are on the same plane. The plane which the transverse side plate k5013 is on is basically vertical to the plane which the side plate body k5010 is on. In the assembling structure of the embodiment, the folding side plate outwards extends from the side plate body k5010, and is assembled with the bearing plate on the assembling piece k503. The assembling structure takes advantage of the side plate k105 to achieve the beneficial effect of reducing the production processes without adding new parts by changing the structure of the side plate k105.

The plane which the bearing plate is on is basically parallel to the transverse side plate k5013. When the folding side plate is assembled with the bearing plate in a mating manner, the transverse side plate k5013 closely contacts with the bearing plate in parallel. When the folding side plate is assembled with the bearing plate in a mating manner, the transverse side plate k5013 closely contacts with the bearing plate in parallel, so the contact area is large, and the bearing capacity is good.

In the embodiment, two side plate k105 structures mounted on the two sides in the length direction of the heat exchanger part k1041 are in mirror symmetry.

As shown in FIG. 148, the side plate k105 further includes a radiating pipe mounting hole k5014 provided for insertion of the radiating pipe k108 to support it. A buckling portion k5015 which may be connected with the heat exchanger part k1041 in a clamping manner is also arranged on the side plate k105. The side plate k105 is connected with the heat exchanger part k1041 through the buckling portion k5015 in a mating manner, so the connection strength between the side plate k105 and the heat exchanger part k1041 may be enhanced.

Embodiment 18

The embodiment provides an air conditioner indoor unit, including the heat exchanger part k1041 and the base part a101. As shown in FIG. 144, the heat exchanger part k1041 and the base part a101 are in assembling connection through the assembling structure in embodiment 14.

Due to adopting the assembling structure, the air conditioner indoor unit of the embodiment has all the advantages brought by adopting the assembling structure.

Embodiment 19

An air conditioner indoor unit includes: a base module s100, a heat exchange module s200, an air and water duct module s300 and an exterior module s400.

The base module s100 is a support and mounting basis of the whole unit. The base module s100 includes a base part s101 suitable to be mounted on a support. The base part s101 is configured to be mounted on a hanging support body such as an indoor wall, is also used as a support part of the whole unit and a basic part for assembly on a production line.

The heat exchange module s200 is connected with an outdoor unit and performs a heat exchanging operation. The heat exchange module s200 is mounted on the base module s100 through a first mounting structure arranged between the heat exchange module s200 and the base part s101. The heat exchange module s200 mainly includes a heat exchanger. The pipeline in the heat exchanger is connected with the outdoor unit through the connection pipeline consisting of the liquid inlet pipe and the air collection pipe. The heat exchange module s200 includes the heat exchanger which is entirely supported by the angular frames on two ends and cross section of which is inverted-U-shaped. Two ends of the heat exchanger are arranged with the sealing parts, so an open chamber is formed in the inverted-U-shaped inside of the heat exchanger.

The air and water duct module s300 includes the air duct configured to be connected with the air inlet and the air outlet and guide air to pass through, and a water duct configured to guide and drain the condensed water. The air and water duct module s300 is connected with the base module s100 through a second mounting structure. The air and water duct module s300 has a bottom shell s310. A fan support for mounting the impeller is arranged on the bottom shell s310. The bottom shell s310 has a side face towards the heat exchange module s200. The water groove for collecting and draining the condensed water from the heat exchange module s200 is formed on the side face. The impeller is in the water groove after being mounted on the fan support. In the mounted state, the impeller is in the inverted-U-shaped open chamber of the heat exchanger.

The exterior module s400 covers and protects the whole unit and its internal structure. The exterior module s400 is detachably connected with the base module s100. The exterior module s400 includes the shell module s410, the air outlet module s420 and the air outlet module s430. The shell module s410 includes the mounting rack and the panel s412. The air outlet module s420 includes the air outlet frame m3 for air outlet. The shell module s410 and the air outlet module s420 cover the outer surface of the air conditioner indoor unit together.

Referring to FIG. 149, the shell module s410 in the embodiment includes: the base part s101 arranged on the rear side of the indoor unit in a working state, the air outlet frame arranged on the front lower part of the shell and movably mounted relative to the base part s101, and the panel s412 adjacently arranged on the upper part of the air outlet frame m3, and movably mounted relative to the base part s101. As shown in FIG. 150, in the implementation mode, the panel s412 and the air outlet frame m3 cover the indoor unit together, and in order to keep the integral aesthetics of exterior and reduce the degree of difficulty in a producing and assembling process, the edge of the panel s412 is arranged to cover the edge, adjacent to it, of air outlet frame m3, so that the size mismatch between the panel s412 and the air outlet frame m3 caused by defects in the production process is avoided; for example, a gap generates because the production size of the panel s412 or the air outlet frame m3 is smaller than a standard size, or a capping phenomenon appears because the production size of the panel s412 or the air outlet frame m3 is larger than the standard size.

Referring to FIG. 151, the panel s412 in the embodiment includes an upper panel s4121 and a front panel p22 integrally formed. The upper panel s4121 is arranged on the upper side of the shell, and has the edge adjacent to the base part s101. The upper panel s4121 is fixedly and detachably connected with the base part s101. As shown in FIG. 152, in the embodiment, the panel s412 is connected with the base part s101 through the buckle arranged on the rear end of the upper panel.

Referring to FIG. 152, in the embodiment, the air outlet frame m3 includes the baseplate and the side plates integrally formed. The baseplate is arranged on the lower side of the panel s412. The side plates are arranged on two sides of the base part s101. Two end sides of the panel s412 cover a forward side edge of the side plate. A side frame is formed integrally on bent inner sides of two ends of the front panel p22 and the upper panel s4121. The side frame is covered by the side plate of the air outlet frame m3 in a mounting state. The side frame is in sliding connection with the side plate. The rear end of the air outlet frame m3 is fixedly connected with with the base part s101.

In the embodiment, the panel s411 is detachably and fixedly connected with the air outlet frame m3. As shown in FIG. 152, air outlet frame buckles s4211 are respectively arranged on the two side plates of the air outlet frame m3. Side frame sliding chutes s4123 are respectively arranged on two sides of the panel s412, and the frame sliding chute corresponds to the panel. A through hole, allowing the air outlet frame buckle s4211 to pass through, is arranged on the lower end of the side frame sliding chute s4123. As shown in FIG. 152, in the embodiment. two air outlet frame buckles s4211 are arranged on each side plate. The air outlet frame m3 is in sliding connection with the panel s412 through the air outlet frame buckle s4211. Using the sliding chute and the buckle to connect is convenient for the user to assemble and disassemble. The user may disassemble the whole air outlet frame m3 from the panel of the air conditioner indoor unit by pulling down the air outlet frame m3.

Referring to FIG. 153 and FIG. 154, in the embodiment, a connection pipe clamping groove is arranged on the lower end of the panel s412. The upper end of the air outlet frame m3 is clamped in the connection pipe clamping groove. The panel s412 uses the clamping groove structure to assemble in a wrapping manner the edge of the air outlet frame m3, and then assembling gaps are covered from the view of exterior while being sealed, so the problem that the exteriors of the existing panel and panel body are bad is solved. As shown in FIG. 153, in the embodiment, an air guide plate b1 is also arranged on the bottom of the air outlet frame m3. As shown in FIG. 152, an air inlet is also arranged on the upper panel s4121.

The two side plates of the air outlet frame m3 of the disclosure are in sliding connection with the two side frames of the panel s412, so it is convenient for the user the assemble and disassemble. And because the edge, connected with the panel s412, of the air outlet frame m3 is covered by the edge of the panel s412, a hidden trouble of step or the capping phenomenon in the process of assembling the shell is reduced.

By setting the panel and an air outlet cabinet to cover the air conditioner indoor unit, arranging the panel above the air outlet frame, using the clamping groove structure to connect the panel with the air outlet frame, and using the clamping groove of the panel to assemble the edge of the air outlet frame in a wrapping manner, the shell of the air conditioner indoor unit of the disclosure covers the assembling gaps from the view of exterior while sealing, so the problem that the exteriors of the existing panel and panel body are bad is solved, and control difficulty of production is reduced.

Embodiment 20

An air conditioner indoor unit includes: a base module s100, a heat exchange module s200, an air and water duct module s300 and an exterior module s400.

The base module s100 is a support and mounting basis of the whole unit. The base module s100 includes a base part s101 suitable to be mounted on a support. The base part s101 is configured to be mounted on a hanging support body such as an indoor wall, is also used as a support part of the whole unit and a basic part for assembly on a production line.

The heat exchange module s200 is connected with an outdoor unit and performs a heat exchanging operation. The heat exchange module s200 is mounted on the base module s100 through a first mounting structure arranged between the heat exchange module s200 and the base part s101. The heat exchange module s200 mainly includes a heat exchanger. The pipeline in the heat exchanger is connected with the outdoor unit through the connection pipeline consisting of the liquid inlet pipe and the air collection pipe. The heat exchange module s200 includes the heat exchanger which is entirely supported by the angular frames on two ends and cross section of which is inverted-U-shaped. Two ends of the heat exchanger are arranged with the sealing parts, so an open chamber is formed in the inverted-U-shaped inside of the heat exchanger.

The air and water duct module s300 includes the air duct configured to be connected with the air inlet and the air outlet and guide air to pass through, and a water duct configured to guide and drain the condensed water. The air and water duct module s300 is connected with the base module s100 through a second mounting structure. The air and water duct module s300 has a bottom shell s310. A fan support for mounting the impeller is arranged on the bottom shell s310. The bottom shell s310 has a side face towards the heat exchange module s200. The water groove for collecting and draining the condensed water from the heat exchange module s200 is formed on the side face. The impeller is in the water groove after being mounted on the fan support. In the mounted state, the impeller is in the inverted-U-shaped open chamber of the heat exchanger.

The exterior module s400 covers and protects the whole unit and its internal structure. The exterior module s400 is detachably connected with the base module s100. The exterior module s400 includes the shell module s410, the air outlet module s420 and the air outlet module s430. The shell module s410 includes the mounting rack and the panel s412. The air outlet module s420 includes the air outlet frame m3 for air outlet. The shell module s410 and the air outlet module s420 cover the outer surface of the air conditioner indoor unit together.

In the embodiment, as shown in FIGS. 155 and 5-9, the shell module s410 includes: the mounting racks s411 mounted on two sides of the base part s101 of the indoor unit, and the tabulate panel s412 arranged on the front end of the indoor unit and mounted on the mounting rack s411. The panel s412 is mounted on the upper part of the air outlet frame m3. As shown in FIG. 155, the filter screen s4124 is mounted on the upper part of the indoor unit. The air outlet frame m3 is arranged on the lower part of the panel s412 on the indoor unit. The air guide plate b1 is arranged on the air outlet frame m3.

As shown in FIG. 157, the mounting rack s411 includes a frame consisting of the vertical plate s4111 and the transverse plate s4112 and arranged on the end of the base part s101. The vertical plate s4111 is on the end of the transverse plate s4112 far away from the base part s101.

As shown in FIGS. 157 and 5-10, the panel s412 is connected with the mounting rack s411 through a panel buckle. Specifically, there are mounting rack sliding chutes s415 arranged at all the positions, corresponding to the panel buckle s414, of the mounting s411 on the two sides. As shown in FIG. 158, the panel buckle s414 is arranged on the back of the panel s412, and they are connected through a pin slot clamping connecting mechanism composed of the buckle and the sliding chute.

The mounting rack sliding chutes s415 in the embodiment are arranged vertically. As indicated by the direction of arrow in FIG. 156, the panel s412 may be disassembled from the mounting rack s411 by moving upwards the panel s412. The vertical plate s4111 is on the end of the transverse plate s4112 far away from the base part s101. The mounting rack sliding chute s415 is arranged on the side face deviating from the base part s101. The mounting rack sliding chutes s415 are respectively arranged on the mounting racks s411 on two ends of the base parts s101. The panel buckles s414 are arranged at the positions, corresponding to the mounting rack sliding chutes s415, on two ends of the back of the panel s412.

As shown in FIG. 157, in the embodiment, the specific form of the pin slot clamping connecting mechanism is that the mounting rack sliding chute s415 includes the through hole s4151 arranged corresponding to the panel buckle s414 and allowing the panel buckle s414 to pass through, and a chute body s4152 connected with the through hole s4151 and not allowing the panel buckle s414 to pass through.

In the embodiment, the panel buckle s414 includes a buckle support and a buckle body. The buckle support is connected with the buckle body and the panel s412. The buckle support is formed integrally with the buckle body. The buckle body is a flat structure. The buckle body may be set to either a solid structure according to needs, or a hollow structure for saving materials. A support height of the buckle support backwards decreases gradually along a moving direction of clamping, so that the buckle body supported is high in the front and low in the back. The setting manner of the buckle support makes the panel buckle s414 clamped tighter and tighter when clamped in the mounting rack s411 along the mounting rack sliding chute s415, so that the panel s412 mates with the mounting rack s411 tight.

As shown in FIG. 158, in the embodiment, each side on the back of the panel s412 is arranged with two panel buckles s414, and as shown in FIG. 157, two through holes s4151 are correspondingly arranged on each group of the mounting rack sliding chutes s415. Each group of the mounting rack sliding chutes s415 includes a chute body s4152 arranged on the mounting rack s411 and two through holes s4151 arranged on the chute body s4152. The two through holes s4151 are arranged corresponding to the two panel buckles s414 on the back of the panel s412. So, during mounting, both the two panel buckles s414 may be accurately inserted in the through hole s4151, and then enter into the mounting rack sliding chute s415.

As an alternative implementation mode, the mounting rack sliding chutes s415 may also be arranged horizontally. The panel buckles s414 are respectively arranged on the upper and lower sides of the back of the panel s412. When the mounting rack sliding chutes s415 are arranged horizontally, the panel s412 may be disassembled from the mounting rack s411 by moving the panel s412 leftwards and rightwards.

As an alternative implementation mode, each group of the mounting rack sliding chutes s415 may also include two independent chute bodies s4152 and two independent through holes s4151 which are arranged on the mounting rack s411. One through hole s4151 is arranged on each chute body s4152, and each through hole s4151 is arranged corresponding to the panel buckle s414 on the back of the panel s412.

In the air conditioner indoor unit of the embodiment, multiple groups of pushing and pulling buckles are arranged on the panel, and the structure height of the pushing and pulling buckle is ¼ of the height of the original panel buckle. The design of such a buckle structure reduces the height of the buckle, and the buckle is less likely to break when falling, so the problem in the conventional art that a hinge, the buckle and other connecting parts on the panel often break in a drop test is solved, a design cycle is shortened, and the cost of mold production and time cost are saved. On the other hand, the panel of the air conditioner indoor unit of the disclosure may be disassembled by translating, so the assembly and disassembly of the panel of the air conditioner is simplified, and it is beneficial to cleaning the air conditioner indoor unit.

Embodiment 21

The embodiment provides a wall-type unit in the exterior module of a modularized air conditioner indoor unit. The wall-type unit includes the base part s101, the panel s412, at least one extending and retracting mechanism and a mounting body m44.

As shown in FIG. 159 and FIG. 160, the panel s412 includes two air inlets p23 and two third through holes m11 formed on the panel s412. The extending and retracting mechanism is in the chamber formed between the base part s101 and the pane s412. The mounting body m44 is in the chamber. The extending and retracting mechanism is mounted on the mounting body m44, and do an extending and retracting movement towards a direction close to or far away from the third through hole m11 on the mounting body m44, so that the panel s412 is detachably mounted relative to the base part s101.

As shown in FIG. 160, the extending and retracting mechanism includes a second limiting piece m45 mounted on the mounting body m44, and a first elastic piece m436 mounted on one end of the second limiting piece m45. The other end of the second limiting piece m45 extends to a through hole m11. The first elastic piece m436 applies a reset force, which is towards the direction of the third through hole m11, on the second limiting piece m45, so that the second limiting piece m45 moves towards the third through hole m11. The first elastic piece m436 is preferably a spring.

As shown in FIG. 162 and FIG. 163, the second limiting piece m45 has a second strip-shaped body m451 and a second pressing portion m453. There are at least two third clamping portions m452 on the wall surface, facing towards one side of the mounting body m44, of second strip-shaped body. On end of the second strip-shaped body m451 is connected to the spring, and the other end extends to the third through hole m11. The second pressing portion m453 is formed on the end face of the other end of the second strip-shaped body m451, and is suitable to pass through the third through hole m11. As shown in FIG. 161, corresponding to the third clamping portion m452, a fourth clamping groove m441 for inserting the third clamping portion m452 in one-one correspondence is formed on the wall face of the side, facing towards the third clamping portion m452, of the mounting body m44. The third clamping portion m452 extends and retracts in the fourth clamping groove m441. Preferably, the fourth clamping groove m441 is a U-shaped groove. A space for the third clamping portion m452 to move is formed between two side walls of the U-shaped groove, but the third clamping portion m452 will not separate from the U-shaped groove. The third clamping portion m452 is preferably a bump. The bump extends in the space between the two side walls of the U-shaped groove via the opening of the U-shaped groove. In addition, an inwards-sunken groove is formed at a position on the surface of the side, facing towards the mounting body m44, of the second strip-shaped body m451, and the position avoids the position of the third clamping portion m452, so as to reduce the weight of the second strip-shaped body m451. Another end of the spring is fixed on the part adjacent to it, for example, the base part s101, the air duct assembly, or the evaporator.

A stepped face is formed between the second pressing portion m453 and the end face of the other end of the second strip-shaped body m451. The stepped face leans against the inner surface of the panel s412, so as to locate whether the panel 412 is mounted in place when mounting the panel s412.

As shown in FIG. 161, the mounting body m44 includes a lug in one-to-one correspondence with the third clamping portion m452 and a support sheathed on the limiting piece and between the two adjacent third clamping portions m452. The fourth clamping groove m441 is formed on the end face of the side, facing towards the third clamping portion m452, of the lug. The support is fixed on other parts adjacent to it, such as the inner surface of the side plate m7 (mentioned below), the setting of the support has a function of supporting the second limiting piece m45. The support is preferably a sleeve structure.

As shown in FIG. 160, the whole panel s412 is L-shaped, its vertical part m23 is arranged relative to the base part s101, and its horizontal part m22 is formed on the top of the vertical part m23. The end, far away from the vertical part m23, of the horizontal part m22 leans against the inner surface of the top of the base part s101. Two side plates m7 are also included. The two side plates are arranged on two side wall ends, facing towards the base part s101, of the vertical part m23, and extend upwards. The chamber is formed between the two side plates m7 and the panel s412 and the base part s101. The mounting body m44 is formed on the inner side wall of the side plate m7. The side plate m7 is detachably connected with the base part s101, so that the two side plates m7 are on two ends of the panel s412.

Preferably, there are air outlet modules arranged on the bottom of the base part s101 and the bottom of the panel s412. The air outlet is formed on the air outlet module. By fixing the air outlet module on the base part s101, the air outlet module is on the bottom of the panel s412 and the base part s101, so the air outlet module, the panel s412, the two side plates m7 and the base part s101 form the whole exterior of the air conditioner wall-type unit.

The two air inlets p23 are formed on the horizontal part m22 of the panel s412. The two third through holes m11 are formed on the vertical part m23 of the panel s412. The two third through holes m11 are on two sides of the two air inlets. Corresponding to the two third through holes m11, two mounting bodies m44 and two extending and retracting mechanisms are arranged in the chamber to detachably arrange the two ends of the panel s412 on the base part s101. Along the width direction of the horizontal part m22, two mounting bodies m44 are respectively formed on the inner surfaces of the two side plates m7. A second connecting portion m454 is on the end face of the end, facing towards the spring, of the second strip-shaped body m451. As a deformation, the connecting piece may also be transformed into a connecting shaft, so as to sheath the spring on this end of the second strip-shaped body m451. The third clamping portion m452 of the second strip-shaped body m451 is inserted in the fourth clamping groove m441, and the second pressing portion m453 extends out of the third through hole m11. When the second pressing portion m453 is pressed towards the chamber, the second strip-shaped body m451 and the second pressing portion m453 do a linear retracting movement along the width direction of the horizontal part m22 of the panel s412, and then the third through hole m11 on the panel s412 separates from the second pressing portion m453, and the panel s412 is disassembled from the air conditioner for cleaning conveniently. Meanwhile, other parts in the chamber are exposed, so it is convenient to clean and overhaul the other parts; for example, the evaporator is cleaned, and the electrical box and other structures are overhauled.

For the air conditioner wall-type unit in the embodiment, when the panel s412 needs to be disassembled, it is only needed to press the second pressing portion m453 towards the chamber along the width direction of the horizontal part m22 of the panel s412, that is, the second pressing portion m453 is pressed on the front of the wall-type unit to make the second pressing portion m453 extend in the chamber, and the panel s412 breaks away from the limit of the second pressing portion m453, and is dissembled from the base part s101; then, the panel s412 may be removed, and the acting force on the second pressing portion m453 is taken off. After the panel s412 is removed, under the action of the reset force of the spring, the second limiting piece m45 extends to the third through hole m11, so that the second pressing portion m453 resets and locates at the start position. The panel s412 and the evaporator exposed are cleaned, and the electrical structures are overhauled; after they are cleaned or overhauled, it is only needed to sheath the panel s412 and the third through hole m11 on the second pressing portion m453, so that the stepped face between the second strip-shaped body m451 and the second pressing portion m453 leans against the inner surface of the panel s412, and then, the panel s412 may be mounted on the base part s101. In such a manner, when assembled and disassembled, the panel s412 does not deform, and the fastness of mounting the panel s412 on the base part s101 is ensured. The pressing way is convenient to disassemble and assemble the panel s412.

The following is an alternative embodiment of the embodiment.

As a deformation of the support, the support may also be in other shapes, for example, an L-shaped support plate or a similar sliding chute. The second limiting piece m45 is in overlap joint with the horizontal part of the L-shaped support plate. The similar sliding chute is configured to support the second limiting piece m45, so that the second limiting piece m45 may extend and retract on it more smoothly. As a further deformation, the support may not be arranged, and the second limiting piece m45 is supported only through a mating relationship between the third clamping portion m452 and the fourth clamping groove m441 on the second limiting piece m45.

As shown in FIG. 164 and FIG. 165, as the first deformation mode of the position of forming the third through hole m11, the two third through holes m11 are formed on the horizontal part m22 of the panel s412. The two third through holes m11 are respectively on two sides of the two air inlets p23. The two third through holes m11 are long waist-shaped holes extending along the horizontal direction. As shown in FIG. 166, a second poking block m455 is arranged on the side wall of the side, with its back to the mounting body m44, of the second strip-shaped body m451, the second strip-shaped body m451 is in the long waist-shaped hole, and the mounting body m44 is mounted slantwise on other parts adjacent to it, such as the air duct assembly arranged in the chamber or the mounting base of the electrical structure. On end of the spring is sheathed on one end of the second limiting piece m45, and the other end is fixed on the other parts adjacent to it, such as the base part s101, the air duct assembly and the evaporator. The pressing portion of the limiting piece is in the chamber and leans against the inner surface of the panel, and only the poking block is in the long waist-shaped hole.

In the implementation mode, when the panel s412 needs to be disassembled, under the action of the spring for example, the second poking block m44 is on the left side of the long waist-shaped hole at beginning, the panel s412 may be dissembled from the air conditioner after breaking away from the limit of the second poking block m455 only by poking rightwards the second poking block m455 to make the second poking block m455 drive the second limiting piece m45 to move slantwise towards the third through hole m11, and make the second poking block m455 extend in the chamber. After the panel is removed, the acting force on the second poking block m455 is taken off; under the reset force of the spring, the second poking block m455 and the second limiting piece m45 does the extending movement contrary to the retracting movement, so that the second limiting piece m45 and the second poking block m455 are reset to the start position. When the panel s412 is mounted, the mounting process may be completed only by sheathing the third through hole m11 of the panel s412 on the second poking block m44, locating the second poking block m455 on the left end of the third through hole m11, and making the end, far away from the vertical part m23, of the horizontal part m22 of the panel s412 lean against the inner surface of the top of the base part s101. In the implementation mode, when the second poking block m455 is in the third through hole m11, the end, facing towards the third through hole m11, of the second limiting piece m45 may also be in the third through hole. When an acting force is applied on the poking block, both the poking block and the end limited in the third through hole extend in the chamber. As a deformation, in the implementation mode, it is unnecessary to arrange the second poking block m455, the end, facing towards the third through hole m11, of the second limiting piece m45 directly extends out of the third through hole m11. By directly pressing this end of the second limiting piece m45 to make it move linearly and slantwise on the mounting body m44 and extend in the chamber, the panel s412 may be disassembled from the air conditioner.

As a second deformation mode of the position of forming the third through hole m11, the two side plates m7 are fixed on two ends of the vertical part m23 of the panel s412, and the two third through holes m11 are respectively formed on the two side plates m7. Correspondingly, the mounting body m44 is horizontally mounted on the other parts adjacent to its, such as the air duct assembly, the evaporator, the electrical mechanism, or the base part. Correspondingly, the second limiting piece m45 is horizontally mounted on the mounting body m44. One end of the spring is fixed on the second limiting piece m45, and the other end is fixed on the parts adjacent to its, such as the air duct assembly, the evaporator, the electrical mechanism, or the base part. In the implementation mode, when the panel s412 needs to be disassembled, it is only needed to press inwards the second pressing portion m453 along the horizontal direction to make the whole second pressing portion m453 retract back to the chamber, then the panel s412 is disassembled.

As a deformation of the third through hole m11, there can also be three, four, five and six third through holes m11. Each of the third through holes m11 mates with one extending and retracting mechanism corresponding to one mounting boy m44, so as to detachably arrange the panel s412 on the base part s101. The number of the third through holes m11 is determined according to the actual use situations and requirements of users.

As a deformation, it is unnecessary to arrange the two side plates m7, the mounting body m44 may be fixed on other parts. As a further deformation, the panel s412 may only have the vertical part m23. The air inlet p23 is formed between the top of the vertical part m23 and the top of the base part s101. The third through hole m11 is formed on the vertical part m23.

As a deformation, it is unnecessary to form the stepped face between the end faces of the second pressing portion m453 and the second strip-shaped body m451. This end of the second strip-shaped body m451 directly extends out of the third through hole m11. Or, it is unnecessary to arrange the second pressing portion m453.

As a further deformation, it is unnecessary to arrange the second connecting portion m454 on the end, facing towards the spring, of the second strip-shaped body m451, and one end of the spring is directly connected to this end of the second strip-shaped body m451 in a sleeving manner. As a deformation, this end of the spring may also be fixed on the second strip-shaped body m451 in other manners. As a deformation of the first elastic piece m436, except the spring, the first elastic piece m436 may also be a reed or other elastic objects.

As a deformation of the second strip-shaped body m451, there can also be three, four and five third clamping portions m452 on the second strip-shaped body m451, correspondingly, three, four and five fourth clamping grooves m441 are arranged on the mounting body m44. The multiple third clamping portions m452 mate with the fourth clamping grooves m441 one by one, so as to ensure that the second limiting piece m45 linearly moves in the fourth clamping grooves m441 more smoothly.

Further, the second limiting piece m45 may also be in other shapes, for example, a circular column or a plate, only it has two third clamping portions m452 facing towards the mounting body m44, and mates with the fourth clamping grooves m441 on the mounting body m44, and the third clamping portions m452 extend and retract in the fourth clamping grooves m441.

As a deformation of the mounting body m44, the mounting body m44 may also be in other shapes, for example, a strip-shaped body or a plate mechanism, only the fourth clamping groove m441 suitable to clamp the third clamping portion m452 is formed on it. The fourth clamping groove m441 may also be in other shapes.

As a further deformation, the third clamping portion m452 on the second limiting piece m45 is replaced with the clamping groove, correspondingly the fourth clamping groove m441 on the mounting body m44 is replaced with the clamping portion or other mating structures, only the second limiting piece m45 extends and retracts on the mounting body m44 with the help of the first elastic piece m436 and external force to make the other end of the second limiting piece m45 extend out of the third through hole m11 or retract back to the chamber, so as to facilitate the disassembly and assembly of the panel s412.

As a deformation, the extending and retracting mechanism may also be directly arranged on the other parts in the chamber without arranging the mounting body m44. As a deformation of the extending and retracting mechanism, the extending and retracting mechanism may also be other structures, for example, an extending and retracting motor arranged in the chamber. Another end of the second limiting piece m45 fixed on an extending and retracting shaft of the motor extends out of the third through hole m11, so that the second limiting piece m45 extends and retracts towards or far away from the third through hole m11 to detachably mount the panel s412 relative to the base part s101. Or, the second limiting piece m45 is driven by a cylinder to extend and retract.

In addition, the "base part" mentioned in the embodiment is the base or the bottom shell mounted on the wall of the air conditioner indoor unit. The exterior module includes the shell module, the air outlet module and the air guide module. Both the base part and the panel mentioned in the embodiment belong to the shell module.

Embodiment 22

The embodiment provides an air conditioner, including any air conditioner wall-type unit provided in embodiment 3. The air conditioner in the implementation mode adopts the air conditioner wall-type unit provided in embodiment 3, and the panel s412 is disassembled from the air conditioner by pressing the end, extending out of the third through hole m11, of the extending and retracting mechanism, so it is convenient to disassemble and assemble the panel s412. In addition, the air conditioner of the embodiment has all the advantages of the wall-type unit provided in embodiment 3.

Embodiment 23

FIG. 167 shows a specific implementation mode of the air conditioner. The shell of the air conditioner includes a rear shell body p10 and a panel. The panel is movably covered on the rear shell body p10, and at least includes two sub-panels able to be opened. Each sub-panel has a panel body p21 arranged on the edge of the rear shell body p10 and a front panel p22 connected with the panel body p21. The panel body p21 and the front panel p22 are formed integrally or detachably.

Because the shell at least includes two sub-panels able to be opened, when it is cleaned and overhauled, a large size of a cleaning pool is not, and then the operation difficulty is reduced. Meanwhile, because each sub-panel has the panel body p21 arranged on the edge of the rear shell body p10 and the front panel p22 connected with the panel body p21, an open depth of the shell of the air conditioner is increased; that is, when the air conditioner is cleaned or maintained and replaced, the heat exchanger p200 and other structures in the shell of the air conditioner may be entirely exposed only by opening the panels arranged to be opened oppositely, so that convenience is brought to disassembling and assembling the panel and completely cleaning or maintaining and replacing the heat exchanger p200 and other structures in the air conditioner.

As an alternative implementation mode, as shown in FIG. 168 and FIG. 169, the panel includes two sub-panels. The two sub-panels are left panel and right panel arranged to be opened oppositely in the length direction relative to the rear shell body p10. The panel body p21 of the left panel is arranged on the upper edge and the left edge of the rear shell body p10, and the panel body p21 of the right panel is arranged on the upper edge and the right edge of the rear shell body p10. So, when the panels are opened, by opening the panels on left and right, no extra holding operation is needed to prevent the panels to close automatically, thereby improving the security of operation while simplifying the operation.

During implementing the manner of oppositely opening the two sub-panels, a mounting portion p11 is arranged on at least one of the opposite two sides along the oppositely opening directions of the panels, of the rear shell body p10. As shown in FIG. 167, the mounting portion p11 is arranged on the side adjacent to the right panel.

Specifically, as shown in FIG. 170 and FIG. 171, a first rotation shaft p111 is arranged on the mounting portion p11, a rotating portion p211 is arranged, corresponding to the first rotation shaft p111, on the panel body p21 of the panel, and the panel body p21 is arranged on the mounting portion p11 in rotational mating with the rotating portion p211 through the first rotation shaft p111, so that the panel is mounted with the rear shell body p10 more firmly while the oppositely opening design of the panels is realized.

As an implementation mode of deformation, the sub-panel may also be mounted by connecting it with the rear shell body p10 through the hinge or the buckle.

In the work of operating the air conditioner, a visual effect is often required except a basic heat exchange function, so a display panel p30 may also be fixedly arranged on the rear shell body p10, and the display panel p30 is above the heat exchanger p200 of the air conditioner, as shown in FIG. 169. The display panel p30 is arranged between the left panel and the right panel. In the implementation mode, the display panel p30 is an L-shaped plate. The display panel p30 is fixedly connected with the upper edge of the rear shell body p10 through the buckle or screws. As shown in FIG. 167 and FIG. 169, when it is needed to clean or maintain and replace the air conditioner, the heat exchanger p200 and other structures in the shell of the air conditioner may be exposed completely by opening the arranged panels, and then disassembling the display panel p30, so it is convenient to disassemble and assemble, and easy to operate. It is to be noted that, a decorative strip (not shown in the drawing) may also fixedly arranged on the rear shell body p10, and the decorating strip is above the heat exchanger p200 of the air conditioner, so as to achieve an decorative effect; besides, when both the display panel p30 and the decorative strip are arranged, the air conditioner not only has a function of visualization, but also achieves the aim of decorating and beautifying.

As shown in FIG. 168 and FIG. 169, in order to control the wind direction of the air conditioner, the air guide plate b1 is movably arranged on the lower part of the rear shell body p10, so that the air outlet is arranged on the lower part of the air conditioner, and then the air conditioner has a good air circulation effect.

When the air conditioner is in an inactive state, and the air conditioner is arranged with the air guide plate b1, the panel and the display panel p30 at the same time, the air guide plate b1, the panel and the display panel p30 close the rear shell body p10, thereby reducing dust enter in the inactive state and prolonging the service life of the air conditioner.

In addition, for achieving a better air filtering effect, the air conditioner in the embodiment further includes at least two first filter screens. The air inlets p23 are respectively arranged on the left panel and the right panel. The first filtering screen is detachably arranged on the air inlets p23 of the left panel and the right panel, and then, when the pane is disassembled to be cleaned, the filtering screen may be cleaned or maintained and replaced at the same time, so the operation steps are simplified, and the operation difficulty is reduce.

As an implementation mode of deformation, each sub-panel has at least two filtering screens. The first filtering screen is formed integrally on the panel body p21 or the front panel p22 of each sub-panel, that is, the first filtering screen can not only be detachably mounted on the panel, but also be formed integrally on the panel.

When is arranged, the first filtering screen is arranged on the panel body p21 above the left panel and the right panel, as shown in FIG. 167. Of course, the first filtering screen may also be arranged on either the panel body p21 on the side or the front panels p22 of the left panel and the right panel, which may also achieve the effects of conveniently assembling, preventing dust and filtering.

In order to achieve a better air filtering effect, the air conditioner further includes a second filtering screen p50. The second filtering screen p50 is fixedly arranged on the rear shell body p10. The second filtering screen p50 is above the heat exchanger p200 of the air conditioner and coats the air inlet of the heat exchanger p200, as shown in FIG. 172 and FIG. 173. In the implementation mode, the second filtering screen p50 may be arranged on the rear shell body p10 by either the buckle or the screw. Of course, in FIG. 172 and FIG. 173, the second filtering screen p50 may coat the air inlet of the heat exchanger p200 as a whole or a plurality of second filtering screens p50 form a whole to coat the air inlet of the heat exchanger p200, the specific is not limited to that.

Embodiment 24

As shown in FIG. 174 to FIG. 177, the side panel g120 on the right side mates drawably with the base g140 in the base part, and has an opening position of the electrical box s110 and a closing position of closing the electrical box s110 in its drawable direction; the electrical box s110 is exposed from the inside of the side panel g120. When the air conditioner is maintained, the electrical box s110 may be exposed to the after-sales maintenance personnel only by pushing and pulling the side panel g120 from the closing position to the opening position without first disassembling the exterior parts of the air conditioner. In such a manner, time and labor are saved, and it is convenient for the after-sales maintenance personnel to maintain the electrical box s110 of the air conditioner.

It is to be noted that what is shown in the drawing is the implementation mode that the side panel g120 on the right side mates drawably with the base part. It can be understood that the implementation mode that the side panel g120 on the left side or the side panels g120 on two sides mate drawably with the base part should fall within the protection scope of the disclosure. Similarly, when the electrical box s110 in the air conditioner needs to be maintained, the electrical box s110 may be exposed to the after-sales maintenance personnel without need of disassembling the exterior parts of the air conditioner, thereby simplifying an after-sales maintenance procedure, saving time and labor.

Specifically, in the embodiment, referring to FIG. 176 and FIG. 177, the side panel g120 does not mate with the base g140 of the base part directly, but through the mounting rack s411 arranged between the side panel g120 and the base g140 and drawably mating with the base g140. The side panel g120 is specifically mounted on the mounting rack s411 and drawably mates with the base part through the mounting rack s411. The air conditioner further includes the mounting rack s411 for realizing the drawable mating between the side panel g120 and the base part. The mounting rack s411 plays a role of skeleton. While the side panel g120 mates drawably with the base part, because the mounting rack s411 may be mounted with the panel s412 and other exterior parts, it is convenient to arrange the side panel g120, the panel s412 and other exterior parts. From the point of view of the whole air conditioner, the side panel g120 realizes the drawable mating relative to the base part by means of the mounting rack s411, and the mounting rack s411 serves as a part of the skeleton of the air conditioner. The realization of the above drawing mating will not bring about negative impact on the stability of the whole structure of the air conditioner.

As for how to realize the mounting of the side panel g120, in the embodiment, the mounting rack s411 has a side panel mounting portion. The mounting rack s411 is detachably connected with the side panel g120 at the side panel mounting portion. Specifically, the mounting rack s411 is connected with the side panel g120 through the buckle at the side panel mounting portion.

As for how to realize the mounting of the panel s412, in the embodiment, the mounting rack s411 has a panel mounting portion. The mounting rack s411 mates drawably with the panel s412 at the panel mounting portion.

Referring to FIG. 178, in the embodiment, the drawable mating between the mounting rack s411 and the base g140 is realized through the guide rail g170 structure. The guide rail g170 structure includes the guide rail g170 arranged on the mounting rack s411, and the guide groove g180 arranged on the base g140. The guide rail g170 and the mounting rack s411 are formed integrally. In a deformed implementation mode not shown in the drawings, the aim of the drawable mating between the mounting rack s411 and the base g140 may also be achieved by arranging the guide rail g170 on the base g140, and arranging the guide groove g180 on the mounting rack s411.

In the embodiment, the guide rail g170 structure extends along the vertical direction, and the side panel g120 may be drawn upwards or downwards to the opening position. It is to be noted that the extending direction of the guide rail g170 does not form a limit to the disclosure. The guide rail g170 structure may horizontally extend along left and right directions, and the side panel g120 may be drawn to the opening position towards the side far away from the base part; or, the guide rail g170 structure of the air conditioner horizontally extends along forward and backward directions, and the side panel g120 may be drawn forwards to the opening position.

Preferably, the air conditioner in the embodiment further includes a limiting structure configured to limit the side panel g120 at the closing position, which may ensure the stability of the side panel g120 of the air conditioner at the closing position, and the side panel g120 will not be opened by accident.

As shown in FIG. 176, specifically, the limiting structure includes a mounting hole formed on the side panel g120 and a limiting hole on the air outlet frame m3, which is formed corresponding to the mounting hole at the closing position of the side panel g120. The screw g160 passes through the mounting hole and the limiting hole, so as to limit the side panel g120 at the closing position and ensure that the side panel g120 at the closing position will not be opened by accident. In such a manner, when the air conditioner needs to be maintained, the electrical box s110 may be exposed to the after-sales maintenance personnel only by removing the screw g160 on the side panel g120 and pushing and pulling upwards the side panel g120, thereby facilitating disassembly of the electrical box s110 from the right side, and preventing the situation of disassembling a lot of parts to check the electrical box s110 in the existing structure.

In the embodiment, the side panel g120 is connected with the air outlet frame m3 through the screw g160 to ensure that some forms of buckle may be adopted while the closing position is limited to prevent exterior defect. Meanwhile, the side panel g120 is fixed with the air outlet frame m3 through the screw g160, and they may serve as the air outlet frame m3 assembly as a whole. The air outlet frame m3 assembly is fixed with the mounting rack by using the buckle. When the air outlet frame m3 assembly needs to be disassembled to be cleaned, the buckles on the two sides of the air outlet frame m3 assembly are moved to downwards pull out the air outlet frame m3, the side panel g120 and other structures along the guide rail g170 structure of the mounting rack s411, so the air duct assembly may also be cleaned.

Embodiment 25

As shown in FIG. 179 and FIG. 180, the air conditioner includes the shell body g410 and the side panel g120. The shell body g410 has the electrical box g110 exposed out of the inside of the air conditioner and the opening g411 of the motor part on the right side end along the length direction of the air conditioner. The side panel g120 is rotationally arranged on the shell body g410, specifically arranged on the top panel g450 in a hinge joint manner. The hinge joint is realized by arranging the rotation shaft p111 on the top panel g450 and arranging the rotation shaft sleeve g437 on the side panel g120. In the rotating direction of the side panel, there is the opening position for opening the opening g411 on the shell body g410 to expose the electrical box g110 and the motor part in the air conditioner, and there is the closing position for closing the opening g411 on the shell body g410 to close the electrical box g110 and the motor part in the air conditioner. In the air conditioner provided in the disclosure, the side panel g120 is arranged to mate rotationally with the shell body g410, and has the opening position for opening the opening g411 on the shell body g410 to expose the electrical box g110 and the motor part in the air conditioner, and the closing position for closing the opening g411 on the shell body g410 to close the electrical box g110 and the motor part in the air conditioner. In such a manner, when the air conditioner is maintained, the electrical box g110 and the motor part may be exposed to the after-sales maintenance personnel only by rotating the side panel g120 from the closing position to the opening position without need of disassembling the exterior part of the air conditioner at first, so time and labor are saved, and it is convenient for the after-sales maintenance personnel to maintain the electrical box g110 and the motor part of the air conditioner.

It is to be noted that the side panel g120 in the embodiment is rotationally arranged on the top panel g450 of the shell body g410. For the change of the setting positions, for example, all the front panel p22, the bottom panel and the back plate arranged in the air conditioner may achieve the aim of opening and closing the opening g411, the implementation mode of the change should fall within the protection scope of the disclosure.

Referring to the drawings from FIG. 179 to FIG. 181, specifically, the air conditioner further includes: a guiding and locating structure arranged between the side panel g120 and the shell body g410, and configured to guide the side panel g120 to switch from the opening position to the closing position. The guiding and locating structure includes a locating pin g431 arranged on the side, facing towards the shell body g410, of the side panel g120, and a locating hole g413 arranged on the shell body g410 and facing towards the side panel g120. The locating pin g431 and the locating hole g413 mate in a pluggable manner, so as to ensure that when switching from the opening position to the closing position, the side panel g120 may be mounted correctly and ensure the beauty of the exterior of the air conditioner. As a deformed implementation mode (not shown in the drawing), the guiding and locating structure may also include the locating hole arranged on the side, facing towards the shell body, of the side panel and the locating pin arranged on the shell body and facing towards the side panel.

Preferably, the guiding and locating structure further includes a locating buckle g433 arranged on the side, facing towards the shell body g410, of the side panel g120 and a locating buckle hole g415 arranged on the shell body g410 and facing towards the side panel g120. The locating buckle g433 and the locating buckle hole g415 form clamping mating, thus while the side panel g120 is located, there is a certain clamping force between the locating buckle g433 and the locating buckle hole g415, which has a certain function limiting the side panel g120 at the closing position. It can be understood that the locating buckle may also be arranged on the shell body, and the corresponding locating buckle hole is arranged on the side panel, which may also realize the functions of locating and limiting.

As shown in 5-33 and FIG. 182, preferably, the air conditioner in the embodiment of the disclosure further includes a lock mechanism arranged between the side panel g120 and the shell body g410 and configured to lock the side panel g120 at the closing position. The lock mechanism includes a lock buckle g435 arranged on the side, facing towards the shell body g410, of the side panel g120, and a lock clamping groove g417 arranged on the shell body g410 and facing towards the side panel g120. The lock buckle g435 mates with the lock clamping groove g417, so that position locking of the side panel g120 at the closing position may be realized. Of course, the lock buckle may also be arranged on the shell body, and the corresponding lock clamping groove is arranged on the side panel. The lock mechanism in the air conditioner is opened or closed by pressing the side panel g120. The existing mature structure is directly used as the lock mechanism. Locking of the closing position may be realized by pressing the side panel g120, and unlocking of the closing position may be realized by pressing the side panel g120 again, which is convenient for operation during after-sales maintenance Embodiment 26

An air conditioner indoor unit includes: a base module s100, a heat exchange module s200, an air and water duct module s300 and an exterior module s400.

The base module s100 is a support and mounting basis of the whole unit. The base module s100 includes a base part s101 suitable to be mounted on a support. The base part s101 is configured to be mounted on a hanging support body such as an indoor wall, is also used as a support part of the whole unit and a basic part for assembly on a production line.

The heat exchange module s200 is connected with an outdoor unit and performs a heat exchanging operation. The heat exchange module s200 is mounted on the base module s100 through a first mounting structure arranged between the heat exchange module s200 and the base part s101. The heat exchange module s200 mainly includes a heat exchanger. The pipeline in the heat exchanger is connected with the outdoor unit through the connection pipeline consisting of the liquid inlet pipe and the air collection pipe. The heat exchange module s200 includes the heat exchanger which is entirely supported by the angular frames on two ends and cross section of which is inverted-U-shaped. Two ends of the heat exchanger are arranged with the sealing parts, so an open chamber is formed in the inverted-U-shaped inside of the heat exchanger.

The air and water duct module s300 includes the air duct configured to be connected with the air inlet and the air outlet and guide air to pass through, and a water duct configured to guide and drain the condensed water. The air and water duct module s300 is connected with the base module s100 through a second mounting structure. The air and water duct module s300 has a bottom shell s310. A fan support for mounting the impeller is arranged on the bottom shell s310. The bottom shell s310 has a side face towards the heat exchange module s200. The water groove for collecting and draining the condensed water from the heat exchange module s200 is formed on the side face. The impeller is in the water groove after being mounted on the fan support. In the mounted state, the impeller is in the inverted-U-shaped open chamber of the heat exchanger.

The exterior module s400 covers and protects the whole unit and its internal structure. The exterior module s400 is detachably connected with the base module s100. The exterior module s400 includes the shell module s410, the air outlet module s420 and the air outlet module s430. The shell module s410 includes the mounting rack and the panel s412. The air outlet module s420 includes the air outlet frame m3 for air outlet. The shell module s410 and the air outlet module s420 cover the outer surface of the air conditioner indoor unit together.

Figure 7:
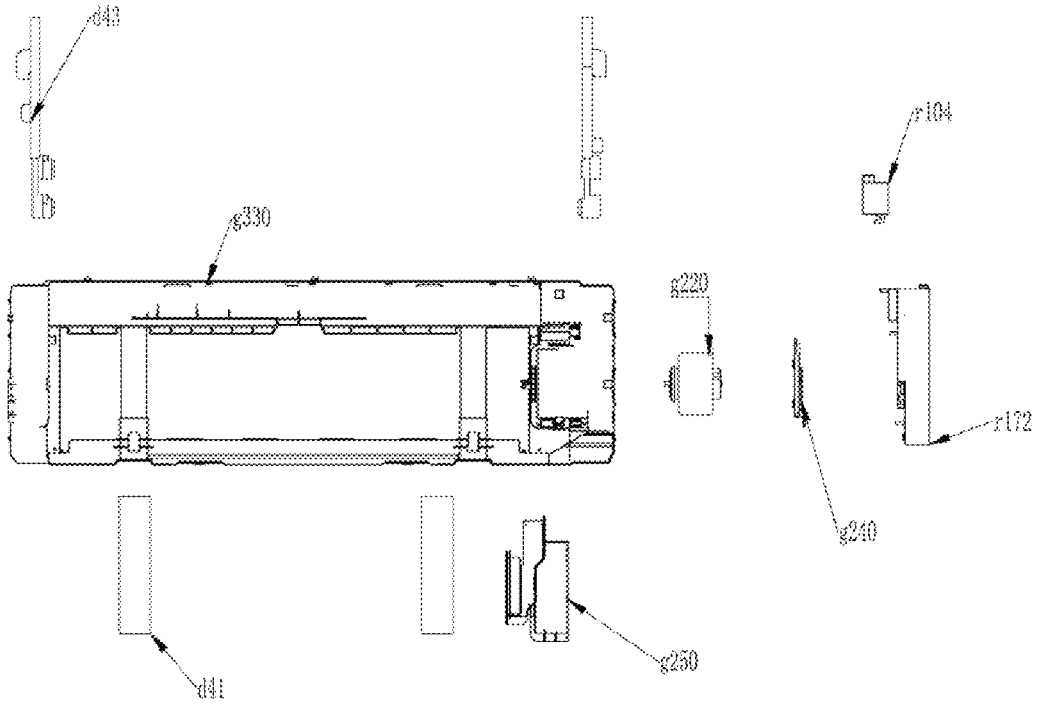
FIG. 7 is an exploded view of a base module of an air conditioner provided by an embodiment of the disclosure.

As shown in FIG. 185, in the embodiment, the air outlet module s420 includes the bottom used in the working state of the air conditioner and a fixing assembly configured to fixedly keep the air outlet frame m3 on the adjacent part. The bottom shields the air outlet frame m3 on the front lower part of the air conditioner together with the panel s412. The air outlet frame m3 may be disassembled from the air conditioner indoor unit s1 through the fixing assembly, specifically as shown in FIG. 7. The air outlet frame m3 is fixedly connected to the bottom shell s310 through the fixing assembly.

In order to clean the inner air duct conveniently, as shown in FIG. 186, in the air conditioner including a structure of sweeping leftwards and rightwards, a structure of sweeping automatically and other structures, by arranging the structure of sweeping leftwards and rightwards, the structure of sweeping automatically and the other structures at the position of the air outlet frame m3, the air sweeping blade b20 and the air outlet frame m3 may be dissembled and cleaned at the same time. Meanwhile, the inner air duct may be exposed completely by disassembling the air outlet frame m3, then a better cleaning mode is obtained. By setting the air outlet frame m3 as a part of the panel s412 of the air conditioner, the disclosure may enable the user to clean the inside of the air duct, and solves the defect that the existing air conditioner cannot be disassembled easily.

As shown in FIG. 183 to FIG. 185, the air outlet frame m3 is movably connected with the base part s101 on the back of the air conditioner indoor unit s1 through the sliding rail device s900. Referring to FIG. 190, the sliding rail device s900 includes the sliding rail support s910 shown in FIG. 191 vertically fixed on the base part s101 in a working state, the sliding frame s911 shown in FIG. 193 mounted in the sliding chute of the sliding rail support s910 in a sliding manner and a sliding rail end rod s912 shown in FIG. 192 of which one end is fixedly mounted on the sliding frame s911, the other end of the sliding rail end rod s912 is fixedly connected with the air outlet frame m3. A clamping hook s9121 is formed on the sliding rail end rod s912. Referring to FIG. 187 and FIG. 190, the clamping hook is connected with the air outlet clamping groove s422 formed on the air outlet frame m3 in an insertion mating manner. A distance of pulling out the air outlet frame m3 by the sliding rail end rod s912 is greater than and equal to 30 mm. By pulling out the air outlet frame, the air and water duct module s300 is fully exposed, which is convenient for the user to clean. Meanwhile, the air and water duct module s300 may also be directly disassembled through the distance between the air outlet frame m3 and the air conditioner to be cleaned. By adjusting the pushing and pulling sliding rail structure, the disclosure enables it to be applied in the air conditioner, so it is convenient to fix the air outlet frame, the users may pull out and disassemble the air outlet frame m3 conveniently; besides, the assembling method is simple, and the users may easily assemble by themselves.

As shown in FIG. 190, the sliding rail end rod s912 of the disclosure is detachably and fixedly connected with the sliding rack s911. The sliding rail end rod s912 may be released from the sliding rail base s910. One locating block s913 having a function of locating the sliding rail end rod s912 is arranged on the front end of the sliding rail base s910, and a rubber block s914 having a function limiting the inner sliding rack is arranged on the back end of the sliding rail base s910. FIG. 194 and FIG. 196 show a locating block structure in a slide bar of the conventional art. It can be seen from the drawings that the locating block in the conventional art is a structure with equal widths of the front end and the back end. As shown in FIG. 197 and FIG. 200, the locating block s913 of the disclosure have an outward extending expanding structure s9131 different from the conventional art. As shown in FIGS. 198 to 5-52, the opening of the extending expanding structure s9131 arranged on the end of the locating block s913 is larger than the opening of other parts in the locating block s913. In the above setting manner, in order to facilitate the mounting of the sliding rail end rod s912, when cleaning the air conditioner, the users may pull out air outlet frame m3 through the guide rail, and then may also disassemble the air outlet frame m3 to clean by water, so in consideration of the convenience of mounting each part of the air outlet frame m3, the locating block s913 is added with the extending expanding structure s9131 shown in FIG. 197. Because the opening of the end of the locating block s913 is expanded, in the process of disassembling and assembling the sliding rail end rod s912 of the sliding rail device s900, convenience is brought to inserting the sliding rail end rod s912 in the locating block s913 quickly and accurately, so that the process of assembling the air outlet frame m3 is accurate and in place, and time is saved.

Figure 41:
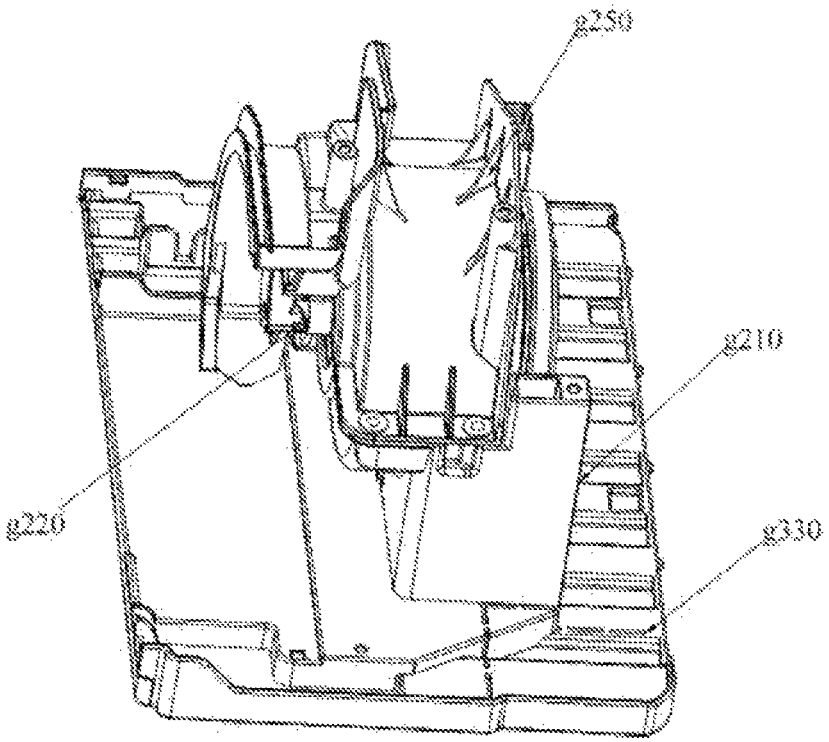
FIG. 41 is a structure diagram of a motor assembly according to an embodiment of the disclosure.
Figure 42:
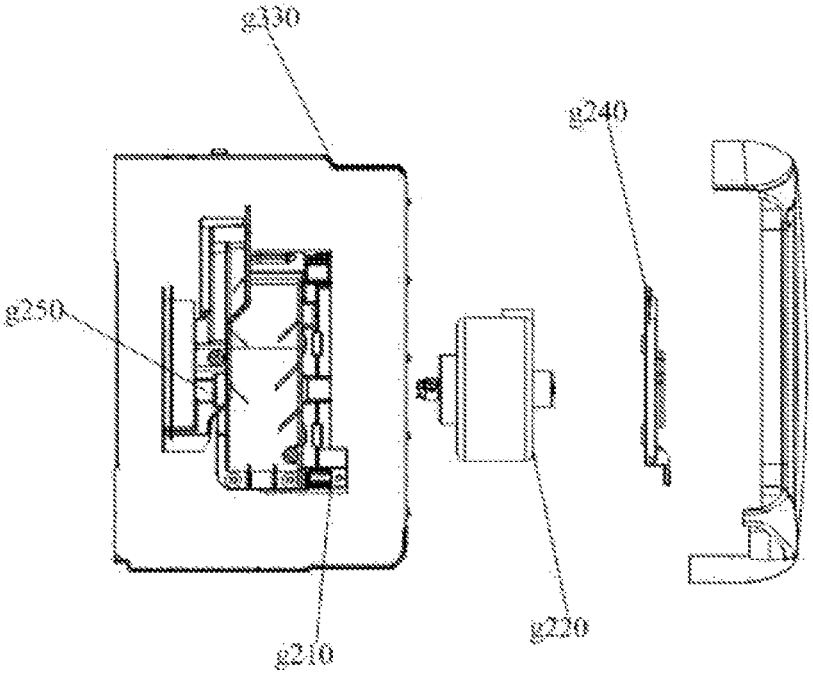
FIG. 42 is an assembling structure diagram of the motor assembly shown in FIG. 41.

Referring to FIG. 189, the fixing assembly is arranged between the air outlet frame m3 and the bottom shell s310 of air conditioner. The fixing assembly includes locking pieces s423 respectively arranged near two ends of the air outlet frame m3, and fixing holes s424 formed on the corresponding positions of the bottom shell s310. The locking piece s423 may pass through the fixing hole s424. Referring to FIG. 188, a protruding poking rod limiting piece s4233 is arranged on the tail end of the locking piece s423, and performs locking by meshing with the edge of the fixing hole s424. The locking piece s423 is movably mounted on the air outlet frame m3 through the poking rod s4231. The bump s4232 convenient to be manually poked is arranged on the poking rod s4231. As shown in FIG. 185, a group of the locking pieces s423 and the fixing holes s424 are respectively arranged at least near the two ends of the air outlet frame m3. As shown in FIGS. 186 to 5-41, the locking piece s423 moves towards the middle to fix the air outlet frame m3 with the bottom shell s310. The locking piece s423 moves towards two sides to release the fixation to the bottom shell s310, so that the air outlet frame m3 separates from the bottom shell 310.

As shown in FIGS. 185 and 5-38, a detachable decorating plate s425 is also arranged on the part, adjacent to the panel s412, of the air outlet frame m3. The decorating plate s425 mates tight with the panel s412. Exposure of the assembling gaps is reduced by arranging the decorating plate s425 on the air outlet frame m3. When the exterior of the panel s412 needs to be changed, different requirements on the exterior may be satisfied by properly changing the decorating plate s425.

As shown in FIG. 184, the fixing assembly further includes the screw fixed with the bottom shell s310 below the air outlet frame m3. When the air outlet frame m3 needs to be disassembled, first of all, the screws for fixing the three air outlet frames shown in FIG. 184 with the bottom shell s310 are disassembled from the screw holes s4261, then, the locking pieces s423 above the air outlet frame m3 are poked towards two sides to release the fixation of the upper side of the air outlet frame m3, and then, the air outlet frame m3 slides out through the sliding rail device s900. In such a manner, the air outlet frame m3 may be directly removed from the clamping hook s9121 of the sliding rail device s900 to be cleaned, at the same time, the inside of the air duct is exposed, which is convenient for the users to thoroughly clean the air duct and other structures. After a cleaning operation is completed, the air outlet frame clamping groove s422 arranged on the air outlet frame m3 is inserted in the clamping hook s9121 on the sliding rail device s900, and they are integrally pushed upwards to mate with the panel s412. The two locking pieces s423 are poked back, and then three screws are fixed on the air outlet frame m3 and the bottom shell s310, so as to prevent the air outlet frame from falling to hurt people due to not fixing it. The air outlet frame m3 structure is fixed through the process, and the cleaning operation is completed.

The disclosure provides a new-type air outlet frame structure of a wall-type unit, which is convenient for the users to thoroughly clean the air conditioner, and meanwhile, provides an alternative solution, which may realize the disassembly and the assembly of parts on the basis of the existing air conditioner, so that convenience is brought to the users to thoroughly clean the air conditioner.

Embodiment 27

As shown in FIG. 201, the air outlet assembly in the air outlet module of a modularized air conditioner indoor unit includes: the mounting rack s411, the air outlet frame m3, the fixing assembly m4, the sliding mechanism and the air sweeping mechanism m12.

As shown in FIG. 201 and FIG. 202, the mounting rack s411 is mounted between the base part s101 and the panel s412 of the indoor unit. The air outlet frame m3, being independent from the panel s412 of the air conditioner indoor unit, has the air outlet m31. The air guide plate b1 is movably arranged in the air outlet m31.

As shown in FIG. 202 and FIG. 228, two side plates m7 upwards extending in a working state are fixedly connected on two side ends of the air outlet frame m3. Two ends of the air outlet frame m3 are respectively connected on the mounting rack s411 in a sliding manner through two vertically arranged sliding mechanisms arranged between the air outlet frame m3 and the mounting rack s411. Two fixing assemblies m4 respectively lock the two ends of the air outlet frame m3 on the mounting rack s411 through the two side plates m7.

As shown in FIG. 204 and FIG. 206, each sliding mechanism also includes a first sliding chute m51 formed on the wall surface, facing towards one side of the side plate m7, of the mounting rack s411, and a first sliding block m52 formed on the inner surface, facing towards one side of the mounting rack s411, of the side plate m7 and suitable to be embedded in the first sliding chute m51. The end, close to the air outlet frame m3, of the first sliding chute m51 is a flaring groove m511 suitable to accommodate the first sliding block m52 and suitable for the first sliding block m52 to slide in or slide out. Preferably, the flaring groove m511 is a trapezoid-shaped groove or a trumpet-shaped groove, or of other shapes.

When the air outlet frame m3 needs to be disassembled from the air conditioner, the fixing assembly m4 first disables the function of locking the side plate m7, then after a downward pulling force is applied on the air outlet frame m3, the first sliding block m52 of the side plate m7 slides downwards in the first sliding chute m51. When the first sliding block m52 slides to the flaring groove m511, the first sliding block m52 is in the flaring groove m511 and is drawn from the flaring groove m511, so that the side plate m7 and the air outlet frame m3 are integrally dissembled from the air conditioner to be cleaned. After the side plate m7 and the air outlet frame m3 are cleaned, an upwards pushing force is applied on the air outlet frame m3, and the first sliding block m52 of the side plate m7 slides in the first sliding chute m51 again from the flaring groove m511, so that the air outlet frame m3 and the side plate m7 are integrally arranged in the first sliding chute m51 in a sliding manner. Under the action of the upward pushing force, the side plate m7 slides to the top of the air conditioner, so that the side plate m7 and the air outlet frame m3 are reset, and then locked by the locking assembly m4. In such a manner, the air outlet frame m3 is arranged on the mounting rack s411 in a sliding manner by pushing and pulling.

As a deformation of the first sliding chute m51, the first sliding chute m51 may also be replaced with the first through hole m53; correspondingly, the flaring groove m511 is replaced with a flaring hole. The flaring hole is a trapezoid-shaped hole or a trumpet-shaped hole, or of other shapes. The specific shape is not limited specifically.

As shown in FIG. 203 and FIG. 206, each fixing assembly m4 includes a first clamping portion m41 formed on the inner surface, facing towards one side of the mounting rack s411, of the side plate m7, and a first limiting portion m42 arranged on the mounting rack s411 for overlap joint of the clamping portion. When an acting force towards the direction far away from the first clamping portion m41 is applied on the first limiting portion m42, the first limiting portion m42 unlocks the first clamping portion m41. Preferably, the first limiting portion m42 is step-shaped. The first clamping portion m41 is a lug boss which may be jointed on the stepped face of the first limiting portion m42 in an overlapping manner.

As shown in FIG. 207, the side plate m7 is a plate, and the mounting rack s411 is an L-shaped bracket. The horizontal part of the L-shaped bracket is arranged between the top of the panel s412 and the base part s101, and the vertical part is between the panel s412 and the base part s101, extends towards the air outlet frame m3, and is on the inner surface of the side plate m7.

As shown in FIG. 207, the air outlet frame m3 includes an arc-shaped part and a horizontal part fixed on the bottom of the arc-shaped part. The air outlet frame m3 is formed on the arc-shaped part. When the air outlet frame m3 is locked on the mounting rack s411, the inner surface of the horizontal part leans against the bottom surface of the base part s101. The arc-shaped part of the air outlet frame m3 is convenient to mate with the bottom surface of the panel s412. The design of the horizontal part is convenient for that, after the air outlet frame m3 is locked in place, the inner surface of the horizontal part leans against the bottom surface of the base part s101, so that the exterior of the air conditioner is nice-looking and the structure is compact.

As shown in FIG. 203, the air sweeping mechanism m12 is mounted on the air outlet frame m3 at the position of the air outlet m31. The air sweeping mechanism m12 includes a connecting base mounted on the air outlet and at least one air sweeping blade alternately mounted on the connecting base in a swaying manner, for example, the number of the air sweeping blades is one, two, three, four, and so on, and the specific number is set according to the length of the air outlet and users' requirements. The air sweeping blade sways at needed angles along the length direction of the air outlet. By mounting the air sweeping mechanism m12 on the air outlet of the air outlet frame m3, when the air outlet frame m3 is disassembled from the air conditioner, the air sweeping mechanism m12 mounted to the air outlet may be disassembled to be cleaned, so convenience is brought to cleaning the air outlet frame m3 and the air sweeping mechanism m12. Multiple air sweeping blades sway in the air outlet to adjust the air outlet direction at the air outlet. The design of the connecting base is convenient to mount the blade in the air outlet.

In the air outlet assembly of the embodiment, the air outlet frame m3 with the air outlet and the panel s412 are arranged separately. As a single part, when the air outlet needs to be cleaned, the first limiting portion m42 is poked, so that the first limiting portion m42 releases the limit to the lug boss, and the lug boss separates from the stepped face of the first limiting portion m42 to apply a downwards pulling force on the air outlet frame m3, then the air outlet frame m3 and the two side plates m7 integrally slide downwards in the first sliding chute m51 or the first through hole m453. When the first sliding block m52 of the side plate m7 slides in the flaring groove m511 or the flaring hole, the first sliding block m52 of the side plate m7 is drawn from the flaring groove m511 or the flaring hole, then the air outlet frame m3, the two side plates m7 and the air sweeping mechanism m12 are disassembled integrally from the air conditioner to be cleaned. After cleaning, the upwards pushing force is applied on the air outlet frame m3 to push the first sliding block m52 of the side plate m7 in the first sliding chute m51 or the first through hole m53 via the flaring groove m511 or the flaring hole, until the inner surface of the horizontal part of the air outlet frame m3 leans against on the bottom surface of the base part s101; at this point, the air outlet frame m3 and the side plate m7 are reset to an initial state, the lug boss on the side plate m7 is jointed on the stepped face of the first limiting portion m42 in an overlapping manner, and then the process of mounting the air outlet frame m3 and the side plate m7 is completed. In such a manner, a pushing and pulling manner is formed to mount integrally the air outlet frame m3 and the side plate m7 on the mounting rack s411 or disassemble them from the mounting rack s411, so as to conveniently clean the air outlet frame m3, the side plate m7 and the air sweeping mechanism m12.

As a deformation of the sliding mechanism, each sliding mechanism includes the guide rail arranged on the wall surface, facing towards the side of the side plate m7, of the mounting rack s411, and a sliding assembly arranged on the guide rail in a sliding manner. The side plate m7 is detachably fixed on one end of the sliding assembly, and this end of the sliding assembly may extend out of the guide rail. The sliding assembly includes a second sliding block (not shown in the drawing) and the connecting piece m54 fixed on the second sliding block. As shown in FIG. 208, a first insertion portion m541 is formed on one end of the connecting piece m54. A first clamping groove (not shown in the drawing) for clamping the first insertion portion m541 in is formed on the inner surface, facing towards the mounting rack s411, of the side plate m7. The connecting piece m54 is an L-shaped plate. The vertical part of the L-shaped plate is fixed on the second sliding block, and the horizontal part is inserted in the first clamping groove.

With the sliding rail mechanism of the implementation mode, when the air outlet frame m3 needs to be cleaned, the fixing assembly m4 needs to first disables the function of locking the side plate m7, then after the downward pulling force is applied on the air outlet frame m3, the second sliding block slides downwards on the guide rail, and the L-shaped plate drives the side plate m7 to slide downwards on the guide rail. When the side plate m7 slides downwards to the lower end of the guide rail, the first clamping groove on the side plate m7 is separated from the horizontal part of the L-shaped plate, then the air outlet frame m3 and the side plate m7 may be disassembled integrally from the air conditioner. Later, the horizontal part of the L-shaped plate is inserted in the first sliding chute to fix the side plate m7 with the connecting piece m54. When the pushing force is applied on the air outlet frame m3, the air outlet frame m3 and the side plate m7 slide upwards on the guide rail, so that the air outlet frame m3 and the side plate m7 are reset, and then locked by the fixing assembly m4. The sliding mechanism of the implementation mode realizes the detachable connection between the side plate m7 and the sliding assembly through the mating between the first clamping groove and the first insertion portion m541.

As a preference of the first clamping groove, the bump is formed on the inner wall surface of the side plate m7, the first clamping groove is formed on the bump; or the first clamping groove is directly formed on the inner wall surface of the side plate m7.

As a deformation of the sliding assembly, the connecting piece m54 in the sliding assembly may also be T-shaped. The T-shaped horizontal part is inserted in the first clamping groove of the side plate m7. Or, the connecting piece m54 is the structure of other shapes, only its one end is fixed on the second sliding block, and the other end serves as the first insertion portion and forms a detachable connection with the side plate m7. As a further deformation, the sliding assembly may also be other structures, for example, the cylinder or the motor driving piece m54 goes up and down on the mounting rack s411 along the vertical direction, one end of the connecting piece m54 is fixed on an extending and retracting shaft of the cylinder or the motor, and the other end is detachably connected on the side plate m7.

As a deformation of the sliding mechanism, except the above two implementation modes, the sliding structure may also be other existing sliding mechanisms, only the two side plates m7 of the air outlet frame m3 are arranged on the mounting rack s411 in a sliding manner.

As a deformation, the structure of the air outlet frame m3 may also be in other shapes, for example, it is U-shaped, or arc-shaped, or in other shapes, only the air outlet is formed on it; the specific shape needs to be designed according to the specific requirements of the users.

As a deformation, the mounting rack s411 may also be a plate, for example, an L-shaped plate, or a T-shaped plate, or a vertical plate. As a further deformation, the mounting rack s411 may also be other structures, only the first sliding chute m51 or the first through hole m53 are formed, or the guide rail may be mounted on it. The mounting rack s411 is mounted between the base part s101 and the panel s412 of the air conditioner indoor unit.

As a deformation, the first clamping portion m41 and the first limiting portion m42 in the fixing assembly m4 may also be in other shapes; for example, the first limiting portion m42 is the first bump on which a groove is formed, the first clamping portion m41 is the second bump which is inserted in the groove of the first bump. The first bump and the second bump may be separated only by poking the top of the first bump.

As shown in FIG. 209 to FIG. 211, when the first through hole m53 is formed on the side plate m7, as a deformation of the fixing assembly m4, the fixing assembly m4 is arranged in the chamber formed between the panel s412 and the base part s101 and the mounting rack s411. Each fixing assembly m4 includes the first limiting piece m43 and the elastic piece mounted on one end of the first limiting piece m43. The other end of the first limiting piece m43 extends to the second through hole m10 formed on the panel s412. The elastic piece applies the reset force, towards the direction of the second through hole m10, on the first limiting piece m43. Under the mating between the elastic piece and the external acting force, the first limiting piece m43 does an extending and retracting movement towards or far away from the second through hole m10, so as to make the first limiting piece m43 mate with the first sliding block m52 in a locking manner or unlock the first sliding block m52. The elastic piece is preferably the spring.

As shown in FIG. 212, the first limiting piece m43 has the first strip-shaped body m431 and the first pressing portion m433 formed on the end face of the other end of the first strip-shaped body m431. There is a second clamping portion m432 in one-to-one correspondence with the first sliding block m52 on the surface, facing towards the mounting rack s411, of the first strip-shaped body m431. One end of the first strip-shaped body m431 is connected to the spring, and the other faces to the second through hole m10 facing towards the panel s412. The first pressing portion m433 is suitable to pass through the second through hole m10. Corresponding to the second clamping portion m432, a second clamping groove for inserting the second clamping portion m432 is formed on the surface, facing towards one side of the mounting rack s411, of the first sliding block m52. In order to sheath the spring on the first strip-shaped body m431 conveniently, a first connecting portion m434 such as a connecting piece or a connecting shaft is formed on the end, facing towards the spring, of the strip-shaped body, so as to directly sheath one end of the spring on the connecting piece or the connecting shaft. The second clamping portion m432 is preferably the bump, and the second clamping groove is preferably the U-shaped groove. The bump is inserted in the U-shaped groove. When the function of locking the side plate m7 needs to be disabled, it is only needed to press the first pressing portion m433 at the second through hole m10 toward the chamber. The first strip-shaped body m431 moves towards the spring to separate the second clamping portion m432 from the second clamping groove, so that the function of locking the side plate m7 is realized, and then the side plate m7 and the air outlet frame m3 slide integrally in the first through hole m53. The acting force on the first pressing portion m433 is withdrawn, and the first strip-shaped body m431 extends to the second through hole m10 under the acting force of the spring, so that the first pressing portion m433 resets to the start position. When the second sliding block of the side plate m7 needs to be locked, the side plate m7 and the air outlet frame m3 slide upwards in the first through hole m53 to align the second clamping groove on the second sliding block with the second clamping portion m432, and then the second clamping portion m432 may be inserted in the second clamping groove again, in such a manner, the function of locking the side plate m7 is realized. In the implementation mode, the first strip-shaped body m431 is arranged in the chamber along the width direction of the mounting rack s411, one end of the spring is fixed on the first strip-shaped body m431, and the other end is fixed on the other parts adjacent to it, such as the air duct assembly, the evaporator or the base part s101; that is, the first strip-shaped body extends and retracts in the forward and backward directions of the air conditioner, and the second through hole m10 is on the front of the air conditioner. In addition, there is the stepped face formed between the first pressing portion m433 and the end face of the end, facing towards the second through hole m10, of the first pressing portion m433. The stepped face leans against on the inner surface of the panel s412. In order to enable the first limiting piece m43 to extend and retract smoothly in the chamber, a second support m9, such as the sleeve structure or the U-shaped structure, is arranged in the chamber. The second support m9 is sheathed on the first limiting piece m43 and between two adjacent second clamping portions 432. The second support m9 may be fixed either on the mounting rack s411 or in other parts.

As a deformation, the second through hole m10 may also be arranged on the mounting rack s411, for example, the first through hole is formed on the vertical part of the L-shaped bracket, and the second through hole m10 is formed on the horizontal part of the L-shaped bracket. Correspondingly, as shown in FIGS. 213 to 215, a first poking block m435 is arranged on the top of the first strip-shaped body m431, and the second through hole m10 is a long waist-shaped hole extending along the width of the mounting rack s411. The end, with its back to the spring, of the first strip-shaped body m431 is in the chamber or leans against the inner surface of the panel s412. When the function of locking the side plate m7 needs to be disabled, it is only needed to poke backwards the first poking block m435 to make it move in the long waist-shaped hole, so that the first strip-shaped body is driven to retract towards the elastic body, and the second clamping portion m432 separates from the second clamping groove. After the acting force applied on the first poking block m435 is withdrawn, under the action of the reset force of the spring, the first poking block m435 moves forwards in the long waist-shaped hole, so that the first limiting piece m43 resets to the start position. In addition, the inwards-sunken groove is formed at a position on the surface of the side, facing toward the mounting rack s411, of the first strip-shaped body m431, and the position avoids the second clamping portion m432, so as to reduce the weight of the first strip-shaped body m431. In the implementation mode, the panel is tabulate. As a deformation, the panel may also be L-shaped. The horizontal part of the L-shaped panel is fixed on the inner surface of the top of the base part. The air inlet p23 is formed on the horizontal part, and correspondingly the second through hole may also be formed on the horizontal part of the panel. Optimally, the horizontal part of the L-shaped panel is mounted on the top surface of the mounting rack, so that the panel, the base part, two side plates and the air outlet frame form the whole exterior of the air conditioner. Correspondingly, in all above implementation modes, the panel may be the L-shaped plate, or in other shapes. The air inlet p23 is formed on the panel.

As a further deformation, the fixing assembly m4 may be replaced with other buckle structures or fasteners such as screw or bolt assembly, only the side plate m7 is fixed on the mounting rack s411 in a detachably connecting manner.

As a deformation, the air sweeping mechanism m12 may also be that in the existing air conditioner. A swaying angle of the air sweeping blade is not specifically limited but adjusted according to users' requirements. As a further deformation, the air sweeping mechanism m12 may also be not arranged on the air outlet of the air outlet frame m3, but arranged on the other parts in the air conditioner indoor unit, only it is close to the air outlet.

As a further deformation, it is unnecessary to arrange the two side plates m7, only the side walls of two ends of the air outlet frame m3 are arranged on the mounting rack s411 in a sliding manner. As a further deformation, it is unnecessary to arrange the sliding mechanism, and the air outlet frame m3 is movably connected on the mounting rack s411 in other fixing manners; for example, the air outlet frame m3 is connected rotationally or reversibly on the mounting rack s411, and then the air outlet frame m3 is fixed and kept between the panel s412 and the base by using the fixing assembly m4.

As a deformation, the fixing assembly m4 may also fix and keep the air outlet frame m3 on the other adjacent parts, not only the base part s101 and the panel s412, in the air conditioner indoor unit.

In addition, the "base part" mentioned in the above embodiments is the base or the bottom shell mounted on the wall of the air conditioner indoor unit.

Embodiment 28

A shell of the air conditioner indoor unit includes the panel s412 vertically ranged, the base part s101 arranged in parallel to the panel s412, and the air outlet assembly provided in embodiment 9. The air outlet frame m3 is arranged on the bottom surfaces of the panel s412 and the base part s101, and forms the mounting space with the panel s412 and the base part s101.

As the exterior module of the modularized air conditioner indoor unit, the shell of the air conditioner indoor unit of this structure makes the structure of the whole shell compact, and when the air outlet needs to be cleaned, the air outlet frame m3 may be disassembled from the base part s101 and the panel s412 to be cleaned, and after being cleaned, the air outlet frame m3 is mounted on the base part s101 and the panel s412, so that convenience is brought to cleaning the air outlet of the air outlet frame m3. The air from the air outlet of the air conditioner is clean, so the health of people will not be affected.

In addition, the shell of the air conditioner indoor unit in the embodiment has all advantages of the air outlet assembly in embodiment 1.

Preferably, the panel s412 is tabulate or in other shapes, such as a curved surface.

Preferably, the shell in the embodiment serves as the exterior module of the modularized air conditioner indoor unit. The exterior module is divided into the shell module, the air outlet module and the air guide module. The shell module includes the base part s101 and the mounting rack s411. The air outlet module includes the air outlet assembly in embodiment 1. The air guide module includes the air sweeping mechanism m12.

Embodiment 29

The embodiment provides an air conditioner indoor unit, including the shell of indoor unit provided in embodiment 2. Because the air conditioner of this structure includes the shell of indoor unit in embodiment 10 and the air outlet assembly in embodiment 9, the air outlet frame m3 of the air conditioner may be disassembled alone, which is convenient to disassemble, clean and assemble the air outlet frame m3.

Embodiment 30

FIG. 215 shows the air outlet structure and the wall-type air conditioner with the structure in the embodiment. The air conditioner includes the base part 101, the shell module s410, the sliding rail device 900, the air and water duct module 300 and the air outlet structure.

The base part 101 is equivalent to an upper frame part in the conventional art, and the shell module s410 includes the shell and a lower frame part in the conventional art. The base part 101 and the shell module s410 are detachably connected. The detachable air and water duct module 300 is arranged on the inner side of the base part 101.

The air outlet mechanism includes the air outlet frame m3 and a number of locking structures. The air outlet frame m3 is detachably mounted at the opening formed by the base part 101 and the shell module s410. The opening corresponds to an air outlet position of the air conditioner. The air outlet frame m3 has the air outlet, and the air from the air conditioner outflows from the air outlet.

The locking structure locks and unlocks the air outlet frame m3. As shown in FIG. 218 and FIG. 225, the locking structure includes a pushing block 201 movably arranged on the air outlet frame m3. One end of the pushing block 201 is arranged with a locking tongue 2011, and a locking groove 206 mating with the locking tongue 2011 is arranged on the base part 101. As shown in FIG. 221 and FIG. 222, when locking, the locking tongue 2011 extends in the locking groove 206; when unlocking, the locking tongue 2011 moves out from the locking groove 206.

In the embodiment, a limiting portion is arranged on the pushing block 201, and is configured to lock a motion trail of the locking tongue 2011 extending in and moving out from the locking groove 206. The limiting portion includes a limiting U-shaped groove 2021 parallel to a moving direction of the pushing block 201. An elongated air outlet frame limiting bump 2031 is arranged on the air outlet frame m3. The air outlet frame limiting bump 2031 mates with the limiting U-shaped groove 2021 and extends in the limiting U-shaped groove 2021, so as to limit a motion trail of the pushing block 201.

In the embodiment, the tail end of the locking tongue 2011 is arranged with the limiting piece 2012 protruding out of the outer wall of the locking tongue 2011. The locking groove 206 contacts with the side wall, facing towards the locking groove 206, of the limiting piece 2012, so as to prevent the locking tongue 2011 from continuing to extend in the locking groove 206.

In the embodiment, an air outlet frame limiting lug boss 2033 is arranged on the air outlet frame 3, so as to prevent the pushing block 201 from continuing to move towards an unlocking direction after unlocking. As shown in FIG. 225, the air outlet frame limiting lug boss 2033 is arranged at the position leaning against the end, far away from the locking groove 206, of the pushing block 201 in an unlocked state.

In the embodiment, the locking structure is arranged on the upper part of the air outlet frame m3 to be suitable to move up and down. The air outlet frame m3 is relatively long, in order to make the locking structure lock the air outlet frame m3 more stably, two locking structures are arranged on the upper part of the air outlet frame m3, and the two locking structures may be arranged near two ends of the air outlet frame m3.

The clamping groove 422 is arranged on the inner side of the air outlet frame m3. As shown in FIG. 215 and FIG. 217, the clamping groove 422 is suitable to fixedly mate with the end of the sliding rail device 900 which may extend and retract on the base part 101. In the embodiment, the clamping hook s9121 is formed on the end, sliding out of the base part 101, of the sliding rail device 900. The clamping hook s9121 is suitable to extend in the clamping groove 422 to be fixed with the clamping groove 422, for example, insertion mating. In the embodiment, there are two clamping grooves 422 arranged, and the two clamping grooves 422 may arranged near the two ends of the air outlet frame m3.

When the air outlet frame m3 is disassembled, first, the two pushing blocks 201 are poked downwards to unlock the air outlet frame m3, and then, the air outlet frame m3 separates from the base part 101 due to gravity, and is pulled to slide along with the end of the sliding rail device 900 to form a certain distance with the base part 101. In order to facilitate cleaning the air and water duct module 300 and the gap between the air and water duct module 300 and the air sweeping blade b20, or disassembling the air and water duct module 300 to clean, the distance that the air outlet frame m3 slides along with the sliding rail device 900 is greater than and equal to 30 cm.

Embodiment 31

On the basis of embodiment 12, as shown in FIG. 218, FIG. 221, FIG. 222 and FIG. 225, the limiting portion further includes pushing block limiting bumps 2022 arranged oppositely on two sides of the pushing block 201 along the moving direction of the pushing block 201. The air outlet frame limiting groove 2032 is arranged on the air outlet frame m3 to limit the motion rail of the pushing block 201. The air outlet frame limiting groove 2032 is arranged mating with the pushing block limiting bump 2022 and allows the pushing block limiting bumps 2022 to move in it.

In the embodiment, an air outlet frame limiting groove plate 2034 is arranged on the side, far away from the locking groove 206, of the air outlet frame limiting groove 2032. The air outlet frame limiting groove plate 2034 prevents the pushing block 201 from continuing to move towards the unlocking direction after being unlocked. In the unlocked state, the air outlet frame limiting groove plate 2034 leans against the end, far away from the clamping groove 206, of the limiting U-shaped groove 2021.

Embodiment 32

The difference between the embodiment and embodiment 13 is that, as shown in FIG. 219, FIG. 223, FIG. 224 and FIG. 226, a mating surface 2061 of the locking tongue 2011 and the locking groove 206 is close fit. The limiting portion includes a pushing block strip body 2041 extending along the moving direction of the pushing block 201. A free end of the pushing block strip body 2041 is formed with an inner bevel and an outer bevel. An air outlet frame limiting body 2051 is arranged on the air outlet frame m3, and one end of the air outlet frame limiting body 2051 leans against the outer bevel in the locked state. During unlocking, the pushing block 201 is pushed hard, and then the pushing block strip body 2041 deforms outwards and elastically along with the movement of the pushing block 201 along the outer bevel, and restores until the inner bevel leans against the other end of the air outlet frame limiting body 2051.

The limiting portion further includes the pushing block limiting bumps 2022 arranged on the side, vertical to the moving direction of the pushing block 201 and facing toward the air outlet frame m3, of the pushing block 201. The air outlet frame limiting groove 2032 is arranged on the air outlet frame m3 to limit the motion rail of the pushing block 201. The air outlet frame limiting groove 2032 is arranged mating with the pushing block limiting bump 2022 and allows the pushing block limiting bumps 2022 to move in it. As shown in FIG. 226, the air outlet frame limiting groove 2032 is an inverted-L-shaped facing towards the pushing block 201.

In the embodiment, the tail end of the locking tongue 2011 is arranged with the limiting piece 2012 protruding out of the outer wall of the locking tongue 2011. The locking groove 206 contacts with the side wall, facing towards the locking groove 206, of the limiting piece 2012, so as to prevent the locking tongue 2011 from continuing to extend in the locking groove 206.

In the embodiment, the locking structure is arranged on the lower part of the air outlet frame m3 and suitable to move leftward and rightward. The number of the locking structures may be two or three. When two locking structures are arranged, the two locking structures may be arranged near the two ends of the air outlet frame m3. When three locking structures are arranged, a locking structure is arranged between the above two locking structures.

Embodiment 33

The difference between the embodiment and embodiment 12, the air outlet frame m3 is detachably mounted at the opening of the shell module s410. The opening corresponds to the air outlet position of the air conditioner. The air outlet frame m3 has the air outlet, and the air from the air conditioner outflows from the air outlet.

Embodiment 34

On the basis of the embodiments 12 to 14, as shown in FIG. 216, a replaceable decorating plate s425 mating with the shell module s410 is arranged on the outer side of the air outlet frame m3. The decorating plate s425 mates tight with the shell module s410. The base part 101, the shell module s410 and the decorating plate s425 form an external visible part of the air conditioner. Of course, the base part 101 adapts to the shell module s410 and the decorating plate s425.

Embodiment 35

On the basis of the embodiments 12 to 16, as shown in FIG. 218 and FIG. 219, a manually pushing position 2013 vertical to the moving direction of the pushing block 201 is arranged on the pushing block 201. Convenience is brought to controlling the pushing block by pushing the manually pushing position 2013.

Embodiment 36

On the basis of the embodiments 12 to 17, as shown in FIG. 216, the air sweeping blade b20 is mounted on the air outlet of the air outlet frame m3. While the air outlet frame m3 is disassembled, the air sweeping blade b20 may also be disassembled to be cleaned.

Embodiment 37

As shown in FIG. 227, an air guide module includes: the air guide plate b1 arranged at the air outlet and driven to close or open the air outlet m31, and the air sweeping assembly b3 mounted on the air guide plate b1.

In the air guide module, the air guide plate is arranged at the air outlet of the air outlet frame and driven to close or open the air outlet, and the air sweeping assembly is fixed arranged relative to the inner side face of the air guide plate and configured to guide the air direction of the air outlet. The air sweeping assembly is arranged at the air outlet of the air outlet frame by means of setting the air guide plate. Because the air sweeping assembly and the air guide plate are arranged as a whole, when the indoor unit is disassembled to clean, the air sweeping assembly and the air guide plate may be conveniently disassembled together, which is convenient for the users to clean the air outlet frame. In such a manner, the technical defect that it is difficult to thoroughly clean the air outlet frame of the existing air conditioner is solved, the secondary pollution to the environment, threatening the users' health, caused by the air from the air outlet frame is avoided.

As shown in FIG. 228 and FIG. 229, the air sweeping assembly b3 includes an air sweeping rotation shaft b8 and an air sweeping blade b20 arranged slantwise on the air sweeping rotation shaft b8. When driven to rotate, the air sweeping rotation shaft b8 drives the air sweeping blade b20 to rotate to guide the air direction.

In the air guide module, the air sweeping assembly includes the air sweeping rotation shaft and the air sweeping blade arranged slantwise on the air sweeping rotation shaft. When the air sweeping rotation shaft is driven to rotate, the air sweeping blade may guide the air direction through a rotation motion without needing a swaying mechanism to drive. The air sweeping assembly has advantages of good air sweeping effect and simple transmission structure.

The air sweeping rotation shaft b8 and the air sweeping blade b20 are an integral structure and detachably connected with the air guide plate b1.

In the air guide module, the air sweeping rotation shaft and the air sweeping blade are an integral structure and detachably connected with the air guide plate. By using the integral structure, the air sweeping rotation shaft and the air sweeping blade has advantages of being simple to assemble and disassemble and being convenient to clean.

At least one third support frame b16 configured to connect the air sweeping rotation shaft b8 is arranged on the air guide plate b1. The third support frame b16 is hooked with the air sweeping rotation shaft b8.

An air guide module connecting piece b21 connected with the air sweeping rotation shaft b8 is arranged on the air guide plate b1.

As shown in FIG. 228, the air guide plate b1 includes an outer air guide plate b18 and an inner air guide plate b19 connected to the inner side of the outer air guide plate b18.

In the above air guide module, the air guide plate includes the outer air guide plate and the inner air guide plate arranged on the inner side of the outer air guide plate. The air guide plate consists of the inner air guide plate and the outer air guide plate, so it is solid and reliable, and may support the air sweeping assembly.

The third support frame b16 and the air guide module connecting piece b21 are arranged on the outer air guide plate b18.

The third support frame b16 is connected with the air sweeping rotation shaft b8 after passing through the inner air guide plate b19.

The air guide module connecting piece b21 is connected with the air sweeping rotation shaft b8 after passing through the inner air guide plate b19.

The air sweeping assembly b3 is mounted on the inner side face of the air guide plate b1.

An air conditioner has the shell with the air outlet frame. The air guide module is arranged at the air outlet.

Embodiment 38

As shown in FIG. 230, FIG. 232 and FIG. 233, an air guide module of air conditioner includes: the air guide plate b1 and the driving mechanism. The air guide plate b1 is arranged at the air outlet and driven to close or open the air guide plate m31. The air sweeping assembly b3 is mounted on the air guide plate b1. The driving mechanism includes a first driving mechanism b4 and a second driving mechanism b5 respectively arranged on the right side and the left side of the shell of the air conditioner. A driving mechanism output shaft b7 arranged on the first driving mechanism b4 is in transmission connection with the air guide plate b1 to drive the air guide plate b1 to rotate. The driving mechanism output shaft b7 arranged on the second driving mechanism b5 is in transmission connection with the air sweeping rotation shaft b8 of the air sweeping assembly b3 to drive the air sweeping assembly b3 to rotate. The air guide module of air conditioner further includes: a support mechanism. The support mechanism includes a first support mechanism b9 and a second support mechanism 10. The first support mechanism 9 mates with the first driving mechanism b4 to provide support for the rotation of the air guide plate b1. The second support mechanism 10 mates with the second driving mechanism b5 to provide support for the rotation of the air sweeping assembly b3. The second support mechanism 10 is rotationally connected with the air sweeping rotation shaft b8 of the air sweeping assembly b3.

The air guide module of the air conditioner solves the problem that when the air sweeping assembly is arranged on the air guide plate, the arrangement of the driving assembly and the driving shaft of the air guide plate and the air sweeping plate is irrational. Arranging both the driving assembly and the driving shaft at the air outlet of the air conditioner causes a large number of parts at the air outlet, occupies the space of the air outlet passage, and blocks the air outlet passage.

As shown in FIG. 232, the first driving mechanism b4 is connected with the air guide plate b1 through a telescopic driving rod b11. The second driving mechanism b5 is connected with the air sweeping assembly b3 through the telescopic driving rod b11.

In the air guide module of the air conditioner, the first driving mechanism and the second driving mechanism are connected with the air guide plate through the telescopic driving rod. The telescopic driving rod pushes the air guide plate to extend and retract, so as to drive the air outlet to open and close. When the air outlet is opened, the air guide plate and the air sweeping assembly arranged on the air guide plate are far away from the air outlet of the air conditioner to prevent the shell on the two sides of the air outlet of the air conditioner from influencing an air sweeping area of the air sweeping assembly, thereby increasing the air sweeping area of the air sweeping assembly of the air conditioner.

As shown in FIG. 233, the driving mechanism output shafts b7 of the first driving mechanism b4 and the second driving mechanism b5 are respectively arranged on their own driving rods b11.

The driving mechanism output shafts b7 and the air sweeping rotation shafts are coaxially arranged on the same axis. The driving mechanism output shafts b7 are respectively arranged on two sides of the air sweeping rotation shaft b8.

In the air guide module of the air conditioner, the driving mechanism output shafts and the air sweeping rotation shafts are coaxially arranged, and the driving mechanism output shafts are respectively arranged on two sides of the air sweeping rotation shaft. Such a setting manner avoids the problem of occupation of a large space caused by setting the driving mechanism output shaft and the air sweeping rotation shaft in a staggering manner, and has an advantage of optimizing space layout.

As shown in FIG. 233, the first support mechanism b9 is a supporting portion arranged on the second driving mechanism b5 which is on the left side of the shell of the air conditioner. The driving mechanism output shaft b7 arranged on the inner side of the second driving mechanism b5 is in transmission connection with the air sweeping rotation shaft b8. The outer side of the second driving mechanism b5 is rotationally connected with the first clamping groove b12 on the first support frame b13 through a supporting piece 6. The first support frame b13 is arranged on the air guide plate b1.

The driving mechanism output shaft b7 has an inner hole. The air sweeping rotation shaft b8 forms transmission connection in the inner hole.

As shown in FIG. 233, the second support mechanism b10 is the supporting portion arranged on the first driving mechanism b4 which is on the right side of the shell of the air conditioner and the third support frame b16 arranged on the air guide plate b1. The air sweeping rotation shaft b8 is rotationally connected with the third support frame b16.

A third clamping groove b17 is arranged on the third support frame b16. The air sweeping rotation shaft b8 is rotationally connected in the third clamping groove b17.

The first driving mechanism drives the air guide plate, and the supporting portion configured to support the second driving mechanism is arranged on the first driving mechanism. The second driving mechanism drives the air sweeping assembly, and the supporting portion configured to support the first driving mechanism is arranged on the second driving mechanism. The third support frame is also arranged to serve as the supporting portion of the second driving mechanism. Such a setting manner avoids the problem in the conventional art of occupation of a large space caused by setting two groups of driving mechanisms to drive the air guide plate and the air sweeping assembly, and is advantaged in being reasonable in structural layout, saving spatial arrangement, and forming a solid and reliable structure.

As shown in FIG. 232 and FIG. 233, the air guide plate b1 includes: the outer air guide plate b18 and the inner air guide plate b19 arranged on the inner side face of the outer air guide plate b18. The inner air guide plate b19 is arranged on the inner side face of the outer air guide plate b18.

In the above air guide module of the air conditioner, the air guide plate includes the outer air guide plate and the inner air guide plate arranged on the inner side of the outer air guide plate. The air guide plate is solid and reliable, and may support the air sweeping assembly.

The air sweeping assembly includes: the air sweeping rotation shaft b8 and the air sweeping blade b20 arranged slantwise on the air sweeping rotation shaft b8.

In the air guide module of the air conditioner, the air sweeping assembly includes the air sweeping rotation shaft and the air sweeping blade arranged slantwise on the air sweeping rotation shaft. When the air sweeping rotation shaft is driven to rotate, the air sweeping blade may guide the air direction through a rotation motion without needing a swaying mechanism to drive. The air sweeping assembly has advantages of good air sweeping effect and simple transmission structure.

Embodiment 39

As shown in FIG. 230, FIG. 232, FIG. 234 and FIG. 235, an air guide module of air conditioner includes: the air guide plate b1 and the driving mechanism. The air guide plate b1 is arranged at the air outlet and driven to close or open the air guide plate m31. The air sweeping assembly b3 is mounted on the air guide plate b1. The driving mechanism includes a first driving mechanism b4 and a second driving mechanism b5 respectively arranged on the left side and the right side of the shell of the air conditioner. A driving mechanism output shaft b7 arranged on the first driving mechanism b4 is in transmission connection with the air guide plate b1 to drive the air guide plate b1 to rotate. The driving mechanism output shaft b7 arranged on the second driving mechanism b5 is in transmission connection with the air sweeping rotation shaft b8 of the air sweeping assembly b3 to drive the air sweeping assembly b3 to rotate. The air guide module of air conditioner further includes: a support mechanism. The support mechanism includes a first support mechanism b9 and a second support mechanism 10. The first support mechanism 9 mates with the first driving mechanism b4 to provide support for the rotation of the air guide plate b1. The second support mechanism 10 mates with the second driving mechanism b5 to provide support for the rotation of the air sweeping assembly b3. The second support mechanism 10 is rotationally connected with the air sweeping rotation shaft b8 of the air sweeping assembly b3.

As shown in FIG. 232, the first driving mechanism b4 is connected with the air guide plate b1 through a telescopic driving rod b11. The second driving mechanism b5 is connected with the air sweeping assembly b3 through the telescopic driving rod b11.

As shown in FIG. 234 and FIG. 235, the driving mechanism output shafts b7 of the first driving mechanism b4 and the second driving mechanism b5 are respectively arranged on their own driving rods b11.

The driving mechanism output shafts b7 and the air sweeping rotation shafts are coaxially arranged on the same axis. The driving mechanism output shafts b7 are respectively arranged on two sides of the air sweeping rotation shaft b8.

As shown in FIG. 234 and FIG. 235, the first support mechanism b9 is a supporting portion arranged on the second driving mechanism b5 which is on the right side of the shell of the air conditioner. The driving mechanism output shaft b7 arranged on the inner side of the second driving mechanism b5 is in transmission connection with the air sweeping rotation shaft b8. The outer side of the second driving mechanism b5 is rotationally connected with the first clamping groove b12 on the first support frame b13 through a supporting piece 6. The first support frame b13 is arranged on the air guide plate b1.

The driving mechanism output shaft b7 has an inner hole. The air sweeping rotation shaft b8 forms transmission connection in the inner hole.

As shown in FIG. 234 and FIG. 235, the second support mechanism b10 is the supporting portion arranged on the first driving mechanism b4 which is on the left side of the shell of the air conditioner and the third support frame b16 arranged on the air guide plate b1. The air sweeping rotation shaft b8 is in transmission connection with the third support frame b16.

A third clamping groove b17 is arranged on the third support frame b16. The air sweeping rotation shaft b8 is rotationally connected in the third clamping groove b17.

As shown in FIG. 232, the air guide plate b1 includes: the outer air guide plate b18 and the inner air guide plate b19 arranged on the inner side face of the outer air guide plate b18. The inner air guide plate b19 is arranged on the inner side face of the outer air guide plate b18.

The air sweeping assembly includes: the air sweeping rotation shaft b8 and the air sweeping blade b20 arranged slantwise on the air sweeping rotation shaft b8.

Embodiment 40

As shown in FIG. 230, FIG. 232 and FIG. 236, an air guide module of air conditioner includes: the air guide plate b1 and the driving mechanism. The air guide plate b1 is arranged at the air outlet and driven to close or open the air guide plate m31. The air sweeping assembly b3 is mounted on the air guide plate b1. The driving mechanism includes a first driving mechanism b4 and a second driving mechanism respectively arranged on the right side and the left side of the shell of the air conditioner. A driving mechanism output shaft b7 arranged on the first driving mechanism b4 is in transmission connection with the air guide plate b1 to drive the air guide plate b1 to rotate. The driving mechanism output shaft b7 arranged on the second driving mechanism b5 is in transmission connection with the air sweeping rotation shaft b8 of the air sweeping assembly b3 to drive the air sweeping assembly b3 to rotate. The air guide module of air conditioner further includes: a support mechanism. The support mechanism includes a first support mechanism b9 and a second support mechanism 10. The first support mechanism 9 mates with the first driving mechanism b4 to provide support for the rotation of the air guide plate b1. The second support mechanism 10 mates with the second driving mechanism b5 to provide support for the rotation of the air sweeping assemblyair sweeping assembly b3. The second support mechanism 10 is rotationally connected with the air sweeping rotation shaft b8 of the air sweeping assemblyair sweeping assembly b3.

As shown in FIG. 232, the first driving mechanism b4 is connected with the air guide plate b1 through a telescopic driving rod b11. The second driving mechanism b5 is connected with the air sweeping assembly b3 through the telescopic driving rod b11.

As shown in FIG. 232 and FIG. 236, the driving mechanism output shafts b7 of the first driving mechanism b4 and the second driving mechanism b5 are respectively arranged on their own driving rods b11.

The driving mechanism output shafts b7 and the air sweeping rotation shafts are coaxially arranged on the same axis. The driving mechanism output shafts b7 are respectively arranged on two sides of the air sweeping rotation shaft b8.

As shown in FIG. 236, the first support mechanism b9 is the supporting portion which is arranged on the second driving mechanism b5 on the left side of the shell of the air conditioner. The driving mechanism output shaft b7 of the second driving mechanism b5 is in transmission connection with the air sweeping rotation shaft b8. The first support mechanism b9 further includes the third support frame b15 arranged on the air guide plate b1 and having the second clamping groove 14. The third support frame b15 is rotationally connected with the driving mechanism output shaft b7.

The second support frame is rotationally connected with the driving mechanism output shaft. Setting the second support frame on the driving mechanism output shaft which is on the right side of the second driving mechanism is beneficial to guiding air to outflow the space on the right side of the second driving mechanism, and optimizing the inner space of the air conditioner according to different needs on spatial arrangement.

The driving mechanism output shaft b7 has an inner hole. The air sweeping rotation shaft b8 forms transmission connection in the inner hole.

The second support mechanism b10 is the third support frame b16 arranged on the air guide plate b1. The air sweeping rotation shaft b8 is rotationally connected with the third support frame b16.

A third clamping groove b17 is arranged on the third support frame b16. The air sweeping rotation shaft b8 is rotationally connected in the third clamping groove b17.

As shown in FIG. 232, the air sweeping assembly includes: the air sweeping rotation shaft b8 and the air sweeping blade b20 arranged slantwise on the air sweeping rotation shaft b8.

Embodiment 41

As shown in FIG. 230, FIG. 231 and FIG. 237, an air guide module of air conditioner includes: the air guide plate b1 and the driving mechanism. The air guide plate b1 is arranged at the air outlet and driven to close or open the air guide plate m31. The air sweeping assembly b3 is mounted on the air guide plate b1. The driving mechanism includes a first driving mechanism b4 and a second driving mechanism respectively arranged on the right side and the left side of the shell of the air conditioner. A driving mechanism output shaft b7 arranged on the first driving mechanism b4 is in transmission connection with the air guide plate b1 to drive the air guide plate b1 to rotate. The driving mechanism output shaft b7 arranged on the second driving mechanism b5 is in transmission connection with the air sweeping rotation shaft b8 of the air sweeping assembly b3 to drive the air sweeping assembly b3 to rotate. The air guide module of air conditioner further includes: a support mechanism. The support mechanism includes a first support mechanism b9 and a second support mechanism 10. The first support mechanism 9 mates with the first driving mechanism b4 to provide support for the rotation of the air guide plate b1. The second support mechanism 10 mates with the second driving mechanism b5 to provide support for the rotation of the air sweeping assemblyair sweeping assembly b3. The second support mechanism 10 is rotationally connected with the air sweeping rotation shaft b8 of the air sweeping assembly b3.

As shown in FIG. 231, the first driving mechanism b4 is connected with the air guide plate b1 through a telescopic driving rod b11. The second driving mechanism b5 is connected with the air sweeping assembly b3 through the telescopic driving rod b11.

As shown in FIG. 231 and FIG. 237, the driving mechanism output shafts b7 of the first driving mechanism b4 and the second driving mechanism b5 are respectively arranged on their own driving rods b11.

The driving mechanism output shafts b7 and the air sweeping rotation shafts are coaxially arranged on the same axis. The driving mechanism output shafts b7 are respectively arranged on two sides of the air sweeping rotation shaft b8.

As shown in FIG. 237, the first support mechanism b9 is the supporting portion which is arranged on the second driving mechanism b5 on the left side of the shell of the air conditioner. The driving mechanism output shaft b7 of the second driving mechanism b5 is in transmission connection with the air sweeping rotation shaft b8. The first support mechanism b9 further includes the third support frame b15 arranged on the air guide plate b1 and having the second clamping groove 14. The third support frame b15 is rotationally connected with the air sweeping rotation shaft b8.

The second support frame is rotationally connected with the driving mechanism output shaft. Setting the second support frame on the air sweeping rotation shaft which is on the right side of the second driving mechanism is beneficial to guiding air to outflow the space on the right side of the second driving mechanism, and optimizing the inner space of the air conditioner according to different needs on spatial arrangement.

The driving mechanism output shaft b7 has an inner hole. The air sweeping rotation shaft b8 forms transmission connection in the inner hole.

The second support mechanism b10 is the supporting portion arranged on the first driving mechanism b4 which is on the right side of the shell of the air conditioner. The air sweeping rotation shaft b8 is rotationally connected with the third support frame b16.

A third clamping groove b17 is arranged on the third support frame b16. The air sweeping rotation shaft b8 is rotationally connected in the third clamping groove b17.

As shown in FIG. 231, the air sweeping assembly includes: the air sweeping rotation shaft b8 and the air sweeping blade b20 arranged slantwise on the air sweeping rotation shaft b8.

It is apparent that the abovementioned embodiments are only examples for clear description and not intended to limit the implementation modes. Those of ordinary skill in the art may further make variations or modifications of other different forms on the basis of the above descriptions. It is unnecessary and impossible to exhaust all of the implementation modes herein. Apparent variations or modifications derived therefrom also fall within the scope of protection of the disclosure.

What is claimed is:

1. An air conditioner indoor unit, comprising:

a base module, having a base part which is arranged with a fan motor;

a heat exchange module having a heat exchanger and a connection pipeline for connecting the heat exchanger to an air conditioner outdoor unit; the heat exchanger and the connection pipeline are arranged in such a way that in a mounted state, the heat exchanger and the connection pipeline are entirely located at a front side of the base module; and an air and water duct module having an air duct assembly; the air duct assembly is suitable to be entirely disassembled from the base part without disassembling the fan motor in the base part, the air and water duct module has a bottom shell and an impeller which is rotationally mounted on the bottom shell; an impeller shaft of the impeller is suitable to be, by means of a quick release connecting structure, connected with and separated from an output shaft of the fan motor through a position movement between the impeller shaft and the output shaft, the quick release connecting structure comprises a clamping groove formed in the impeller shaft of the impeller and a clamping claw arranged on the output shaft of the fan motor and mating with the clamping groove, at the working position of the fan motor, the clamping claw is arranged in the clamping groove and the output shaft rotates to drive the impeller shaft to rotate, the clamping claw is a helical clamping claw, and the clamping groove is a helical clamping groove, so that the output shaft rotate at the working position of the fan motor to make the helical clamping claw and the helical clamping groove get close to each other under the action of helical surfaces of the helical clamping groove and the helical clamping claw, at the quick release position of the fan motor, when the fan motor is disassembled after the fan motor is unlocked, the clamping claw is separated from the clamping groove.

2. The air conditioner indoor unit as claimed in claim 1, wherein the heat exchange module and the air and water duct module are movably mounted on the base part respectively.

3. The air conditioner indoor unit as claimed in claim 1, further comprising:

an exterior module, having an air guide module detachably mounted on the base module, an air outlet frame module detachably mounted on the base module and/or the air and water duct module, and a shell module detachably mounted on the base module; and an electric assembly, having an electrical box, an air guide poking box, and the fan motor for poking an impeller to rotate.

4. The air conditioner indoor unit as claimed in claim 3, wherein the shell module is detachably mounted on the base module, and comprises a panel body, and a filter screen and a panel which are detachably mounted on the panel body.

5. A method for assembling an air conditioner indoor unit, comprising:

a. pre-assembling in the base module, the air and water duct module, the heat exchange module, the air outlet frame module and the air guide module as claimed in claim 4 on a corresponding pre-assembly line, so that the base module, the air and water duct module, the heat exchange module, the air outlet frame module and the air guide module form five independent pre-assembly modules respectively;

b. on a general assembly line, taking the base module as an assembling basis, respectively assembling the heat exchange module and the air and water duct module with the base module at first;

c. assembling a panel body of a shell module as claimed in claim 4 with the base module, and assembling a filter screen of the shell module with the panel body; then, assembling the air outlet frame module with the base module, and assembling the panel with the panel body;

d. at last, assembling the air guide module with the base module, and completing the assembly of the whole body of the air conditioner indoor unit.

6. The air conditioner indoor unit as claimed in claim 3, wherein the electric assembly is detachably mounted on the base part of the base module, or detachably mounted on the bottom shell of the air and water duct module.

7. The air conditioner indoor unit as claimed in claim 6, wherein the base module comprises a motor bracket fixed on the base part; the motor bracket comprises:

a motor stand; and a motor pressure plate and a motor cover plate which are mounted on the motor stand and configured to fix the fan motor;

wherein the motor pressure plate and the motor cover plate are detachably mounted on the base part respectively;

the motor pressure plate limits the fan motor in a radial direction, and the motor cover plate limits the fan motor in an axial direction.

8. The air conditioner indoor unit as claimed in claim 6, wherein the electric assembly further comprises a concentrator; a load terminal of the air conditioner indoor unit is electrically connected with the concentrator; the concentrator is electrically connected with the electrical box, the concentrator comprise a patch panel and a mounting matrix, the patch panel is mounted on the mounting matrix, the load terminal is arranged on the patch panel.

9. The air conditioner indoor unit as claimed in claim 6, wherein the electric assembly is detachably mounted on an end of the base part or an end of the bottom shell.

10. The air conditioner indoor unit as claimed in claim 3, wherein the shell module is detachably mounted on the base module, and comprises:

a panel body; and a filter screen and a panel which are detachably mounted on the panel body;

wherein the panel body comprises a mounting rack, and two side panels which are detachably mounted on two ends of the mounting rack and correspond to the two ends of the base part.

11. The air conditioner indoor unit as claimed in claim 3, wherein the shell module is detachably mounted on the base module through a buckle structure.

12. The air conditioner indoor unit as claimed in claim 11, wherein the air and water duct module is mounted on the base module in a sliding manner through a first guide structure, and performs limiting locking to a mounting state through the buckle structure and a threaded connecting piece;

the air outlet frame module is mounted on the base module in a sliding manner through a second guide structure, and performs limiting locking to the mounting state through the buckle structure and the threaded connecting piece.

13. The air conditioner indoor unit as claimed in claim 12, wherein the first guide structure is a first sliding structure or a first guide rail structure; the second guide structure is a second sliding structure or a second guide rail structure.

14. The air conditioner indoor unit as claimed in claim 11, wherein the heat exchange module is detachably mounted on the base module through the buckle structure or a hanging structure, and the threaded connecting piece.

15. The air conditioner indoor unit as claimed in claim 11, wherein the air guide module is detachably mounted on the base module through the buckle structure.

16. A method for assembling an air conditioner indoor unit, comprising:

a. pre-assembling in the base module, the air and water duct module, the heat exchange module, the shell module, the air outlet frame module and the air guide module as claimed in claim 3 on a corresponding pre-assembly line, so that the base module, the air and water duct module, the heat exchange module, the shell module, the air outlet frame module and the air guide module form six independent pre-assembly modules respectively;

b. on a general assembly line, taking the base module as an assembling basis, respectively assembling the heat exchange module and the air and water duct module with the base module at first;

c. respectively assembling the shell module and the air outlet frame module with the base module;

d. assembling the air guide module with the base module, and then completing the assembly of the whole body of the air conditioner indoor unit.

17. A method for dissembling an air conditioner indoor unit, comprising:

a. disassembling the air guide module as claimed in claim 3 from a base module;

b. disassembling the air outlet frame module as claimed in claim 3 from the base module;

c. disassembling the whole body of the air duct assembly as claimed in claim 3 from a base part without disassembling a fan motor in the base part.

18. The air conditioner indoor unit as claimed in claim 1, wherein both an air duct and a water duct of the air conditioner indoor unit are formed on the bottom shell of the air and water duct module.

19. The air conditioner indoor unit as claimed in claim 1, wherein the connection pipeline has a liquid inlet pipe and an air collection pipe; both the liquid inlet pipe and the air collection pipe are connected on one side, far away from the motor bracket, of the heat exchanger; there are tee structures arranged on both the liquid inlet pipe and the air collection pipe; with the tee structures, both sides of the heat exchanger are arranged with an outdoor unit connection terminal of the connection pipeline.

20. The air conditioner indoor unit as claimed in claim 19, wherein after the liquid inlet pipe and the air collection pipe pass through the tee structures, one branch forms a U-shaped bend which bypasses the motor bracket from the side, far away from a back plate of the base part, of the motor bracket after extending beyond the length of the heat exchanger at a position close to the back plate of the base part, reaches a lower edge of the back plate of the base part in a working and mounting state, and bends, at the position close to the back plate of the base part, towards an end of the base part on this side; another branch extends to the lower edge of the back plate of the base part in the working and mounting state on this side, and bends, at the position close to the back plate of the base part, towards the end of the base part on this side.

21. The air conditioner indoor unit as claimed in claim 19, wherein a cross section of the heat exchanger is inverted-U shaped, and its two sides are arranged with a hanging fixing structure for mounting the heat exchanger on the base module in a hanging way; two ends of the heat exchanger are arranged with a sealing part, so that an open chamber is formed in the inverted-U shaped interior of the heat exchanger; an angular frame is fixed on the heat exchanger, and a fixing structure for fixing the connection pipeline is arranged on the angular frame.

22. A method for assembling an air conditioner indoor unit, comprising:

a. pre-assembling in the base module, the heat exchange module and the air and water duct module as claimed in claim 1 on a corresponding pre-assembly line, so that the base module, the heat exchange module and the air and water duct module form three independent pre-assembly modules respectively;

b. on a general assembly line, taking the base module as an assembling basis, respectively assembling the heat exchange module with the base module at first, and then assembling the air and water duct module with the base module.

23. The method as claimed in claim 22, wherein at Step b, one side, arranged with a motor bracket, of the base module is installed on the assembly line upwards;

the heat exchange module is assembled on the base module from top to bottom, and after assembly, an opening of a chamber between a back plate of the base module and the heat exchanger faces to a predetermined direction;

after that, assembling, along the predetermined direction to which the opening of the chamber between the back plate of the base module and the heat exchanger faces, the air and water duct module in the part assembled at Step b.

24. The method as claimed in claim 23, wherein at Step b, first mounting a guide rail base of a second guide rail structure on the base part; and then mounting the air outlet frame module on the base module through a second guide rail structure.

25. The method as claimed in claim 23, wherein at Step d, after mounting the air outlet frame module, mounting the air guide module at an air outlet which is on the air outlet frame of the air outlet frame module.

* * * * *